US008651177B2

(12) United States Patent
Vail, III et al.

(10) Patent No.: US 8,651,177 B2
(45) Date of Patent: Feb. 18, 2014

(54) LONG-LASTING HYDRAULIC SEALS FOR SMART SHUTTLES, FOR COILED TUBING INJECTORS, AND FOR PIPELINE PIGS

(75) Inventors: William Banning Vail, III, Bothell, WA (US); Robert L. Dekle, Tulsa, OK (US); James E. Chitwood, Spring, TX (US); Damir S. Skerl, Houston, TX (US)

(73) Assignee: Smart Drilling and Completion, Inc., Bothell, WA (US)

( * ) Notice: Subject to any disclaimer, the term of this patent is extended or adjusted under 35 U.S.C. 154(b) by 577 days.

(21) Appl. No.: 12/653,740

(22) Filed: Dec. 17, 2009

(65) Prior Publication Data

US 2011/0036560 A1 Feb. 17, 2011

Related U.S. Application Data

(60) Provisional application No. 61/274,215, filed on Aug. 13, 2009.

(51) Int. Cl.
*E21B 19/00* (2006.01)

(52) U.S. Cl.
USPC ..... 166/87.1; 166/177.6; 166/119; 418/48

(58) Field of Classification Search
USPC ..... 166/87.1, 177.6, 119, 68, 250.01; 418/48
See application file for complete search history.

(56) References Cited

U.S. PATENT DOCUMENTS

| | | | | |
|---|---|---|---|---|
| 6,857,486 | B2 | 2/2005 | Chitwood et al. | 175/61 |
| 7,032,658 | B2 | 4/2006 | Chitwood et al. | 166/61 |
| 7,311,151 | B2 | 12/2007 | Chitwood et al. | 166/347 |
| 8,353,348 | B2 * | 1/2013 | Chitwood et al. | 166/302 |
| 2003/0034177 | A1 | 2/2003 | Chitwood et al. | 175/61 |
| 2004/0134662 | A1 | 7/2004 | Chitwood et al. | 166/61 |
| 2004/0244982 | A1 | 12/2004 | Chitwood et al. | 166/347 |
| 2008/0128128 | A1 * | 6/2008 | Vail et al. | 166/250.15 |
| 2008/0149343 | A1 | 6/2008 | Chitwood et al. | 166/360 |
| 2009/0308656 | A1 | 12/2009 | Chitwood et al. | 166/347 |

FOREIGN PATENT DOCUMENTS

| | | | |
|---|---|---|---|
| CA | 2454865 | 2/2003 | |
| EP | 1 436482 B1 | 4/2007 | 175/26 |
| NO | 326447 | 12/2008 | |
| WO | WO 03/016671 A2 | 2/2003 | 175/26 |
| WO | WO 2004/053935 A2 | 6/2004 | 166/61 |
| WO | WO 2004/083595 A2 | 9/2004 | 166/347 |

* cited by examiner

*Primary Examiner* — Yong-Suk (Philip) Ro

(57) ABSTRACT

A well conveyance apparatus for conveying equipment into a wellbore possessing long-lasting movable and slidable hydraulic seals against the interior of a borehole casing located within a wellbore in a geological formation in the earth that is caused to move by the application of pressurized wellbore fluids against the seals. The seals are allowed to rotate on bearings about the tool mandrel to prevent the build-up of torque on the seals to minimize wear and to extend the life of the seals. Vibratory means are attached to the tool mandrel to vibrate the sealing portion of the seals, so as the extend the life of the seals and to minimize wear of the seals. Sensor arrays provide information to a computer system that is used to control the vibratory means, pressure relief valves, and other parameters to minimize wear of the hydraulic seals.

20 Claims, 92 Drawing Sheets

LONG-LASTING HYDRAULIC SEALS FOR SMART SHUTTLES, FOR COILED TUBING INJECTORS, AND FOR PIPELINE PIGS

PRIORITY FROM A U.S. PROVISIONAL PATENT APPLICATION

The present application relates to U.S. Provisional Patent Application No. 61/274,215, filed Aug. 13, 2009, that is entitled "Long-Lasting Hydraulic Seals for Smart Shuttles, for Coiled Tubing Injectors, and for Pipeline Pigs", an entire copy of which is incorporated herein by reference, unless unintentional errors have been found in that Provisional Patent Application that are specifically identified and corrected in the present application.

Applicant claims priority from the above U.S. Provisional Patent Application No. 61,274,215, filed Aug. 13, 2009.

CROSS-REFERENCES TO RELATED APPLICATIONS

This section is divided into "Cross References to Related U.S. Patent Applications", "Other Related U.S. Applications", "Related Foreign Applications", "Cross-References to Related U.S. Provisional Patent Applications", and "Related U.S. Disclosure Documents". This is done so for the purposes of clarity.

CROSS-REFERENCES TO RELATED U.S. PATENT APPLICATIONS

The present application is related to U.S. patent application Ser. No. 12/583,240, filed on Aug. 17, 2009, that is entitled "High Power Umbilicals for Subterranean Electric Drilling Machines and Remotely Operated Vehicles", an entire copy of which is incorporated herein by reference. Ser. No. 12/583,240 is scheduled to be published on the date of Dec. 17, 2009, and the present application herein shall be filed on, or before, that date. It is intended that this portion of the specification in this paragraph shall be amended after the present application herein is filed in the USPTO.

The present application is related U.S. patent application Ser. No. 12/005,105, filed on Dec. 22, 2007, that is entitled "High Power Umbilicals for Electric Flowline Immersion Heating of Produced Hydrocarbons", an entire copy of which is incorporated herein by reference. Ser. No. 12/005,105 was published on Jun. 26, 2008 having Publication Number US 2008/0149343 A1, an entire copy of which is incorporated herein by reference.

The present application is related to U.S. patent application Ser. No. 10/800,443, filed on Mar. 14, 2004, that is entitled "Substantially Neutrally Buoyant and Positively Buoyant Electrically Heated Flowlines for Production of Subsea Hydrocarbons", an entire copy of which is incorporated herein by reference. Ser. No. 10/800,443 was published on Dec. 9, 2004 having Publication Number US 2004/0244982 A1, an entire copy of which is incorporated herein by reference. Ser. No. 10/800,443 issued as U.S. Pat. No. 7,311,151 B2 on Dec. 25, 2007.

The present application is related U.S. patent application Ser. No. 10/729,509, filed on Dec. 4, 2003, that is entitled "High Power Umbilicals for Electric Flowline Immersion Heating of Produced Hydrocarbons", an entire copy of which is incorporated herein by reference. Ser. No. 10/729,509 was published on Jul. 15, 2004 having the Publication Number US 2004/0134662 A1, an entire copy of which is incorporated herein by reference. Ser. No. 10/729,509 issued as U.S. Pat. No. 7,032,658 B2 on the date of Apr. 25, 2006, an entire copy of which is incorporated herein by reference.

The present application is related to U.S. patent application Ser. No. 10/223,025, filed Aug. 15, 2002, that is entitled "High Power Umbilicals for Subterranean Electric Drilling Machines and Remotely Operated Vehicles", an entire copy of which is incorporated herein by reference. Ser. No. 10/223,025 was published on Feb. 20, 2003, having Publication Number US 2003/0034177 A1, an entire copy of which is incorporated herein by reference. Ser. No. 10/223,025 issued as U.S. Pat. No. 6,857,486 B2 on the date of Feb. 22, 2005, an entire copy of which is incorporated herein by reference.

Applicant does not claim priority from the above five U.S. patent application Ser. No. 12/583,240, Ser. No. 12/005,105, Ser. No. 10/800,443, Ser. No. 10/729,509 and Ser. No. 10/223,025.

OTHER RELATED U.S. APPLICATIONS

The following applications are related to this application, but applicant does not claim priority from the following related applications.

This application relates to Ser. No. 09/375,479, filed Aug. 16, 1999, having the title of "Smart Shuttles to Complete Oil and Gas Wells", that issued on Feb. 20, 2001, as U.S. Pat. No. 6,189,621 B1, an entire copy of which is incorporated herein by reference.

This application also relates to application Ser. No. 09/487,197, filed Jan. 19, 2000, having the title of "Closed-Loop System to Complete Oil and Gas Wells", that issued on Jun. 4, 2002 as U.S. Pat. No. 6,397,946 B1, an entire copy of which is incorporated herein by reference.

This application also relates to application Ser. No. 10/162,302, filed Jun. 4, 2002, having the title of "Closed-Loop Conveyance Systems for Well Servicing", that issued as U.S. Pat. No. 6,868,906 B1 on Mar. 22, 2005, an entire copy of which is incorporated herein by reference.

This application also relates to application Ser. No. 11/491,408, filed Jul. 22, 2006, having the title of "Methods and Apparatus to Convey Electrical Pumping Systems into Wellbores to Complete Oil and Gas Wells", that issued as U.S. Pat. No. 7,325,606 B1 on Feb. 5, 2008, an entire copy of which is incorporated herein by reference.

And this application also relates to application Ser. No. 12/012,822, filed Feb. 5, 2008, having the title of "Methods and Apparatus to Convey Electrical Pumping Systems into Wellbores to Complete Oil and Gas Wells", that was Published as US 2008/128128 A1 on Jun. 5, 2008, an entire copy of which is incorporated herein by reference.

RELATED FOREIGN APPLICATIONS

The following foreign applications are related to this application, but applicant does not claim priority from the following related foreign applications.

This application relates to PCT Application Serial Number PCT/US00/22095, filed Aug. 9, 2000, having the title of "Smart Shuttles to Complete Oil and Gas Wells", that has International Publication Number WO 01/12946 A1, that has International Publication Date of Feb. 22, 2001, that issued as European Patent No. 1,210,498 B1 on the date of Nov. 28, 2007, an entire copy of which is incorporated herein by reference.

This application also relates to Canadian Serial No. CA2000002382171, filed Aug. 9, 2000, having the title of "Smart Shuttles to Complete Oil and Gas Wells", that was published on Feb. 22, 2001, as CA 2382171 AA, an entire copy of which is incorporated herein by reference.

This application further relates to PCT Patent Application Number PCT/US02/26066 filed on Aug. 16, 2002, entitled "High Power Umbilicals for Subterranean Electric Drilling Machines and Remotely Operated Vehicles", that has the International Publication Number WO 03/016671 A2, that has International Publication Date of Feb. 27, 2003, that issued as European Patent No. 1,436,482 B1 on the date of Apr. 18, 2007, an entire copy of which is incorporated herein by reference.

This application further relates to Norway Patent Application No. 2004 0771 filed on Aug. 16, 2002, having the title of "High Power Umbilicals for Subterranean Electric Drilling Machines and Remotely Operated Vehicles", that issued as Norway Patent No. 326,447 that issued on Dec. 8, 2008, an entire copy of which is incorporated herein by reference.

This application further relates to Canada Patent Application 2454865 filed on Aug. 16, 2002, having the title of "High Power Umbilicals for Subterranean Electric Drilling Machines and Remotely Operated Vehicles", that was published as CA 2454865 AA on the date of Feb. 27, 2003, an entire copy of which is incorporated herein by reference.

This application further relates to PCT Patent Application Number PCT/US03/38615 filed on Dec. 5, 2003, entitled "High Power Umbilicals for Electric Flowline Immersion Heating of Produced Hydrocarbons", that has the International Publication Number WO 2004/053935 A2, that has International Publication Date of Jun. 24, 2004, an entire copy of which is incorporated herein by reference.

This application further relates to PCT Patent Application Number PCT/US2004/008292, filed on Mar. 17, 2004, entitled "Substantially Neutrally Buoyant and Positively Buoyant Electrically Heated Flowlines for Production of Subsea Hydrocarbons", that has International Publication Number WO 2004/083595 A2 that has International Publication Date of Sep. 30, 2004, an entire copy of which is incorporated herein by reference.

CROSS-REFERENCES TO RELATED U.S. PROVISIONAL PATENT APPLICATIONS

This application relates to Provisional Patent Application No. 60/313,654 filed on Aug. 19, 2001, that is entitled "Smart Shuttle Systems", an entire copy of which is incorporated herein by reference.

This application also relates to Provisional Patent Application No. 60/353,457 filed on Jan. 31, 2002, that is entitled "Additional Smart Shuttle Systems", an entire copy of which is incorporated herein by reference.

This application further relates to Provisional Patent Application No. 60/367,638 filed on Mar. 26, 2002, that is entitled "Smart Shuttle Systems and Drilling Systems", an entire copy of which is incorporated herein by reference.

And yet further, this application also relates the Provisional Patent Application No. 60/384,964 filed on Jun. 3, 2002, that is entitled "Umbilicals for Well Conveyance Systems and Additional Smart Shuttles and Related Drilling Systems", an entire copy of which is incorporated herein by reference.

This application also relates to Provisional Patent Application No. 60/432,045, filed on Dec. 8, 2002, that is entitled "Pump Down Cement Float Valves for Casing Drilling, Pump Down Electrical Umbilicals, and Subterranean Electric Drilling Systems", an entire copy of which is incorporated herein by reference.

And yet further, this application also relates to Provisional Patent Application No. 60/448,191, filed on Feb. 18, 2003, that is entitled "Long Immersion Heater Systems", an entire copy of which is incorporated herein by reference.

Ser. No. 10/223,025 claimed priority from the above Provisional Patent Application No. 60/313,654, No. 60/353,457, No. 60/367,638 and No. 60/384,964, and applicant claims any relevant priority in the present application.

Ser. No. 10/729,509 claimed priority from various Provisional Patent Applications, including Provisional Patent Application No. 60/432,045, and 60/448,191, and applicant claims any relevant priority in the present application.

The present application also relates to Provisional Patent Application No. 60/455,657, filed on Mar. 18, 2003, that is entitled "Four SDCI Application Notes Concerning Subsea Umbilicals and Construction Systems", an entire copy of which is incorporated herein by reference.

The present application further relates to Provisional Patent Application No. 60/504,359, filed on Sep. 20, 2003, that is entitled "Additional Disclosure on Long Immersion Heater Systems", an entire copy of which is incorporated herein by reference.

The present application also relates to Provisional Patent Application No. 60/523,894, filed on Nov. 20, 2003, that is entitled "More Disclosure on Long Immersion Heater Systems", an entire copy of which is incorporated herein by reference.

The present application further relates to Provisional Patent Application No. 60/532,023, filed on Dec. 22, 2003, that is entitled "Neutrally Buoyant Flowlines for Subsea Oil and Gas Production", an entire copy of which is incorporated herein by reference.

And yet further, the present application relates to Provisional Patent Application No. 60/535,395, filed on Jan. 10, 2004, that is entitled "Additional Disclosure on Smart Shuttles and Subterranean Electric Drilling Machines", an entire copy of which is incorporated herein by reference.

Ser. No. 10/800,443 claimed priority from U.S. Provisional Patent Applications No. 60/455,657, No. 60/504,359, No. 60/523,894, No. 60/532,023, and No. 60/535,395, and applicant claims any relevant priority in the present application.

Further, the present application relates to Provisional Patent Application No. 60/661,972, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to Provisional Patent Application No. 60/665,689, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to Provisional Patent Application No. 60/669,940, filed on Apr. 9, 2005, that is entitled "Methods and Apparatus to Enhance Performance of Smart Shuttles and Well Locomotives", an entire copy of which is incorporated herein by reference.

And further, the present application relates to Provisional Patent Application No. 60/761,183, filed on Jan. 23, 2006, that is entitled "Methods and Apparatus to Pump Wirelines into Cased Wells Which Cause No Reverse Flow", an entire copy of which is incorporated herein by reference.

And yet further, the present application relates to Provisional Patent Application No. 60/794,647, filed on Apr. 24, 2006, that is entitled "Downhole DC to AC Converters to Power Downhole AC Electric Motors and Other Methods to Send Power Downhole", an entire copy of which is incorporated herein by reference.

Still further, the present application relates to Provisional Patent Application No. 61/189,253, filed on Aug. 15, 2008, that is entitled "Optimized Power Control of Downhole AC and DC Electric Motors and Distributed Subsea Power Consumption Devices", an entire copy of which is incorporated herein by reference.

And further, the present application relates to Provisional Patent Application No. 61/190,472, filed on Aug. 28, 2008, that is entitled "High Power Umbilicals for Subterranean Electric Drilling Machines and Remotely Operated Vehicles", an entire copy of which is incorporated herein by reference.

And finally, the present application relates to Provisional Patent Application No. 61/192,802, filed on Sep. 22, 2008, that is entitled "Seals for Smart Shuttles", an entire copy of which is incorporated herein by reference.

Ser. No. 12/583,240 claimed priority from Provisional Patent Application Ser. No. 61/189,253, No. 61/190,472, No. 61/192,802, No. 61/270,709, and No. 61/274,215, and applicant claims any relevant priority in the present application.

Entire copies of Provisional Patent Applications are incorporated herein by reference, unless unintentional errors have been found and specifically identified. Several such unintentional errors are herein noted. Provisional Patent Application Ser. No. 61/189,253 was erroneously referenced as Ser. No. 60/. . . within Provisional Patent Application Ser. No. 61/270,709 and within Provisional Patent Application No. 61/274,215 mailed to the USPTO on Aug. 13, 2009, and these changes are noted here, and are incorporated by herein by reference. Entire copies of the cited Provisional Patent Applications are incorporated herein by reference unless they present information which directly conflicts with any explicit statements in the application herein.

RELATED U.S. DISCLOSURE DOCUMENTS

This application further relates to disclosure in U.S. Disclosure Document No. 451,044, filed on Feb. 8, 1999, that is entitled 'RE:—Invention Disclosure—"Drill Bit Having Monitors and Controlled Actuators"', an entire copy of which is incorporated herein by reference.

This application further relates to disclosure in U.S. Disclosure Document No. 458,978 filed on Jul. 13, 1999 that is entitled in part "RE:—INVENTION DISCLOSURE MAILED Jul. 13, 1999", an entire copy of which is incorporated herein by reference.

This application further relates to disclosure in U.S. Disclosure Document No. 475,681 filed on Jun. 17, 2000 that is entitled in part "ROV Conveyed Smart Shuttle System Deployed by Workover Ship for Subsea Well Completion and Subsea Well Servicing", an entire copy of which is incorporated herein by reference.

This application further relates to disclosure in U.S. Disclosure Document No. 496,050 filed on Jun. 25, 2001 that is entitled in part "SDCI Drilling and Completion Patents and Technology and SDCI Subsea Re-Entry Patents and Technology", an entire copy of which is incorporated herein by reference.

This application further relates to disclosure in U.S. Disclosure Document No. 480,550 filed on Oct. 2, 2000 that is entitled in part "New Draft Figures for New Patent Applications", an entire copy of which is incorporated herein by reference.

This application further relates to disclosure in U.S. Disclosure Document No. 493,141 filed on May 2, 2001 that is entitled in part "Casing Boring Machine with Rotating Casing to Prevent Sticking Using a Rotary Rig", an entire copy of which is incorporated herein by reference.

This application further relates to disclosure in U.S. Disclosure Document No. 492,112 filed on Apr. 12, 2001 that is entitled in part "Smart Shuttle™ Conveyed Drilling Systems", an entire copy of which is incorporated herein by reference.

This application further relates to disclosure in U.S. Disclosure Document No. 495,112 filed on Jun. 11, 2001 that is entitled in part "Liner/Drainhole Drilling Machine", an entire copy of which is incorporated herein by reference.

This application further relates to disclosure in U.S. Disclosure Document No. 494,374 filed on May 26, 2001 that is entitled in part "Continuous Casting Boring Machine", an entire copy of which is incorporated herein by reference.

This application further relates to disclosure in U.S. Disclosure Document No. 495,111 filed on Jun. 11, 2001 that is entitled in part "Synchronous Motor Injector System", an entire copy of which is incorporated herein by reference.

And yet further, this application also relates to disclosure in U.S. Disclosure Document No. 497,719 filed on Jul. 27, 2001 that is entitled in part "Many Uses for The Smart Shuttle™ and Well Locomotive™", an entire copy of which is incorporated herein by reference.

This application further relates to disclosure in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

Still further, this application also relates to disclosure in U.S. Disclosure Document No. 499,136 filed on Aug. 26, 2001, that is entitled in part 'Commercial System Specification PCP-ESP Power Section for Cased Hole Internal Conveyance "Large Well Locomotive™"', an entire copy of which is incorporated herein by reference.

And yet further, this application also relates to disclosure in U.S. Disclosure Document No. 516,982 filed on Aug. 20, 2002, that is entitled "Feedback Control of RPM and Voltage of Surface Supply", an entire copy of which is incorporated herein by reference.

And further, this application also relates to disclosure in U.S. Disclosure Document No. 531,687 filed May 18, 2003, that is entitled "Specific Embodiments of Several SDCI Inventions", an entire copy of which is incorporated herein by reference.

Further, the present application relates to U.S. Disclosure Document No. 572,723, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to U.S. Disclosure Document No. 573,813, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to U.S. Disclosure Document No. 574,647, filed on Apr. 9, 2005, that is entitled "Methods and Apparatus to Enhance Performance of Smart Shuttles and Well Locomotives", an entire copy of which is incorporated herein by reference.

Yet further, the present application relates to U.S. Disclosure Document No. 593,724, filed Jan. 23, 2006, that is entitled "Methods and Apparatus to Pump Wirelines into Cased Wells Which Cause No Reverse Flow", an entire copy of which is incorporated herein by reference.

Further, the present application relates to U.S. Disclosure Document No. 595,322, filed Feb. 14, 2006, that is entitled "Additional Methods and Apparatus to Pump Wirelines into Cased Wells Which Cause No Reverse Flow", an entire copy of which is incorporated herein by reference.

And further, the present application relates to U.S. Disclosure Document No. 599,602, filed on Apr. 24, 2006, that is entitled "Downhole DC to AC Converters to Power Downhole AC Electric Motors and Other Methods to Send Power Downhole", an entire copy of which is incorporated herein by reference.

And finally, the present application relates to the U.S. Disclosure Document that is entitled "Seals for Smart Shuttles" that was mailed to the USPTO on the Date of Dec. 22, 2006 by U.S. Mail, Express Mail Service having Express Mail Number EO 928 739 065 US, an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". To best knowledge of applicant, all copies of U.S. Patents that were ordered from commercial sources that were specified in the U.S. Disclosure Documents are in the possession of applicant at the time of the filing of the application herein.

RELATED U.S. TRADEMARKS

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". In particular, applicant includes herein by reference entire copies of each and every U.S. Patent cited in U.S. Disclosure Document No. 452648, including all its attachments, that was filed on Mar. 5, 1999. To best knowledge of applicant, all copies of U.S. Patents that were ordered from commercial sources that were specified in the U.S. Disclosure Documents are in the possession of applicant at the time of the filing of the application herein.

Applications for U.S. Trademarks have been filed in the USPTO for several terms used in this application. An application for the Trademark "Smart Shuttle" was filed on Feb. 14, 2001 that is Ser. No. 76/213,676, an entire copy of which is incorporated herein by reference. The term Smart Shuttle® is now a Registered Trademark. The "Smart Shuttle™" is also called the "Well Locomotive". An application for the Trademark "Well Locomotive" was filed on Feb. 20, 2001 that is Ser. No. 76/218,211, an entire copy of which is incorporated herein by reference. The term "Well Locomotive" is now a Registered Trademark. An application for the Trademark of "Downhole Rig" was filed on Jun. 11, 2001 that is Ser. No. 76/274,726, an entire copy of which is incorporated herein by reference. An application for the Trademark "Universal Completion Device" was filed on Jul. 24, 2001 that is Ser. No. 76/293,175, an entire copy of which is incorporated herein by reference. An application for the Trademark "Downhole BOP" was filed on Aug. 17, 2001 that is Ser. No. 76/305,201, an entire copy of which is incorporated herein by reference.

Accordingly, in view of the Trademark Applications, the term "smart shuttle" will be capitalized as "Smart Shuttle"; the term "well locomotive" will be capitalized as "Well Locomotive"; the term "downhole rig" will be capitalized as "Downhole Rig"; the term "universal completion device" will be capitalized as "Universal Completion Device"; and the term "downhole bop" will be capitalized as "Downhole BOP".

Other U.S. Trademarks related to the invention disclosed herein include the following: "Subterranean Electric Drilling Machine", or "SEDM™"; "Electric Drilling Machine™", or "EDM™"; "Electric Liner Drilling Machine™", or "ELDM™"; "Continuous Casing Casting Machine™", or "CCCM™"; "Liner/Drainhole Drilling Machine™", or "LDDM™"; "Drill and Drag Casing Boring Machine™", or "DDCBM™"; "Next Step Drilling Machine™", or "NSDM™"; "Next Step Electric Drilling Machine™", or "NSEDM™"; "Next Step Subterranean Electric Drilling Machine™", or "NSSEDM™"; and "Subterranean Liner Expansion Tool™", or "SLET™"

Other additional Trademarks related to the invention disclosed herein are the following: "Electrically Heated Composite Umbilical™", or "EHCU™"; "Electric Flowline Immersion Heater Assembly™", or "EFIHA™"; and "Pump-Down Conveyed Flowline Immersion Heater Assembly™", or "PDCFIHA™".

Yet other additional Trademarks related to the invention disclosed herein are the following: "Adaptive Electronics Control System™", or "AECS™"; "Subsea Adaptive Electronics Control System™", or "SAECS™"; "Adaptive Power Control System™", or "APCS™"; and "Subsea Adaptive Power Control System™", or "SAPCS™".

BACKGROUND OF THE INVENTION

1. Field of Invention

The fundamental field of the invention relates to methods and apparatus that may be used to drill and complete wells at great lateral distances from a drill site. The invention may be used to reach any lateral distance from the surface drill site, from close to the drill site, to a maximum radial distance of at least 20 miles from the surface drill site. This is accomplished by using a near neutrally buoyant umbilical that is attached to a Subterranean Electric Drilling Machine. The near neutrally buoyant umbilical is capable of providing up to 320 horsepower to do work at lateral distances of at least 20 miles. This drilling application requires near neutrally buoyant umbilicals capable of providing high power at great distances and high speed data communications to and from the surface. The near neutrally buoyant umbilical reduces the frictional drag of the umbilical within the wellbore. To convey drilling equipment to great distances also requires methods and apparatus to move heavy equipment through pipes at relatively high speeds. Similar high power umbilicals having high speed data communications to and from the surface are also useful for providing power and communications to remotely operated vehicles used for subsea service work in the oil and gas industry.

Such high power electrically heated composite umbilicals are also useful as immersion heaters to be installed, or retrofitted, into subsea flowlines to prevent the formation of waxes and hydrates and to prevent the blockage of the flowlines. Such retrofitted electrically heated composite umbilicals provide an alternative for previously installed, but failed, permanent heating systems. A hydraulic pump installed on the distant end of an electrically heated composite umbilical also provides artificial lift to the produced hydrocarbons. Other electrically heated umbilicals used as immersion heaters are also described. Such immersion heater systems may be removed from the well, repaired, and retrofitted into flowlines without removing the flowlines. Near neutrally buoyant electrically heated umbilicals are described which may be installed great distances into flowlines. Different methods of deploying the electrically heated umbilicals are also discussed.

Such high power, electrically heated composite umbilicals that are substantially neutrally buoyant, or positively buoyant, in sea water are also useful as flowlines for producing hydrocarbons from subsea wells.

Closed-loop feedback control systems have also been developed to provide the required energy to either AC and DC electric motors attached to long umbilicals that are used for drilling purposes. Such systems are also useful to provide power and commands to ROV's and to other subsea power consumption systems. Such systems are also useful for the control subsea systems.

Composite umbilicals are described which provide electrical power to distant subterranean electric motors and other electrical devices which incorporate major umbilical strength members comprised of titanium, aluminum, and/or their alloys.

Methods of fabrication that protects against hydrogen sulfide stress corrosion of titanium, and its alloys, by forcing high temperature helium or other noble gases into the titanium during fabrication are also described.

Numerous different embodiments of hydraulic seals are described for the Smart Shuttle, for the Subterranean Electric Drilling Machine, and for pipeline pigs, including novel cup seals and novel chevron seals.

Different embodiments of hydraulic seals are described which incorporate measurement sensors, and in yet other embodiments, measurement information from the sensors is used for the closed-loop feedback control of the hydraulic seals.

2. Description of the Related Art

The oil and gas industry does not now have the capability to drill horizontally extreme distances of approximately 20 miles to commercially meet some of the challenges that exist today. Industry extended reach-drilling capability is currently between 6 and 7 miles. Conventional drilling rigs using drill pipe and mud motors at shallow angles have established these conventional records. These wells have pushed conventional drilling technologies close to their practical limit and new methods are required for longer offsets.

The industry's lack of a 20 mile drilling capability reduces accessibility to oil and gas reserves. Many areas, both onshore and offshore, have no surface access for development drilling. Onshore, this may be due to urban development as is the case in Holland, national parks or other special areas such as the Arctic National Wildlife Refuge (ANWR), or other land uses that are sensitive to surface drilling operations. Offshore, the incentive is to maximize the use of existing structures and infrastructure by replacing expensive flowlines, manifold and trees. Near shore regions as found in the Santa Barbara Channel, and especially where ice may be present such as in the Arctic or near Sakhalin Island, or where migrating whales may limit seasonal operations provide significant incentives for this new 20 mile drilling capability.

The industry does not have an extreme reach lateral drilling system that is compatible with existing drilling and production infrastructure. If such a system were available, new roads, drill sites, pits, site remediation, permitting, etc. are all avoided in such onshore operations. Offshore, existing host structures will have greatly extended usefulness while reservoirs within 20-mile radii may be developed.

The industry does not have an extreme reach drilling capability that reduces the risk to the environment. If such a system were available, then operating from drilling and production centers would allow using subsurface access to the reservoirs. There would be no surface flowlines or facilities outside the regional drilling and production center. Extreme reach lateral drilling systems could eliminate the need for many of the flowlines on the ocean bottom in a regional development. However, centralized surface operations with fixed facilities require a paradigm shift in development drilling operations. The well drilling and maintenance equipment would not normally be mobile (except offshore on vessels) and it would normally spend its entire working life from one location.

Several references are cited below related to the topics of expandable casing, methods to expand tubulars and casings, fabricating composite umbilicals, and well management systems.

Relevant references to expandable casing includes U.S. Pat. No. 5,667,011, entitled "Method of Creating a Casing in a Borehole", which issued on Sep. 16, 1997, that is assigned to Shell Oil Company of Houston, Tex., and the following U.S. Patents, entire copies of which are incorporated herein by reference:

U.S. Pat. No. 5,366,012; U.S. Pat. No. 5,348,095; U.S. Pat. No. 5,240,074; U.S. Pat. No. 4,716,965; U.S. Pat. No. 4,501,327; U.S. Pat. No. 4,495,997; U.S. Pat. No. 3,958,637; U.S. Pat. No. 3,203,451; U.S. Pat. No. 3,172,618; U.S. Pat. No. 3,052,298; U.S. Pat. No. 2,447,629; U.S. Pat. No. 2,207,478

Relevant references to expandable casing also includes U.S. Pat. No. 6,431,282, entitled "Method for Annular Sealing", which issued on Aug. 13, 2002, that is assigned to Shell Oil Company of Houston, Tex., and the following U.S. Patents, entire copies of which are incorporated herein by reference:

U.S. Pat. No. 6,012,522; U.S. Pat. No. 5,964,288; U.S. Pat. No. 5,875,845; U.S. Pat. No. 5,833,001; U.S. Pat. No. 5,794,702; U.S. Pat. No. 5,787,984; U.S. Pat. No. 5,718,288; U.S. Pat. No. 5,667,011; U.S. Pat. No. 5,337,823; U.S. Pat. No. 3,782,466; U.S. Pat. No. 3,489,220; U.S. Pat. No. 3,363,301; U.S. Pat. No. 3,297,092; U.S. Pat. No. 3,191,680; U.S. Pat. No. 3,134,442; U.S. Pat. No. 3,126,959; U.S. Pat. No. 2,294,294; U.S. Pat. No. 2,248,028

Other relevant foreign patent documents related expandable casing include the following, entire copies of which are incorporated herein by reference:

E.P. 0,643,794; W.O. 09,933,763; W.O. 09,923,046; W.O. 09,906,670; W.O. 09,902,818; W.O. 09,703,489; W.O. 09,519,942; W.O. 09,419,574; W.O. 09,409,252; W.O. 09,409,250; W.O. 09,409,249

Other publications related to expandable casing include the following documents related to Enventure Global Technology of Houston, Tex., entire copies of which are incorporated herein by reference:

(a) Campo, D., et al., "Drilling and Recompletion Applications Using Solid Expandable Tubular Technology", SPE/

IARC 72304 at 2002 SPE/IADC Middle East Drilling Technology Conference and Exhibition, 11 Mar. 2002.

(b) Moore, M., et al., "Field Trial Proves Upgrades to Solid Expandable Tubulars", OTC 14217 at 2002 Offshore Technology Conference, 6-9 May 2002.

(c) Grant, T., et al., "Deepwater Expandable Openhole Liner Case Histories Learnings Through Field Applications", OTC 14218 at 2002 Offshore Technology Conference, 6-9 May 2002.

(d) Dupal, K., et al., "Realization of the Mono-Diameter Well: Evolution of a Game-Changing Technology", OTC 14312 at 2002 Offshore Technology Conference, 6-9 May 2002.

(e) Moore, M., et al., "Expandable Linear Hangers: Case Histories", OTC 14313 at 2002 Offshore Technology Conference, 6-9 May 2002.

(f) Nor, N., et al., "Transforming Conventional Wells to Bigbore Completions Using Solid Expandable Tubular Technology", OTC 14315 at 2002 Offshore Technology Conference, 609 May 2002.

(g) Merritt, R., et al., "Well Remediation Using Expandable Cased-Hole Liners—Summary of Case Histories", Texas Tech University's Southwestern Petroleum Short Course—2002 Conference.

(h) Cales, G., et al., "Subsidence Remediation—Extending Well Life Through the Use of Solid Expandable Casing Systems", AADE 01-NC-HO-24 at March 2001 Conference.

(i) Dupal, K., et al., "Solid Expandable Tubular Technology—A Year of Case Histories in the Drilling Environment", SPE/IADC 67770 at 2001 SPE/IADC Drilling Conference 27 Feb.-1 Mar. 2001.

(j) Dupal, K., et al., "Well Design With Expandable Tubulars Reduces Costs and Increases Success in Deepwater Applications", Deep Offshore Technology, 2002.

(k) Daigle, C., et al., "Expandable Tubulars: Field Examples of Application in Well Construction and Remediation", SPE 62958 at SPE Annual Technical Conference and Exhibition, 1-4 Oct. 2000.

(l) Bullock, M., et al., "Using Expandable Solid Tubulars to Solve Well Construction Challenges in Deep Waters and Maturing Properties", IBP 275 00 at the Rio Oil & Gas Conference, 16-19 Oct. 2000.

(m) Mack, A., et al., "In-Situ Expansion of Casing and Tubing—Effect on Mechanical Properties and Resistance to Sulfide Stress Cracking", NACE 00164 at the NACE Expo Corrosion 2000 Conference, 26-30 Mar. 2000.

(n) Lohoefer, C., et al., "Expandable Liner Hanger Provides Cost-Effective Alternative Solution", IADC/SPE 59151 at 2000 IADC/SPE Drilling Conference, 23-25 Feb. 2000.

(o) Filippov, A., et al., "Expandable Tubular Solutions", SPE 56500 at 1999 SPE Annual Technical Conference and Exhibition, 3-6 Oct. 1999.

(p) Haut, R., et al., "Meeting Economic Challenge of Deepwater Drilling with Expandable-Tubular Technology", Deep Offshore Technology Conference, 1999.

(q) Bayfield, M., et al., "Burst and Collapse of a Sealed Multilateral Junction Numerical Simulations", SPE/IADC 52873 at 1999 SPE/IADC Drilling Conference, 9-11 Mar. 1999.

Relevant references related to expandable casing also include U.S. Pat. No. 6,354,373, entitled "Expandable Tubing for a Well Bore Hole and Method of Expanding", which issued on Mar. 12, 2002, that is assigned to the Schlumberger Technology Corporation of Houston, Tex., and the following U.S. Patents, entire copies of which are incorporated herein by reference:

U.S. Pat. No. 6,012,522; U.S. Pat. No. 5,631,557; U.S. Pat. No. 5,494,106; U.S. Pat. No. 5,366,012; U.S. Pat. No. 5,348,095; U.S. Pat. No. 5,337,823; U.S. Pat. No. 5,200,072; U.S. Pat. No. 5,083,608; U.S. Pat. No. 5,014,779; U.S. Pat. No. 4,976,322, U.S. Pat. No. 5,830,109; U.S. Pat. No. 4,716,965; U.S. Pat. No. 4,501,327; U.S. Pat. No. 4,495,997; U.S. Pat. No. 4,308,736; U.S. Pat. No. 3,948,321; U.S. Pat. No. 3,785,193; U.S. Pat. No. 3,691,624; U.S. Pat. No. 3,489,220; U.S. Pat. No. 3,477,506; U.S. Pat. No. 3,364,993; U.S. Pat. No. 3,353,599; U.S. Pat. No. 3,326,293; U.S. Pat. No. 3,054,455; U.S. Pat. No. 3,028,915; U.S. Pat. No. 2,734,580; U.S. Pat. No. 2,447,629; U.S. Pat. No. 2,214,226; U.S. Pat. No. 1,652,650; U.S. 341,327

Other relevant foreign patent documents related to expandable casing include the following, entire copies of which are incorporated herein by reference:

S.U. 1,747,673; S.U. 1,051,222; W.O. 93/25799

Relevant references for methods to expand tubulars and casings include U.S. Pat. No. 6,325,148, entitled "Tools and Methods for Use with Expandable Tubulars", which issued on Dec. 4, 2001, that is assigned to Weatherford/Lamb, Inc. of Houston, Tex., and the following U.S. Patents, entire copies of which are incorporated herein by reference:

U.S. Pat. No. 6,070,671; U.S. Pat. No. 6,029,748; U.S. Pat. No. 5,979,571; U.S. Pat. No. 5,960,895; U.S. Pat. No. 5,924,745; U.S. Pat. No. 5,901,789; U.S. Pat. No. 5,887,668; U.S. Pat. No. 5,785,120; U.S. Pat. No. 5,706,905; U.S. Pat. No. 5,667,011; U.S. Pat. No. 5,636,661; U.S. Pat. No. 5,560,426; U.S. Pat. No. 5,553,679; U.S. Pat. No. 5,520,255; U.S. Pat. No. 5,472,057; U.S. Pat. No. 5,409,059; U.S. Pat. No. 5,366,012; U.S. Pat. No. 5,348,095; U.S. Pat. No. 5,322,127; U.S. Pat. No. 5,307,879; U.S. Pat. No. 5,301,760; U.S. Pat. No. 5,271,472; U.S. Pat. No. 5,267,613; U.S. Pat. No. 5,156,209; U.S. Pat. No. 5,052,849; U.S. Pat. No. 5,052,483; U.S. Pat. No. 5,014,779; U.S. Pat. No. 4,997,320; U.S. Pat. No. 4,976,322; U.S. Pat. No. 4,883,121; U.S. Pat. No. 4,866,966; U.S. Pat. No. 4,848,469; U.S. Pat. No. 4,807,704; U.S. Pat. No. 4,626,129; U.S. Pat. No. 4,581,617; U.S. Pat. No. 4,567,631; U.S. Pat. No. 4,505,612; U.S. Pat. No. 4,505,142; U.S. Pat. No. 4,502,308; U.S. Pat. No. 4,487,630; U.S. Pat. No. 4,483,399; U.S. Pat. No. 4,470,280; U.S. Pat. No. 4,450,612; U.S. Pat. No. 4,445,201; U.S. Pat. No. 4,414,739; U.S. Pat. No. 4,407,150; U.S. Pat. No. 4,387,502; U.S. Pat. No. 4,382,379; U.S. Pat. No. 4,362,324; U.S. Pat. No. 4,359,889; U.S. Pat. No. 4,349,050; U.S. Pat. No. 4,319,393; U.S. Pat. No. 3,977,076; U.S. Pat. No. 3,948,321; U.S. Pat. No. 3,820,370; U.S. Pat. No. 3,785,193; U.S. Pat. No. 3,780,562; U.S. Pat. No. 3,776,307; U.S. Pat. No. 3,746,091; U.S. Pat. No. 3,712,376; U.S. Pat. No. 3,691,624; U.S. Pat. No. 3,689,113; U.S. Pat. No. 3,669,190; U.S. Pat. No. 3,583,200; U.S. Pat. No. 3,489,220; U.S. Pat. No. 3,477,506; U.S. Pat. No. 3,354,955; U.S. Pat. No. 3,353,599; U.S. Pat. No. 3,326,293; U.S. Pat. No. 3,297,092; U.S. Pat. No. 3,245,471; U.S. Pat. No. 3,203,483; U.S. Pat. No. 3,203,451; U.S. Pat. No. 3,195,646; U.S. Pat. No. 3,191,680; U.S. Pat. No. 3,191,677; U.S. Pat. No. 3,186,485; U.S. Pat. No. 3,179,168; U.S. Pat. No. 3,167,122; U.S. Pat. No. 3,039,530; U.S. Pat. No. 3,028,915; U.S. Pat. No. 2,633,374; U.S. Pat. No. 2,627,891; U.S. Pat. No. 2,519,116; U.S. Pat. No. 2,499,630; U.S. Pat. No. 2,424,878; U.S. Pat. No. 2,383,214; U.S. Pat. No. 2,214,226; U.S. Pat. No. 2,017,451; U.S. Pat. No. 1,981,525; U.S. Pat. No. 1,880,218; U.S. Pat. No. 1,301,285; U.S. Pat. No. 988,504

Other relevant foreign patent documents related to methods to expand tubulars and casings include the following, entire copies of which are incorporated herein by reference:

W.O. 99/23354; W.O. 99/18328; W.O. 99/02818; W.O. 98/00626; W.O. 97/21901; W.O. 94/25655; W.O. 93/24728;

W.O. 92/01139 G.B. 2329918A; G.B. 2320734A; G.B. 2313860B; G.B. 2216926A; G.B. 1582392; G.B. 1457843; G.B. 1448304; G.B. 1277461; G.B. 997721; G.B. 792886; G.B. 730338; E.P. 0 961 007 A2; E.P. 0 952 305 A1; E.P. WO93/25800; D.E. 4133802C1; D.E. 3213464A1

Another relevant publication related to methods to expand tubulars and casings includes the following, an entire copy of which is incorporated herein by reference: Metcalfe, P. "Expandable Slotted Tubes Offer Well Design Benefits", Petroleum Engineer International, vol. 69, No. 10 (October 1996), pp 60-63.

Relevant references for fabricating composite umbilicals includes U.S. Pat. No. 6,357,485 B2, entitled "Composite Spoolable Tube", which issued on Mar. 19, 2002, having the inventors of Quigley et al. (hereinafter "Quigley et al."), that is assigned to the Fiberspar Corporation, an entire copy of which is incorporated herein by reference. Column 7, lines 39-60, of Quigley et al. states the following: 'P. K. Mallick in the text book entitled *Fiber-Reinforced Composites, Materials manufacturing and Design*, defines a composite in the following manner: "Fiber-reinforced composite materials consist of fibers of high strength and modulus embedded in or bonded to a matrix with distinct interfaces (boundary) between them. In general, fibers are the principal load arraying [carrying] member, while the surrounding matrix keeps them in the desired location and orientation, acts as a load transfer medium between them, and protects them from environmental damages due to elevated temperatures and humidity, for example." This definition defines composites as used in this invention with the fibers selected from a variety of available materials including carbon, aramid, and glass and the matrix or resin selected from a variety of available materials including thermoset resin such as epoxy and vinyl ester or thermoplastic resins such as polyetheretherketone (PEEK), polyetherketoneketone (PEKK), nylon, etc. Composite structures are capable of carrying a variety of loads in combination or independently, including tension, compression, pressure, bending, and torsion.'

Relevant references for fabricating composite umbilicals also include the following U.S. Patents, entire copies of which are incorporated herein by reference:

U.S. Pat. No. 6,286,558; U.S. Pat. No. 6,148,866; U.S. Pat. No. 5,921,285; U.S. Pat. No. 6,016,845; U.S. Pat. No. 646,887; U.S. Pat. No. 1,930,285; U.S. Pat. No. 2,648,720; U.S. Pat. No. 2,690,769; U.S. Pat. No. 2,725,713; U.S. Pat. No. 2,810,424; U.S. Pat. No. 3,116,760; U.S. Pat. No. 3,277,231; U.S. Pat. No. 3,334,663; U.S. Pat. No. 3,379,220; U.S. Pat. No. 3,477,474; U.S. Pat. No. 3,507,412; U.S. Pat. No. 3,522,413; U.S. Pat. No. 3,554,284; U.S. Pat. No. 3,579,402; U.S. Pat. No. 3,604,461; U.S. Pat. No. 3,606,402; U.S. Pat. No. 3,692,601; U.S. Pat. No. 3,700,519; U.S. Pat. No. 3,701,489; U.S. Pat. No. 3,734,421; U.S. Pat. No. 3,738,637; U.S. Pat. No. 3,740,285; U.S. Pat. No. 3,769,127; U.S. Pat. No. 3,783,060; U.S. Pat. No. 3,828,112; U.S. Pat. No. 3,856,052; U.S. Pat. No. 3,856,052; U.S. Pat. No. 3,860,742; U.S. Pat. No. 3,933,180; U.S. Pat. No. 3,956,051; U.S. Pat. No. 3,957,410; U.S. Pat. No. 3,960,629; U.S. RE29,122; U.S. Pat. No. 4,053,343; U.S. Pat. No. 4,057,610; U.S. Pat. No. 4,095,865; U.S. Pat. No. 4,108,701; U.S. Pat. No. 4,125,423; U.S. Pat. No. 4,133,972; U.S. Pat. No. 4,137,949; U.S. Pat. No. 4,139,025; U.S. Pat. No. 4,190,088; U.S. Pat. No. 4,200,126; U.S. Pat. No. 4,220,381; U.S. Pat. No. 4,241,763; U.S. Pat. No. 4,248,062; U.S. Pat. No. 4,261,390; U.S. Pat. No. 4,303,457; U.S. Pat. No. 4,308,999; U.S. Pat. No. 4,336,415; U.S. Pat. No. 4,463,779; U.S. Pat. No. 4,515,737; U.S. Pat. No. 4,522,235; U.S. Pat. No. 4,530,379; U.S. Pat. No. 4,556,340; U.S. Pat. No. 4,578,675; U.S. Pat. No. 4,627,472; U.S. Pat. No. 4,657,795; U.S. Pat. No. 4,681,169; U.S. Pat. No. 4,728,224; U.S. Pat. No. 4,789,007; U.S. Pat. No. 4,992,787; U.S. Pat. No. 5,097,870; U.S. Pat. No. 5,170,011; U.S. Pat. No. 5,172,765; U.S. Pat. No. 5,176,180; U.S. Pat. No. 5,184,682; U.S. Pat. No. 5,209,136; U.S. Pat. No. 5,285,008; U.S. Pat. No. 5,285,204; U.S. Pat. No. 5,330,807; U.S. Pat. No. 5,334,801; U.S. Pat. No. 5,348,096; U.S. Pat. No. 5,351,752; U.S. Pat. No. 5,428,706; U.S. Pat. No. 5,435,867; U.S. Pat. No. 5,443,099; U.S. RE35,081; U.S. Pat. No. 5,469,916; U.S. Pat. No. 5,551,484; U.S. Pat. No. 5,730,188; U.S. Pat. No. 5,755,266; U.S. Pat. No. 5,828,003; U.S. Pat. No. 5,921,285; U.S. Pat. No. 5,933,945; U.S. Pat. No. 5,951,812; U.S. Pat. No. 6,016,845; U.S. Pat. No. 6,148,866; U.S. Pat. No. 6,286,558; U.S. Pat. No. 6,004,639; U.S. Pat. No. 6,361,299

Other relevant foreign patent documents related to fabricating composite umbilicals include the following, entire copies of which are incorporated herein by reference:

DE 421-4383; EP 0024512; EP 352148; EP 505815; GB 553,110; GB 2255994; GB 2270099

Other relevant publications related to fabricating composite umbilicals include the following, entire copies of which are incorporated herein by reference:

(a) Fowler Hampton et al.; "Advanced Composite Tubing Usable", The American Oil & Gas Reporter, pp. 76-81 (September 1997).

(b) Fowler Hampton et al.; "Development Update and Applications of an Advanced Composite Spoolable Tubing", Offshore Technology Conference held in Houston Tex. from 4 to 7 of May 1998, pp. 157-162.

(c) Hahan H. Thomas and Williams G. Jerry; "Compression Failure Mechanisms in Unidirectional Composites", NASA Technical Memorandum pp 1-42 (August 1984).

(d) Hansen et al.; "Qualification and Verification of Spoolable High Pressure Composite Service Lines for the Asgard Field Development Project", paper presented at the 1997 Offshore Technology Conference held in Houston Tex. from 5 to 8 of May 1997, pp. 45-54.

(e) Haug et al.; "Dynamic Umbilical with Composite Tube (DUCT)", Paper presented at the 1998 Offshore Technology Conference held in Houston Tex. from 4 to 7 of May, 1998, pp. 699-712.

(f) Lundberg et al.; "Spin-off Technologies from Development of Continuous Composite Tubing Manufacturing Process", Paper presented at the 1998 Offshore Technology Conference held in Houston, Tex. from 4 to 7 of May 1998, pp. 149-155.

(g) Marker et al.; "Anaconda: Joint Development Project Leads to Digitally Controlled Composite Coiled Tubing Drilling System", Paper presented at the SPEI/COTA, Coiled Tubing Roundtable held in Houston, Tex. from 5 to 6 of Apr., 2000, pp. 1-9.

(h) Measures R. M.; "Smart Structures with Nerves of Glass", Prog. Aerospace Sc. 26(4):289-351(1989).

(i) Measures et al.; "Fiber Optic Sensors for Smart Structures", Optics and Lasers Engineering 16: 127-152 (1992)

(j) Poper Peter; "Braiding", International Encyclopedia of Composites, Published by VGH, Publishers, Inc., 220 English 23rd Street, Suite 909, New York, N.Y. 10010.

(k) Quigley et al., "Development and Application of a Novel Coiled Tubing String for Concentric Workover Services", Paper presented at the 1997 Offshore Technology Conference held in Houston, Tex. from 5 to 8 of May 1997, pp. 189-202.

(l) Sas-Jaworsky II and Bell Steve "Innovative Applications Stimulated Coiled Tubing Development", World Oil, 217 (6): 61 (June 1996).

(m) Sas-Jaworsky II and Mark Elliot Teel; "Coiled Tubing 1995 Update: Production Applications", World Oil, 216 (6): 97 (Ju. 1995).

(n) Sas-Jaworsky, A. and J. G. Williams, "Advanced composites enhance coiled tubing capabilities", World Oil, pp. 57-69 (April 1994).

(o) Sas-Jaworsky, A. and J. G. Williams, "Development of a composite coiled tubing for oilfield services", Society of Petroleum Engineers, SPE 26536, pp. 1-11 (1993).

(p) Sas-Jaworsky, A. and J. G. Williams, "Enabling capabilities and potential application of composite coiled tubing", Proceedings of World Oil's 2nd International Conference on Coiled Tubing Technology, pp. 2-9 (1994).

(p) Sas-Jaworsky II Alex; "Developments Position CT for Future Prominence", The American Oil & Gas Reporter, pp. 87-92 (March 1996).

(r) Moe Wood T., et al.; "Spoolable, Composite Tubing for Chemical and Water Injection and Hydraulic Valve Operation", Proceedings of the 11th International Conference on Offshore Mechanics and Arctic Engineering-1992, vol. III, Part A-Materials Engineering, pp. 199-207 (1992).

(s) Shuart J. M. et al.; "Compression Behavior of 45°—Dominated Laminates with a Circular Hole of Impact Damage", AIAA Journal 24(1): 115-122 (January 1986).

(t) Silverman A. Seth, "Spoolable Composite Pipe for Offshore Applications", Materials Selection & Design pp. 48-50 (January 1997).

(u) Rispler K. et al.; "Composite Coiled Tubing in Harsh Completion/Workover Environments", paper presented at the SPE Gas Technology Symposium and Exhibition held in Calgary, Alberta, Canada, on Mar. 15-18, 1998, pp. 405-410.

(v) Williams G. J. et al.; "Composite Spoolable Pipe Development, Advancements, and Limitations", Paper presented at the 2000 Offshore Technology Conference held in Houston Tex. from 1st to 4 of May 2000, pp. 1-16.

A relevant reference for well management systems includes U.S. Pat. No. 6,257,332, entitled "Well Management System", which issued on Jul. 10, 2001, that is assigned to the Halliburton Energy Services, Inc., an entire copy of which incorporated herein by reference.

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is incorporated herein by reference in its entirety that is comprised of the following:

Unit I—"The Rig and Its Maintenance" (12 Lessons);

Unit II—"Normal Drilling Operations" (5 Lessons);

Unit III—Nonroutine Rig Operations (4 Lessons);

Unit IV—Man Management and Rig Management (1 Lesson);

and Unit V—Offshore Technology (9 Lessons). All of the individual Glossaries of all of the above Lessons in their entirety are also explicitly incorporated herein, and all definitions in those Glossaries shall be considered to be explicitly referenced and/or defined herein.

Additional procedures used in the oil and gas industries to drill and complete wells are well documented in the series entitled "Lessons in Well Servicing and Workover" published by the Petroleum Extension Service of The University of Texas at Austin, Austin, Tex. that is incorporated herein by reference in its entirety that is comprised of all 12 Lessons. All of the individual Glossaries of all of the above Lessons in their entirety are also explicitly incorporated herein, and any and all definitions in those Glossaries shall be considered to be explicitly referenced and/or defined herein.

Entire copies of each and every reference explicitly cited above in this section entitled "Description of the Related Art" are incorporated herein by reference.

At the time of the filing of the application herein, the applicant is unaware of any additional art that is particularly relevant to the invention other than that cited in the above defined "related" U.S. patents, the "related" co-pending U.S. Patent Applications, the "related" co-pending PCT Application, and the "related" U.S. Disclosure Documents that are specified in the first paragraphs of this application.

SUMMARY OF THE INVENTION

An object of the invention is to provide high power umbilicals for subterranean electric drilling.

Another object of the invention is to provide high power umbilicals that allow subterranean electric drilling machines to drill boreholes of up to 20 miles laterally from surface drill sites.

Another object of the invention is to provide high power umbilicals that allow the subterranean liner expansion tools to install casings within monobore wells to distances of up to 20 miles laterally from surface drill sites.

Another object of the invention is to provide high power near neutrally buoyant umbilicals for subterranean electric drilling to reduce the frictional drag on the umbilicals.

Yet another object of the invention is to provide a high power near neutrally buoyant umbilical that possesses high speed data communications and also provides a conduit for drilling mud.

Another object of the invention is to provide an umbilical that delivers in excess of 60 kilowatts to a downhole electric motor that is a portion of a Subterranean Electric Drilling Machine.

Yet another object of the invention is to provide a novel feedback control of a downhole electric motor that is a part of a Subterranean Electric Drilling Machine.

Yet another object of the invention is to provide high power umbilicals to operate subsea remotely operated vehicles.

Another object of the invention is to provide an umbilical to operate a subsea remotely operated vehicle that possesses high speed data communications and provides a conduit for fluids.

Yet another object of the invention is to provide a novel feedback control of a downhole electric motor that comprises a portion of a remotely operated vehicle.

Another object of the invention is to provide electric flowline immersion heater assemblies that may be retrofitted into existing subsea flowlines.

Yet another object of the invention is to provide electrically heated composite umbilicals that may be retrofitted into existing subsea flowlines.

Another object of the invention is to provide different types of electrically heated composite umbilicals that may be installed within subsea flowlines.

Yet another object of the invention is to provide different types of electrically heated umbilicals.

Another object of the invention is to provide different methods to convey electrically heated composite umbilicals into subsea flowlines.

Yet another object of the invention is to provide different methods to convey electrically heated umbilicals into subsea flowlines.

Another object of the invention is to provide electrically heated immersion heater systems to prevent the build up of wax and hydrates to prevent the blockage of subsea flowlines.

Yet another object of the invention is to provide a hydraulic pump attached to the distant end of an electrically heated composite umbilical installed within a flowline to provide artificial lift to the produced hydrocarbons.

Another object of the invention is to install an electrically heated composite umbilical within a flowline carrying heavy oils to reduce the viscosity of those heavy oils.

Another object of the invention is to provide electrically heated composite umbilicals that are heated uniformly within a flowline.

Yet another object of the invention is to provide electrically heated composite umbilicals that are heated nonuniformaly within a flowline.

Yet another object of the invention is to provide electrically heated composite umbilicals that are substantially neutrally buoyant within the fluids present within the flowlines.

Another object of the invention is to provide electrically heated umbilicals that are substantially neutrally buoyant within the fluids present within the flowlines.

It is yet another object of the invention to provide an electrically heated immersion heater system that may be removed from the well, repaired, and retrofitted in the flowline without removing the flowline.

It is another object of the invention to provide an electrically heated, substantially neutrally buoyant tabular umbilical to be used as a flowline from a subsea well.

Yet further, it is another object of the invention to provide an electrically heated, positively neutrally buoyant tubular umbilical to be used as a flowline from a subsea well.

It is yet another object of the invention to provide a substantially neutrally buoyant tabular umbilical to be used as a flowline from a subsea well.

Further, it is another object of the invention to provide a positively neutrally buoyant tubular umbilical to be used as a flowline from a subsea well.

It is yet another object of the invention to provide the required power and to provide the closed-loop feedback control of an AC electric motor used to rotate a rotary drill bit.

It is yet another object of the invention to provide the required power and to provide the closed-loop feedback control of a DC electric motor used to rotate a rotary drill bit.

Further, it is yet another object of the invention to provide a power distribution system where an uphole power system is connected by a long umbilical to a downhole power consumption device.

Yet further, it is another object of the invention to provide a power distribution system where an uphole power system is connected by a long umbilical to a control node that is in turn connected to other downhole power consumption devices.

It is yet another object of the invention to provide composite umbilicals which provide electrical power to distant subterranean electric motors and other electrical devices which incorporate major umbilical strength members comprised of titanium, aluminum, or their alloys.

It is yet another object of the invention to provide methods of fabrication that protects against hydrogen sulfide stress corrosion of titanium, and its alloys, by forcing high temperature helium or other noble gases into the titanium during fabrication are also described.

Further still, it is yet another object of the invention to provide hydraulic seals for the Smart Shuttle, for the Subterranean Electric Drilling Machine, and for pipeline pigs including novel cup seals and novel chevron seals.

And finally, it is yet another object of the invention to provide hydraulic seals that incorporate measurement sensors, and in yet other embodiments, measurement information from the sensors is used for the closed-loop feedback control of the hydraulic seals.

The above mentioned Smart Shuttle seals may be also be used for the Subterranean Electric Drilling Machine and for pipeline pigs, but those extra uses are not put in each separate description above in the interests of brevity.

DESCRIPTION OF THE PREFERRED EMBODIMENTS

Figure 1:
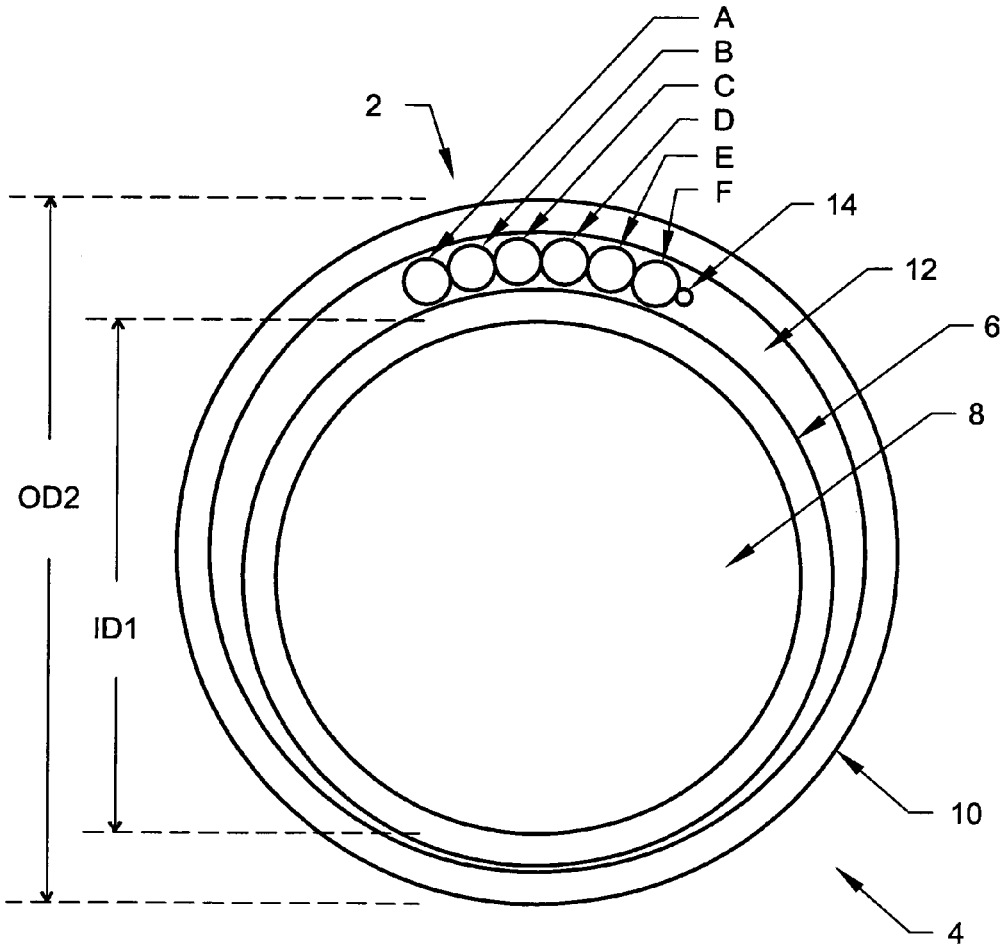
FIG. 1 shows a section view of a umbilical that is substantially neutrally buoyant in drilling mud within the well which provides a conduit for drilling fluids that is capable of providing 320 horsepower of electrical power at a distance of up to 20 miles.

FIG. 1 shows a section view of a preferred embodiment of an umbilical 2. In this preferred embodiment, substantial portions of the umbilical are fabricated from one or more composite materials. Consequently umbilical 2 is also called a composite umbilical. Composite umbilical 2 provides a connection between the surface and other downhole tools (such as a Subterranean Electric Drilling Machine to be described later) which is capable of performing useful work at great distances from a well site. In the preferred embodiment shown in FIG. 1, the umbilical is capable of performing useful work at the distance of 20 miles away from a surface drilling site. This statement means that the umbilical is capable of performing useful work at any distance between 0 miles to 20 miles away from a wellsite. This connection is called an umbilical and it does not rotate like drill pipe and its capabilities are different from those of coiled tubing used in drilling operations.

In particular, FIG. 1 shows an umbilical that is substantially neutrally buoyant in any specific density of drilling mud 4 that is present in a wellbore. The drilling mud 4 may also be called the drilling fluid. The symbol for the density of drilling mud is ρ (drilling mud). In this particular example of a preferred embodiment, the density of drilling mud present in the wellbore is 12 lbs/gallon.

In FIG. 1, the composite umbilical is partially fabricated from inside pipe 6. In FIG. 1, the umbilical has an inside diameter of ID1. In this particular embodiment, the inside diameter ID1 is equal to 4.5 inches. The inside diameter forms a hollow region through which fluids may be sent to, and from downhole. Put another way, the inside diameter forms a conduit through which fluids may be sent from the surface downhole, or from downhole to the surface. Therefore, the umbilical possesses a fluid conduit for conducting drilling fluids through the interior of the umbilical. The fluids present within the inside pipe are shown by element 8 in FIG. 1. The density of the fluids 8 is defined to be the symbol ρ (umbilical fluid). For example, drilling mud may be sent downhole through the 4.5 inch ID pipe. The ID of this pipe is also called the interior of this pipe. The inside pipe 6 has wall thickness T1, but this legend is not shown in FIG. 1 for brevity. In this preferred embodiment, the wall thickness of the inside pipe T1 is 0.25 inches. The wall of the inside pipe 6 is made from a composite material. This composite wall may have many layers of different composite materials made of different materials, each layer having a different specific gravity. As an example of one preferred embodiment, the composite material may be a carbon-based composite material. For reasons of simplicity, those layers are not shown in FIG. 1. However, there will be an average specific gravity of the interior pipe that is defined to be SG (inside pipe). In this preferred embodiment, the specific gravity of the inside pipe is equal to 1.5.

In FIG. 1, the composite umbilical is partially fabricated from outside pipe 10. In FIG. 1, the umbilical has an outside diameter of OD2 and this legend is shown in FIG. 1. In this preferred embodiment, the outside diameter OD2 is equal to 6.00 inches O.D. Consequently, the external portion of the composite umbilical appears to be a pipe having the outside diameter of OD2. The outside pipe 10 has wall thickness T2, but this legend is not shown in FIG. 1 for brevity. In this preferred embodiment, the wall thickness of the outside pipe T2 is 0.25 inches. The wall of the outside pipe 10 is made from a composite material. This composite wall may have many layers of different composite materials made of different materials, each layer having a different specific gravity. In one preferred embodiment, the composite material may be a carbon-based composite material. Those layers are not shown in FIG. 1 for simplicity. For example, an outer layer of composite material may be chosen to be particularly abrasion resistant. As one example, the outer layer of composite material may be made of a carbon-based composite material. However, there will be an average specific gravity of the outside pipe that is defined to be SG (outside pipe). In this preferred embodiment, the specific gravity of the outside pipe is equal to 1.5.

As shown in FIG. 1, the interior pipe 6 is asymmetrical located within the exterior pipe 10 that forms an the asymmetric volume 12 between the two pipes. Within the asymmetric volume 12 between the two pipes are insulated current carrying electric wires designated by the legends A, B, C, D, E, and F in FIG. 1. Also shown in FIG. 1 is high speed data link 14. This high speed data link provides high speed data communications from the surface to downhole equipment, and from the downhole equipment to the surface. High speed data link 14 is selected from a list including a fiber optic cable, a coaxial cable, and twisted wire cables. In the particular preferred embodiment of the invention shown in FIG. 1, the high speed data link is chosen to be a fiber optic cable. The asymmetric volume 12 between the two pipes that contains wires A, B, C, D, E, and F, and the fiber optic cable, is otherwise filled with syntactic foam material. This syntactic foam material is often made from silica microspheres that are embedded in a filler material, such as epoxy resin or other composite materials. The syntactic foam material has a specific gravity that is defined as SG (syntactic foam material). In this preferred embodiment of the invention, the specific gravity of the syntactic foam material is 0.825. In this preferred embodiment of the invention, syntactic foam material possessing silica microspheres is provided by the Cumming Corporation. The Cumming Corporation is located at 225 Bodwell Street, Avon, Mass. 02322. The Cumming Corporation can also be reached by telephone at (508) 580-2660 or by the internet at www.emersoncumming.com. The details on the syntactic foam material may be reviewed in detail in Attachment 28 to Provisional Patent Application No. 60/384,964, that has the Filing Date of Jun. 3, 2002, an entire copy of which is incorporated herein by reference. Using silica microspheres in a syntactic matrix provides the necessary buoyancy in high pressure wellbores. The high axial strength of the composite pipe construction compensates for variations in axial loads caused by mud weight and other density variations.

Figure 4:
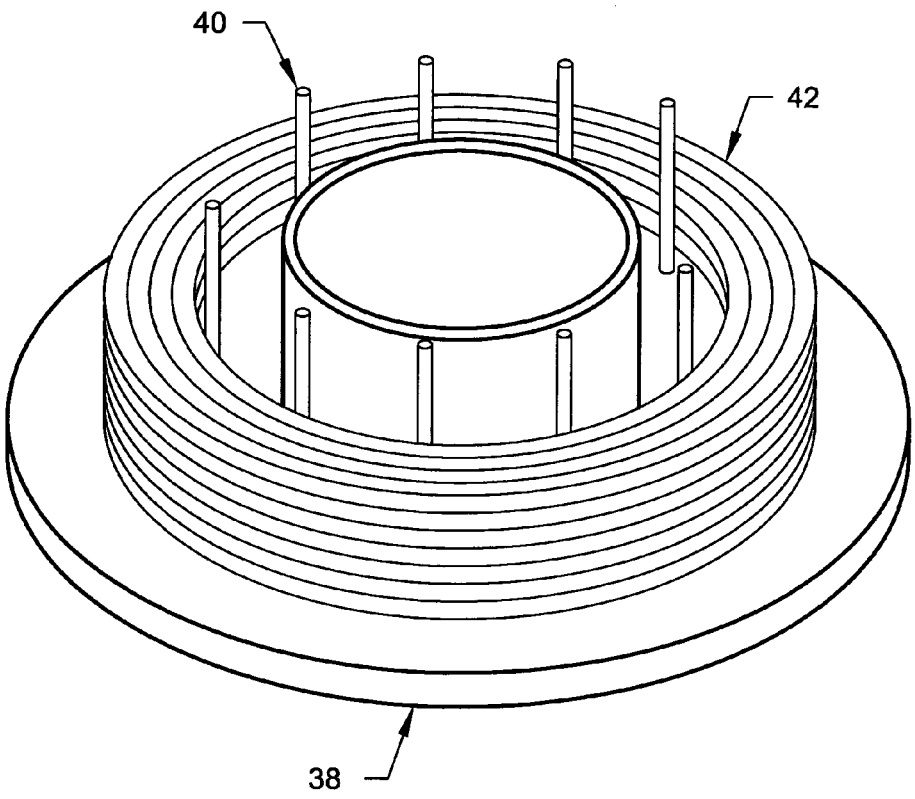
FIG. 4 shows an umbilical carousel in the process of being constructed.

In FIG. 1, wires A, B, C, D, E, and F are 0.355 inches O.D. insulated No. 4 AWG Wire. The insulation is rated at 14,000 volts DC, or 0-peak AC. Wires A, B, and C comprise the first independent three phase delta circuit. Wires D, E, and F comprise the second independent three phase delta circuit. Each separate circuit is capable of providing 160 horsepower (119 kilowatts) over an umbilical length of 20 miles at the temperature of 150 degrees C. So, combined, the umbilical can deliver a total of 320 horsepower (238 kilowatts) at 20 miles to do work at that distance. At 320 horsepower, less than 1 watt per foot of power is dissipated in the form of heat, which makes this a practical design even if the umbilical is completely wound up on an umbilical carousel as shown in a later figure (FIG. 4). In this preferred embodiment, wires A, B, C, D, E, and F are No. 4 AWG stranded silver plated copper wire which are covered with insulation rated to 14,000 VDC at 200 degrees C., where each wire has a DC resistance of 0.250 ohms per 1000 feet at the temperature of 20 degrees C., where the nominal outside diameter of each insulated wire is 0.355 inches, and where each wire weighs 180 lbs/1000 feet. Each wire is Part Number FEP4FLEXSC provided by Allied Wire & Cable, Inc. which is located at 401 East 4th Street, Bridgeport, Pa. 19405, which may be reached by telephone at (800) 828-9473. The details on Allied Part Number FEP4FLEXSC may be reviewed in Attachment 27 to Provisional Patent Application No. 60/384,964, that has the Filing Date of Jun. 3, 2002, an entire copy of which is incorporated herein by reference.

If the inside pipe 6 is carrying 12 lb per gallon mud, and if the exterior pipe is immersed in 12 lb per gallon mud in the well, then the upward buoyant force in the above preferred embodiment of the umbilical is plus 5.9 lbs per 1000 feet of this umbilical. Assuming a coefficient of friction of 0.2, the total frictional "pull-back" on 20 miles of this umbilical is only 124 lbs. This "pull-back" does not include any differential fluid drag forces. This umbilical was chosen to have an extreme length which shows that the essentially neutrally buoyant umbilical overcomes most friction problems associated with umbilicals disposed in wells. For the details of this calculation of a net upward force of 5.9 lbs as described above, please refer to "Case J" of Attachment 34 to Provisional Patent Application No. 60/384,964, that has the Filing Date of Jun. 3, 2002, an entire copy of which is incorporated herein by reference. Those particular calculations were performed on the date of Nov. 12, 2001. In these calculations, the density of water of 62.43 lbs/cubic foot was used to calculate the net forces acting on volumes having particular specific gravities. Please also see other relevant buoyancy calculations in Attachments 29 to 35 of Provisional Patent Application No. 60/384,964.

The phrase "substantially neutrally buoyant", "essentially neutrally buoyant", "near neutral buoyant", and "approximately neutrally buoyant" may be used interchangeably. For a substantially neutrally buoyant umbilical, or near neutrally buoyant umbilical, the downward force of gravity on a section of the umbilical of a given length is approximately balanced out by the upward buoyant force of well fluid acting on the umbilical of that given length. The density of mud in the well is strongly influenced by any cuttings from any drilling machine attached to the umbilical (to be described later). Similarly, the density of the fluids inside pipe 6 may also be strongly influenced by any cuttings from the drilling machine (if reverse flow is used). So, the density of the drilling mud 4 and the density of fluids present within the pipe 8 may vary with distance along the length of the umbilical. However, at any position along the length of the umbilical which is disposed in the well, the umbilical may be designed to be "substantially neutrally buoyant", "essentially neutrally buoyant", "near neutral buoyant" or "approximately neutrally buoyant". In addition, using the design principles described herein, the entire length of the umbilical may be designed to be on average "substantially neutrally buoyant", "essentially neutrally buoyant", "near neutral buoyant", or "approximately neutrally buoyant" over the entire length of the umbilical that is disposed within a wellbore.

An umbilical that is "substantially neutrally buoyant", "essentially neutrally buoyant", "near neutral buoyant", or "approximately neutrally buoyant" greatly reduces the frictional drag on the umbilical as it moves in the wellbore. That statement is evident from the following. The net force on a length of umbilical from gravity and buoyant forces is F. The coefficient of sliding friction is k. Therefore, the net "pull back force" P for the given length of the umbilical is given by:

$$P=Fk \qquad \text{Equation 1.}$$

The requirement of a near neutrally buoyant umbilical greatly reduces the frictional drag on the umbilical as it moves in the wellbore. This is a particularly important point. If an umbilical is "substantially neutrally buoyant", "essentially neutrally buoyant", "near neutral buoyant", or "approximately neutrally buoyant" then the frictional drag on the umbilical is greatly reduced as it moves through the wellbore. There are other details to consider such as the starting friction, any sticky substances in the well, drag due to viscous forces, etc. However, Equation 1 forms the basis for providing high electrical power through umbilicals at great distances such as 20 miles from a drilling site. As stated before in relation to this preferred embodiment, with a net force on 1,000 feet of the umbilical being only plus 5.9 lbs (an upward force), assuming a coefficient of friction of 0.2, the total frictional "pull-back" on 20 miles of this umbilical is only 124 lbs.

The preferred embodiment also calls for other reasonable design requirements on the umbilical. The umbilical needs significant axial strength (to pull the drilling machine from the well in the event of equipment failure downhole as explained later) that would require a 160,000 lbs design load. The umbilical must provide an internal pressure capacity (shut-in pressure capacity of the well) of about 10,000 psi. The collapse resistance of the umbilical must exceed a 6,000 psi differential pressure. The umbilical must have the ability to work in at least 120 degrees C., and preferably, 150 degrees C. Composites are now routinely used at 120 degrees C., and experiments are now being conducted on composites at 150 degrees C. Hollow high-strength glass may replace carbon fiber composites for a cost savings, but there will be a weight penalty, thereby increasing frictional drag.

The umbilical may occasionally be damaged during its use and require field repairs. Repairs will be accomplished by cutting out the damaged part and using field installable end connections to rejoin the intact umbilical sections. The end connections will also join various sections of umbilical that may be stored separately at the surface. These couplings are expected to slightly reduce the ID and increase the umbilical OD.

The particular asymmetric design shown in FIG. 1 was selected as a preferred embodiment in part because it illustrates the various considerations necessary to design and build such a high power umbilical that is neutrally buoyant in well fluids. Other more symmetric designs for such an umbilical are shown in another preferred embodiment shown in FIG. 20 below. The references cited above in the section entitled "Description of the Related Art" provide the generally known methods used in the industry to construct composite umbilicals.

Flexible umbilicals have been described in the prior art. In particular, copies of the following patents are incorporated herein by reference: U.S. Pat. No. 4,256,146 entitled "Flexible Composite Tube" that is assigned to the Coflexip Corporation; and U.S. Pat. No. 6,926,039 B2 entitled "Flexible Pipe for Transporting a Fluid" that is assigned to the Technip Corporation. Definitions from these two patents will be used freely below without. Applicant understands that these two firms have merged into the Technip-Coflexip Corporation.

In addition, and in relation to the foregoing, an entire copy of U.S. Provisional Patent Application No. 61/190,472 entitled "High Power Umbilicals for Subterranean Electric Drilling Machines and Remotely Operated Vehicles", having the Filing Date of Aug. 29, 2008 is incorporated herein in its entirety by reference herein. In particular, and to be redundant, entire copies of all the reference documents U.S. Provisional Patent Application No. 61/190,472 are also incorporated in their entirety by reference herein that are used in part to define relevant portions of the prior art for the purposes of this application, and which further define what any individual having ordinary skill in the art would know and understand for the purposes of this application.

Figure 1A:
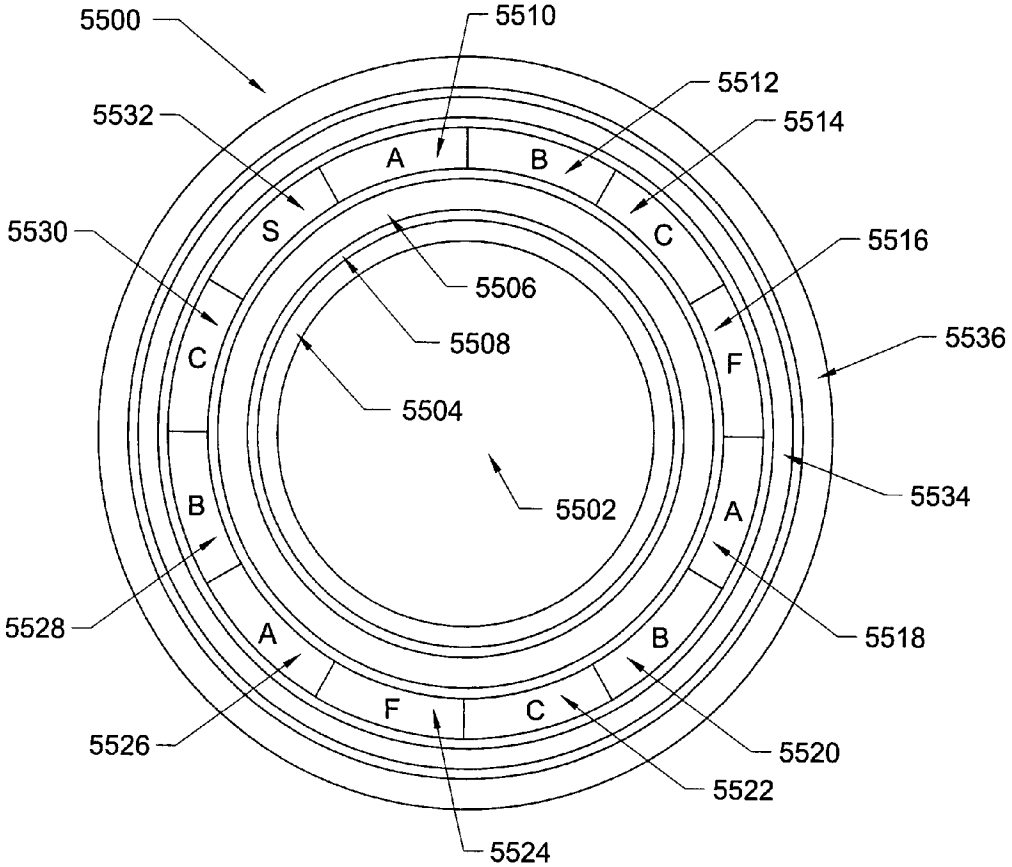
FIG. 1A provides shows a section view of a composite umbilical which provides electrical power to distant subterranean electric motors and other electrical devices which incorporates a major umbilical strength member that may be comprised of titanium, aluminum, or their alloys.

FIG. 1A is another preferred embodiment of the invention shown in FIG. 1. In this embodiment, an AC electric motor is located downhole that rotates the drill bit (as described, for example, in FIG. 51). In this particular embodiment, the downhole AC electric motor is a three phase electric motor requiring phases A, B and C. Those phases A, B, and C are shown in FIG. 1A. A total of 3 insulated electric wire assemblies, each labeled with the legend A, provides electrical power to phase A of the downhole electric motor. A total of 3 insulated electric wire assemblies, each labeled with the legend B, provides electrical power to phase B of the downhole electric motor. A total of 3 insulated electric wire assemblies, each labeled with legend C, provides electrical power to phase C of the downhole electric motor. In addition, two separate fiber optic assemblies, labeled with the legend F, provides redundant, bidirectional, fiber-optic communications links (so that errors may be detected, or in the event that one fiber-optic cable becomes non-functional). And finally, there is the spare insulated wire assembly S, that can be used in the event that any one power wire to the electric motor in phase A, B, or C breaks.

A preferred embodiment of the invention is shown in FIG. 1A. Umbilical 5500 possesses mud flow channel 5502. Inner sheath or polymeric pressure sheath 5504 provides a barrier to fluid flow or gas invasion into the interior of the umbilical. This can be important if hydrogen sulfide or other corrosive gases or corrosive fluids are present. Major umbilical strength member 5506 provides the major tensile strength of the umbilical, and also provides the majority of the resistance to pressure collapse of the umbilical due to the difference between any internal pressure Pi within the umbilical mud flow channel or any external pressure Po outside (at any one distance along the umbilical) although the symbols Po, Pi, and z are not shown in FIG. 1A for the purposes of brevity.

The inner radius of the inner sheath or polymeric pressure sheath 5504 is r1 and its outer radius is r2. The inner radius of major umbilical strength member 5506 is r3 and its outer radius is r4. The legends r1, r2, r3 and r4 are not shown in FIG. 1A for the purposes of brevity.

In one preferred embodiment of the invention, r2 and r3 are approximately equal. In this case, the inner sheath or polymeric pressure sheath 5504 may be chemically or physically bonded to the inner surface of the major umbilical strength member 5506. In such case, region 5508 (the difference between r3 and r2), may be very small.

In a preferred embodiment, major umbilical strength member 5506 is a titanium pipe that is described in part in U.S. Provisional Patent Application No. 61/190,472, filed Aug. 28, 2009, an entire copy of which is incorporated herein by reference.

In sequence, elements 5510, 5512, 5514, 5516, 5518, 5520, 5522, 5524, 5526, 5528, 5530, and 5532 are shown in FIG. 1A. As shown in FIG. 1B, these respective elements are loosely fitted together around the radius, and are held in place by electric wire assemblies retainer 5534 shown in FIG. 1A.

In one preferred embodiment, these respective elements are held in place by a polymeric sealing sheath. The inner radius of this polymeric sealing sheath is r5 and the outer radius is r6 (that are not shown in FIG. 1A for brevity).

In a preferred embodiment, outer protective member 5536 is a thin mild steel tube that is designed to prevent abrasion of the umbilical as it is wound on the drum and to prevent crushing of the insulated electric wire assemblies and to prevent crushing of the fiber-optic communications links. The inner radius of the outer protective member is r7 and the outer radius is r8 (that are not shown in FIG. 1A)

In other preferred embodiments, the inner sheath or polymeric pressure sheath 5504 may not be bonded to the inner surface of the major strength member 5506, so that when the umbilical is bent, the two elements can slide with respect to one another. In this case, region 5508 (the difference between r3 and r2), may be relatively large.

In other preferred embodiments, major umbilical strength member 5506 may instead be an aluminum pipe made by typical producers, including Alcoa. Here, aluminum pipe includes any suitable alloys of aluminum that are further discussed in the following.

In yet other preferred embodiments, major umbilical strength member 5506 may be comprised of any metallic substance or alloy.

In yet other preferred embodiments, major umbilical strength member 5506 may be comprised of a steel member or steel wires.

In other preferred embodiments, major umbilical strength member 5506 may instead be comprised of the following elements as defined in column 3, lines 28-45 of U.S. Pat. No. 6,926,039 B2: " . . . a pressure armor layer 3 wound helically around the longitudinal axis of the pipe with a short pitch, (and) a pair of tensile armor layers 4, 5, the armor layer 4 being produced by along-pitch helical winding and the armor layer 5 being wound helically with a long pitch but in the opposite direction to the armor layer 5, . . . " (the quotes herein are from column 3, lines 28-45 of U.S. Pat. No. 6,926,039). An entire copy of U.S. Pat. No. 6,926,039 B2 is incorporated herein in its entirety by reference.

In other preferred embodiments, the major umbilical strength member 5506 may be surrounded by internal isolation material means and by external isolation material means so that no fluids can come into contact with the major umbilical strength member means. There are many variations of this invention. So, for example, if titanium is used as a material for the major umbilical strength member, then such isolation means will keep hydrogen sulfide from making contact with the material that can cause stress cracking. In fact the major umbilical strength member in yet other preferred embodiments may be fabricated from helical windings of titanium wires in analogy with that description presented in the previous paragraph. And in yet other preferred embodiments, wires of different materials, for example titanium and steel, can be used to fabricate the major umbilical strength member.

In yet other preferred embodiments, the major umbilical strength member may be comprised of metal-composite materials. For example, helical wound titanium wires as described in the last two paragraphs can be surrounded with a composite material, having a resin base as one example. Inner and outer fluid isolation means as previously described may be used to keep fluids away from the helical wound titanium wires and the composite material—to avoid damage to both the titanium wires and the composite material.

In yet other preferred embodiments, the major umbilical strength element may be fabricated out of composite materials, and this major strength element is further characterized as being isolated from well fluids by inner fluid barrier means and by outer fluid barrier means. Composites have shown that they have adequate strength for wellbore applications, but experience has also shown that fluid invasion into the composite materials can cause the materials to unwind, denature, disintegrate, or "turn into cotton like structures".

In yet other preferred embodiments, the major umbilical strength element may be comprised of any number of materials, including a composite material, that has inner and outer fluid isolation means to protect the composite material, and any other materials, from fluid invasion.

In other preferred embodiments, spare insulated wire assembly S can instead be replaced with other functional elements such as: (a) it can instead be used to provide a "ground reference" downhole (so that cross-talk can be detected and measured with respect to a "surface ground"); or (b) it can be used as a distributed sensor array to measure and detect parameters along the length of the umbilical including pressure, any gas or liquid leakage, strain, stress, bending parameters, and any other relevant parameters cited in any of the other references made a part of this document, may be sent to a computer system located anywhere, including on the surface of the earth.

Figure 52:
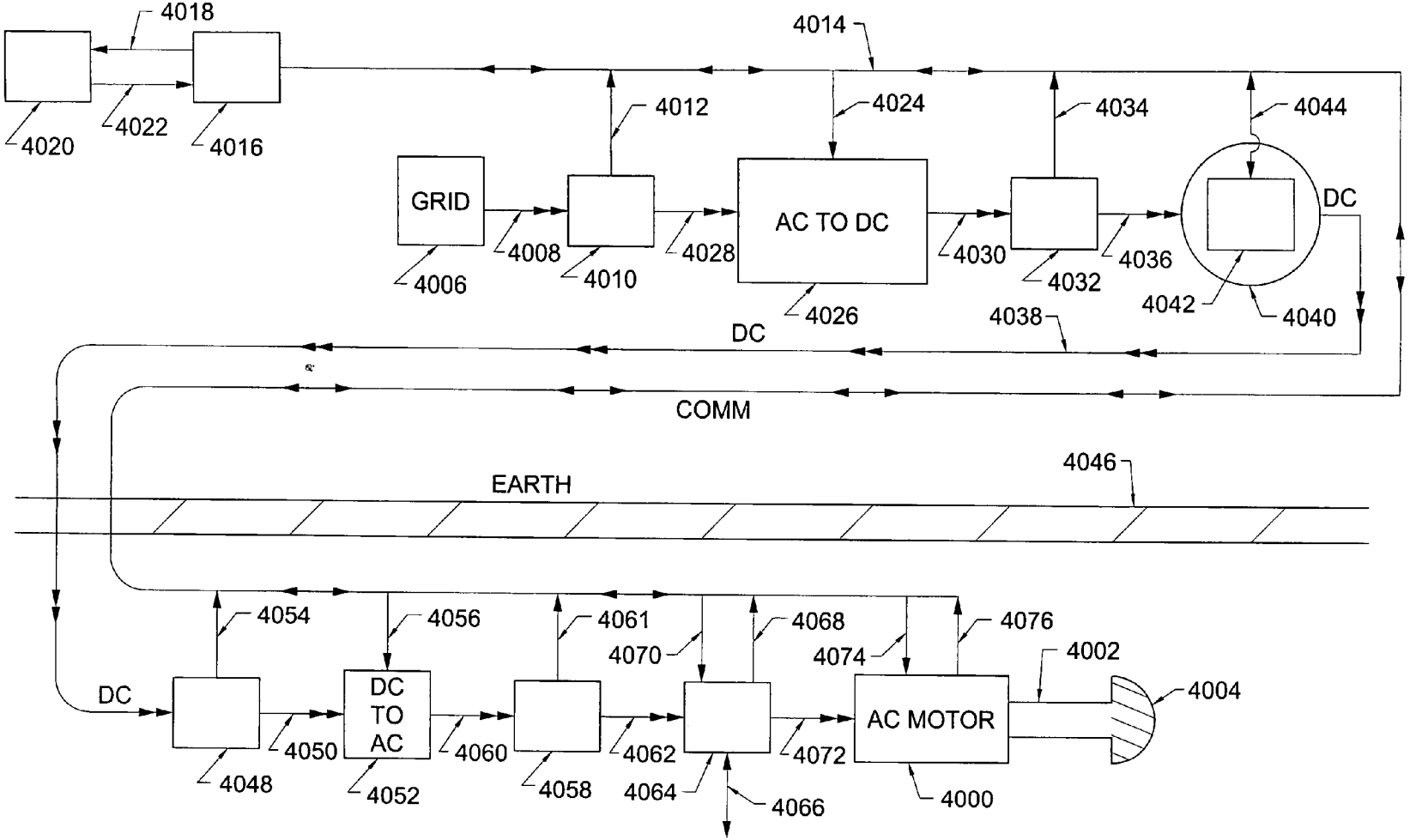
FIG. 52 is a block diagram that shows the power and closed-loop feedback controls to drill a borehole with the Subterranean Electric Drilling Machine using an AC electric motor to rotate the rotary drill bit energized by DC current conducted down the umbilical.
Figure 53:
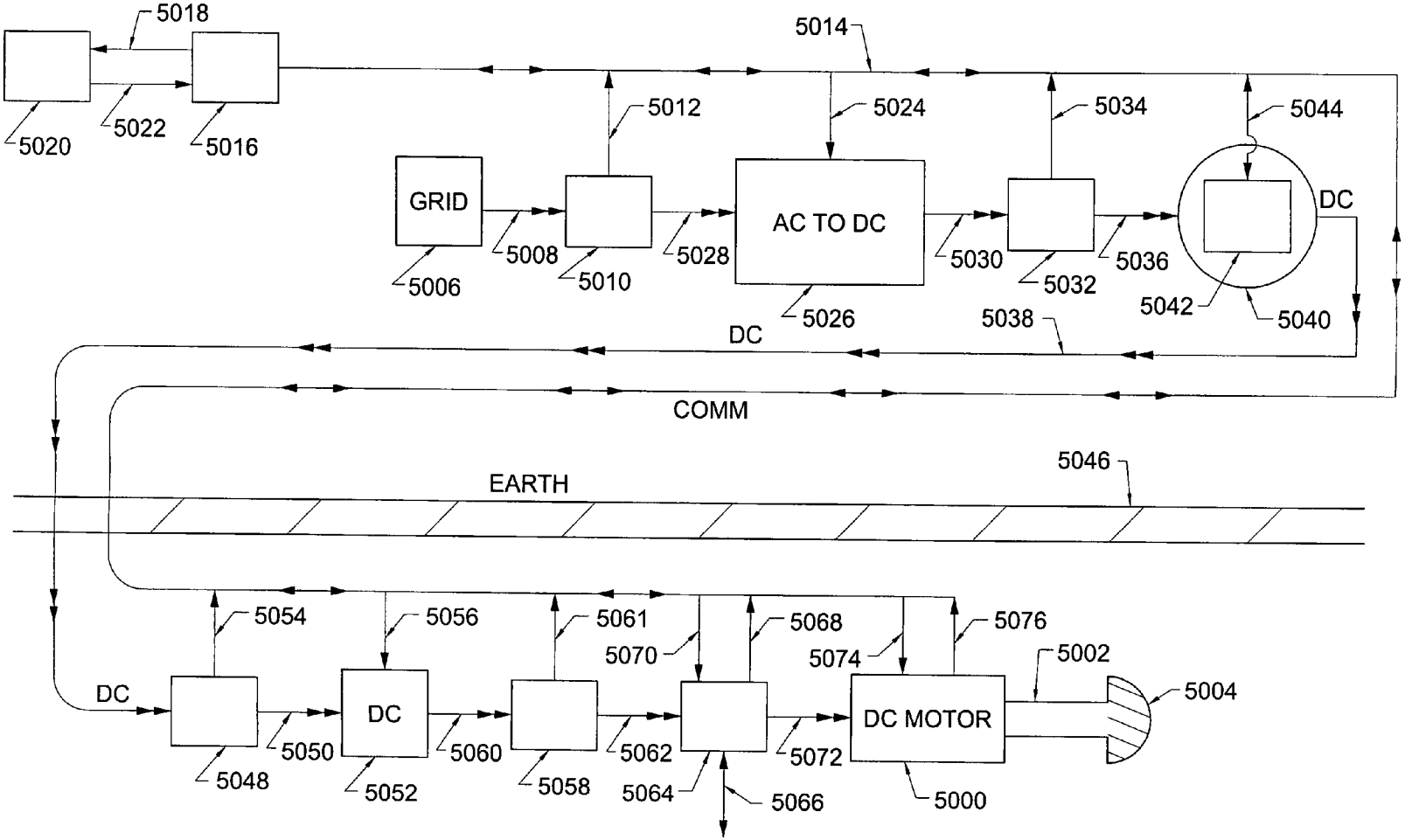
FIG. 53 is a block diagram that shows the power and closed-loop feedback controls to drill a borehole with the Subterranean Electric Drilling Machine using a DC electric motor energized by DC current conducted down the umbilical.

In other preferred embodiments, the elements marked as A, B, C, and S in FIG. 1A can be instead used as follows: (a) the number of insulated electric wire assemblies designated for any phase, or function may be changed (increased or decreased as the number of sections can be increased or decreased); or (b) the number and type of insulated electric wire assemblies can be used to conduct appropriate DC electric power downhole as shown in FIGS. 52 and 53.

In other preferred embodiments, the electric wire assemblies retainer 5534 may be made of any material known in the art. As an example, the retainer may be made from helically wound armor as just one possibility.

In other preferred embodiments, outer protective member 5536 may be made of titanium, may be made out of aluminum, may be a composite material of any type, may be selected to be any suitable material mentioned in any of he references incorporated by reference herein.

In other preferred embodiments, extra concentric tubes are provided in the structure shown in FIG. 1A. Sensors may be distributed along the length of the umbilical to measure all relevant physical parameters, including the buoyancy of the umbilical in the well at that distance. Fluids can be pumped in the volume between extra concentric tubes to control the buoyancy. So, measurements are taken, data is sent to an uphole computer, and commands are sent through the umbilical to adjust its buoyancy that is a closed-loop control system to control the buoyancy of the umbilical. Accordingly, the invention discloses a closed-loop control means to measure and control the buoyancy of an umbilical in a wellbore fluid at a minimum of one depth in said wellbore.

In yet different preferred embodiments, any number of additional fluid channel means may be introduced into the embodiment of the invention shown in FIG. 1A to provide measurements and control of the buoyancy.

In yet other preferred embodiments, any distribution of syntactic foam material may be introduced into the umbilical in FIG. 1A to adjust the buoyancy of the umbilical.

In yet other preferred embodiments, oil having syntactic foam material in the oil may be used to control the buoyancy of the umbilical.

In still other preferred embodiments, pressure balanced oil may be introduced into channels within the umbilical in FIG. 1A to adjust buoyancy, and also for another purpose to isolate the major umbilical strength element from well fluid invasion.

In a preferred embodiment, FIG. 1B shows one choice for element 5510 in FIG. 1A. Here, high temperature teflon 5550 (or FEP) encapsulates a group of stranded copper wires in an oblong shape 5552 to fit within the shape of element 5510, but nevertheless maintaining the required voltage specifications.

In alternative preferred embodiments, element 5552 could instead be layers of copper foil.

Figure 1C:
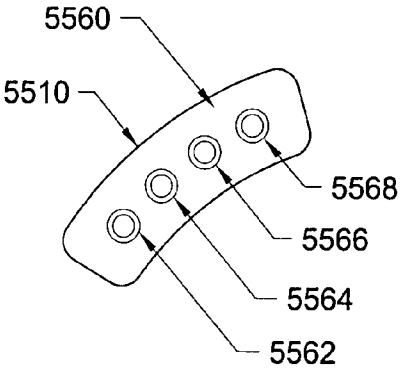
FIG. 1C provides a section view of another embodiment of insulated conductors used to fabricate the umbilical shown in FIG. 1A.
Figure 1B:
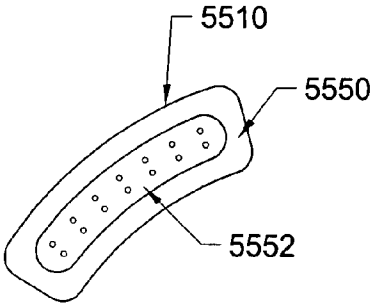
FIG. 1B provides a section view of one embodiment of an insulated conductor used to fabricate the umbilical shown in FIG. 1A.

An alternative preferred embodiment is shown in FIG. 1C. Here, high temperature teflon 5560 (or FEP) encapsulates 4 insulated wires having braided copper wire interiors respectively labeled as 5562, 5564, 5566 and 5568. The electrical insulation around each wire need not have the full electrical voltage insulation required for operation. For example, if each wire had a breakdown voltage of 5,000 volts, and the encapsulation provided another 5,000 volts, then the net operational voltage would be 10,000 volts. Such construction would tend to reduce failure in the event of any water leakage into the material 5560.

From the description provided so far, it is evident how elements 5510, 5512, 5514, 5516, 5518, 5520, 5522, 5524, 5526, 5528, 5530, and 5532 can be fabricated.

It is also evident that these elements may be used for many different purposes, for example, for different power conductors, or for different fiber optic sensors, or as another example, to make room for fluid channels.

In addition, FIGS. 41, 43, 45, 46, 47 and 48 may be suitably modified to make umbilicals for the Subterranean Electric Drilling Machine or for ROV's.

The various elements in FIG. 1A may be in rigid contact with one another (such as being "glued" together") or they may be just held in place that would allow each, or some, of the individual elements to move with respect to another within the interior of umbilical 5500 which would lead to additional flexibility, and would reduce certain destructive forces within the umbilical.

In one method to design a particular preferred embodiment of an umbilical, an iterative design procedure is to be adopted beginning with slippage allowed for all elements, and then eliminating slippage one at a time to determine an optimum design. There are many variations on the method to choose an optimum design. This same process may be iteratively repeated for different particular preferred embodiments of the umbilical which are described above.

In FIG. 1A, the various elements need not be circular, but may have any suitable shape for the intended application. Similarly, the individual elements such as 5510 may have any suitable shape for the application.

In yet other embodiments, the inner sheath or polymeric pressure sheath 5504 may be eliminated. However, if this barrier to fluid flow or gas invasion into the interior of the umbilical is removed, other interior parts must be made more resistant to hydrogen sulfide stress corrosion.

In yet other embodiments, the titanium may be subject to a special process. Here, high pressure helium is forced at high temperatures into the titanium pipe near the end of the extrusion process. High temperature helium is therefore forced into the spaces between the titanium atoms, and this tends to reduce the invasion of hydrogen sulfide into pore spaces within the titanium. So, the method of forcing noble gases under high pressure into titanium during fabrication is one preferred embodiment of the invention. The method of forcing other gases under high pressure into titanium during fabrication is yet another preferred embodiment of the invention.

By analogy, similar methods of fabrication for extruded aluminum tubes are also a preferred embodiment of the invention.

In addition, several of the on-site methods of fabrication described by Smart Pipe Company, Inc. may be adapted to fabricate selected preferred embodiments of the umbilical described herein. Such methods are shown in U.S. Pat. No. 7,374,127, an entire copy of which is incorporated herein in its entirety by reference. All references cited within U.S. Pat. No. 7,374,127 are also incorporated herein by reference that is used in part to define the prior art in this field.

Selected preferred embodiments of the umbilical may not be neutrally buoyant in drilling fluids present, or may not be neutrally buoyant in portions of the well. However, any reduction in the weight of the umbilical allows it to be used for further reach within an extended reach wellbore—all other conditions remaining the same. So, reducing the weight of the umbilical is important in its own right.

In the above discussion, the word "titanium" has been used. By this term, is meant to also include selected titanium alloys, some of which are acceptable for sour well service as explained in the documents that define and describe "NACE MR0175" sulfide stress cracking resistant metallic materials in U.S. Provisional Patent Application No. 61/190,472, an entire copy of which is incorporated herein by reference that is used in part to define the prior art at this time in the industry.

In the above discussion, the word "aluminum" has been used. By this term is meant to also include selected aluminum alloys described in SPE Paper No. 97035 entitled "Aluminum Alloy Tubulars for Oil and Gas Industry", an entire copy of which is incorporated herein by reference.

The following references help define technology that is known to anyone having ordinary skill in the art, and entire copies of all such references are incorporated herein in their entirety by reference.

The book entitled "Dictionary of Petroleum Exploration, Drilling, and Production", Norman J. Hyne, Ph.D., PennWell Books, Pennwell Publishing Company, Tulsa, Okla., 1992, an entire copy of which is incorporated herein by reference.

The book entitled "The Illustrated Petroleum Reference Dictionary", edited by Robert D. Langenkamp, Pennwell Books, Pennwell Publishing Company, Tulsa, Okla., 4th Edition, 1994, an entire copy of which is incorporated herein by reference.

The book entitled "Handbook of Oil Industry Terms & Phrases", R. D. Langenkamp, Pennwell Books, Pennwell Publishing Company, Tulsa, Okla., 5th Edition, 1994, an entire copy of which is incorporated herein by reference.

Figure 2:
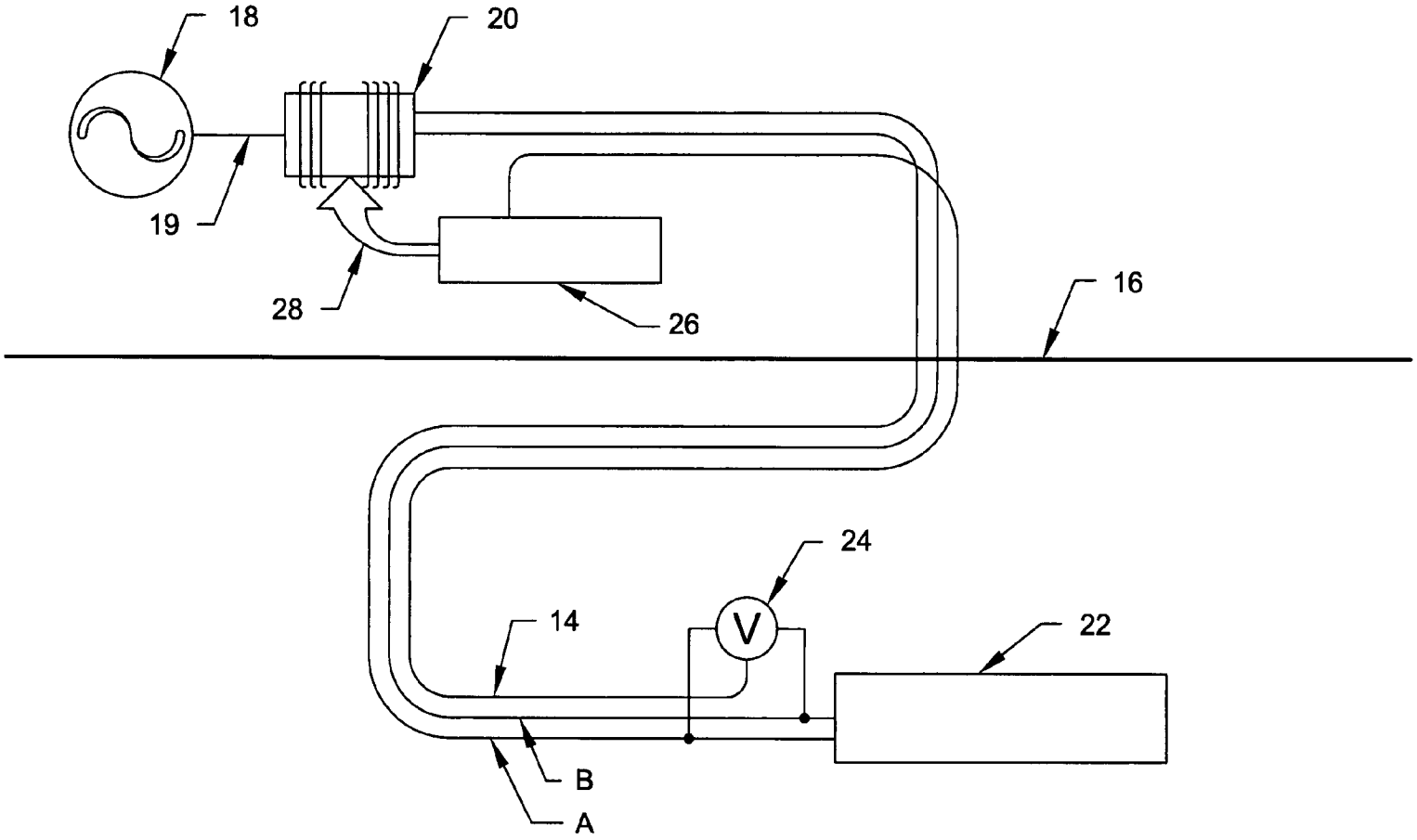
FIG. 2 shows the uphole and downhole power management system for the composite umbilical shown in FIG. 1.

FIG. 2 shows the uphole and downhole power management system for the composite umbilical shown in FIG. 1. Wires A, B, and fiber optic cable 14, which were identified in FIG. 1, are shown in FIG. 2. In FIG. 2, the surface of the earth is shown figurative as element 16. Any function shown above element 16 is identified as an "uphole function", and any function shown below element 16 is identified as a "downhole function".

In FIG. 2, only wires A and B of a first three phase delta circuit are shown. Three phase delta is an AC circuit having three wires (for example A, B, and C), each wire of which carries a an AC current, and there exists a voltage difference between each wire. There exists phase relationships between the current vs. time in each wire. There exits phase relationships between the voltage vs. time in each wire. However, in FIG. 2, wire C is not shown for simplicity. Electrical generator 18 provides three phase delta power through cable 19 to variable voltage and frequency converter 20. The variable voltage and frequency converter possesses electronics that provides measurement of the voltages, currents and phases of the three phase delta circuit (although that electronics is not shown in FIG. 2 for the purposes of simplicity). Electrical power is delivered by wires A and B to the downhole electrical load 22. In one preferred embodiment, the electrical load is a downhole electric motor. The voltage, current, the relevant phases, and other parameters of the electrical load are measured with sensing unit 24. Sensing unit 24 is marked with the legend "V" indicating that at least the voltage V is measured between wires A and B at electrical load 22. Sensing unit 24 is attached to the electrical input terminals of the downhole electrical load. If this is a downhole electrical motor, the sensing unit 24 is attached to the electrical input terminals of the electric motor.

Sensing unit 24 also possesses suitable electronics that sends the measured downhole information to the surface through optical fiber 14. The downhole information is sent by optical fiber 14 that provides the measured information to computer system 26. The measured downhole information is digitized with related instrumentation (not shown for the purposes of simplicity in FIG. 2), and the downhole information is forwarded uphole by light pulses sent through the optical fiber 14.

In FIG. 2, the computer system 26 also possesses related electronics to implement the following. The computer system and related electronics provides commands to the variable voltage and frequency converter 20 by electronic feedback loop 28 to provide the necessary voltage, current, phases, and frequency as required by the downhole load 22. Consequently, FIG. 2 shows a closed-loop, dynamic feedback system, where downhole load parameters are measured, the information is sent uphole, and the uphole system is automatically adjusted to provide what is required to properly operate the electrical load. The point is that the feedback loop 28 from computer 20 is used to produce the required frequency, voltage, current and phases required by the downhole load 22. This is an example of the feedback control of the downhole load 22, which may be a downhole electric motor in several preferred embodiments.

In an alternative embodiment of feedback control, the feedback loop from computer 26 in FIG. 2 is used to control the RPM of a motor generator whose O-peak output voltage may be easily varied, which provides conveniently controlled frequency and voltage outputs, although that minor variation of the preferred embodiment is not shown in a separate figure for the purposes of brevity. In this case, the feedback loop from computer 26 is first used to control the RPM of the motor, and is also used for the second purpose to control the output voltage, frequency, and phase from the generator attached to the motor which makes the motor generator assembly.

Additional measured downhole load parameters are also sent uphole through the optical fiber. For example, in one preferred embodiment, element 22 in FIG. 2 is an electrical motor, and as an example, the measured RPM, the current drawn by the motor through its input terminals, the voltage across its input terminals, and the phases of the voltages and current vs. time, the temperature, torque, etc. of that electrical motor can be sent uphole through the optical fiber 14. In other preferred embodiments, the electrical load 22 is a submersible electric drilling machine, and in another embodiment, the electrical load is a remotely operated vehicle.

The system shown in FIG. 2 controls a first three phase delta circuit that energizes wires A, B, and C in FIG. 1. A second similar system to that shown in FIG. 2 controls the power derived to wires D, E and F from a second three phase delta circuit. For simplicity, the second three phase delta circuit is not shown in FIG. 2. Such a system is capable of delivering 320 horsepower through an umbilical disposed in a wellbore shown in FIG. 1 that has a length of up to 20 miles. This is important, because most of the available motors for downhole use are AC motors, and are not DC motors.

The AC power management system shown in FIG. 2 has at least several advantages. First, DC voltages are not used which would generally require a "chopper" to convert DC to AC to operate most currently available downhole electric motors. Such high power choppers are complex, often large, and generate considerable heat. Second, no downhole transformer is necessary because of the active closed-loop feedback system shown in FIG. 2.

However, the basic feedback control of downhole parameters as such as voltage and current are also useful for a DC power management system for DC electric motors that can be used in a Subterranean Electric Drilling Machine. Accordingly, another preferred embodiment of the invention is controlling DC voltages with an analogous system as outlined in FIG. 2.

Figure 3:
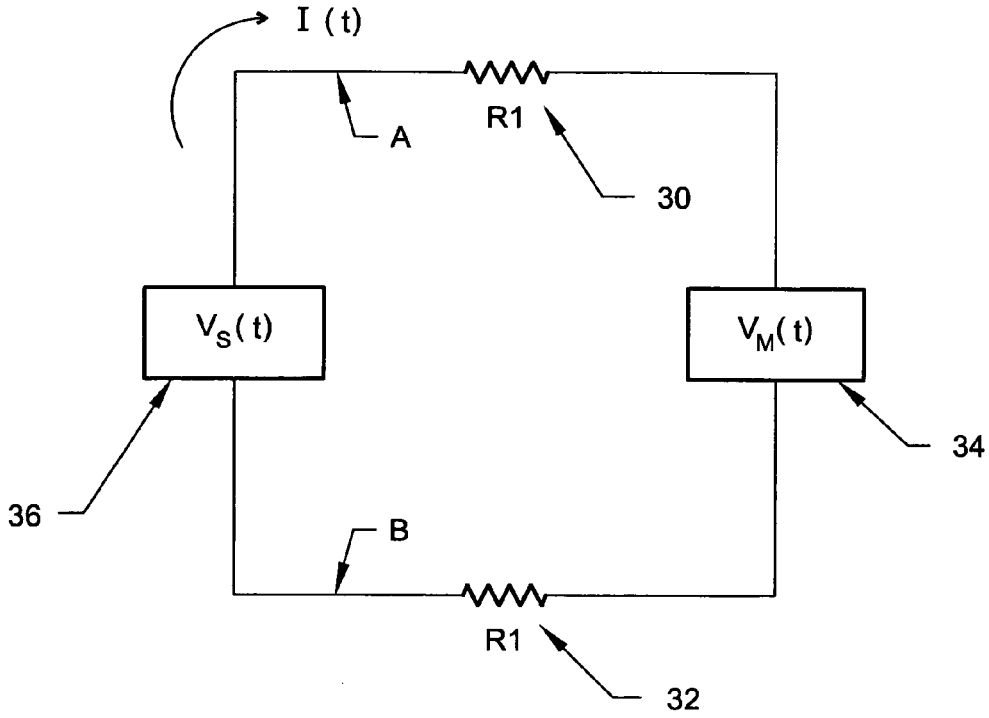
FIG. 3 shows an electrical block diagram representing two conductors from one three phase delta circuit providing up to 160 horsepower of electrical power at a distance of up to 20 miles.

FIG. 3 shows how three phase power of 160 horsepower (119 kilowatts) can be delivered through the electrical conductors in FIGS. 1 and 2 to distances of 20 miles. This means that this power can be delivered from 0 miles to 20 miles away from a drill site for example. Two "legs" of the three phase delta circuit are shown in FIG. 3 as wires A and B (wire C of the three phase delta circuit is not shown for simplicity). The resistances of a length of 20 miles of the wire is simulated with resistors having the magnitude of resistance in ohms of "R1". The legend "R1" appears in FIG. 3. These two resistors are also respectively labeled as elements 30 and 32. In a preferred embodiment, the load at the end of the umbilical is simulated with a downhole electric motor 34 requiring 2,500 volts 0-peak at 45 amps 0-peak between any two wires of the three phase wiring system operating at 60 Hz. As a practical case, this "downhole motor" could in principle be comprised of two each REDA, 4 Pole Motors, each requiring 1250 volts O-peak, at 45 amps 0-peak, having a nominal RPM of about 1700 RPM. The current flowing through wires A and B is represented by the legend I(t) in FIG. 3. This required motor voltage is represented by the legend $V_M(t)$. The closed-loop, dynamic feedback system described in FIG. 2 automatically and continuously adjusts the voltage provided downhole to the motor that is measured with sensing unit 24 in FIG. 2. In this preferred embodiment, typically, the variable voltage and frequency converter 20 in FIG. 2 provides 6,182 volts O-peak and provides 45 amps 0-peak between any two legs of the three phase circuit. The supplied voltage is represented by element 36 in FIG. 3. The voltage supplied by the voltage and frequency converter 20 is represented by the legend $V_s(t)$ in FIG. 3. The point of this is that using the above described feedback system and reasonable gauge wiring, it is possible to actually deliver 160 horsepower (119 kilowatts) at a distance of 20 miles.

FIG. 3 shows a first independent circuit that provides 2,500 volts 0-peak to a load, a motor in this preferred embodiment, at distances of up to 20 miles between wires A, B, and C respectively, and the motor may draw up to 45 amps 0-peak between any pairs of wires, A-B, B-C, or C-A. A second independent circuit, that is not shown for simplicity, also provides 2,500 volts 0-peak to another motor at distances to 20 miles between wires D, E, and F respectively, and that motor may also draw up to 45 amps 0-peak from any wire D, E, and F. Such voltages and currents are necessary for two series operated REDA 4 Pole Motors, each rated for 80 Horsepower (as shown in a later figure, FIG. 8). REDA is a manufacturer called "Reda Div. Camco International, Inc." that may be reached at 4th & Dewey, Bartlesville, Okla. 74005, having the telephone number of (918) 661-2000, that has a website that may be reached through www.schlumberger.com.

In summary, the umbilical 2 in FIG. 1 must carry high power and high speed communications (320 hp—two circuits of 160 hp each—and fiber optic communications). An A.C. voltage, transformerless, downhole electrical power arrangement is used. The input power and voltage are managed topside to maintain constant downhole load voltage. In one preferred embodiment, one of the two circuits is dedicated to the downhole mud pump (or Smart Shuttle®) service, while the second circuit operates other Downhole Rig™ functions such as the rotation and weight loading of a drilling bit, which will be described in later figures. In various preferred embodiments, the various downhole motors feature soft start controls allowing the topside power supply to reliably track power demand.

In the above preferred embodiment, a three phase delta power circuit is used. In principle, any electrical power system may be used including 208 Y and related power systems, and ordinary single phase power systems.

FIG. 4 shows an umbilical carousel in the process of being constructed. This equipment is similar to flexible pipe handling equipment now used in the industry. A first carousel flange 38 possesses interior spokes 40 that forms the inside diameter of the umbilical carousel. Wound on those interior spokes is the umbilical 42. A second carousel flange (not shown) encloses the wound up umbilical, although it not shown in the interest of brevity. In one preferred embodiment, the umbilical 42 is the same umbilical as shown in FIG. 1 that is 6 inches OD. The umbilical may be stored and operated as a single line. However, the umbilical is preferably divided into several smaller lengths, as an example 5 miles each, and stored on smaller carousals or drums to reduce the fluid friction losses as compared to one 20-mile continuous length. A level wind is provided on each carousel to correctly wrap the pipe as it is pulled from the well and returned to the carousel for storage.

Each carousel holding 5 miles of the 6 inch OD umbilical is approximately 8 ft tall with an outside diameter of 22 ft. The mud filled umbilical weighs approximately 234 tons. Unless this equipment is installed on offshore vessels, it is not easily moved. For this reason, drilling centers where the rig is assembled are expected to use the equipment over its useful life. Such carousals may be supplied by Coflexip Stena Offshore, Inc. located at 7660 Woodway, Suite 390, Houston, Tex. 77063, having the telephone number (713) 789-8540, which has its website at www.coflexip.com. Such carousals may also be supplied by Oceaneering International, Inc. located at 11911 FM 529, Houston, Tex. 77401, having telephone number (713) 329-4500, which has its website at www.oceaneering.com.

Much surface equipment is needed in support of handling the umbilical. This surface equipment is briefly described in the following. Much of this equipment may be supplied by a firm located in Holland called. Huisman-Itrec, that may be located at Admiraal Trompstraat 2-3115 HH Schiedam, P.O. Box 150-3100 AD Schiedam, The Netherlands, Harbour No. 561, having the telephone number of 31(0) 10 245 22 22, that has its website at www.Huisman-Itrec.com.

Stripper heads and surface blow-out preventers (BOP's) provide an OD pressure seal to the umbilical, although no figures are provided to show this feature for simplicity. This equipment has a similar function to a coiled tubing stripper head, except it handles the larger umbilical OD sizes. In practice, the actual sealing element is expected to be dual 13⅝" annular stripping BOPs with grease injection to lubricate the sealing elements as the umbilical moves through the sealing elements. This approach of dual stripping units allows the umbilical mechanical couplings to be transitioned into the well. The surface BOPs provide for surface well control in the event of a well kick. These (shear, pipe & blind ram) BOPs will be located between the wellhead and the stripping annular units.

An injector unit is required on the surface, although no figure is shown for simplicity. A 100-ton linear traction unit is preferred for this application. The injection unit provides drilling umbilical pushing and pulling loads at speeds to 10 feet per second. The maximum loads will be at low speeds. Speed will be limited by mudflows within the wellbore. This injector unit has a function similar to a coiled tubing injector but practically is closer in size and performance to a pipeline tensioner used to lay flexible pipe. Similar units are used for the handling and installation of flexible pipe by such firms as Coflexip Stena Offshore, Inc.; Wellstream, Inc.; and NKT Flexibles I/S. The address of Coflexip Stena Offshore, Inc. has been provided above. Wellstream, Inc. is a subsidiary of Halliburton Energy Services, and may be reached at 10200 Bellaire Boulevard, Houston, Tex. 77072-5299, having the telephone number of (281) 575-4033. NKT Flexibles I/S is a firm located in Denmark having the address of Priorparken 510, DK-2605 Broendby, Denmark, having the telephone of 45 43 48 30 00, that has its website at www.nktflexibles.com.

Figure 14:
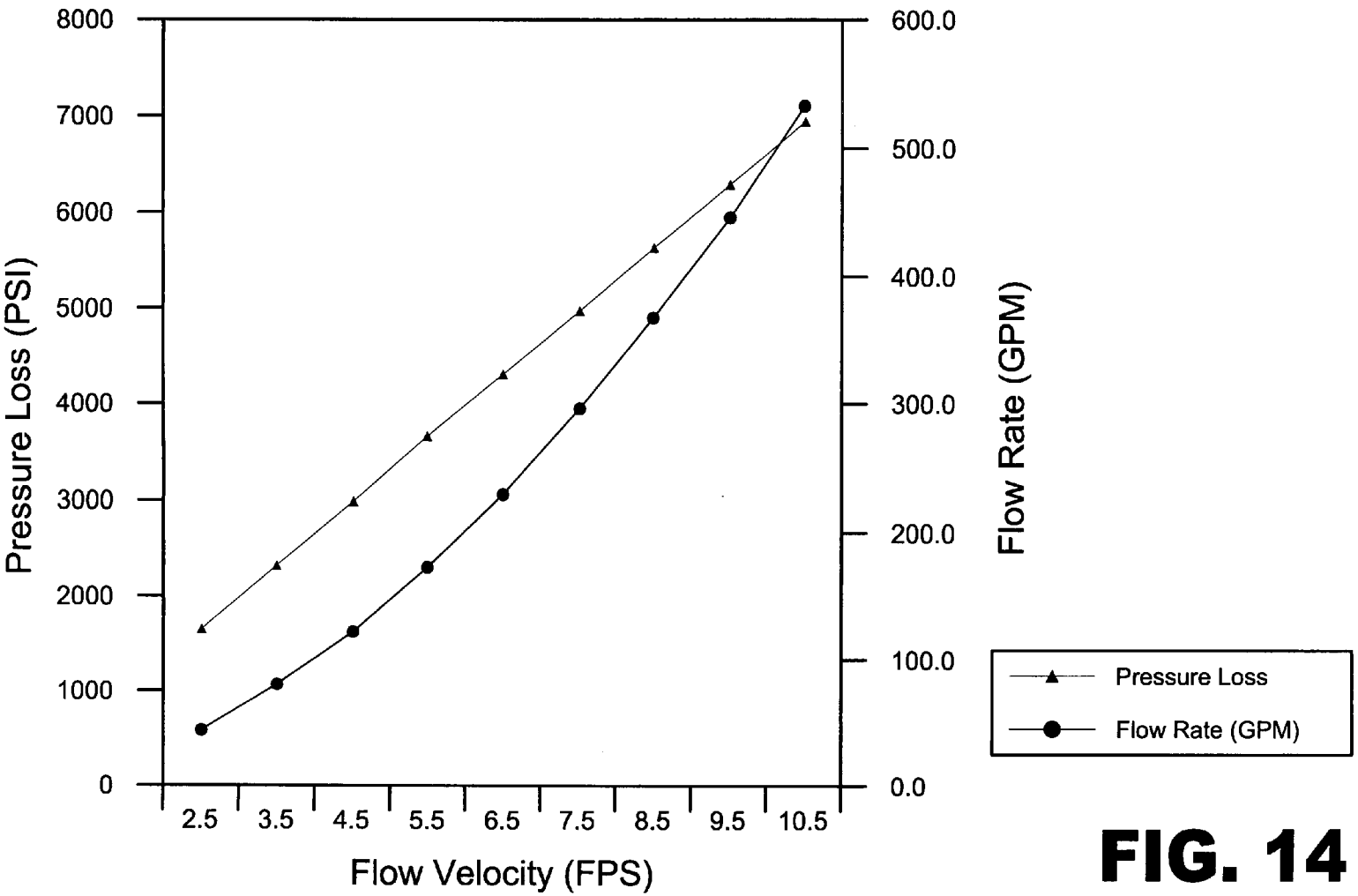
FIG. 14 shows relevant parameters related to fluid flow rates through the umbilical.

A surface mud system is required for the umbilical, although no figures showing this feature are provided for the sake of brevity. A large volume of working mud will be needed to manage the umbilical volume while tripping in the hole. For 20-mile offset operations, an active mud tank volume of 3,500 barrels may be required. This is similar to some large offshore drilling rigs in capacity. A minimum of two 750 hp surface mud pumps will be required for the preferred embodiment. The other details concerning the mud system will be presented in relation to a forthcoming figure (FIG. 14).

A surface rig is needed to support umbilical and casing operations, although no figure is presented showing this detail in the interests of brevity. The surface rig handles and makes-up the casing as it is run into the hole. In many respects, it is similar to conventional coiled tubing drilling rigs, except it is much larger in size. During drilling operations, the best method for joining expandable casing is continuing to develop. Enventure Global Technology is developing an expandable threaded joint. Enventure also has commercially available various sizes of expandable pipes and can supply various means of joining lengths of the expandable pipe. Enventure Global Technology may be reached at 16200-A Park Row, Houston, Tex. 77084, having the telephone number of (281) 492-5000, that has its website at www.EnventureGT.com. Other alternatives of joining expandable is to weld long casing strings (similar to J-laying pipelines). The arrangement of surface rig equipment is compatible with both alternatives.

Figure 5:
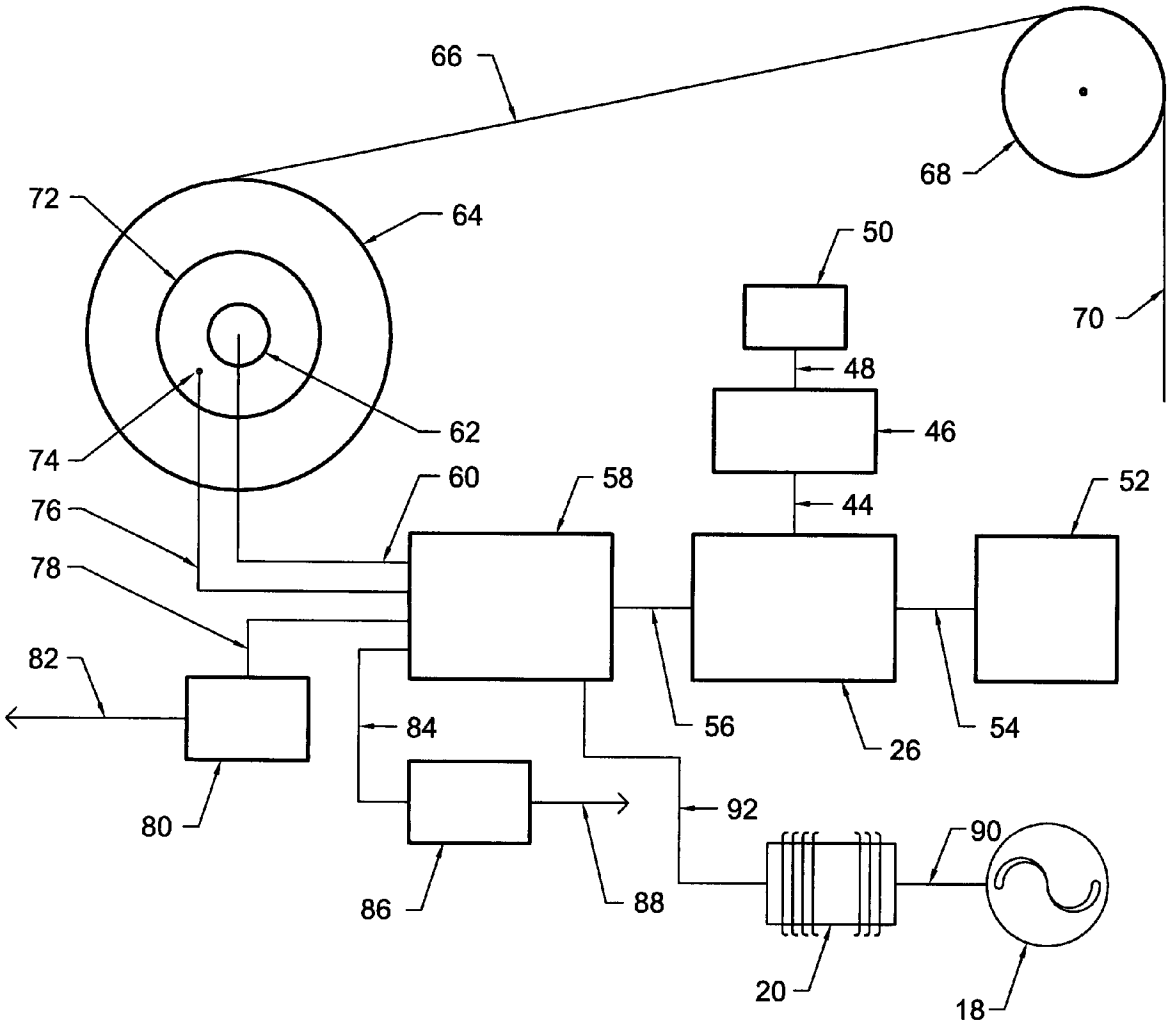
FIG. 5 shows a computerized uphole management system for the umbilical that provides for the closed-loop automatic control of all uphole and downhole functions.

FIG. 5 shows a computerized uphole management system for the umbilical. It is a portion of a preferred embodiment of an automated system to drill and complete oil and gas wells. It is also a portion of a preferred embodiment of a closed-loop system to drill and complete oil and gas wells. FIG. 5 shows the computer control of the umbilical carousel in a preferred embodiment of the invention.

In FIG. 5, computer system 26 (previously described in FIG. 2) has typical components in the industry including one or more processors, one or more non-volatile memories, one or more volatile memories, many software programs that can run concurrently or alternatively as the situation requires, etc., and all other features as necessary to provide computer control of all of the uphole functions. In this preferred embodiment, this same computer system 26 also has the capability to acquire data from, send commands to, and otherwise properly operate and control all downhole functions. Therefore LWD and MWD data is acquired by this same computer system when appropriate. As a consequence, in one preferred embodiment, the computer system 26 has all necessary components to interact with a Subterranean Electric Drilling Machine. In a "closed-loop" operation of the system, information obtained downhole from the downhole system is sent to the computer system that is executing a series of programmed steps, whereby those steps may be changed or altered depending upon the information received from the downhole sensor located within the downhole system.

In FIG. 5, the computer system 26 has a cable 44 that connects it to display console 46 that has one or more display screens. The display console 46 displays data, program steps, and any information required to operate the entire uphole and downhole system. The display console is also connected via cable 48 to alarm and communications system 50 that provides proper notification to crews that servicing is required. Data entry and programming console 52 provides means to enter any required digital or manual data, commands, or software as needed by the computer system, and it is connected to the computer system via cable 54.

In FIG. 5, computer system 26 provides commands over cable 56 to the electronics interfacing system 58 that has many functions. One function of the electronics interfacing system is to provide information to and from any downhole load through cabling 60 that is connected to the slip-ring 62, as is typically used in the industry. Another function of the electronics interfacing system is to provide power to any downhole load through cabling 60 that is connected to the slip-ring 62. The slip-ring 62 is suitably mounted on the side of the assembled umbilical carousel 64 in FIG. 5. Information provided to slip-ring 62 then proceeds to wires A, B, C, D, E, F, and G within the umbilical wound up on the umbilical carousel. The umbilical 66 proceeds to an sheave and tensioner device 68 and then the umbilical proceeds downward at location 70 towards the injection unit and on to the stripper heads and surface blow-out preventers (BOP's). The sheave an tensioner device 68 may place appropriate tension on the umbilical as required.

In FIG. 5, electronics interfacing system 58 also provides power and electronic control of the hydraulic system 72 that controls the umbilical carousel through the connector at location 74. Cabling 76 provides the electrical connection between the electronics interfacing system 58 and the hydraulic system 72 that controls the umbilical carousel. In addition, electronics interfacing system 58 has output cable 78 that provides commands and control to the drilling rig hardware control system 80 that controls various drilling rig functions and apparatus including the rotary drilling table motors, the mud pump motors, the pumps that control cement flow and other slurry materials as required, and all electronically controlled valves, and those functions are controlled through cable bundle 82 which has an arrow on it in FIG. 5 to indicate that this cabling goes to these enumerated items.

In relation to FIG. 5, electronics interfacing system 58 also has cable output 84 to ancillary surface transducer and communications control system 86 that provides any required surface transducers and/or communications devices required for communications with the downhole equipment. In a preferred embodiment, ancillary surface and communications system 86 provides acoustic transmitters and acoustic receivers as may be required to communicate to and from certain downhole equipment. The ancillary surface and communications system 86 is connected to the required transducers, etc. by cabling 88 that has an arrow in FIG. 5 designating that this cabling proceeds to those enumerated transducers and other devices as may be required. Electrical generator 18 provides three phase delta power to variable voltage and frequency converter 20 by cable 90. The output from the voltage and frequency converter 20 is provided by cable 92 to the electronics interfacing system 58. Power to wires A, B, C, D, E, F, and G, and signals to the fiber optic cable 14 (not shown in FIG. 5, but which are defined in FIG. 1) are provided from the electronics interfacing system 58 through cabling 60 that is connected to the slip-ring 62. The cabling 60 and the slip-ring provide the suitable electrical and fiber optic connections. Cabling 60 possesses connection to wires A, B, C, D, E, F, and G, and to the fiber optic cable 14. In certain preferred embodiments, there are two separated generators and voltage and frequency converters to independently control to first three phase delta system having wires A, B, and C, and the second three phase delta system having wires D, E, and F.

With respect to FIG. 5, and to the closed-loop system to drill and complete oil and gas wells, standard electronic feedback control systems and designs are used to implement the entire system as described above, including those described in the book entitled "Theory and Problems of Feedback and Control Systems", "Second Edition", "Continuous(Analog) and Discrete(Digital)", by J. J. DiStefano III, A. R. Stubberud, and I. J. Williams, Schaum's Outline Series, McGraw-Hill, Inc., New York, N.Y., 1990, 512 pages, an entire copy of which is incorporated herein by reference. Therefore, in FIG. 5, the computer system 58 has the ability to communicate with, and to control, all of the above enumerated devices and functions that have been described to this point.

To emphasize one major point in FIG. 5, computer system 26 has the ability to receive information from one or more downhole sensors for the closed-loop system to drill and complete oil and gas wells. This computer system executes a sequence of programmed steps, but those steps may depend upon information obtained from at least one sensor located within the downhole system. This computer system provides the automatic control of the umbilical and any uphole and downhole functions related to the deployment of that umbilical.

Figure 6:
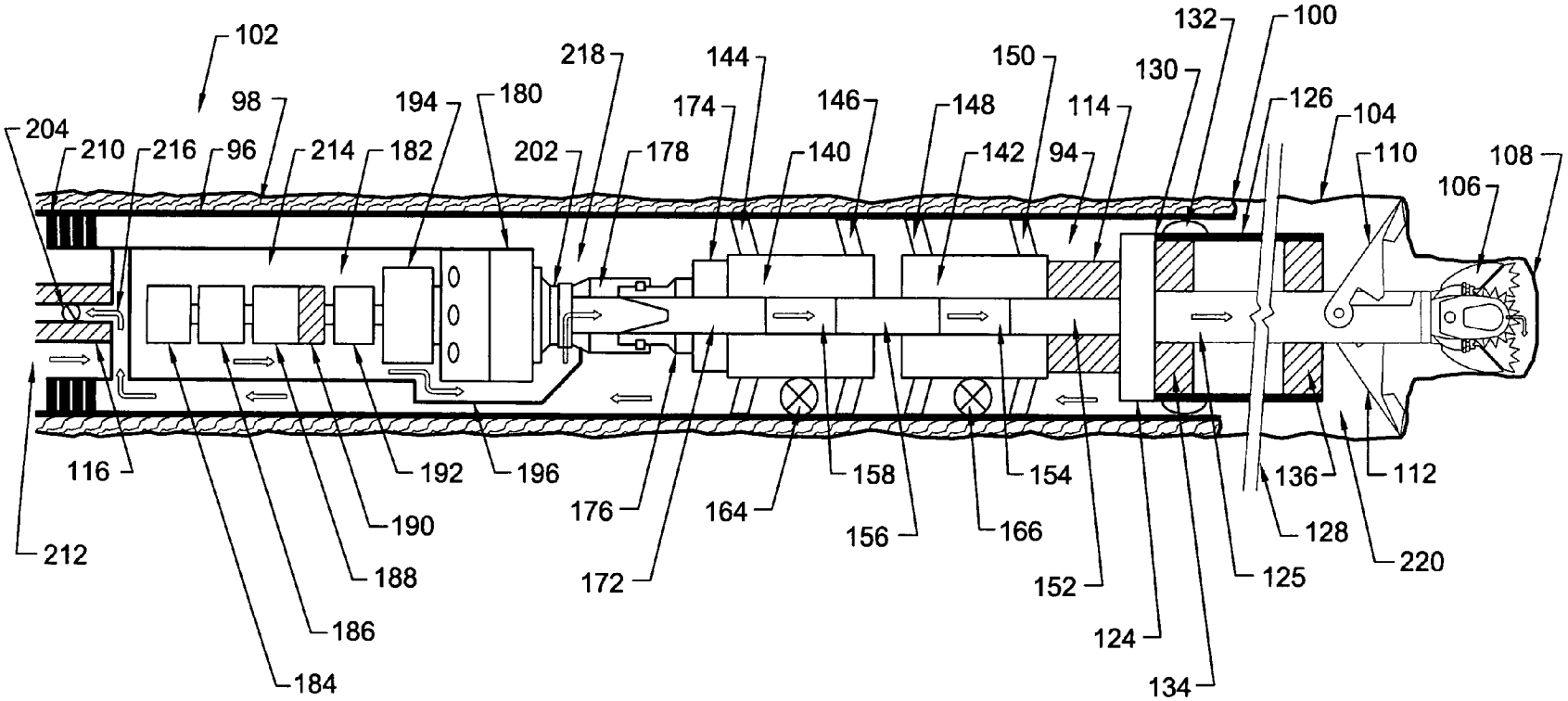
FIG. 6 generally shows the Subterranean Electric Drilling Machine that is disposed within a previously installed borehole casing during the process of drilling a new borehole and simultaneously installing a section of expandable casing.

FIG. 6 generally shows the Subterranean Electric Drilling Machine 94 that is disposed within a previously installed borehole casing 96 that is surrounded by existing downhole cement 98. The previously installed casing ends at location 100. The inside diameter of the previously installed casing is defined as "ID Casing", but this legend is not shown on FIG. 6 for simplicity. The outside diameter of the previously installed casing is defined as "OD Casing", but this legend is not shown on FIG. 6 for simplicity. The wall thickness of the previously installed casing is defined as "WT Casing", but this legend is not shown in FIG. 6 for simplicity. The previously installed casing is located within a geological formation 102.

As shown in FIG. 6, the Subterranean Electric Drilling Machine is in the process of drilling a new borehole 104 into the geological formation. Pilot bit 106 is shown drilling the pilot hole 108. The OD of the pilot bit is defined as "OD Pilot Bit", but that legend is not shown in FIG. 6 for brevity. The ID of the pilot hole is defined as "ID Pilot Hole", but that legend is not shown in FIG. 6 for brevity. Undercutters 110 and 112 expand the new borehole to full diameter. The OD of the undercutters 110 and 112 when in the fully extended position is defined as "OD Undercutters", but that legend is not shown in FIG. 6 for the purpose of brevity. The overall ID of the new borehole so drilled is defined to be "ID of New Hole", but that legend is not shown in FIG. 6 for the purposes of brevity. The pilot bit 106 and the undercutters 110 and 112 together form the entire "drill bit" of this assembly. This drill bit is an example of an "expandable drill bit", also called a "retrievable drill bit", that is also called a "retractable drill bit". The following references describe such drill bits: U.S. Pat. No. 3,552,508, C. C. Brown, entitled "Apparatus for Rotary Drilling of Wells Using Casing as the Drill Pipe", that issued on Jan. 5, 1971, an entire copy of which is incorporated herein by reference; U.S. Pat. No. 3,603,411, H. D. Link, entitled "Retractable Drill Bits", that issued on Sep. 7, 1971, an entire copy of which is incorporated herein by reference; U.S. Pat. No. 4,651,837, W. G. Mayfield, entitled "Downhole Retrievable Drill Bit", that issued on Mar. 24, 1987, an entire copy of which is incorporated herein by reference; U.S. Pat. No. 4,962,822, J. H. Pascale, entitled "Downhole Drill Bit and Bit Coupling", that issued on Oct. 16, 1990, an entire copy of which is incorporated herein by reference; and U.S. Pat. No. 5,197,553, R. E. Leturno, entitled "Drilling with Casing and Retrievable Drill Bit", that issued on Mar. 30, 1993, an entire copy of which is incorporated herein by reference. Some experts in the industry call this type of drilling technology to be "drilling with casing". For the purposes herein, the terms "retrievable drill bit", "retrievable drill bit means", "retractable drill bit" and "retractable drill bit means" may be used interchangeably. The combination of the pilot bit and retractable drill bit may also be replaced under certain circumstances with a bicenter drill bit. The retrievable drill bits and the bicenter bits are rotary drill bits.

When the undercutters 110 and 112 are retracted into their closed positions, then they can be pulled through the unexpaded casing, and then the entire Subterranean Electric Drilling Machine can removed from the previously installed casing because in their retracted positions, the OD of the undercutters is less than the ID of the expandable casing and the ID of the previously installed casing. However, when the undercutters are in their extended position as shown in FIG. 6, the Subterranean Electric Drilling Machine is used to drill the new borehole.

The downhole electric motor 114 of the Subterranean Electric Drilling Machine obtains its electrical energy from umbilical 116. The downhole electric motor 114 is a rotary motor. In one preferred embodiment, the umbilical is the lower end of the particular composite umbilical that is shown in FIG. 1. Various electrical wires and connectors along the length of the Subterranean Electric Drilling Machine conduct electrical power from the umbilical to the downhole electric motor (which are designated figuratively by element 118 which is not shown in FIG. 6 for the purposes of brevity). Downhole electric motor 114 also possesses internal sensors indicating the voltages between various inputs to the motor, the current drawn by various inputs to the motor, the power consumed by the motor, the temperature of the motor, the RPM of the motor, the torque delivered by the motor, etc. That information is digitized, sent thorough suitable electrical circuitry and connectors along the length of the Subterranean Electric Drilling Machine (designated figuratively by element 120 which is not shown in FIG. 6 for brevity), which digital information is then sent uphole through the fiber optical cable 14 within the umbilical in the form of suitable light pulses. Commands from the surface are also send downhole through the same bidirectional communications path. Such commands including changing RPM of the motor, etc.

The downhole electric motor has an output shaft which is figuratively designated by element 122, which is not shown in FIG. 6 for brevity. Electric motor output shaft 122 proceeds through the swivel and seal unit 124 to turn rotary shaft 125 which in turn rotates the undercutters 110 and 112 and the pilot bit 106. Rotary shaft 125 is also called the "drilling work string" or simply the "drill pipe". In this preferred embodiment, the undercutters 110 and 112, and the pilot bit 106 comprise the "drill bit". Therefore, in this preferred embodiment, electrical energy provided by umbilical 116 to downhole electric motor 114 rotates the drill bit and bores the new borehole 104 into the geological formation.

In FIG. 6, expandable casing 126 generally surrounds rotary shaft 125. Expandable casing is described in various references in the above section entitled "Description of the Related Art". The initial OD of the expandable casing (before expansion) is defined to be "Initial OD of Expandable Casing", but that legend is not shown in FIG. 6 for brevity. The initial ID of the expandable casing (before expansion) is defined to be "Initial ID of Expandable Casing", but that legend is not shown in FIG. 6 for brevity. The initial wall thickness of the expandable casing (before expansion) is defined to be the "Initial WT of Expandable Casing", but that legend is not shown in FIG. 6 for brevity. The length of the expandable casing 126 is defined to be "Length of Expandable Casing", but that legend is not shown in FIG. 6 for brevity. The Length of the Expandable Casing can be quite long, and in one preferred embodiment can be at least several thousand feet long. In such a situation, the length of the rotary shaft 125 would be approximately the same length.

In FIG. 6, the length of the submersible electric drilling machine is defined to be "Length of Submersible Electric Drilling Machine", but that legend is not shown in FIG. 6 for brevity. The Length of the Expandable Casing can be much longer than the Length of Submersible Electric Drilling Machine. The broken lines 128 in FIG. 6 indicate that the Length of the Expandable Casing can be quite long compared to the Length of the Submersible Electric Drilling Machine. The various elements in FIG. 6 are not in proportion.

Figure 7:
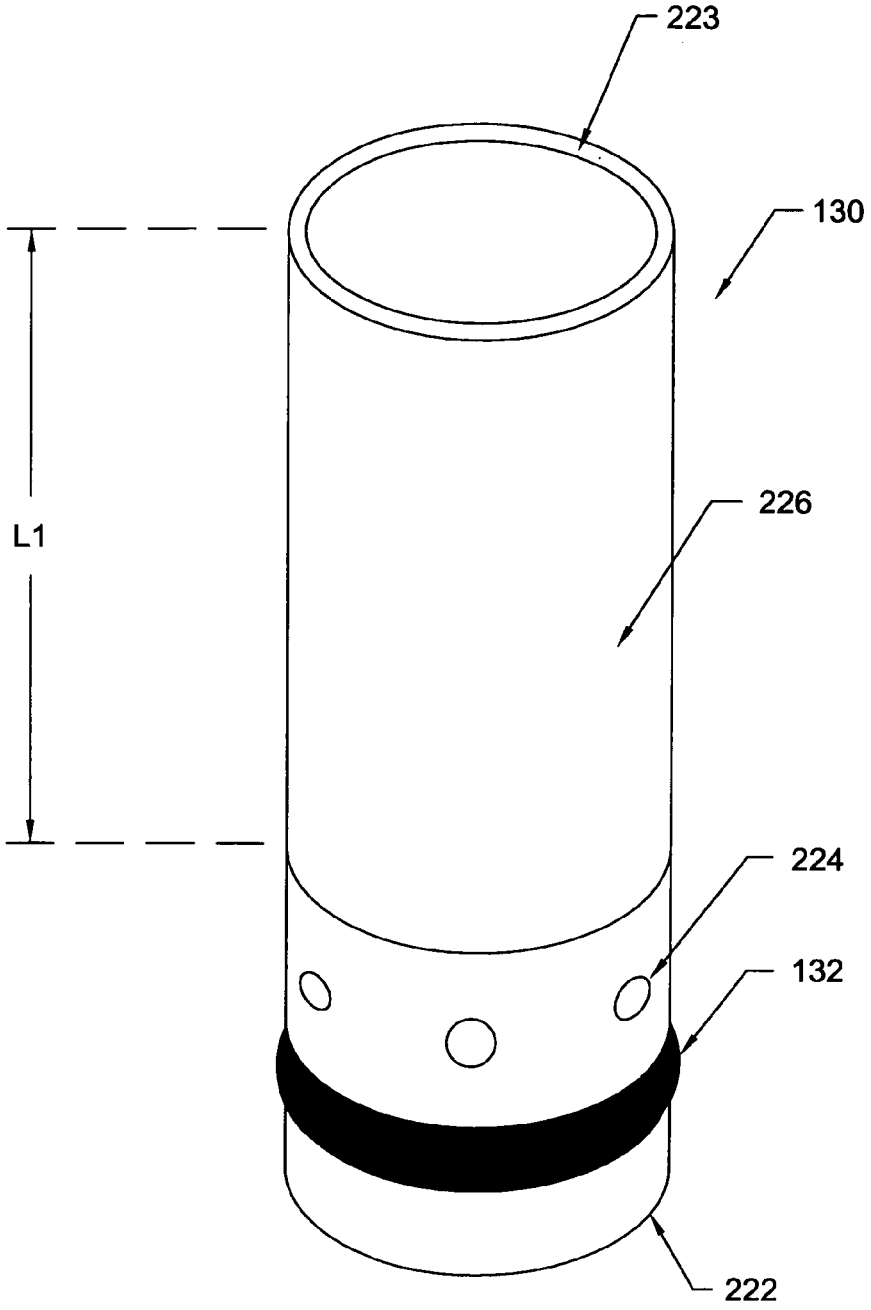
FIG. 7 shows the casing hanger.
Figure 10:
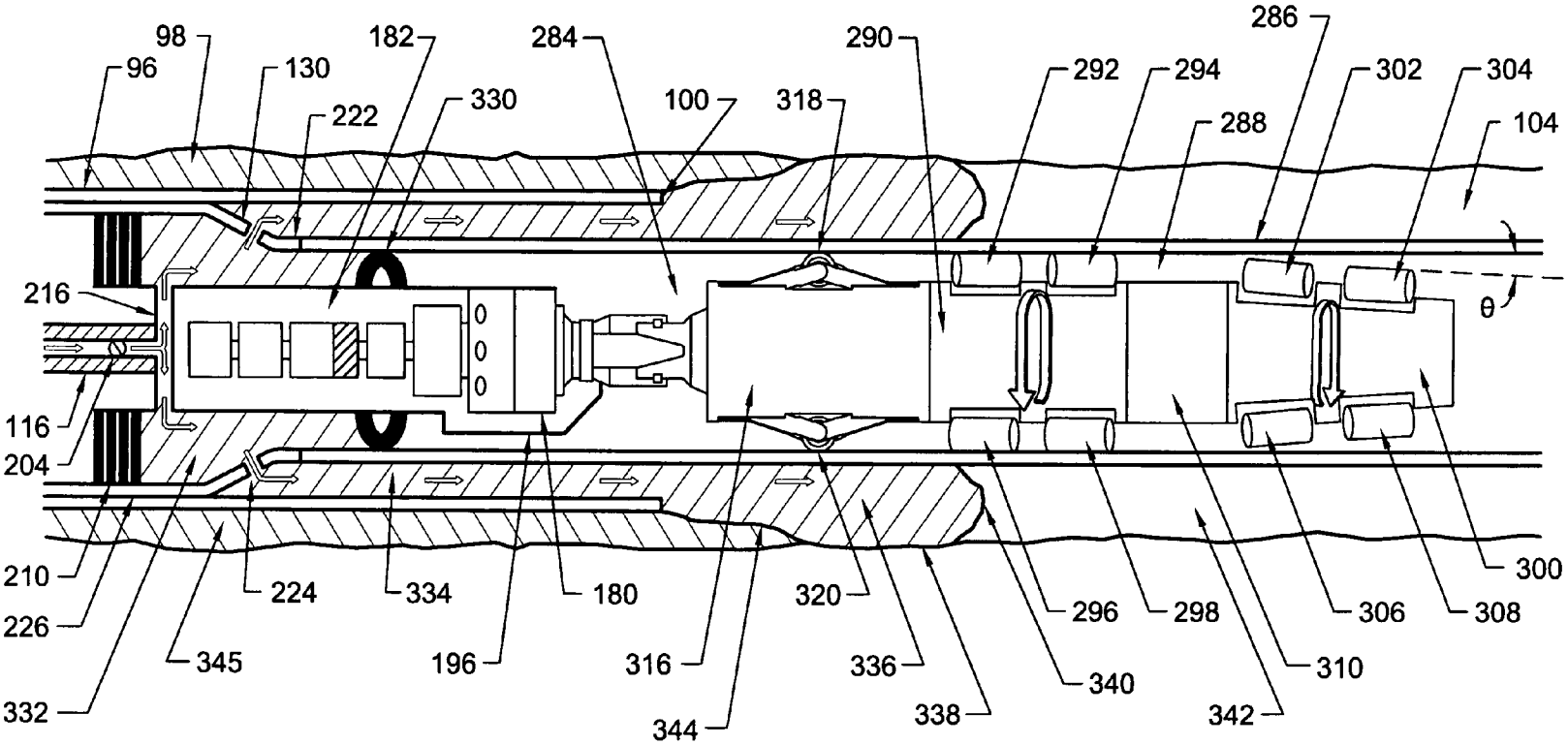
FIG. 10 shows a section view of the Subterranean Liner Expansion Tool positioned within an unexpanded casing that is injecting new cement into the new borehole.
Figure 12:
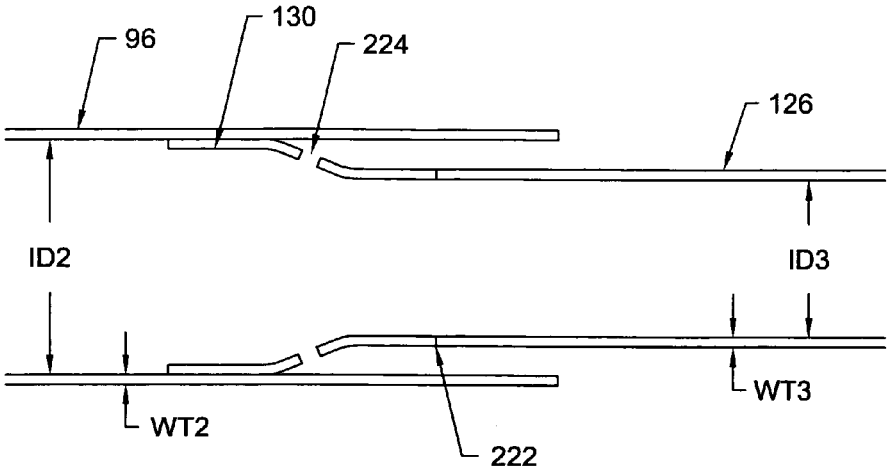
FIG. 12 shows the casing hanger after a portion of it has been expanded with the casing hanger setting tool inside the previously installed casing.

In FIG. 6, the expandable casing 126 is attached to the casing hanger 130. The casing hanger is shown in FIG. 7, and will be described in detail below. A portion of the casing hanger is surrounded by casing hanger seal 132. The casing hanger setting tool 134 is located within the casing hanger 130. When the new borehole 104 has been completed, the casing hanger setting tool 134 is used to expand the casing hanger so that it can make positive hydraulic and mechanical contact to the interior of the previously installed downhole casing that is adjacent to the casing hanger seal. FIG. 10 below shows the casing hanger after it has been expanded with the casing hanger setting tool, but that will be described in detail in relation to that FIG. 10. FIG. 12 below also shows the casing hanger after it has been expanded with the casing hanger setting tool, but that will be described in detail in relation to that FIG. 12.

Drilling operations typically require means to directionally drill, means to determine the location and direction of drilling, and means to perform measurements of geological formation properties during the drilling operations. Tool section 136 provides the rotary steering device for directional drilling and the LWD/MWD instrumentation packages. Here LWD means "Logging While Drilling" and "MWD" means "Measurement While Drilling". Typically, MWD instrumentation provides at least the location and direction of drilling. The LWD instrumentation provides typical geophysical measurements which include induction measurements, laterolog measurements, resistivity measurements, dielectric measurements, magnetic resonance imaging measurements, neutron measurements, gamma ray measurements; acoustic measurements, etc. This information may be used to determine the amount of oil and gas within a geological formation. Power for this instrumentation is obtained from the umbilical 116.

In FIG. 6, various electrical wires and connectors along the length of the Subterranean Electric Drilling Machine conduct electrical power from the umbilical to the rotary steering device and to the MWD/LWD instrumentation (which are designated figuratively by element 138 which are not shown in FIG. 6 for the purposes of brevity). The sensors on the direction steering device and the MWD and LWD instrumentation provide information that is digitized, sent thorough suitable electrical circuitry and connectors along the length of subterranean drilling machine (designated figuratively by element 139 which is not shown in FIG. 6 for brevity), which digital information is then sent uphole through the fiber optical cable 14 within the umbilical in the form of suitable light pulses. Commands from the surface are also send downhole through the same bidirectional communications path. For example, commands to change the direction of drilling may be sent downhole through this bidirectional communications path.

In FIG. 6, first anchor and weight on bit mechanism (AWOBM) 140 and second anchor and weight on bit mechanism (AWOBM) 142 selectively anchor the Subterranean Electric Drilling Machine and provide suitable weight on bit for drilling purposes. First AWOBM possesses anchor means 144 and 146. Second AWOBM possesses anchor means 148 and 150. This is an example of a tandem anchor system. In one preferred embodiment, the tandem anchor means 144, 146, 148 and 150 are comprised of inflatable packer-like elements.

In FIG. 6, first shaft 152 couples second AWOBM to the downhole electric motor 114. In one preferred embodiment, the first shaft 152 is of fixed length. In another preferred embodiment, first shaft 152 is an extensible shaft. Mud flow channel 154 is shown in FIG. 6 that will be more fully described later.

In FIG. 6, second shaft 156 couples the first AWOBM to the second AWOBM. Second shaft 156 is an extensible shaft. In one preferred embodiment, first AWOBM can move itself with respect to one end of the second shaft 156, and second AWOBM can also move itself with respect to the opposite end of shaft 156. In one embodiment, simple electric motor operated threaded screws and nuts suitably coupled to second shaft 156 are used to provide such motion. Those threaded screws, nuts, and electric motors are not shown in FIG. 6 for the propose of simplicity. For other examples of related mechanisms, please refer to the following references: (a) Roy Marker, et al., in the paper entitled "Anaconda: Joint Development Project Leads to Digitally Controlled Composite Coiled Tubing Drilling System", SPE 60750, presented at the SPE/ICoTA Coiled Tubing Roundtable, Houston, Tex., Apr. 5-6, 2000, and particularly in FIG. 8 entitled "Tractor-driven BHA", an entire copy of which is incorporated herein by reference; and (b) U.S. Pat. No. 5,794,703 that issued on Aug. 18, 1998 that is entitled "Wellbore Tractor and Method of Moving an Item Through a Wellbore", an entire copy of which is incorporated herein by reference.

First anchor and weight on bit mechanism (AWOBM) 140 and second anchor and weight on bit mechanism (AWOBM) 142 provide extension mechanisms with electric powered assemblies that are used to advance the casing and provide bit weight during drilling operations. These mechanisms also resist the drilling torque of the bit by anchoring the rotary motor. In a preferred embodiment, the anchor packers are inflated and deflated with motor driven progressing cavity pumps. Using dedicated PCPs simplifies controls and valves to operate the mechanism.

First anchor and weight on bit mechanism (AWOBM) 140 and second anchor and weight on bit mechanism (AWOBM) 142 are high strength anchor assemblies which provide axial load capacity at a relative slow axial advance rate. Should the suspended casing weight (in the vertical wellbore) during casing running procedures exceed the umbilical strength rating, then this mechanism may be used to lower the casing into the near horizontal wellbore.

In FIG. 6, various electrical wires and connectors along the length of the Subterranean Electric Drilling Machine conduct electrical power from the umbilical to the first anchor and weight on bit mechanism (AWOBM) 140 and to the second anchor and weight on bit mechanism (AWOBM) 142 (which are designated figuratively by element 160 which are not shown in FIG. 6 for the purposes of brevity). The first anchor and weight on bit mechanism (AWOBM) 140 and second anchor and weight on bit mechanism (AWOBM) 142 have many sensors including force sensors, torque sensors, position sensors, speed sensors, etc. Information from these sensors are sent thorough suitable electrical circuitry and connectors along the length of subterranean drilling machine (designated figuratively by element 162 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change the locations of first AWOBM 140 and second AWOBM 142 or to change the effective load placed on the drilling bit by these mechanisms.

In FIG. 6, first mud cuttings and bypass port (MCBP) 164 allows mud and drill cuttings to pass by the first AWOBM 140. Second mud cutting and bypass port (MCBP) 166 allows mud and drill cutting to pass by the second AWOBM 142. These are electrically operated ports. Various electrical wires and connectors along the length of the Subterranean Electric Drilling Machine conduct electrical power from the umbilical to the first MCBP and to the second MCBP (which are designated figuratively by element 168 which are not shown in FIG. 6 for the purposes of brevity). The first MCBP and to the second MCBP have many sensors providing temperature, pressure, etc. The information from these sensors are sent through suitable electrical circuitry and connectors along the length of subterranean drilling machine (designated figuratively by element 170 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to close first MCBP and to the second MCBP to prevent a well blow-out.

In FIG. 6, mud carrying shaft 172 is attached to the first AWOBM by housing 174. The female side of universal mud and electrical connector 176 is attached to the male side of universal mud and electrical connector 178. Progressing cavity pump 180 is driven by a downhole pump motor assembly generally designated by element 182. A progressing cavity pump is abbreviated as a "PCP". Progressing cavity pump 180 also includes an integral flexible shaft as is typical in the industry. In one preferred embodiment, the downhole pump motor assembly generally designated by element 182 is comprised of protector 184; first 80 horsepower electric motor 186 requiring 1250 volts at 45 amps that runs at the nominal RPM of 1700 RPM; second 80 horsepower electric motor 188 requiring 1250 volts at 45 amps that also runs at the nominal RPM of 1700 RPM; universal motor base 190; gearbox protector 192; and gearbox 194 having a 4:1 reduction. The downhole pump motor assembly and a portion of the progressing cavity pump 180 is covered by shroud 196.

Various electrical wires and connectors along the length of the Subterranean Electric Drilling Machine conduct electrical power from the umbilical to the downhole pump motor assembly (which are designated figuratively by element 198 which are not shown in FIG. 6 for the purposes of brevity). The Subterranean Electric Drilling Machine has has many sensors including voltage sensors, current sensors, torque sensors, temperature sensors, RPM sensors, etc. The information from these sensors are sent thorough suitable electrical circuitry and connectors along the length of subterranean drilling machine (designated figuratively by element 200 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change the RPM of first electric motor 186 and second electric motor 188.

FIG. 6 also shows three-way valve 202. This three-way valve is used to change the direction of mud flow inside the Subterranean Electric Drilling Machine. The functions of the three way 202 valve will be described below.

FIG. 6 also shows umbilical mud valve 204. This mud valve is used to shut off mud flow, or otherwise prevent well blow-outs. The mud valve 204 has a total of three positions: (a) open, namely it allows mud to flow through as shown in FIG. 6; (b) stop (not allow any mud to flow straight through); and (c) vent to the annulus between the umbilical 116 and the ID of the previously installed casing 212 so that cement or cuttings can be cleaned from within the umbilical (which state is not shown in FIG. 6 for simplicity).

Various electrical wires and connectors along the length of the Subterranean Electric Drilling Machine conduct electrical power from the umbilical to three-way valve 202 and to the umbilical mud valve 204 (which are designated figuratively by element 206 which are not shown in FIG. 6 for the purposes of brevity). The three-way valve 202 and the umbilical mud valve 204 possess many sensors including pressure sensors, voltage sensors, current sensors, and temperature sensors, etc. The information from these sensors are sent thorough suitable electrical circuitry and connectors along the length of subterranean drilling machine (designated figuratively by element 208 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change set the three-way valve 202 into any position, or to close, or open, umbilical valve 204.

In addition, Smart Shuttle° seal 210 is shown in FIG. 6. Smart Shuttle seal 210 is attached to a portion of shroud 180. For the purposes of succinct reference within this disclosure, the above entire list of Provisional Patent Applications, the U.S. Patents that have issued, the Pending U.S. Patent Applications that appear under the title of "Cross-References to Related Applications", the foreign pending Patent Applications under "Related PCT Applications", and the above U.S. Disclosure Documents under of "Related U.S. Disclosure Documents", all having William Banning Vail III as at least one of the inventors, is owned by the firm Smart Drilling and Completion, Inc. ("SDCI"), and therefore this intellectual property is defined herein to be the "SDCI Intellectual Property" or simply "SDCI IP" as an abbreviation. Smart Drilling and Completion, Inc. may be reached at 3123-198th Place S. E., Bothell, Wash. 98012, having the telephone number of (425) 486-8789, that has the website of www.Smart-Drilling-and-Completion.com. The Smart Shuttle is extensively described in the above defined "SDCI IP". The principal of operation of the Smart Shuttle is also described below in relation to FIG. 24. The shroud 196 extends to the left in FIG. 6 so that the Smart Shuttle® seal 210 is installed on a portion of that shroud.

In a preferred embodiment shown in FIG. 6. A reverse mud circulation system has been configured with the umbilical in the wellbore. Fresh mud travels from the surface down the annuli between the well casing and the umbilical designated by element 212. The right-hand side of FIG. 6 is "down" in FIG. 6. Fresh mud travels down from the surface as indicated by various arrows throughout the subterranean drilling machine. Clean mud then flows through the interior of the shroud 214 to the three-way valve 202. In one preferred embodiment, the three-way valve directs mud into the input of the progressing cavity pump so that the pump boosts the pressure of the mud delivered to the drill bit. This is called "Position A" of the three-way mud valve. The detailed tubing and other hardware necessary to accomplish the details of "Position A" is not shown in FIG. 6 for the purpose of simplicity. In "Position A", clean mud then flows through the interior of the male side of universal mud and electrical connector 178; then through the female side of universal mud and electrical connector 176; then through mud carrying shaft 172; then through mud flow channel 158; then through the interior of second shaft 156; then through mud flow channel 154; then through the interior of first shaft 152; then through the swivel and seal unit 124; then through rotary shaft 125; and then through the mud channels in pilot bit 108.

In FIG. 6, cuttings laden mud then returns to the surface through the following path. The cuttings laden mud flows up between the outside diameter of the expandable casing 126 and the inside diameter of the new borehole 104; then through the second mud cutting and bypass port (MCBP) 166; then through the first mud cuttings and bypass port (MCBP) 164; then through the volume between the exterior of the shroud 196 and the ID of the previously installed borehole casing 96; then through cross-over system 216; and then into umbilical 116 and through the umbilical mud valve 204 and then to the surface of the earth through the remainder of the umbilical disposed in the wellbore.

Cuttings laden mud returns to the surface flowing through the ID of the umbilical. The purpose is to keep the wellbore clean. The Subterranean Electric Drilling Machine 94 may be recovered to the surface while cuttings and mud fill the umbilical. Time to circulate the umbilical clean is not needed prior to tripping out of the hole.

In the preferred embodiment illustrated in FIG. 6, the clean mud is provided a booster pressure to improve bit hydraulics. If a bit is selected that produces fine cuttings, the PCP mud pump is compatible with pumping the cuttings filled mud. In an alternative design, the benefit for pumping the cuttings is a reduction in backpressure held on the geological formation.

In FIG. 6, there are two other positions of the three way-valve 202, "Position B", and "Position C". In "Position B" of the three-way valve, the PCP pump 180 is not used to boost the mud pressure delivered through the mud channels of the pilot bit 108. Here, clean mud flows through the interior of the shroud 214 to the three-way valve 202, and then directly into the male side of universal mud and electrical connector 178 and through the remaining portions of the Subterranean Electric Drilling Machine to the mud channels of the pilot bit 108. The detailed configuration of pipes and other related hardware to accomplish this mode of operation is not shown in FIG. 6 for the purpose of brevity.

In FIG. 6, Position C of the three-way valve 202 allows the entire subterranean drilling machine to move within the previously installed borehole casing 96. The fluid filled region defined between the subterranean drilling machine and the interior of the previously installed borehole casing is designated by element 218 in FIG. 6. As previously stated, the fluid filled region defined between the inside of the previously installed casing and the outside diameter of the umbilical, which is the annuli between the well casing and the umbilical, is designated by element 212. In "Position C" of the three-way valve 202, fluids are pumped from the region 218 into region 212. If there is a good seal between the exterior of the umbilical and the borehole at the surface produced by the stripper heads and surface blow-out preventers (BOP's), then the existence of the Smart Shuttle° seal 210 causes the subterranean drilling machine to go down into the well. Reversing the PCP, causes the Subterranean Electric Drilling Machine to reverse direction. For a more detailed description of the operation of a Smart Shuttle, please refer to the above defined "SDCI IP", entire copies of which are incorporated herein by reference. "Position C" of the three-way valve 202 provides an important function to rapidly trip the Subterranean Electric Drilling Machine to the surface and back should any drilling component need maintenance or replacement. This capability provides operational flexibility for the system. Based upon existing designs with currently available downhole electric motors and progressing cavity pumps, practical speeds of 10 feet per second can be anticipated while pulling a load of at least 4,000 lbs.

In FIG. 6, the fluid filled region between the casing hanger seal 132 and the pilot bit 106 is designated by element 220. During drilling operations, the mud pressure in region 212 is defined to be P1; the mud pressure in the interior of the shroud defined by element 214 is P2; the mud pressure at the input to the three-way valve 202 is P3; the mud pressure within the male side of universal mud and electrical connector 178 is P4; the mud pressure inside the mud channels of the pilot bit 108 is P5; the pressure within region 220 is P5; the pressure within region 218 is P6; and the pressure within the umbilical 116 is P6.

The Subterranean Electric Drilling Machine in FIG. 6 provides other benefits. Since the anchor points secure the drilling machine in the well's casing and mudflow paths must pass through valves within the machine, the entire unit serves the function of a downhole packer with safety valve and serves as a BOP located downhole, or Downhole BOP™. The BOP is comprised of first mud cuttings and bypass port (MCBP) 164, second mud cutting and bypass port (MCBP) 166, and the umbilical mud valve 204 provide the required functions of a BOP located downhole.

It is also worthwhile to make a few more comments about the downhole electric motor 114. This electric motor rotates the drilling bit. This electric motor may possess a gearbox to match the bit's speed requirements. Monitoring the motor's power, RPM, torque, current drawn, voltage drawn etc., provides significant information about the condition of the bit and its drilling performance. As one particular example, the electric motor is chosen to be a REDA 4 pole, 80 horsepower, electric motor requiring 1250 volts at 45 amps that runs at the nominal RPM of 1700 RPM that is 5.4 inches OD and 31.5 inches long. The RPM of this motor may be conveniently varied by varying the frequency of the voltage applied to it as is indicated by FIG. 2 and the related description. In one preferred embodiment, the RPM of the electric motor in the Subterranean Electric Drilling Machine is varied between about 900 RPM to 2,500 RPM. In this one preferred embodiment, the particular REDA motor does not need a gearbox for this application. In another preferred embodiment, two such REDA motors are operated in series that provide a net downhole motor capable of providing 160 horsepower to a rotating drill bit at the rotation speed between 900 RPM and 2,500 RPM. The RPM and other parameters of the downhole motor are controlled by computer system 26 in FIG. 5. Another preferred embodiment uses the electric motor described in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

The drilling fluid transitions from a nonrotating element which is first shaft 152, into a rotating pipe that is rotary shaft 125. The swivel and seal unit 124 prevents fluid leaks in this area. Unlike a swivel-packing gland, this seal operates at a relative low differential pressure. Suitable rotating seal assemblies are commercially available for these conditions. Electric power and communications from the fixed (non-rotating) components to the rotating assembly is required. An inductive connection or a slip-ring assembly will provide the power, communication and control linkage through the swivel and seal unit 124 to the fiber optic communication system and the power available through the umbilical. However, the details for either the inductive connection or slip-ring assembly are not shown in FIG. 6 in the interests of simplicity.

FIG. 6 as described above drills the borehole with the long section of expandable casing 126 carried into the new hole 104 as the new hole is drilled. However, in an alternative preferred embodiment, a short section of expandable pipe 126 is used to drill the borehole, then the Subterranean Electric Drilling Machine is retrieved from the wellbore, and then that machine conveys into the well the long section of expandable casing 126 to be cemented and expanded into place within the new borehole 104.

FIG. 6 as described, uses the pilot bit 106 and the two undercutters 110 and 112 as the "drill bit" to drill the new borehole 104. However, a bicenter bit as is used in the industry could also be used as the "drill bit" in FIG. 6, provided it had suitable dimensions to be withdrawn through the ID of the unexpanded state of the expandable casing 126, and through the interior of the previously installed borehole casing 96.

In relation to FIG. 1, wires A, B, and C comprise the first independent three phase delta circuit. Wires D, E, and F comprise the second independent three phase delta circuit. Each separate circuit is capable of providing 160 horsepower (119 kilowatts) over an umbilical length of 20 miles. In relation to FIG. 6, and in one preferred embodiment, the first independent three phase delta circuit provides up to 160 horsepower to the downhole electric motor 114. In relation to FIG. 6, and in one preferred embodiment, the second independent three phase delta circuit provides up to 160 horsepower to the downhole pump motor assembly 182 in FIG. 6. In one preferred embodiment, each first and second circuit are independently controlled. So, combined, the umbilical shown in FIG. 1 can deliver a total of 320 horsepower (238 kilowatts) at 20 miles to do work at that distance.

FIG. 7 shows the casing hanger 130. The casing hanger was identified with element 130 in FIG. 6. A portion of the casing hanger is surrounded by casing hanger seal 132. The casing hanger seal was also previously identified with element 132 in FIG. 6.

The expandable casing 126 shown in FIG. 6 is attached to the casing hanger 130. In one embodiment, the casing hanger is attached to the expandable casing by a threaded joint. In this embodiment, that threaded joint appears at end of casing hanger 222, although the threads on the casing hanger are not shown in FIG. 7 for simplicity. The opposite end of the casing hanger is shown as element 223. In another preferred embodiment, the casing hanger can be manufactured integral with the expandable casing. A cement flowby port 224 is used during the cementing process as further explained in relation to FIG. 10. The expandable hanger contact area is generally designated as element 226 in FIG. 7. The length of the expandable hanger contact area is designated by the legend L1 in FIG. 7.

Figure 8:
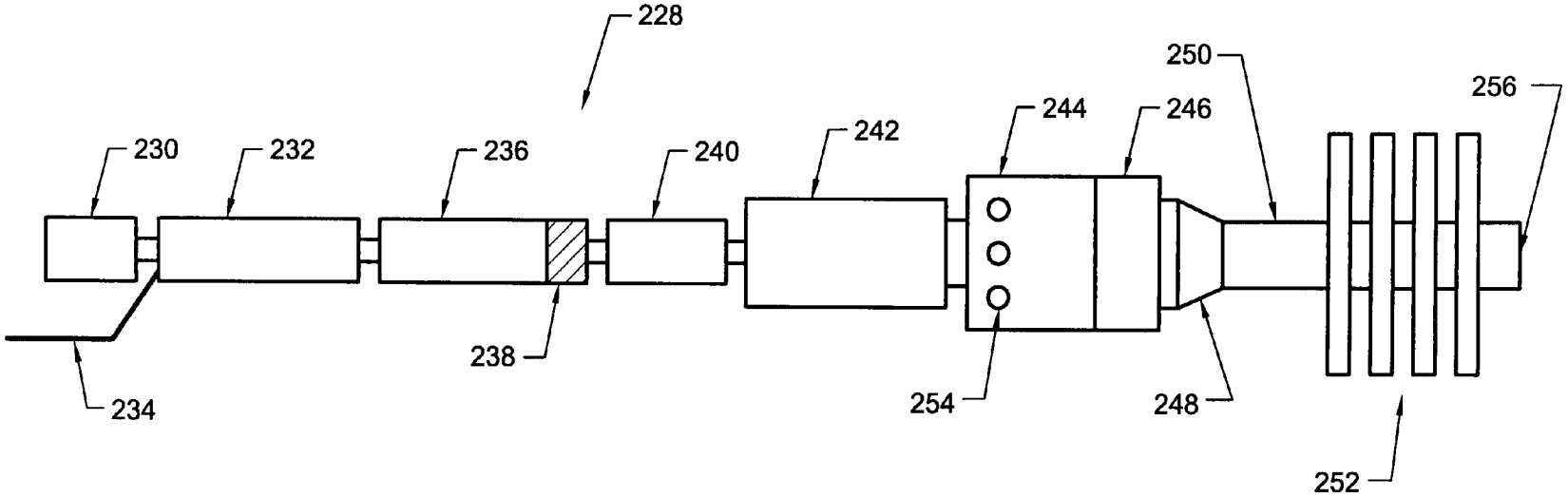
FIG. 8 shows detail for a downhole pump motor assembly that is related to the downhole pump motor assembly in FIG. 6 that also shows one preferred embodiment of the Smart Shuttle.

FIG. 8 shows more detail for the downhole pump motor assembly that is related to element 182 in FIG. 6. Elements 180, 184, 186, 188, 190, 192 and 194 were previously identified in FIG. 6. Those same elements are related to the elements appearing in the following.

FIG. 8 generally shows a downhole pump motor assembly identified as element 228 which is configured as one embodiment of a Smart Shuttle®. In one preferred embodiment, various parts from REDA are used to make a downhole pump motor assembly 182. REDA may be located as defined above. In the embodiment, element 230 is a REDA protector for a bottom drive motor that is 5.4 inches OD, and 4.5 feet long. In this embodiment, element 232 is a first REDA 4 pole, 80 horsepower, electric motor requiring 1250 volts at 45 amps that runs at the nominal RPM of 1700 RPM that is 5.4 inches OD and 31.5 inches long. Element 234 is a power cable providing electrical power to the downhole pump motor assembly 228. In this embodiment, element 236 is a second REDA 4 pole, 80 horsepower, electric motor requiring 1250 volts at 45 amps that runs at the nominal RPM of 1700 RPM that is 5.4 inches OD and 31.5 inches long. Element 238 is a REDA universal motor base part number UMB-B1 for a bottom drive motor that is 5.4 inches OD and 1.7 feet long. Element 240 is REDA gearbox protector part number BSBSB having 4 mechanical seals that is 5.4 inches OD and 10.6 feet long. Element 242 is a REDA gearbox having a 4:1 gear reduction that is 6.8 inches OD and 10.9 feet long. Element 244 is a Netzsch flexible shaft that is 7.87 inches OD and 10 feet long. Netzsch Oilfield Products is located at 119 Pickering Way, Exton, Pa. 19341, having the telephone number of (610) 363-8010, that has the website of www.netzchusa.com. Element 246 is a Netzsch progressing cavity pump part number NM090*3L (EX) that is 7.87 inches OD and 11.8 feet long. Element 248 is a crossover. Element 250 is 4 inch tubing. Element 252 is a Smart Shuttle seal. Element 254 is an intake port into the Netzsch progressing cavity pump. Element 256 is the discharge outlet from the Netzsch progressing cavity pump.

The downhole pump motor assembly identified as element 228 needs a cablehead, centralizers, bypass valves, sensors, and intelligent controls to make one embodiment of a Smart Shuttle®. Such a Smart Shuttle will have a minimum pulling force of 4400 lbs, a maximum transit speed of 11 feet per second, that operates within 9⅝ inch O.D., 53.5 lb/foot casing. It has variable speed, is reversible, and has high speed bidirectional communications with instrumentation on the surface of the earth.

Figure 8A:
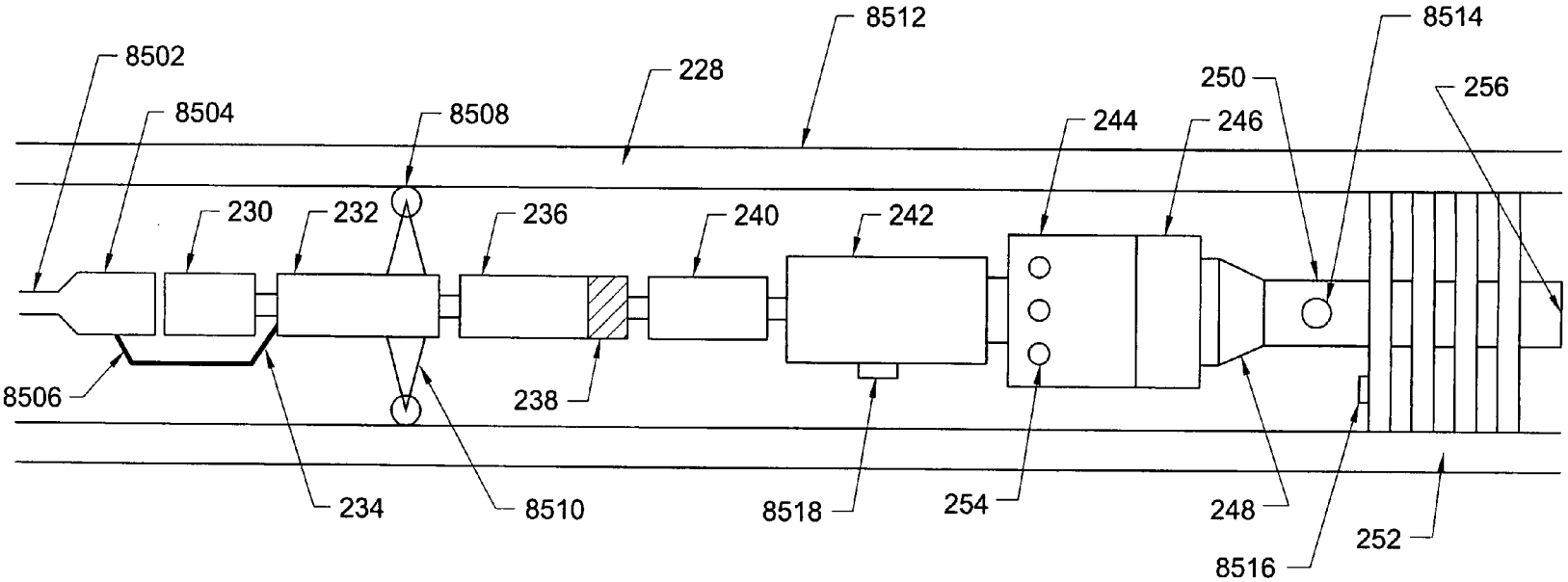
FIG. 8A shows a basic Smart Shuttle having centralizer rollers, a cablehead, a bypass port, and which is controlled with a closed-loop feedback system.

FIG. 8 shows one embodiment of a Smart Shuttle. FIG. 8A shows some additional features. All the elements from 228-254 have already been previously defined. Wireline 8502 is connected to cablehead 8504 and insulated electrical breakout wiring 8506 is connected to element 234 providing power and communications to the Smart Shuttle. Centralizer rollers 8508 and 8510 centralize the Smart Shuttle within pipe 8512. Bypass valve 8514 allows the bypass port to open that allows fluid to bypass pump 246, and this bypass valve was not explicitly shown in FIG. 8. The electric motors 232 and 234 may be run in reverse so that element 256 becomes the intake and element 254 becomes the discharge so that the Smart Shuttle can power itself downhole. In many preferred embodiments, a standard lubricator is used so that fluid may be pressurized above the Smart Shuttle seal 252 as has been previously described herein and in other references that have been incorporated herein. In one preferred embodiment, a sensor pack 8516 is attached to at least a portion of the Smart Shuttle seal. In another preferred embodiment, another sensor pack is installed in element 8518. Sensory information is sent uphole to a computer system by communication means, the computer system processes information, and then communications means sends downhole so that the Smart Shuttle is controlled using a closed-loop feedback system as described. A slip-ring mechanism, or swivel mechanism, may be incorporated within any portion of FIG. 8A that will prevent torque from building up in the wireline 8502 as is conventional in the industry, although such devices are not shown in FIG. 8A for the purposes of simplicity.

Figure 8B:
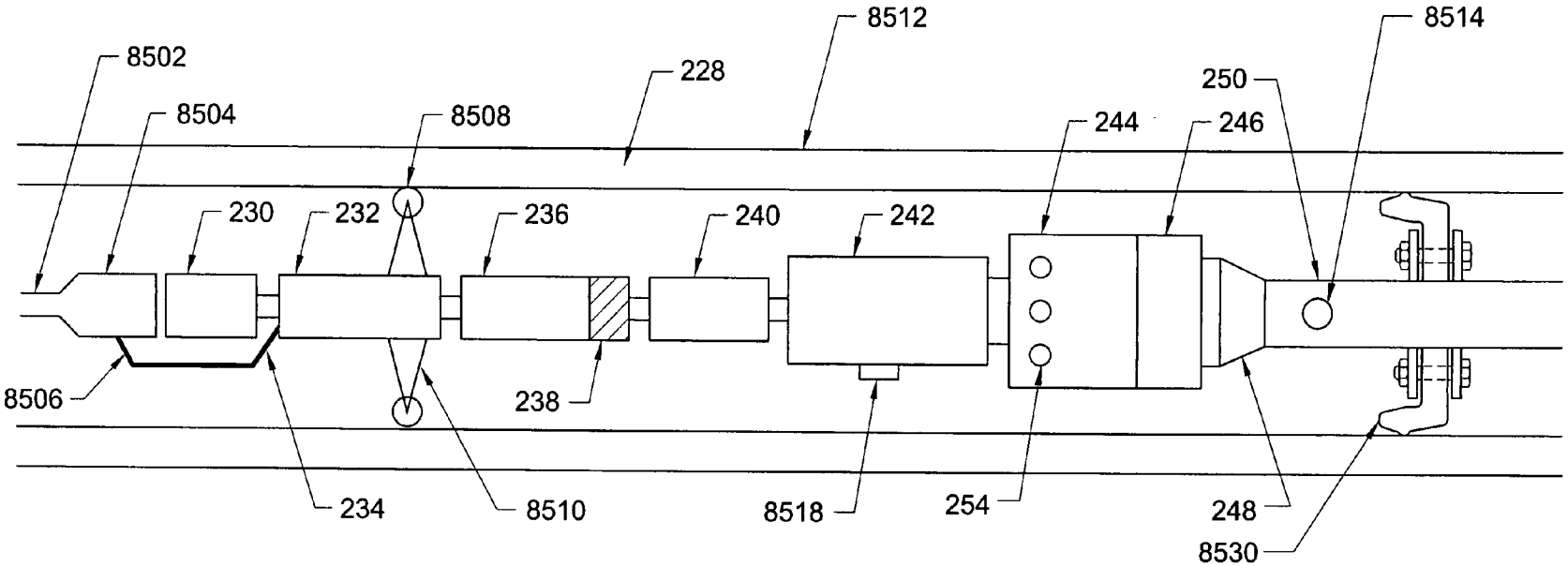
FIG. 8B is similar to FIG. 8A except Smart Shuttle seal 252 has been replaced with a dual cup seal, one portion of which is shown as element 8530.
Figure 62:
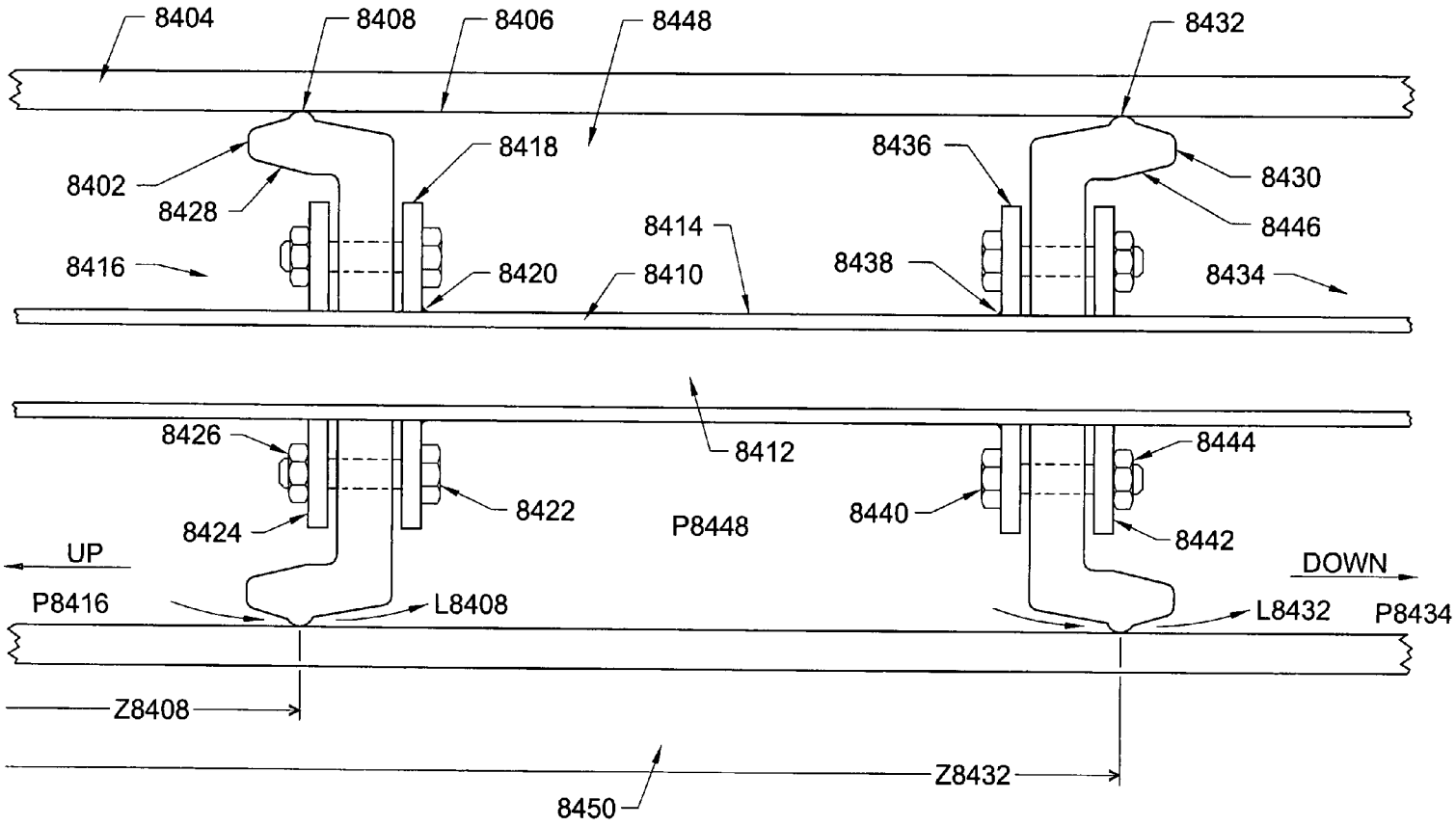
FIG. 62 shows a dual cup seal arrangement, or dual chevron seal arrangement, that is mounted on a mandrel for the Smart Shuttle.

FIG. 8B is similar to that in FIG. 8A except Smart Shuttle seal 252 has been replaced with a dual cup seal generally shown as having two elements 8402 and 8430 in FIG. 62. However, in FIG. 8B, element 8530 corresponding to only the left-hand element 8402 in FIG. 62 is explicitly shown. The other portion of the dual cup seal corresponding to element 8430 in FIG. 62 is not shown in FIG. 8 solely for the purposes of simplicity.

In addition, an unintentional error was found in FIG. 8B in the Provisional Patent Application mailed to the USPTO on Aug. 13, 2009 having Express Mail Label No. ED 258 746 600 US, now Provisional Patent Application No. 61/274,215, and the orientation of element 8530 has been properly changed in FIG. 8B in the application herein to show the correct orientation.

In FIGS. 8, 8A, and 8B, no explicit attachment means are shown. However, attachment means 251 may be connected to tubing element 250, which element 251 is not shown in these figures for the purposes of brevity. Attachment means 251 is similar to attachments means 7180 in FIGS. 31 and 32. Element 250 may also be called a hollow mandrel portion for the purposes herein. Element 228 in FIGS. 8, 8A, and 8B may also be called equivalently a well conveyance apparatus for the purposes herein.

Figure 9:
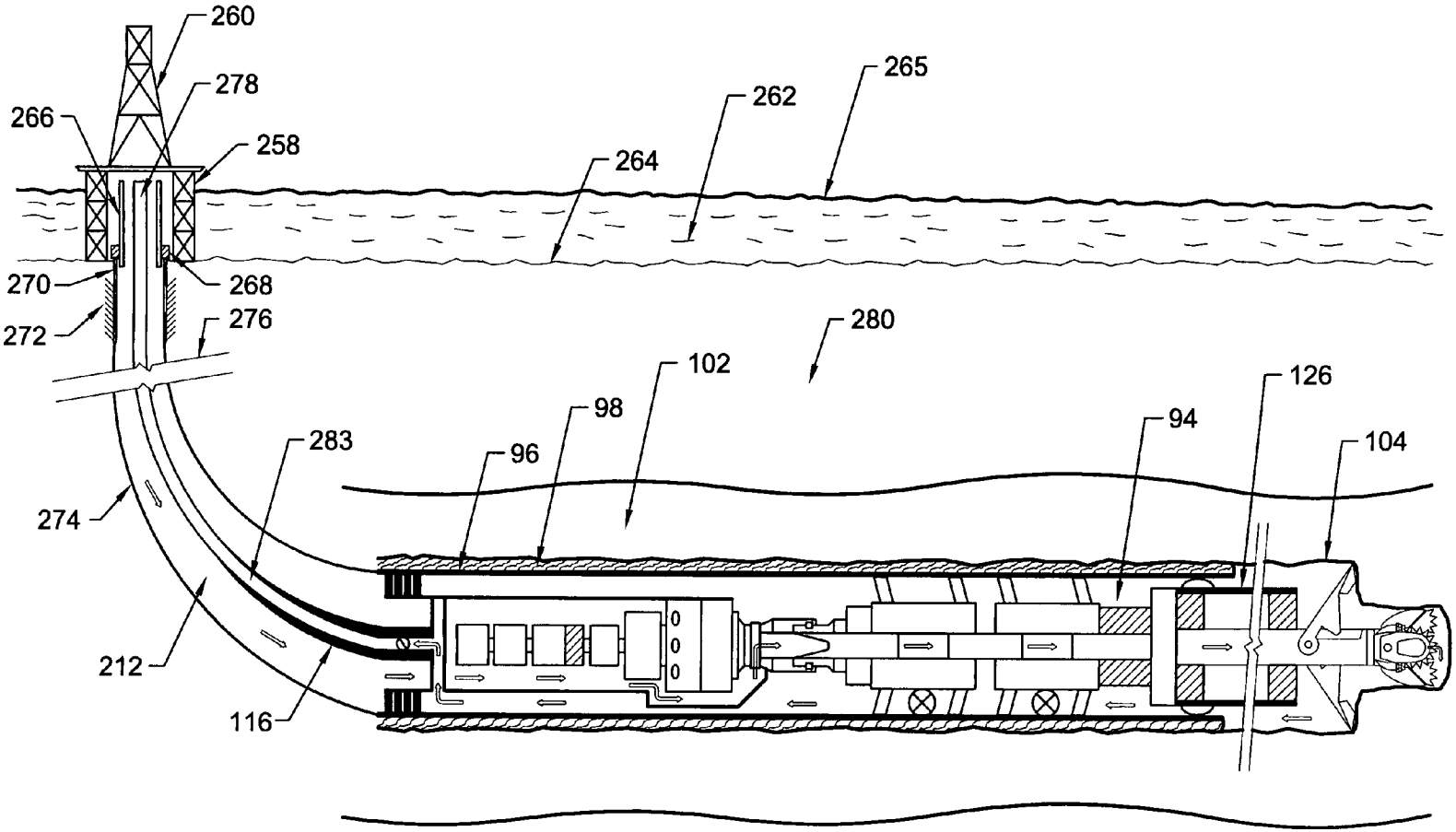
FIG. 9 shows a Subterranean Electric Drilling Machine boring a new borehole from an offshore platform.

FIG. 9 shows a Subterranean Electric Drilling Machine boring a new borehole from an offshore platform. FIG. 9 shows the Subterranean Electric Drilling Machine 94 deployed within a previously installed borehole casing 96 that is surrounded by existing downhole cement 98 that is in the process of drilling the new borehole 104 into geological formation 102, which elements were previously defined in relation to FIG. 6. Also shown in FIG. 9 is the expandable casing 126 that was also defined in FIG. 6. The Subterranean Electric Drilling Machine was thoroughly described in FIG. 6.

In FIG. 9, an offshore platform 258 has a hoisting mechanism 260 that is surrounded by ocean 262 that is attached to the bottom of the ocean 264. The ocean surface is shown by element 265. Riser 266 is attached to blow-out preventer 268. Surface casing 270 is cemented into place with cement 272. A section of previously installed casing 274 extends from the lower portion of the surface casing 270 to the previously installed borehole casing 96. The broken line 276 shows that the section of previously installed casing 274 can be many thousands of feet long. Previously installed casing 274 may actually be comprised of different lengths of casings having different inside diameters, outside diameters, and weights, but that detail is not shown in FIG. 9 in the interest of simplicity. Other conductor pipes, surface casings, intermediate casings, liner strings, or other pipes may be present, but they are not shown for simplicity. The upper portion of the umbilical 278 proceeds to the stripper heads and surface blow-out preventers (BOP's), then proceeds to location 70 in FIG. 5, and is then wound up on the umbilical carousel 64 in FIG. 5.

In this preferred embodiment, the computerized uphole management system for the umbilical as shown FIG. 5 is mounted on the offshore platform. In FIG. 9, other geological formations represented by element 280 are located above geological formation 102. Other geological formations represented by element 282 are below geological formation 102.

In FIG. 9, the directions of the arrows show the mud flow. Fresh mud travels from the surface down the annuli between the well casing and the umbilical designated by element 212. Element 212 was previously defined in FIG. 6. Cuttings laden mud returns to the offshore platform 258 on the interior of the umbilical 283. The arrows show the mud flow pattern in the vicinity of the Subterranean Electric Drilling Machine 94. This mud flow system is called a "reverse mud flow system". This reverse mud flow system will keep the cuttings within the umbilical, therefore preventing any debris from accumulating in the annuli between the well casing and the umbilical that might prevent the Subterranean Electric Drilling Machine from returning to the offshore platform. In other preferred embodiments, the mud flow can be opposite—namely, clean mud flows down the interior of the umbilical, and cuttings laden mud flows up the annuli between the well casing and the umbilical.

For the purposes of this invention, the phrase "offshore platform" includes the following: (a) bottom anchored structures that include artificial islands, gravity based structures, piled truss structures (conventional platforms), and compliant towers; (b) mobile-bottom sitting structures that include submersible structures including submersible barges (in swampy and shallow water areas), mobile gravity base structures (like the concrete islands in the Arctic) and jackup platforms; (c) floating-permanently moored structures including the tension leg platforms (TLP), the SPAR and Semisubmersible, and the Floating Production, Storage, and Offloading structures (FPSO); and (d) floating-mobile structures such as shipshape-like drilling rigs, semisubmersibles that are catenary moored, and barges.

It is helpful to review how FIGS. 6, 7, 8, and 9 relate to the drilling process. As was shown in FIG. 6, the expandable casing 126 in its un-expanded state is carried into the hole as an outer sheath over rotary shaft 125 and associated components, which may also be called a "drilling work string". At the lower end of that borehole assembly ("BHA") is anchored into the casing. In one preferred embodiment, the string of expandable casing is 3,000 ft long.

Starting with the drilling machine out of the hole, the expandable casing is run in and suspended in the wellbore from the surface. The top of the casing has an expandable casing hanger installed. FIG. 7 shows the expandable casing hanger. Next, the bottom hole assembly is run through the casing and secured into the bottom joint of the unexpanded suspended casing. The casing hanger setting tool 134 is secured into the casing hanger 130 together with the first and second anchor and weight on bit mechanisms 140 and 142, the downhole electric motor 114, and the remaining portions of the Subterranean Electric Drilling Machine 94. The entire Subterranean Electric Drilling Machine and expandable casing is then tripped to the bottom of the well. Drilling the next section of the well continues until sufficient hole for the expandable casing has been drilled. With the expandable casing in place, the casing hanger setting tool expands and locks the unexpanded length of expandable casing in the hole. The Subterranean Electric Drilling Machine 94 then releases from the casing and is recovered from the well.

In one preferred embodiment, the casing hanger setting tool 134 is a packer-like assembly located beneath the downhole electric motor 114. The casing hanger setting tool initially expands with sufficient pressure to secure the casing to the non-rotating housing that is connected to the swivel and seal unit 124 that centralizes the casing. Once the new hole has been drilled, and the casing hanger 130 is in proper setting position, much higher pressure is pumped into the casing hanger setting tool to plastically expand the hanger and cold forge the hanger into the previously installed borehole casing 96. As an example of this process, various manufacturers connect pipeline repair tools to pipeline ends and connect wellheads to the top of casing strings with this type of "cold forge" process. The cement flowby ports of the casing hanger are left open for circulation of cement behind the casing. When the expandable casing is later expanded, these holes are sealed through contact with overlap in the previous casing string. The casing hanger seal and cement help ensure a leak tight seal.

In one preferred embodiment of the invention, the Subterranean Electric Drilling Machine is used to accomplish the many purposes including the following: (a) drill the new borehole 104; (b) convey into the well the expandable casing 126; and (c) then using the casing hanger setting tool 134, the casing hanger is expanded into the previously installed borehole casing 96. Thereafter, the Subterranean Electric Drilling Machine releases from the casing hanger, thereby leaving the casing hanger and the expandable casing 126 in its unexpanded state in the well, and the Subterranean Electric Drilling Machine is then removed from the well.

Thereafter, another tool called a Subterranean Liner Expansion Tool is conveyed into the wellbore. In one preferred embodiment, the Subterranean Liner Expansion Tool is labeled with element 284 in FIG. 10. FIG. 10 shows the previously installed borehole casing 96, the existing downhole cement 98, the new borehole 104, a portion the casing hanger 130 after the above expansion steps have been performed in (c) above, one end 222 of the casing hanger shown in FIG. 7, and the other end 223 of the casing hanger shown in that figure. Cement flowby port 224 is also shown.

Figure 11:
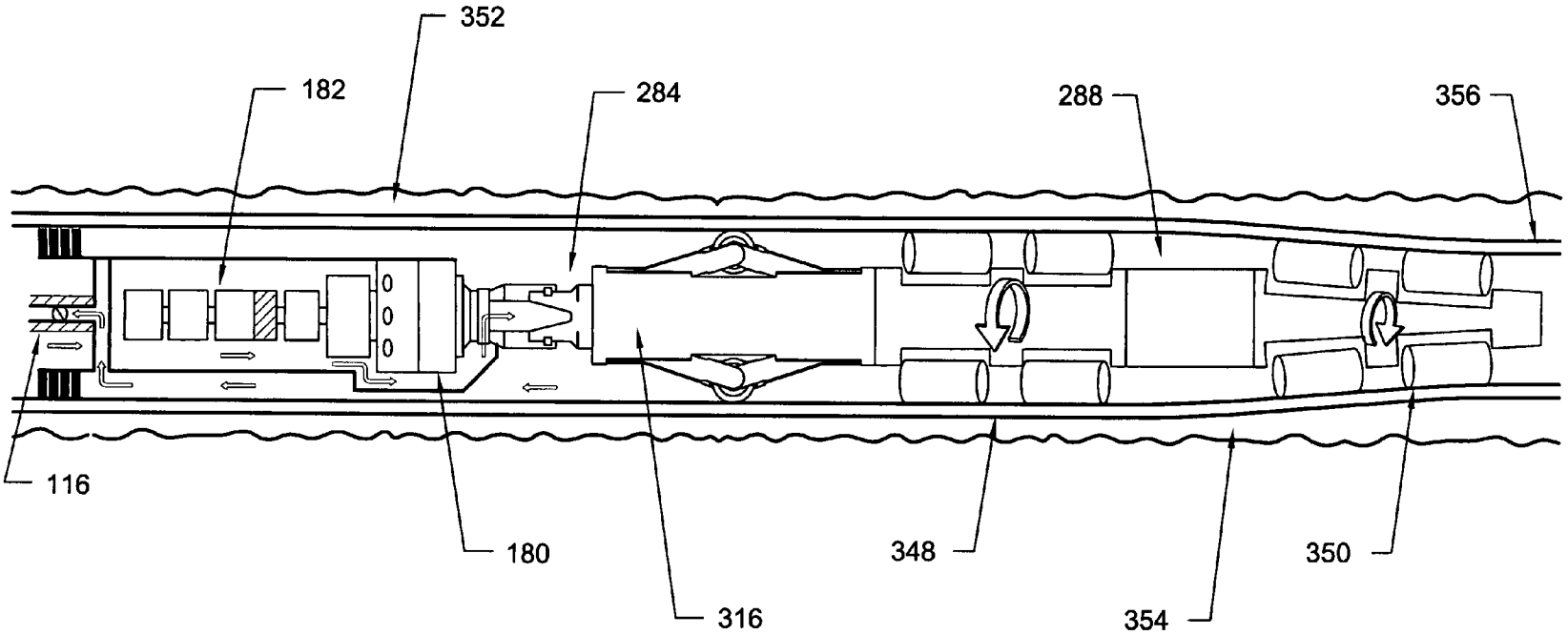
FIG. 11 shows the Subterranean Liner Expansion Tool in the process of expanding the expandable casing within the new borehole before the new cement sets up.

The Subterranean Liner Expansion Tool 284 is used in a two step process. First, the cement is injected behind the unexpanded expandable casing. That process is shown in FIG. 10. Second, the expandable casing is expanded. That process is shown in FIG. 11. Thereafter, the Subterranean Liner Expansion Tool is removed from the well, and the well is either completed, or the well is further extended using the methods and apparatus described above.

In FIG. 10, the Subterranean Liner Expansion Tool 284 is positioned within unexpanded casing 286. Counter-rotating roller casing expander tool is generally shown as numeral 288 in FIG. 10. In one preferred embodiment, clockwise rotating roller assembly 290 is on the uphole side of the counter-rotating roller casing expander tool. It has individual rollers 292, 294, 296, and 298. In this embodiment, counter-clockwise rotating roller assembly 300 is on the downhole side counter-rotating roller casing expander tool. It has individual rollers 302, 304, 306 and 308. Electrically powered hydraulic systems within the counter-rotating roller casing expander tool are capable of loading the individual rollers against the interior of the expandable casing. In one preferred embodiment, several of the rollers, such as roller 304, are canted through the angle θ. In one preferred embodiment, the rollers are hydraulically loaded and are canted to advance through the expandable casing as the rotating roller assembles 290 and 300 rotate in their respective directions. Electrically powered systems within the counter-rotating roller casing expander tool are then capable of rotating the appropriate elements of each rotating roller assembly. In FIG. 10, the rollers are in their fully retracted position. The electric motor and related hydraulics for the counter-rotating roller casing expander tool are located within housing 310. That electric motor is labeled with legend 312, and the related hydraulics is labeled with legend 314, although those are not shown in FIG. 10 for simplicity.

The torque resistance section 316 is a component of the counter-rotating roller casing expander. It has longitudinal rollers 318 and 320. An electric motor 322 and associated hydraulics 324 are located within torque resistance section 316 to properly actuate the longitudinal rollers 318 and 320. However, elements 322 and 324 are not shown in FIG. 10 for the purposes of simplicity. The purpose of the torques resistance section 316 is to prevent any unbalanced torque resulting from the operation of the Subterranean Liner Expansion Tool that might cause the remainder of the downhole tool attached to the umbilical 116 to twist, thereby possibly breaking the umbilical. Breaking the umbilical downhole would be a catastrophic failure, although the tool can be retrieved using techniques to be described below.

Various electrical wires and connectors along the length of the Subterranean Liner Expansion Tool conduct electrical power from the umbilical 116 to the counter-rotating roller casing expander tool 288 (which are designated figuratively by element 326 which are not shown in FIG. 6 for the purposes of brevity). Sensors within the counter-rotating roller casing expander tool provide measurements such as the force delivered by the rollers to the casing, the position of the rollers, etc., which measurements are suitably is digitized and sent thorough suitable electrical circuitry and connectors along the length of Subterranean Liner Expansion Tool (designated figuratively by element 328 which is not shown in FIG. 10 for brevity), which digital information is then sent uphole through the fiber optical cable 14 within the umbilical 116 in the form of suitable light pulses. Commands from the surface are also send downhole through the same bidirectional communications path. For example, commands to change the contact of the rollers, or expand the rollers outward to expand the casing may be sent downhole through this bidirectional communications path.

FIG. 10 further shows progressing cavity pump 180 that is driven by a downhole pump motor assembly 182 and shroud 180, which were previously described in FIG. 6. Inflatable cement seal 330 is inflated during cementing operations.

In the preferred embodiment shown in FIG. 10, cement from the surface proceeds through umbilical 116; through umbilical mud valve 204 (which is used for both mud and cementing purposes); to the cross-over system 216 and into region 332; through the cement flowby port 224; through region 334 between the previously installed borehole casing 96 and the exterior of the unexpanded casing 286; then into region 336 between the exterior of the unexpanded casing and the ID of the new borehole that labeled with element 338. The mud valve 204 has a total of three positions: (a) open, namely it allows cement to flow through as shown in FIG. 10; (b) stop (not allow any cement to flow straight through); and (c) vent to the annulus between the umbilical 116 and the ID of the previously installed casing so that cement can be cleaned from within the umbilical (which state is not shown in FIG. 10 for simplicity). The region between the umbilical 116 and the ID of the previously installed casing is shown a element 212 in FIG. 6, although that particular element is not shown in FIG. 10 for simplicity (because of the large number of labeled elements in that vicinity of FIG. 10).

In FIG. 10, the position of the "front" of the cement flow is shown by element 340. Sufficient cement is introduced into region 336 so that when the unexpanded casing 286 is expanded in the next step (as explained below), then the well is properly cemented in place. Various sensors within the Subterranean Liner Expansion Tool provide data that allows the computer system 26 on the offshore platform in this embodiment to determine the proper amount of cement to be sent downhole that at least partially fills region 342 that is located between the exterior of the unexpanded casing 286 and OD of the new borehole 338 which is not filled with cement in FIG. 10. The overlapping region between the old cement and the new cement that has not set up in FIG. 10 is shown as element 344. The new cement is now allowed to set up as shown in FIG. 10. However, there is old cement that is hardened in FIG. 10 such as the old cement behind the casing hanger 130 that is identified with numeral 345.

The Subterranean Liner Expansion Tool 284 is comprised of a number of components including the counter-rotating roller casing expander tool 284 and the Smart Shuttle®. The Subterranean Liner Expansion Tool is transported downhole by the Smart Shuttle® which is comprised of components including the Smart Shuttle® seal 210, the progressing cavity pump 180, the downhole pump motor assembly 182, and the shroud 180 which have been previously described in relation to FIG. 6. The Smart Shuttle also returns the Subterranean Liner Expansion Tool to the offshore platform in this preferred embodiment.

In a preferred embodiment of the invention shown in FIG. 10, the unexpended casing 286 is 3,000 feet long, has a weight of approximately 40 lbs/foot, and has an unexpanded OD of approximately 8.0 inches OD. In a preferred embodiment shown in FIG. 10, the previously installed borehole casing 96 is a 9⅝ inch OD casing having a weight of approximately 40 lbs/foot.

FIG. 11 shows the Subterranean Liner Expansion Tool 284. Portions of the Subterranean Liner Expansion Tool are shown in FIG. 11 including the counter-rotating roller casing expander tool 288, the torque resistance section 316, and the progressing cavity pump 180 that is attached to the downhole pump motor assembly 182.

After cementing was completed in FIG. 10, the Subterranean Liner Expansion Tool is pulled up vertically above the casing hanger 130. Then the rollers of the clockwise rotating roller assembly 290 the counter-clockwise rotating roller assembly 300 are placed in their extended positions. Then counter-rotating roller casing expander tool 288 is suitably energized, and it begins to expand the expandable casing on its downward travel (to the right-hand side of FIG. 11) within the well. FIG. 11 shows the Subterranean Liner Expansion Tool in a location in the formation that is beyond the end of the previously installed casing 100 that is defined in FIG. 10.

In FIG. 11, the expandable casing in its fully expandable form is shown at location 348. In FIG. 11, the expandable casing in its unexpanded form is shown at location 350. Cement surrounding the expandable casing in its fully expandable form is shown as element 352 in FIG. 11. Cement surrounding the expandable casing in its unexpanded form is shown as element 354 in FIG. 11. The counter-rotating roller casing expander tool 288 remains suitable energized, and it eventually completes the expansion of the expandable casing at some extreme distance in the well designed by element 356 in FIG. 11. Thereafter, the liner expansion tool 284 is removed from the wellbore. Thereafter, the cement is allowed to cure. After the cement is cured, the well is completed to produce oil and gas using techniques and procedures typically used in the oil and gas industry or using those methods and apparatus described in the "SDCI IP", entire copies of which are incorporated herein by reference.

In FIG. 11, the expandable casing in its fully expandable form as shown at location 348 can also be called equivalently a "liner" because of its attachment to the previously installed casing 96 in FIG. 10. Hence, the name "Subterranean Liner Expansion Tool".

FIG. 12 shows the casing hanger 130, a cement flowby port 224, the previously installed borehole casing 96, and expandable casing 126 in its unexpanded form that is attached to the casing hanger at casing hanger end 222. These elements have been previously defined in FIG. 6 and in FIG. 7. FIG. 12 shows the casing hanger after a portion of it has been expanded with the casing hanger setting tool. The state of the casing hanger 130 in FIG. 12 is similar to that shown in FIG. 10. The inside diameter of the previously installed borehole casing 96 is shown in FIG. 12 by the legend ID2. The wall thickness of the previously installed borehole casing is identified by the legend WT2. The inside diameter of the expandable casing 126 in its unexpanded form is identified by the legend ID3. The wall thickness of the previously installed borehole casing is identified by the legend WT3. This is the configuration before the passage of the Subterranean Liner Expansion Tool.

Figure 13:
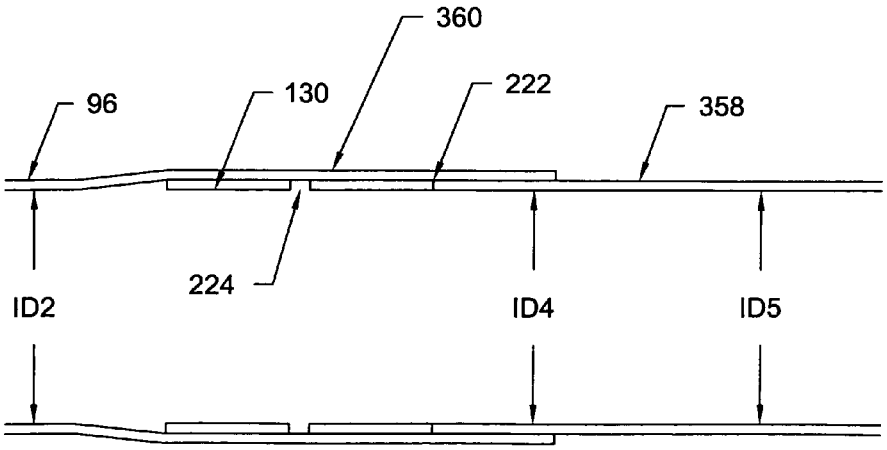
FIG. 13 shows a section view of the monobore well, or near-monobore well, after passage of the Subterranean Liner Expansion Tool.

FIG. 13 provides a section view of the configuration of components shown in FIG. 12 after the passage by the Subterranean Liner Expansion Tool. Various elements on FIG. 13 have been previously described. In addition, element 358 shows the expandable casing in its expanded state after the passage of the Subterranean Liner Expansion Tool. Various inside diameters are defined by legends ID2, ID4, and ID5. In general, ID2 will equal ID4 that will equal ID5. If this is the case, this is a true monobore well. However, there are limitations to the power of the Subterranean Liner Expansion Tool. So, if old hard cement is set up behind the overlapping portions of the previously installed casing in the location identified by element 360, the Subterranean Liner Expansion Tool may not have sufficient power to crush old hard cement and rock behind that particular location. Such a location is identified by element 345 in FIG. 10. In such event, ID4 would be less than ID2 by as much as 2 times the dimension of WT2 in FIG. 12. This extra thickness may persist for the length of the casing hanger L1 as shown in FIG. 7. Therefore, the installation described in FIG. 13 will provide either a monobore well, or a near-monobore well.

In the following, there are different topics of interest related to the above described preferred embodiment. Subsection titles will be used for the purposes of clarity.

FIG. 14 shows relevant parameters related to fluid flow rates through the umbilical. Umbilical fluid flow rates are sufficient to support drilling as shown in FIG. 9. One preferred embodiment uses a 4.5 inch ID pipe providing 173 gallons per minute (GPM) at a pressure of 1000 pounds per square inch (PSI) pressure loss over a 20 mile offset. Here, the "Pressure Loss" is 1000 PSI. Here, the "Flow Rate" is 173 gallons per minute. This was calculated using a Bingham Plastic mudflow model with 12 lb/gallon mud at a velocity of 3.5 feet per second (fps). This is a "Flow Velocity" of 3.5 feet per second. The umbilical geometry of 4.5 inches ID and 6.0 inches OD may be optimized under different situations as required. However, these particular dimensions are selected for a reverse flow mud system inside a 8.5 inch ID cased hole having a 20-mile offset. The Bingham Plastic mudflow model is described in detail in Section 8.2 entitled "Mathematical and Physical Models" of the book entitled "Petroleum Well Construction" by Michael J. Economides, Larry T. Watters, and Shari Dunn-Norman, John Wiley & Sons, New York, N.Y., 1998, an entire copy of which is incorporated herein by reference. An entire copy of the book referenced in the previous sentence is also incorporated herein by reference. In particular, please refer to Table 8-2 on page 222 of the book for detailed algebraic equations related to the Bingham Plastic Model.

Tripping into the Well

There are various constraints on how rapidly the Subterranean Electric Drilling Machine can enter the wellbore. Since the vertically suspended casing string and the Subterranean Electric Drilling Machine weight may be greater than can be safely run with the umbilical, the first anchor and weight on bit mechanism (AWOBM) 140 and second anchor and weight on bit mechanism (AWOBM) 142 as shown in FIG. 6 provide an anchor mechanism that acts as a "downhole hoist" to "walk" the casing vertically downhole and eventually into any horizontal section of the well. This "downhole hoist" is also called herein an "anchor mechanism" when used for this particular purpose. The Subterranean Electric Drilling Machine and its related anchor mechanism can be fielded from within a lubricator as is standard practice in the industry to maintain well pressure control. Once the downhole weight is within the capacity of the umbilical, use of the anchor mechanism is stopped and the casing load is transferred to the umbilical. The anchor means 144 and 146 and anchor means 148 and 150 as shown in FIG. 6 of the anchor mechanism are then collapsed for rapid transit to the bottom of the well. Further downhole travel of the casing and the Subterranean Electric Drilling Machine is accomplished by pumping mud into the annulus space between the well's installed casing and the umbilical. Pressure acting upon this annular piston area generates sufficient force to rapidly move the equipment downhole at about 2 fps in the 15 to 20 mile offset range. A 225,000 lb load with a 0.2 coefficient of friction requires approximately 1,600 psi differential pressure across Smart Shuttle seals (see element 210 in FIG. 6). This pressure capability is obtained with multiple seals load-sharing the pressure. Motion cannot be accomplished without moving mud from below the drilling machine out of the well up through the umbilical ID. The pressure in the casing below the drilling machine (a sealed volume due to cementing) is approximately 3500 psi above static. The downhole mud pump may be used to assist in moving this required mudflow through the umbilical ID. For trip velocities in the range of 2 feet per second the surface mud pumps will need to provide 350 gallons per minute at 4600 pounds per square inch. At shorter distances with less pressure losses, the equipment may move faster (if surface mud pump volume capacity is available).

Figure 15:
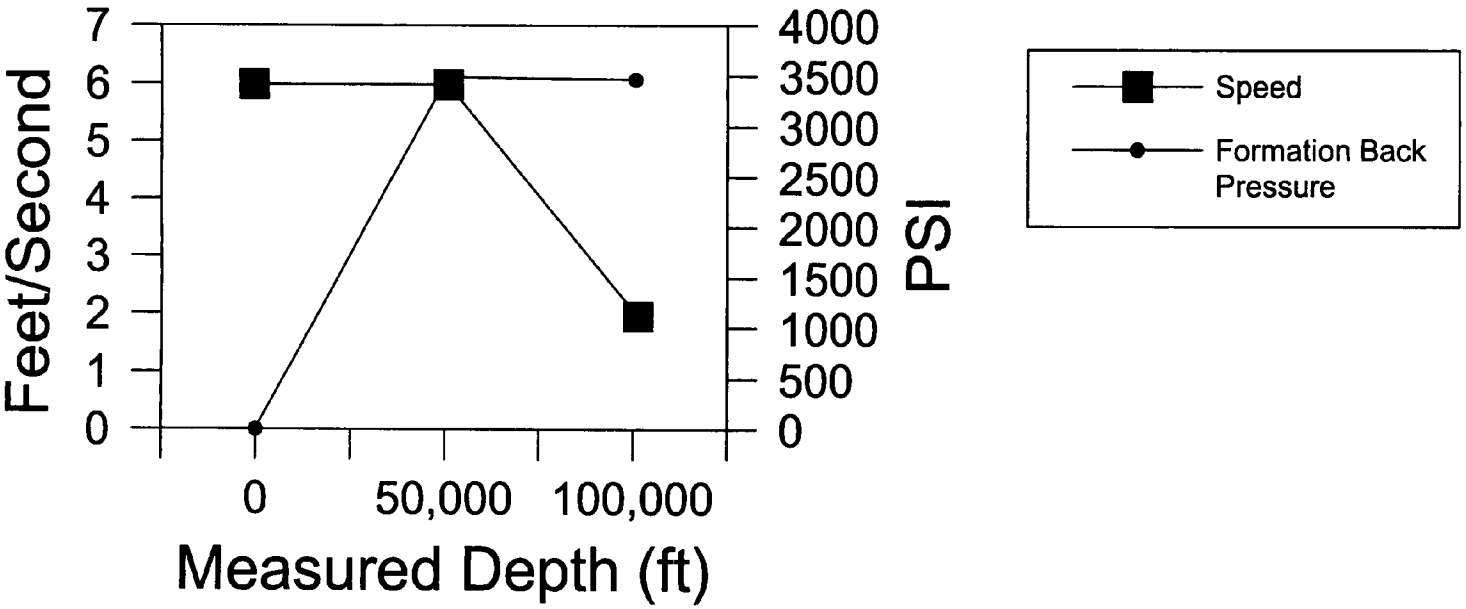
FIG. 15 shows various parameters related to tripping the Subterranean Electric Drilling Machine and the expandable casing into the well.

FIG. 15 shows various parameters related to tripping the Subterranean Electric Drilling Machine and the expandable casing into the well. A 20 mile well is on the order of 100,000 feet. At this distance, and at 2 feet per second, the formation back pressure is 1000 PSI.

Tripping Out of the Well

The Subterranean Electric Drilling Machine 94 is tripped from the well with cuttings filled mud within the umbilical. Sufficient mudflow is pumped down the annulus between the umbilical and the uphole casing to fill the entire cased wellbore below the drilling machine. The maximum pressure the pump will provide this annulus is 5000 psi and at a 20 mile offset, the volume is limited to approximately 440 gallons per minute or a drilling machine trip speed of approximately 2.4 fps. Simultaneously, the surface linear umbilical traction unit pulls at approximately 12,500 lbs (to overcome the fluid flow drag upon the umbilical, the frictional umbilical drag and the frictional drag of the Subterranean Electric Drilling Machine and its seals).

As the Subterranean Electric Drilling Machine moves up the wellbore and the annular fluid pressure losses become less, the maximum mud pump pressure no longer limits the trip speed. The limiting factor then becomes the mud volumes, which the mud pumps may provide. For these tripping purposes, a third surface mud pump may be used in another preferred embodiment. It will support higher speed trips and provide redundancies during other operations.

Since all of the mud volumes pass through the downhole mud pump, an accurate metering of the mud volume and pressures is obtained throughout the trip. This keeps pressure off the open formation during trips out of the wellbore.

Surface Mud System

A large volume of working mud is needed to manage the umbilical volume while tripping in the hole. For 20-mile offset operations, an active mud tank volume of 3500 barrels may be required. This is similar in capacity to those used in some large offshore drilling rigs.

In one preferred embodiment, the installed casing is 8.5 inches ID, and the umbilical is a 6 inch OD umbilical with a 4.5 inch ID. During drilling operations, the maximum mud flow rate is 150 gallons per minute with a pressure drop of 825 pounds per square inch, which includes frictional losses only. During tripping out of the hole at 2.4 feet per second, the maximum mud flow rate is 422 gallons per minute with a pressure drop of 4,750 pounds per square inch. During running in the hole with casing at 2 feet per second, the maximum mud flow rate is 350 gallons per minute, with a pressure drop of 3600 pounds per square inch (with cement sealed on the bottom of the well).

Thus, for the tripping out of the well, a minimum of two 750 hp surface mud pumps would be required. One pump is adequate for routine drilling operations. When the Subterranean Electric Drilling Machine is at a distance of 20 miles, approximately 14 hours are required to run into the hole, 12 hours are required to come out of the hole, and 11 hours are required for cuttings to circulate from the bottom of the hole to the surface. Therefore, accurate monitoring and management of mudflow and quality into and out of the well and umbilical both at the surface and downhole at the drilling machine is important for reliable well control.

The Drilling Operation

When the subterranean drilling rig reaches the bottom of the hole, the high-speed bit may encounter cement within the bore of the cased hole. The anchor means 144, 146, 148 and 150 as shown in FIG. 6 are engaged, mud circulation started and the bit is rotated. Notice that downhole sensors monitor mudflow composition parameters to minimize circulation time for conditioning the hole. Weight on bit is applied and drilling moves forward out of the previously cased hole. Traditional steering mechanisms and MWD tools are used to guide forward progress of the bit through the formation. Directly behind this BHA is the unexpanded casing.

The mudflow rates and the cutting solids this flow rate can transport out of the hole will limit drilling progress. For example, a drilled 12½ inch ID hole and a 4½ inch ID umbilical having an internal mud velocity of 3 feet per second carrying 6.5% solids will have a maximum penetration rate of 90 ft/hr.

Significant information will be monitored and communicated real time to the surface for control of the operations. Some of the information includes:

(a) Weight on bit
(b) Penetration rate
(c) Bit RPM
(d) Bit power (determined from power consumed by the downhole electric motor 114 of the subterranean drilling machine)
(e) Mud flow rate through bit (by monitoring throughput of the progressing cavity pump 180)
(f) Differential mud pressures across bit and to surface across umbilical
(g) Mud quality sensors for entrained gas, cuttings loading, etc.
(h) Mud temperatures
(i) Basic operating parameters of the various Subterranean Electric Drilling Machine functions that include voltage, power, RPM, pressure, temperature, axial load in umbilical at the pump, etc. are all monitored in real time to verify equipment status.

This monitoring will provide for efficient control of the downhole drilling operation. If additional information is required, in one preferred embodiment additional instrumentation or tools may be included in the umbilical at the various connection points (approximately every 5 miles). In one preferred embodiment, it is preferable to have remotely operated downhole BOP's. These devices are packer-like assemblies, which when inflated, anchor to the inside of the casing. An internal valve provides a well fluid isolation point.

This extensive monitoring capability allows drilling operations to use under-balanced fluids, if beneficial to the well program. This equipment capability also allows for direct well control and production testing through the drilling machine.

When the well has drilled forward to the casing point, pressuring the setting tool included in the Subterranean Electric Drilling Machine sets the expandable casing hanger. The success of the hanger setting operation may be load tested with the downhole hoist (which when used in this application is also called a "weight on bit mechanism"). Upon verification of a successful operation, the Subterranean Electric Drilling Machine releases from the casing and starts its trip from the well. This will leave the well ready for casing cementing and casing expansion.

During all operations in a wellbore, the umbilical is maintained under tension between the downhole tools and the surface equipment. This permits rapid transit in the wellbore by preventing buckling. A constraint is that a minimum number of gentle bends should be included in the wellbore design. This constraint is similar to familiar drill pipe and coiled tubing operational constraints in current well operations. Selected means to provide such tension are shown in FIG. 5. The tension is monitored with computer system 26 in FIG. 5.

Several contingency operations are reviewed to illustrate the capabilities of the subterranean electric drilling system.

The Subterranean Electric Drilling Machine can control the well and can control a well "kick", or well kicks. In one preferred embodiment, the well uses a reverse circulation system. The first mud cuttings and bypass port (MCBP) 164 and the second mud cutting and bypass port 166 in of the Subterranean Electric Drilling Machine act as a packer within the well directing all returns to the umbilical. The umbilical has sufficient pressure rating to contain any kick and allow it to be circulated from the well. Instrumentation monitoring mud conditions downhole should provide early indication of developing well control problems.

The Subterranean Electric Drilling Machine can survive n open hole collapse. The well is drilled with unexpanded casing over the drilling work string (that is element 125 in FIG. 6). Should the formation collapse on the casing, the Subterranean Electric Drilling Machine is withdrawn through the unexpanded casing. The casing may subsequently be expanded and drilling operations resumed.

The Subterranean Electric Drilling Machine can survive a downhole blackout of power. Assume the failure is in the power transmission or control system during a tripping operation. The umbilical and surface traction winch have sufficient power to pull the dead equipment from the wellbore. Surface pumps would continue to provide mud for displacement replacement. With care, mud pressure below the Subterranean Electric Drilling Machine may be used to reduce the load required to pull the machine from the well.

If the failure occurs when the drilling machine is anchored and making hole, then a release between the downhole mud pump and the anchor means of the drilling machine is actuated. That disconnect occurs between the female side of universal mud and electrical connector 176 and the male side of universal mud and electrical connector 178 as shown in FIG. 6. In one preferred embodiment, the release may be triggered with an "over-pull" or operation may be via pumping a dart or ball down the umbilical. Once the release is actuated, the drilling machine controls, and mud pump assembly may be pulled "dead" from the well. Once the fault is isolated and repaired, the recovered equipment is run back into the well where it connects with the drilling equipment left in the hole. The Smart Shuttle portion of the subterranean electric drilling makes this reconnection. Regaining control of the equipment allows either drilling operations to proceed or for the equipment to be recovered from the well.

The Well Construction Process

Drilling and casing operations in the preferred embodiment is a two-trip process. The drilling equipment defined above (the Subterranean Electric Drilling Machine) is used to drill the hole, position and anchor the casing (but not expand it) within the hole. The casing is left in position ready for cementing operations (if required) and casing expansion to its final installed dimension is accomplished with the use of a second tool system (the Subterranean Liner Expansion Tool).

In this preferred embodiment, the new expandable casing is 3,000 feet long, 54 lbs/ft, and has an unexpanded OD of 8.0 inches OD. The downhole casing hanger and the casing string are then suspended from the surface rig floor. The bottom hole assembly (BHA) is then made up and run into the casing string. In one preferred embodiment, the centralizing casing hanger setting tool is used to lock the casing and drilling equipment together. Next the rotary motor and the anchor mechanism are added to the assembly together with the downhole mud pump that may be used as a Smart Shuttle.

This described equipment is all long and heavy. It is handled as major assemblies with quick connection devices between each assembly. The estimated size and weight of various components appear below in the following.

The bit is about 2 feet long, and weighs 500 lbs in air. The MWD tools are 40 feet long and weigh about 1,200 lbs in air. The rotary steering tool is about 30 feet long, and weighs 1,500 lbs in air. The rotary shaft (element 125 in FIG. 6) also called the "drilling work string" or simply "drill pipe", is about 3,000 feet long and weighs 28,500 lbs in air. The expandable casing has a weight of 54 lbs/ft, is about 3,000 feet long, and weighs 162,000 lbs in air. The rotary section and anchor section of the Subterranean Electric Drilling Machine (that includes elements 114, 140 and 142 in FIG. 6) is about 120 feet long and weights 2,800 lbs. The downhole mud pump section of the Subterranean Electric Drilling Machine (including elements 180, 196, and 214 in FIG. 6) is about 122 feet long and weighs about 3,900 lbs in air. Any separate control module associated with the Subterranean Electric Drilling Machine is about 20 feet long and has a weight of 4,000 lbs. So, the total length of the assembly is about 3,334 feet long that weighs about 200,800 lbs in air.

Cementing and Expanding the Casing

In this preferred embodiment of the invention, Subterranean Liner Expansion Tool 284 in FIG. 10 installs the cement and expands the monobore casing in the well. This approach was selected to simplify the Subterranean Electric Drilling Machine and to provide operational flexibility when performing these monobore well construction operations.

The Subterranean Liner Expansion Tool has two basic functions. The first is to cement the casing in the well (if required). In one embodiment, this is accomplished through a 2 inch cementing line in a 3½ inch OD umbilical. Unlike the Subterranean Electric Drilling Machine when attached to casing, the Smart Shuttle at speeds up to 10 feet per second pulls this umbilical into the well. The Smart Shuttle operation of the liner expansion tool requires that the inflatable cement seal 330 is collapsed, and then fluids are pumped from the downhole side of the Smart Shuttle® seal 210 to the uphole side of that seal as has been previously described. To cement the well, inflatable cement seal 330 is inflated. This cement seal is also called a straddle seal (with one side being inflatable) on the tool's outside diameter that ensures the fluid connection between the umbilical and the cement ports in the casing hanger. Once the tool is in place, cement is circulated into the annulus space behind the unexpanded casing. Adequate instrumentation monitors cement placement, volume and Smart Shuttle location and reports all of these monitored parameters to the surface.

The second function of the Subterranean Liner Expansion Tool is to expand the casing to its final operating size. The roller mechanisms for this task have already been described in relation to FIG. 10. Rollers provide power, control and reversibility. If the casing were expanded with internal pressure, it would lack any expansion control—for example, if the hole diameter were irregular, then the casing expansion would be irregular as well. Expansion dies have the problem of being a one shot, one size expansion process. Internal casing rollers have experience in buckled casing repair tools and in anchoring casing inside Unibore wellheads. Weatherford has developed a one step expansion tool for expanding casing that is featured on their website. Weatherford International, Inc. may be reached at 515 Post Oak Blvd, Suite 600, Houston, Tex. 77027, having the telephone number of (713) 693-4000, that has the website of www.weatherford.com. In FIG. 10, the counter-rotating roller casing expander tool 288 has contra-rotating rollers to minimize the tool's torque that has to be externally reacted while expanding the casing. The longitudinal rollers 318 and 320 in FIG. 10 provide for this torque reaction. As previously described, a downhole motor powered with a separate electrical circuit from the surface provides the necessary rotary power.

In a preferred embodiment, the surface equipment is similar in arrangement to the drilling machine system. However, this equipment may be smaller as the umbilical OD may be chosen to be 3½ inches OD.

As described earlier, in one mode of operation of the Subterranean Electric Drilling Machine, it acts like a Smart Shuttle. The Smart Shuttle will be used to pump the umbilical and the Subterranean Liner Expansion Tool to the downhole worksite. The Smart Shuttle works by pumping fluid from one side of the seals to the other with an electric powered progressive cavity pump (PCP) (or any positive displacement pump). At relative low differential pressures, large axial forces (approximately 4,000 lbs net) are generated that are sufficient to pull the tool and umbilical into the hole. Top-hole speeds are the maximum design speed of 10 fps. At extreme offsets, the speed will be slower (2.5 feet per second) due to fluid drag force on the umbilical, which will be proportional to the transit speed.

The Smart Shuttle system is equipped with sensors to detect location and to easily position the tools straddle seals across the casing hanger of the last casing string. Once in position, the inflatable seal is inflated and circulation through the hole-casing annulus is confirmed. This may be accomplished by pumping from the surface or by using the Smart Shuttle pump to circulate the area. Cement will be spotted into the annulus and the casing will be expanded prior to the cement hardening.

FIG. 10 illustrates the Subterranean Liner Expansion Tool with cement being injected from the surface through the umbilical. Approximately 69 gallons per minute will flow at 100,000 ft with a pressure loss of about 9,000 pounds per square inch. Thus, the cementing pump will have to deliver at 10,000 pounds per square inch at these rates. It will require 240 minutes for the cement to be delivered at 100,000 ft from the surface and then another 77 minutes to spot approximately 126 barrels of cement into the hole-casing annulus space. When operating at these large offsets, managing the setting time of the cement and the required volume of cement is important.

Tracers may be added to the fluid pads before and following the cement as it is pumped into the umbilical. Sensors located on the Subterranean Electric Drilling Machine will verify when the cement is passing these downhole sensor locations. This will help accurately spot cement into the well. Once the cement is out of the umbilical, a bypass valve is opened and mud is circulated through the annulus to clear the umbilical.

Some casing may not require to be cemented into the hole. It may be possible that the casing can be expanded into the wall of the hole with sufficient pressure that the residual contact stress between the rock and expanded casing are sufficient to form an axial fluid seal. This avoids the cementing step and simplifies operations. However, it places a significant load upon the casing expansion rollers.

Once the cement is in position within the hole-casing annulus, the inflatable cement seal 330 is deflated and the Smart Shuttle pulls the expansion tool back into the previously cased wellbore. The counter-rotating roller casing expander tool is energized, and its roller engage the casing ID by expanding until contact with the casing is established. Rotation of the rollers is begun and the tool slowly moves forward. Forward motion is provided by the slight canted angle of the rollers, which screw the expander into the casing hanger and pipe. This canted angle is shown as the angle θ in FIG. 10. In one preferred embodiment, the counter-rotating roller casing expander tool has sufficient strength to expand the casing hanger and the previously set casing back into the formation to provide a smooth casing ID. This process is illustrated in FIGS. 12 and 13. FIG. 12 shows the casing hanger area prior to tool's passage and FIG. 13 illustrates this same region after the tool has passed. The Subterranean Liner Expansion Tool has to have sufficient strength to expand the two casing strings back into the formation rocks.

The Subterranean Liner Expansion Tool continues expanding the casing to the bottom of the string. The process of expanding the casing will reposition the cement that is in the annuli. It will be extruded along the reducing annuli until the cement reaches the end of the casing where excess will flow into the uncased hole below the expansion machine. Once the casing has been fully expanded, the rollers of the Subterranean Liner Expansion Tool are collapsed to their small transport size and the Smart Shuttle and surface traction winch are used to bring the tool to the surface. This leaves the hole ready for the next drilling cycle.

Drilling and monobore casing operations continue until the well reaches the target reservoir. It is then possible to drill lateral drainholes (using a similar process) or a single large bore completion may be made.

There are various methods to handle contingencies with the Subterranean Liner Expansion Tool. Similar to the Subterranean Electric Drilling Machine, considerable flexibility exists in the cementing and expansion tool concepts to handle most contingencies. A few of these contingencies illustrate this capability.

Suppose the power to the Subterranean Liner Expansion Tool is cut off during a tip into the well. A bypass valve around the Smart Shuttle pump will open and allow the tool to be pulled from the wellbore using the surface linear winch and the strength of the umbilical. Alternatively, in some wells, it may be possible to pump mud down the cement line in the umbilical and apply pressure below the Smart Shuttle to assist in its retrieval.

Suppose there is a loss of power with cement in the umbilical. Then, a downhole bypass valve will open connecting the umbilical bore with the cased well annulus.

Mud pumps may then be used to flow the cement to the surface. Suppose the Subterranean Liner Expansion Tool fails without expanding the entire casing string. The tool is then recovered and the cement in the well annulus is assumed to harden. The next drilling operation will be to mill out of the wellbore and sidetrack to resume drilling to target.

Suppose the expansion strength of the Subterranean Liner Expansion Tool is not sufficient to expand the casing hanger to a full bore ID. The Subterranean Liner Expansion Tool has the capability of operating at various diameters. It will expand the casing to gage diameter where ever possible. Some areas, (like the casing hanger area) may not achieve gage—especially if the formation is exceptionally hard/strong. The under gage diameter is not desirable, but not a significant problem as all of the tool systems should pass through this reduced diameter. Should it not be possible to achieve the minimum gage diameter, then a mill may be used to increase inside diameter as a last resort.

Casing Flotation Techniques

Casing flotation techniques may be used to dramatically reduce the well annuli pressure required to pump casing into the well or reduce the required downhole hoist capacity. Air or nitrogen may be enclosed within the casing at the surface to reduce its apparent weight in mud during running operations. Once on bottom, the near buoyant casing would be flooded and filled with mud so that operations as previously described would continue. This and other related weight saving concepts have the potential to reduce the well annuli running pressure or downhole hoist capacity by 90% as compared to the loads identified above in the section entitled "The Well Construction Process". This capability allows much longer and/or heavier strings of casing to be optionally run.

Casing flotation techniques will not have an impact upon the umbilical's design criteria. The umbilical's internal working pressure defines its required axial strength. A 10,000 psi internal pressure for well control requires an umbilical axial load strength of approximately 160,000 lbs to resist the surface pressure effects.

Alternative Embodiments of Drilling Systems

In FIG. 6, first anchor and weight on bit mechanism (AWOBM) 140 and second anchor and weight on bit mechanism (AWOBM) 142 are an example of "anchors" or "anchor means". In the following summary, the term "Anchor Means" may be capitalized.

In FIG. 6, the expandable casing 126 is being "pushed" deeper into the wellbore by the anchor means. Therefore, this configuration is called a "Drill & Push" configuration. In this situation, the anchor means are on the uphole side of the Subterranean Electric Drilling Machine. On the other-hand, if the anchor means were instead on the downhole side of the Subterranean Electric Drilling Machine, then this configuration would be called a "Drill & Drag" configuration.

In FIG. 6, the anchor means are located on the inside of the previously installed borehole casing 96. In this configuration, the anchor means are located within the "Wellbore". On the other-hand, if the anchor means are instead located within the new borehole 104, then the anchor means are located in the "Open-Hole".

In FIG. 6, the downhole electric motor 114 rotates the rotary shaft 125 that is also called the "drilling work string" or simply the "Drill Pipe". In FIG. 6, the downhole electric motor rotates the Drill Pipe. Therefore, the "rotary means", in FIG. 6 is described by the following: "Rotates Drill Pipe". In FIG. 6, the expandable pipe 126 is not rotated. However, there are other configurations of the rotary means including: "Rotates Drill Pipe and Casing", and "In Open Hole Rotates Bit". In the below defined list of different preferred embodiments, the term "rotary means" is capitalized as "Rotary Means".

In FIG. 6, the expandable casing 126 is not rotated. Therefore, in this configuration, the expandable casing is "Non-Rotating". In other preferred embodiments, the expandable casing can be rotated by the rotary means. In this configuration, the expandable pipe is "Rotated".

In FIG. 6, the progressing cavity pump 180 is driven by a downhole pump motor assembly generally designated by element 182 that comprises the mud pump, or "Mud Pump" in FIG. 6. In this preferred embodiment, the Mud Pump is located within the Wellbore.

Accordingly, the preferred embodiment shown in FIG. 6 can be described as follows (Preferred Embodiment "A"):

Arrangement: Drill & Push
Anchor Means In Wellbore
Mud Pump In Wellbore
Rotary Means Rotates Drill Pipe
Expandable Casing Non-Rotating
Comments: Preferred Embodiment shown in FIG. 6.

Accordingly, another preferred embodiment of the invention may be succinctly described as follows (Preferred Embodiment "B"):

Arrangement: Drill & Push
Anchor Means: In Wellbore
Mud Pump: In Wellbore
Rotary Means: Rotates Drill Pipe and Expandable Casing
Expandable Casing: Rotating
Comments: This requires higher rotary torque than Preferred Embodiment "A".

Accordingly, another preferred embodiment of the invention may be succinctly described as follows (Preferred Embodiment "C"):

Arrangement: Drill & Drag
Anchor Means: In Open Hole
Mud Pump: In Wellbore
Rotary Means: In Open Hole, Rotates Drill Bit
Expandable Casing: Non-Rotating, Drags Behind Anchor Means
Comments: This requires stable formations for Open Hole Anchor Means.

Accordingly, another preferred embodiment of the invention may be succinctly described as follows (Preferred Embodiment "D"):

Arrangement: "Drainhole Drilling"
Anchor Means: In Wellbore
Mud Pump: In Wellbore
Rotary Means: Rotates Drill Pipe
Expandable Casing: Non-Rotating
Comments: Similar to Preferred Embodiment "A", except smaller diameters of expandable casing used.

In the above, Preferred Embodiment "C" is further described in the following document: U.S. Disclosure Document No. 494374 filed on May 26, 2001 that is entitled in part "Continuous Casting Boring Machine", an entire copy of which is incorporated herein by reference.

In the above, Preferred Embodiment "D" is further described in the following document: U.S. Disclosure Document No. 495112 filed on Jun. 11, 2001 that is entitled in part "Liner/Drainhole Drilling Machine", an entire copy of which is incorporated herein by reference.

The Subterranean Electric Drilling Machine has been illustrated performing hydrocarbon drilling applications. However, there are other preferred embodiments of the invention. The Subterranean Electric Drilling Machine has the capability of performing directional drilling over large distances both onshore and offshore. This includes drilling pipelines under large and deep rivers, across large topographical features like cliffs or subsea escarpments. Other applications for the Subterranean Electric Drilling Machine include near surface drilling in urban areas for installation or replacement of utilities like water lines, gas mains, sewers, storm drains, underground power lines, and communication lines, including broadband cables and fiber optic cables. The selected drill bit would be sized for the application. These preferred embodiments are not further described herein in the interests of brevity.

Figure 16:
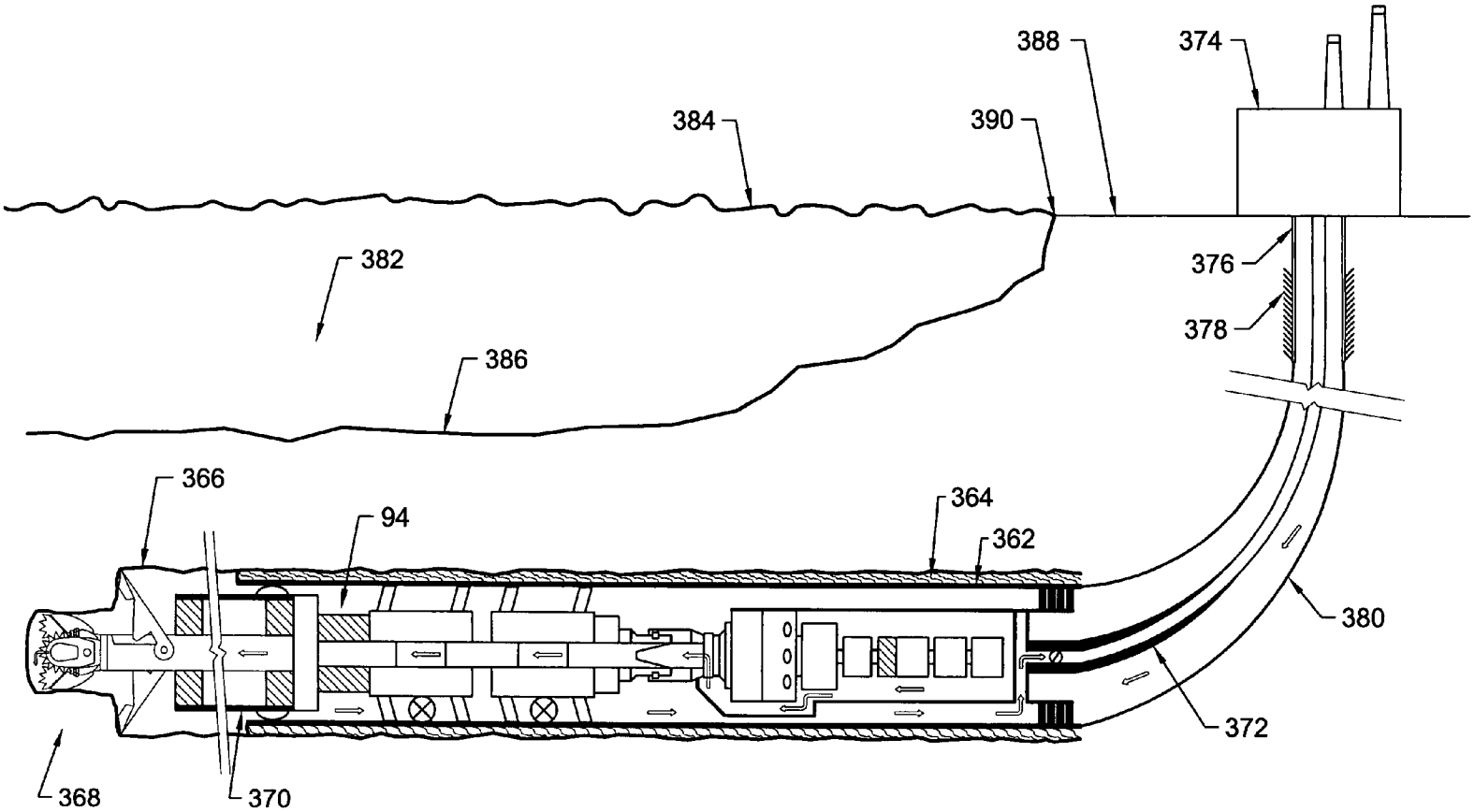
FIG. 16 shows a Subterranean Electric Drilling Machine boring a new borehole under the ocean bottom from an onshore wellsite.

FIG. 16 is similar to FIG. 9, except here the well is being drilled from an onshore wellsite. Subterranean Electric Drilling Machine 94 is disposed within a previously installed borehole casing 362 that is surrounded by existing downhole cement 364. The Subterranean Electric Drilling Machine 94 was described in relation to FIG. 6. The Subterranean Electric Drilling Machine is in the process of drilling a new borehole 366 into geological formation 368. Expandable casing 370 is carried into the new borehole by the Subterranean Electric Drilling Machine. Umbilical 372 connects the Subterranean Electric Drilling Machine to a land-based drill center 374 that has the hoist, the computer systems, the umbilical carousel, etc. Surface casing 376 is surrounded by cement 378. The bottom of the surface casing is connected to previously installed casing 362 by casing string 380. The ocean 382 has ocean surface 384 and ocean bottom 386. Here, the new borehole is being drilled beneath the ocean from a land-based drill center. The land 388 joins the ocean at a beach 390.

Figure 17:
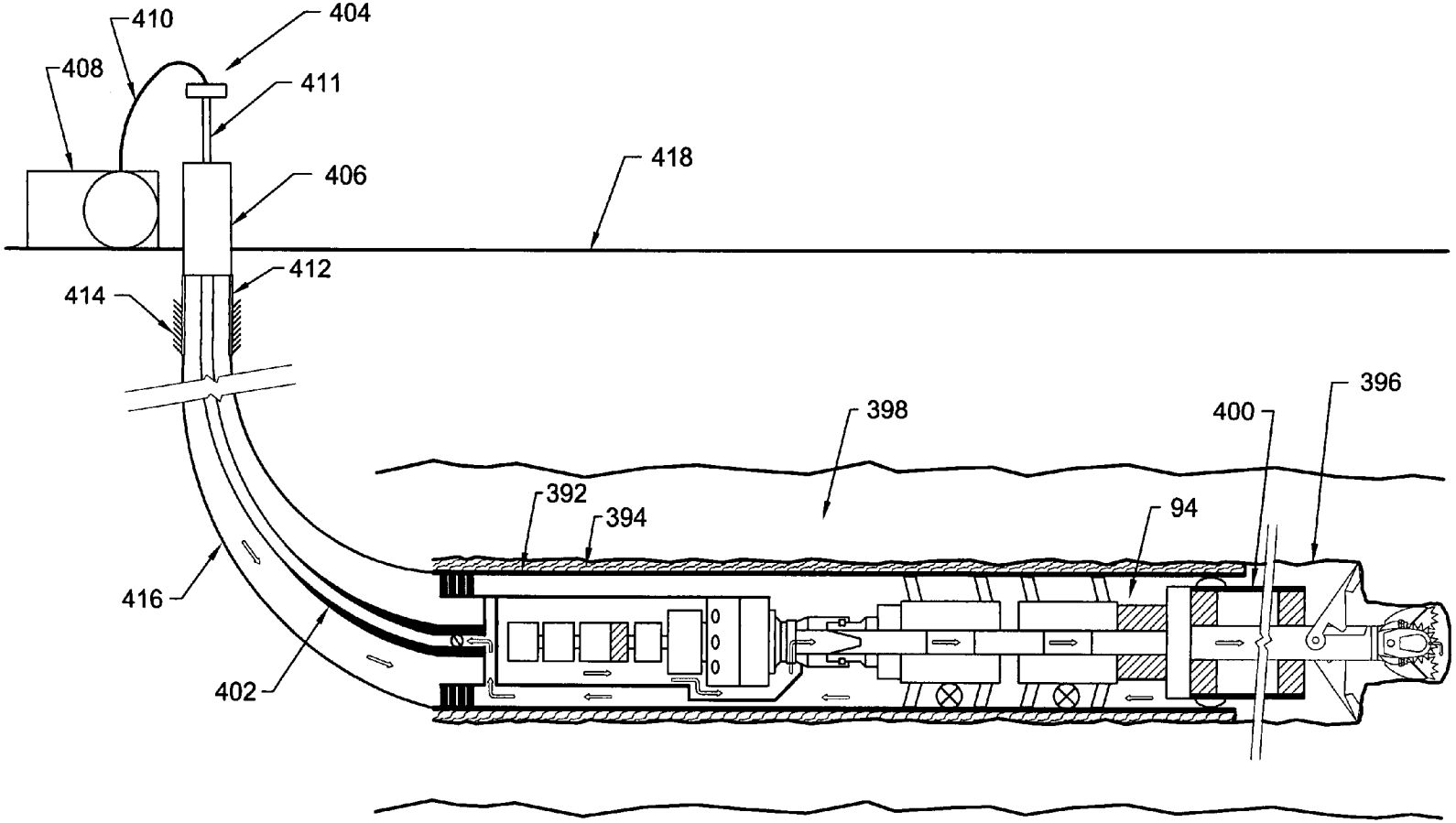
FIG. 17 shows a Subterranean Electric Drilling Machine boring a new borehole under the earth from a land based drill site.

FIG. 17 is similar to FIG. 9 and FIG. 16, except here the well is being drilled from a land based drill site. Subterranean Electric Drilling Machine 94 is disposed within a previously installed borehole casing 392 that is surrounded by existing downhole cement 394. The Subterranean Electric Drilling Machine 94 was described in relation to FIG. 6. The Subterranean Electric Drilling Machine is in the process of drilling a new borehole 396 into geological formation 398. Expandable casing 400 is carried into the new borehole by the Subterranean Electric Drilling Machine. Umbilical 402 connects the Subterranean Electric Drilling Machine to the land based drill site generally designated by element 404. Shown figuratively are hoist 406; the umbilical carousel, computers, etc. 408; and another section of umbilical 410. Element 411 figuratively shows a lubricator. Surface casing 412 is surrounded by cement 414. The bottom of the surface casing is connected to previously installed casing 392 by casing string 416. The surface of the earth is identified by element 418.

Figure 18:
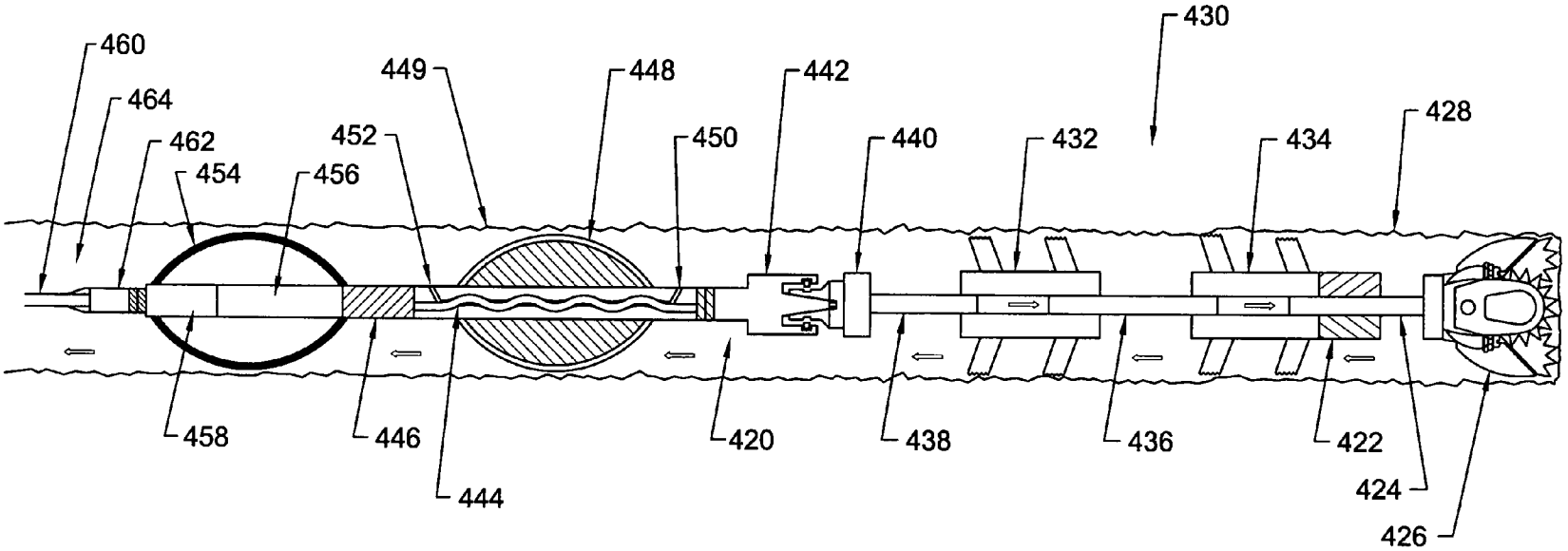
FIG. 18 shows an open hole Subterranean Electric Drilling Machine that is drilling an open borehole in the earth.

FIG. 18 shows a Subterranean Electric Drilling Machine 420 that is drilling an open borehole in the earth. Element 420 is called an open hole Subterranean Electric Drilling Machine. Electric motor 422 turns shaft 424 that rotates the rotary drill bit 426 that drills borehole 428 in geological formation 430. First anchor and weight on bit mechanism (AWOBM) 432 is connected to second anchor and weight on bit mechanism (AWOBM) 434 by extensible shaft 436, which elements comprise an anchor mechanism. Shaft 438 connects the female side of universal mud and electrical connector 440 to the male side of universal mud and electrical connector 442. Progressing cavity pump 444 is driven by its pump motor 446. Inflatable seal 448 surrounds the progressing cavity pump that makes a positive seal against the borehole wall of geological formation 449. The progressing cavity pump has inlet 450 and outlet 452. The inflatable seal 448 and the progressing cavity pump form a Smart Shuttle that can be used to move the open hole Subterranean Electric Drilling Machine shown in FIG. 18 in and out of the hole. Centralizer 454 is attached to the portions of the tool body having electronics 456 and bidirectional communications 458 with the surface. Mud carrying umbilical 460 is connected to the cable head 462 that provides electrical power and mud to the open hole Subterranean Electric Drilling Machine. Mud from the surface through the umbilical proceeds down the interior of various elements of the drilling machine that are not shown for simplicity, and then mud laden cuttings return to the surface through the annulus 464 between the borehole wall and the outside diameter of the umbilical. The arrows in FIG. 18 show the direction of mud flow. The inflatable seal 448 surrounding the progressing cavity pump is partially collapsed during actual drilling operations to allow the mud to pass. The inflatable seal 448 is inflated when quickly transporting the open hole subterranean electric drilling in and out of the well. In view of the detailed description provided in FIG. 6 and elsewhere, and in view of the description herein, it is now evident how the open hole Subterranean Electric Drilling Machine functions. Accordingly, no further detail will be presented here in the interests of brevity.

Figure 19:
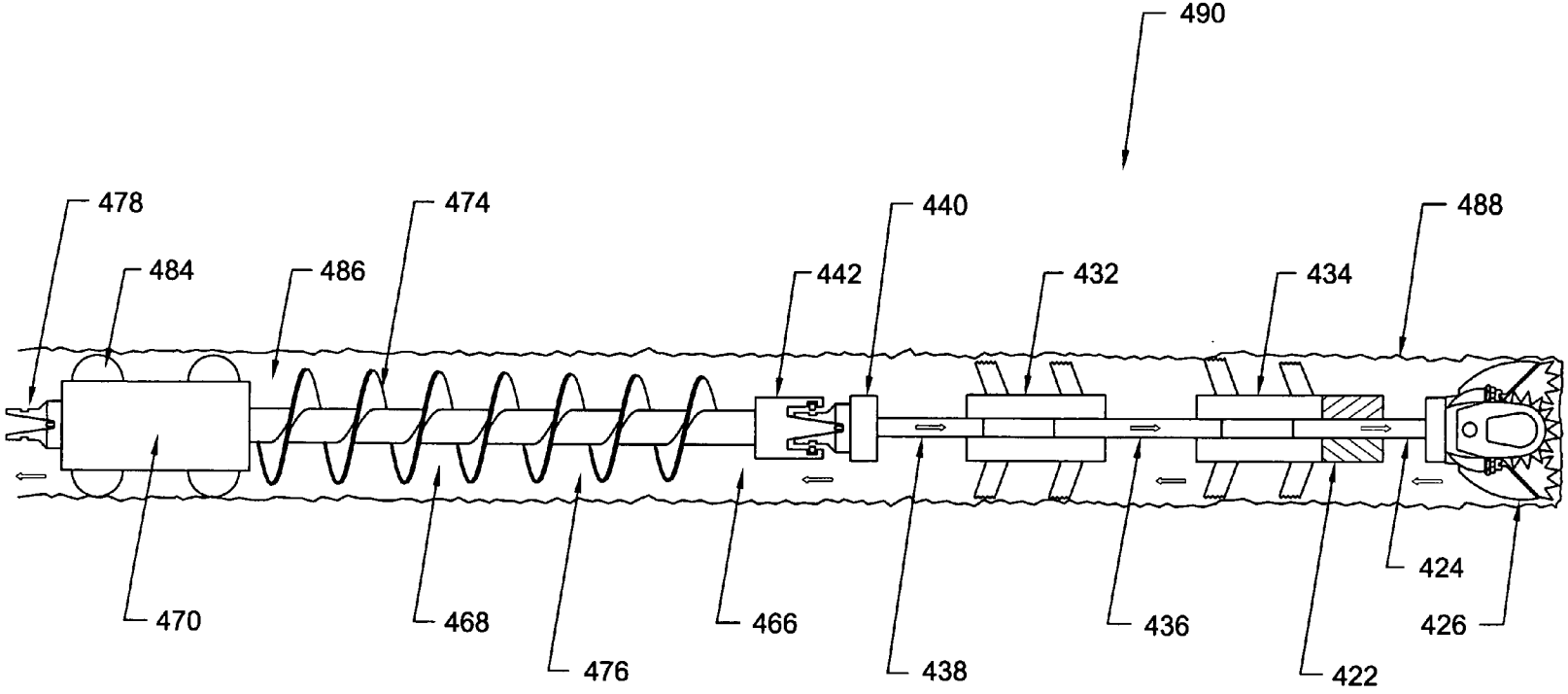
FIG. 19 shows screw drive Subterranean Electric Drilling Machine that is drilling an open borehole in the earth.

FIG. 19 shows another Subterranean Electric Drilling Machine 466 that is drilling an open borehole in the earth. Element 466 is another embodiment of an open hole Subterranean Electric Drilling Machine called a "screw drive subterranean electric drilling machine". FIG. 19 is similar to FIG. 18. Elements 422, 424, 426, 432, 434, 436, 438, 440 and 442 have been defined in relation to FIG. 18.

The fundamental change in FIG. 19 is that the form of the Smart Shuttle shown in FIG. 18 has been replaced by the screw translator device 468. Element 470 has an electric motor 472 (not shown for simplicity), related electronics, and bidirectional communications electronics. When electric motor 472 rotates the screw blades 474, then friction against the mud in the hole 476 causes the screw translation device 468 to translate within the hole (if the anchor means of elements 432 and 434 are in their retracted positions). Reversing the rotation of the screw blades reverses the direction of translation within the borehole. The female side of universal mud and electrical connector 478 is attached to the male side of universal mud and electrical connector 480, that is in turn connected to umbilical 482, however, elements 480 and 482 are not shown in FIG. 19 for the purposes of simplicity. Centralizers 484 centralize element 470 within the wellbore 486. The arrows show the path of the mud flow during drilling operations. In view of the previous disclosure, it is evident how the screw drive subterranean electric drilling machine is used to drill the new borehole 488 in the geological formation 490.

In another preferred embodiment in FIG. 19, the screw blades 474 have a variable pitch, where the distance between successive blades is a smaller distance to the right-hand side of FIG. 19 than to the left-hand side of FIG. 19. In yet another preferred embodiment, the pitch between the screw blades 474 is variable and controlled by the surface computer system 26. Various embodiments of the "screw drive subterranean electric drilling machine" are further described in U.S. Disclosure Document No. 494374 filed on May 26, 2001, that is entitled in part "Continuous Casting Boring Machine", an entire copy of which is incorporated herein by reference.

Umbilicals

Figure 20:
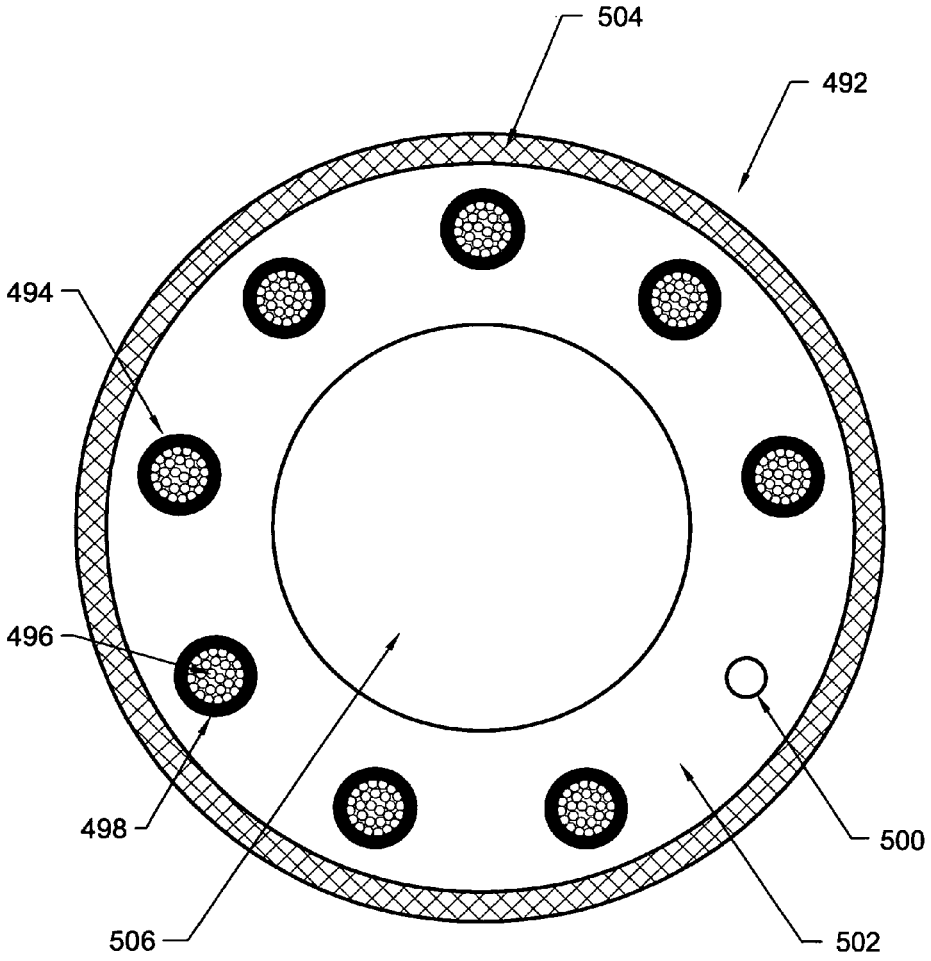
FIG. 20 shows a cross section of another embodiment of an umbilical used for subterranean electric drilling machines, for open hole subterranean electric drilling machines, and for other applications.

FIG. 20 shows a cross section of another embodiment of an umbilical used for subterranean electric drilling machines and for open hole subterranean electric drilling machines. A version of FIG. 20 was originally filed in the U.S.P.T.O. on the date of Oct. 2, 2000 as a portion of U.S. Disclosure Document 480550. Umbilical 492 contains at least one insulated electrical conductor 494. Each such conductor has electrical copper conductors 496 encapsulated by electrical insulation 498. As shown in FIG. 20, there are a total of 8 such insulated electrical conductors. In one embodiment, the insulated electrical conductors may be chosen to be the same as shown in FIG. 1. Also shown is high speed bidirectional data communications means 500, which may be a fiber optic cable or a coaxial cable. The insulated electrical conductors and the high speed bidirectional data communication means is encapsulated by first composite material 502. Second composite material 504 surrounds first composite material. As described above, the specific gravities of composite materials 502 and 504 may be engineered so that the umbilical 492 is substantially neutrally buoyant in wellbore fluids.

In one preferred embodiment of the invention in FIG. 20, the second composite material 504 is chosen for its good strength, durability against abrasion in the well, and perhaps for its electrical insulation properties. In one embodiment of FIG. 20, the first composite material is chosen so with a particular specific gravity such that the overall umbilical is neutrally buoyant in typical well fluids (in 12 lb per gallon mud, for example, or in salt water, as another example). As previously discussed, syntactic foam materials having silica microspheres as provided by the Cumming Corporation (www.emersoncumming.com) for such purposes. The details on pressure balanced silica microspheres in syntactic foam may be reviewed in Attachment 28 to the Provisional Patent Application No. 60/384,964 filed on Jun. 3, 2002 that is entitled "Umbilicals for Well Conveyance Systems and Additional Smart Shuttles and Related Drilling Systems", an entire copy of which is incorporated herein by reference.

The interior 506 of the umbilical is used to provide drilling fluids or cement downhole as required. Therefore, different embodiments of umbilicals provide electric power downhole, bidirectional communications, and provide the ability to conduct fluids to and from the borehole, which are neutrally buoyant in the fluids present. Umbilicals handling well fluids are also useful with a number of well services including the use with straddle packers, injection tools, oil gas separators, flow line cleaning tools, valves, etc. In another preferred embodiment, the interior 506 may be filled with composite materials to provide extra strength for certain applications that is also substantially neutrally buoyant.

Figure 21:
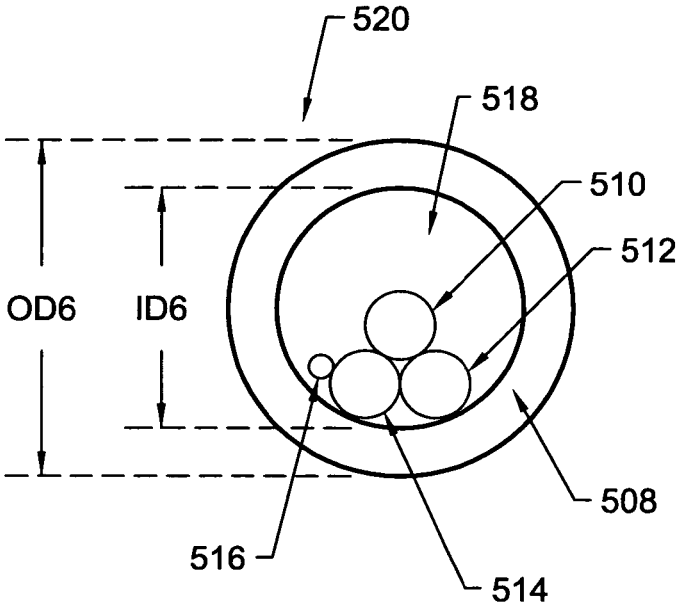
FIG. 21 shows yet another neutrally buoyant composite umbilical in 12 lb per gallon mud.

FIG. 21 shows yet another neutrally buoyant composite umbilical in 12 lb per gallon mud. Outer spoolable composite tubing 508 has an OD shown by legend OD6, and has an ID shown by legend ID6. In a preferred embodiment, OD6 is equal to 1.75 inches O.D., and ID6 is equal to 1.25 inches I.D. In one preferred embodiment, the composite tubing is chosen to have a specific gravity of 1.50.

Three each 0.355 inch O.D. insulated No. 4 AWG Wires 510, 512 and 514 are disposed within the I.D. of the spoolable composite tubing. Optical fiber 516 is also disposed within the spoolable composite tubing. The remaining available volume within the spoolable composite 518 is then filled with pressure balanced silica microspheres in syntactic foam that has a specific gravity of 0.60. A calculation shows that this umbilical in 12 lbs/gallon mud weighs −50 lbs for every 1,000 feet. Assuming a coefficient of friction of 0.2, at 20 miles the umbilical could pull back with a frictional force of 1,056 lbs. So, this umbilical is substantially neutrally buoyant (or simply "neutrally buoyant" as defined below).

In FIG. 21, the insulated wire is rated at 14,000 volts. This particular wire is Part Number FEP4FLEXSC available through Allied Wire & Cable located in Bridgeport, Pa. This wire was previously described in relation to FIG. 1. As is evident from the discussion involving FIG. 1, the three power conductors can provide 160 horsepower (119 kilowatts) at 20 miles to do work at that distance. No fluids are conducted down the interior of this umbilical generally designated by element 520 in FIG. 21. This umbilical is also useful for other applications to be discussed later.

Selecting different specific gravities for the pressure balanced silica microspheres in syntactic foam that fills the volume within the spoolable composite 518 allows different preferred embodiments to be designed to be neutrally buoyant within different well fluids having different densities. As a practical matter, an umbilical having a particular density will be used within a range of acceptable densities of well fluids.

Subsea Well Servicing

Figure 22:
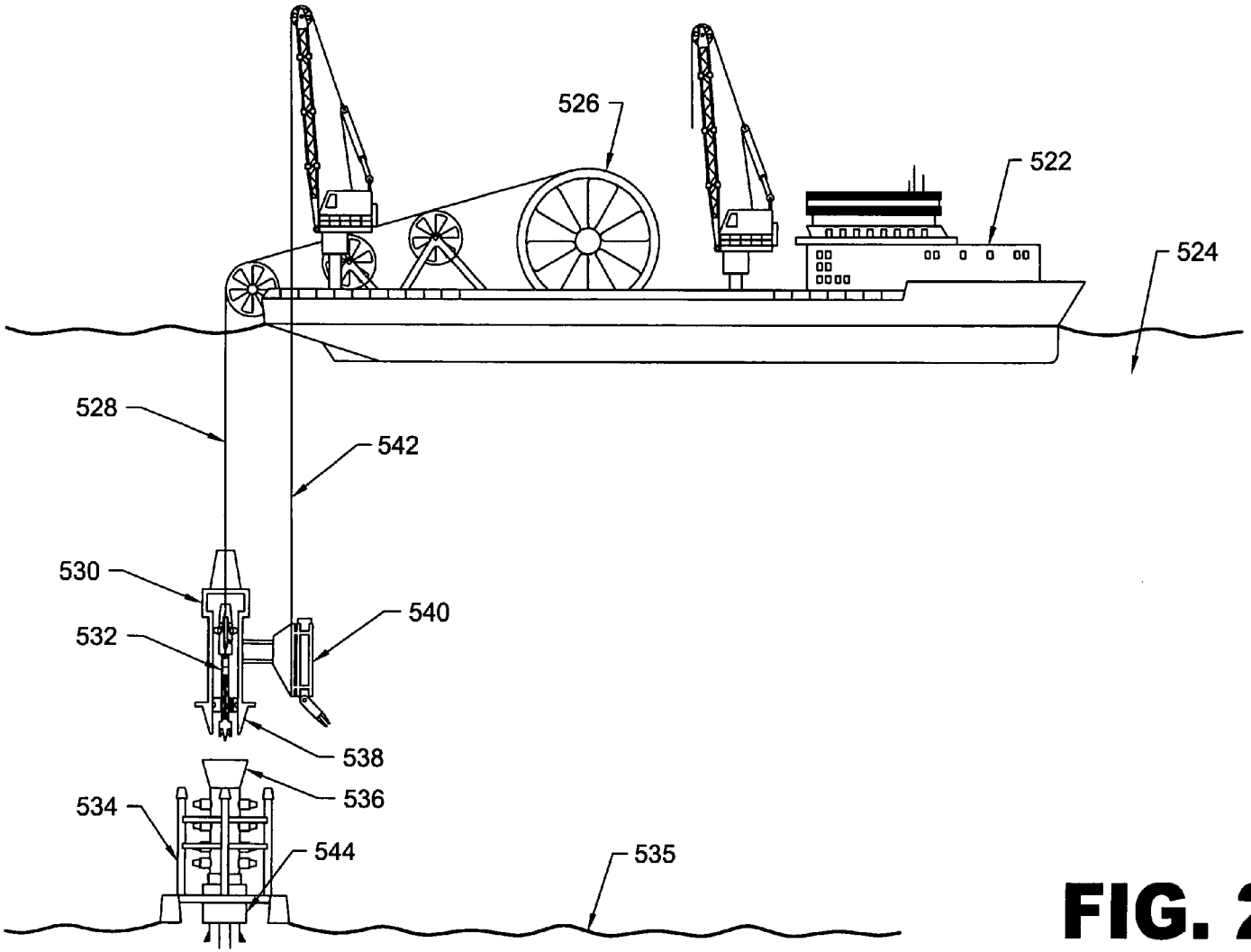
FIG. 22 shows an umbilical providing power in excess of 60 kilowatts and communications to a remotely operated vehicle

FIG. 22 is a schematic drawing that shows a ship performing subsea well servicing. Ship 522 in ocean 524 possesses an umbilical carousel 526 having umbilical 528 that proceeds through lubricator 530 that houses Smart Shuttle 532. Subsea well 534 on the ocean bottom 535 has mating equipment 536 that mates to mating equipment 538 of the lubricator 530. The lubricator is guided into place by remotely operated vehicle 540 obtaining its power and communications from umbilical 542. The umbilical carousel for umbilical 542 is not shown for simplicity.

Upon entering the subsea well, the Smart Shuttle is to proceed through the base of the lubricator 544 and into the wellbore below (not shown in FIG. 22). There, the Smart Shuttle is to perform a well workover that requires fluids to be injected into formation such as acids. Umbilical 528 may be selected to be a suitable umbilical including umbilical 2 in FIG. 1, and umbilical 492 in FIG. 20. Equipment resembling what is shown in FIG. 5 is on board the ship so that a computer system can control the workover operations.

In this case, umbilical 542 need not provide fluids to the remotely operated vehicle 540. Therefore, umbilical 542 may be chosen from umbilicals that includes umbilical 520 in FIG. 21. Equipment resembling what is shown in FIG. 5 is also onboard ship so that a computer system can control the remotely operated vehicle 540. The upper end of umbilical 542 proceeding to its carousel is not shown on the left-hand side of FIG. 22 for simplicity. In this case, the umbilical 542 is designed to have any desired buoyancy in sea water, that specifically includes densities greater than sea water, as is conventional in the industry. The apparatus and methods to control the power and communications is similar to that shown in FIGS. 2, 3, 4 and 5 and will not be repeated here for the purpose of brevity. In one preferred embodiment, over 60 kilowatts of power is provided by umbilical 542 to remotely operated vehicle 540. This power is provided to the load of the remotely operated vehicle, which in several preferred embodiments, is an electric motor that drives a propeller that provides thrust for the remotely operated vehicle. For simplicity, FIG. 22 does not show a free floating remotely operated vehicle (ROV) tethered to the ship by a free floating umbilical.

Figure 23:
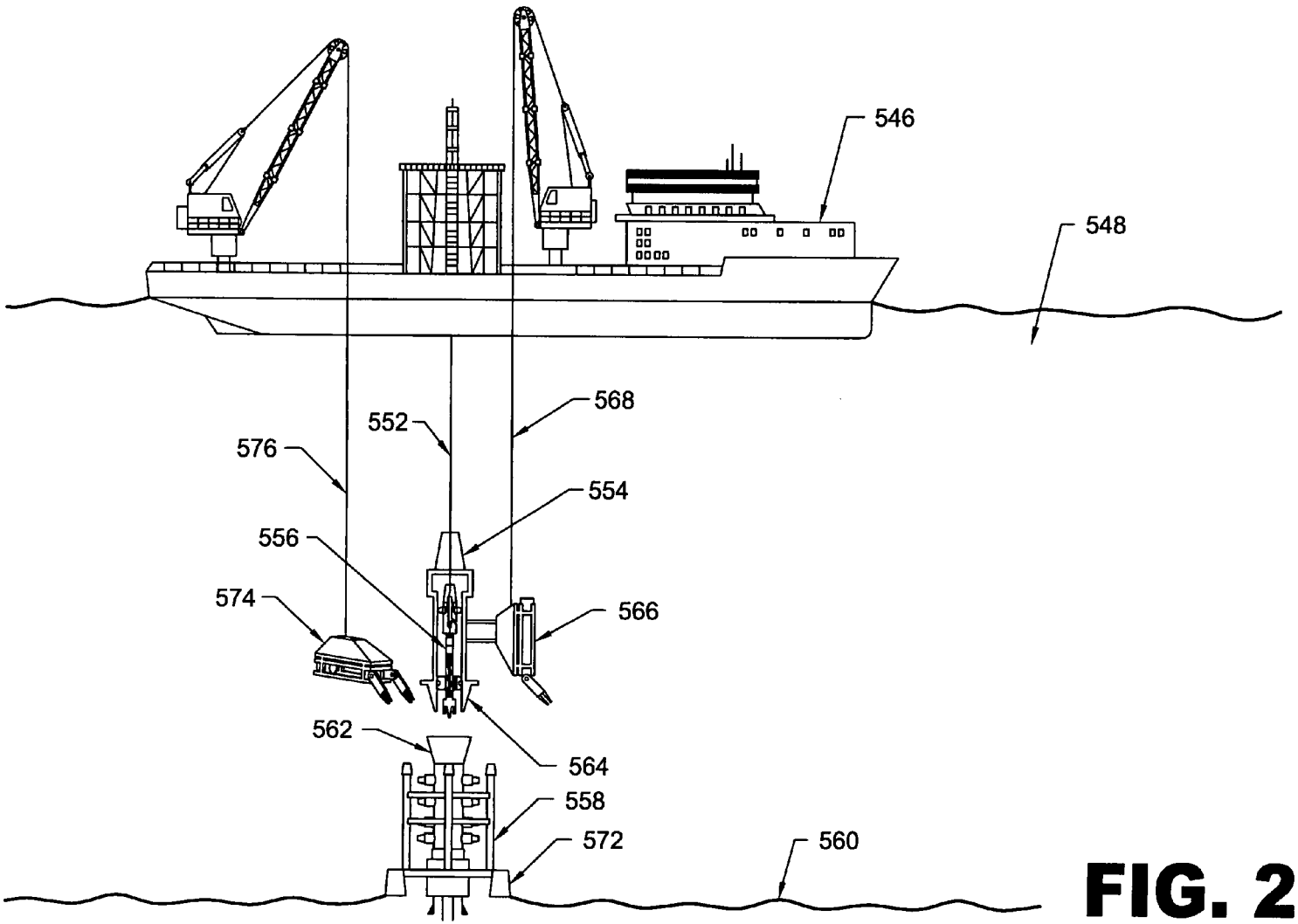
FIG. 23 shows a umbilical providing power in excess of 60 kilowatts, communications, and fluids to a remotely operated vehicle.

FIG. 23 is a schematic drawing similar to FIG. 22. FIG. 23 also shows a ship performing subsea well servicing. Ship 546 in ocean 548 possesses a first umbilical carousel 550 (not shown in FIG. 23 for simplicity) having umbilical 552 that proceeds through lubricator 554 that houses Smart Shuttle 556. Subsea well 558 on the ocean bottom 560 has mating equipment 562 that mates to mating equipment 564 of the lubricator 554. The lubricator is guided into place by first remotely operated vehicle 566 that obtains its power and communications from umbilical 568 that is deployed from second umbilical carousel 570 (not shown in FIG. 23 for simplicity). In this case, the umbilical 568 is designed to have any desired buoyancy in sea water, that specifically includes densities greater than sea water as is conventional in the industry. The upper end of umbilical 568 proceeding to carousel 570 near the top of the crane on the right-hand side of FIG. 23 is not shown for simplicity.

Upon entering the subsea well, the Smart Shuttle is to proceed through the base of the lubricator 572 and into the wellbore below (not shown in FIG. 22). There, the Smart Shuttle is to perform a well workover that does not necessarily require fluids to be injected into formation. Therefore, umbilical 552 may be selected to be a suitable umbilical including umbilical 520 in FIG. 21. Equipment resembling what is shown in FIG. 5 is on board the ship so that a computer system can control the Smart Shuttle, and any equipment attached to the Smart Shuttle, during workover operations.

In this case, umbilical 568 need not provide fluids to first remotely operated vehicle 566. Therefore, umbilical 568 may be chosen from umbilicals that includes umbilical 520 in FIG. 21. Equipment resembling what is shown in FIG. 5 is also onboard ship so that a computer system can control first remotely operated vehicle 566. In this case, the umbilical 568 is designed to have any desired buoyancy in sea water, that specifically includes densities greater than sea water as is conventional in the industry. The apparatus and methods to control the power and communications to first remotely operated vehicle are similar to that shown in FIGS. 2, 3, 4 and 5 and will not be repeated here for the purpose of brevity.

FIG. 23 shows second remotely operated vehicle 574 that obtains its power and communications from umbilical 576 that is deployed from third umbilical carousel 578 (not shown in FIG. 23 for simplicity). Second remotely operated vehicle 574 is to suitably attach to the subsea well 558 and is to remove fluids from the wellbore. Therefore, umbilical 576 may be selected to be a suitable umbilical including umbilical 2 in FIG. 1 and umbilical 492 in FIG. 20. The upper end of umbilical 576 proceeding to carousel 578 near the top of the crane on the left-hand side of FIG. 23 is not shown for simplicity. Equipment resembling what is shown in FIG. 5 is on board the ship so that a computer system can control the operation of second remotely operated vehicle 574. In this case, the umbilical 576 is designed to have any desired buoyancy in sea water, that specifically includes densities greater than sea water as is conventional in the industry. In one preferred embodiment, over 60 kilowatts of power is provided by umbilical 576 to remotely operated vehicle 574. This power is provided to the load of the remotely operated vehicle, which in several preferred embodiments, is an electric motor that drives a propeller that provides thrust for the remotely operated vehicle. In other embodiments, this power is provided to an electric motor that drives a downhole pump. For simplicity, FIG. 23 does not show a free floating remotely operated vehicle (ROV) tethered to the ship by a free floating umbilical.

In FIGS. 22 and 23, the feedback control of the voltage, RPM, current, and other parameters of an electric motor within an remotely operated vehicle is accomplished by analogy to that disclosed in relation to the electric motor of the Subterranean Electric Drilling Machine. In the interests of brevity, this feedback control of remotely operated vehicles will not be further discussed.

The Smart Shuttle and Other Conveyance Systems

Figure 24:
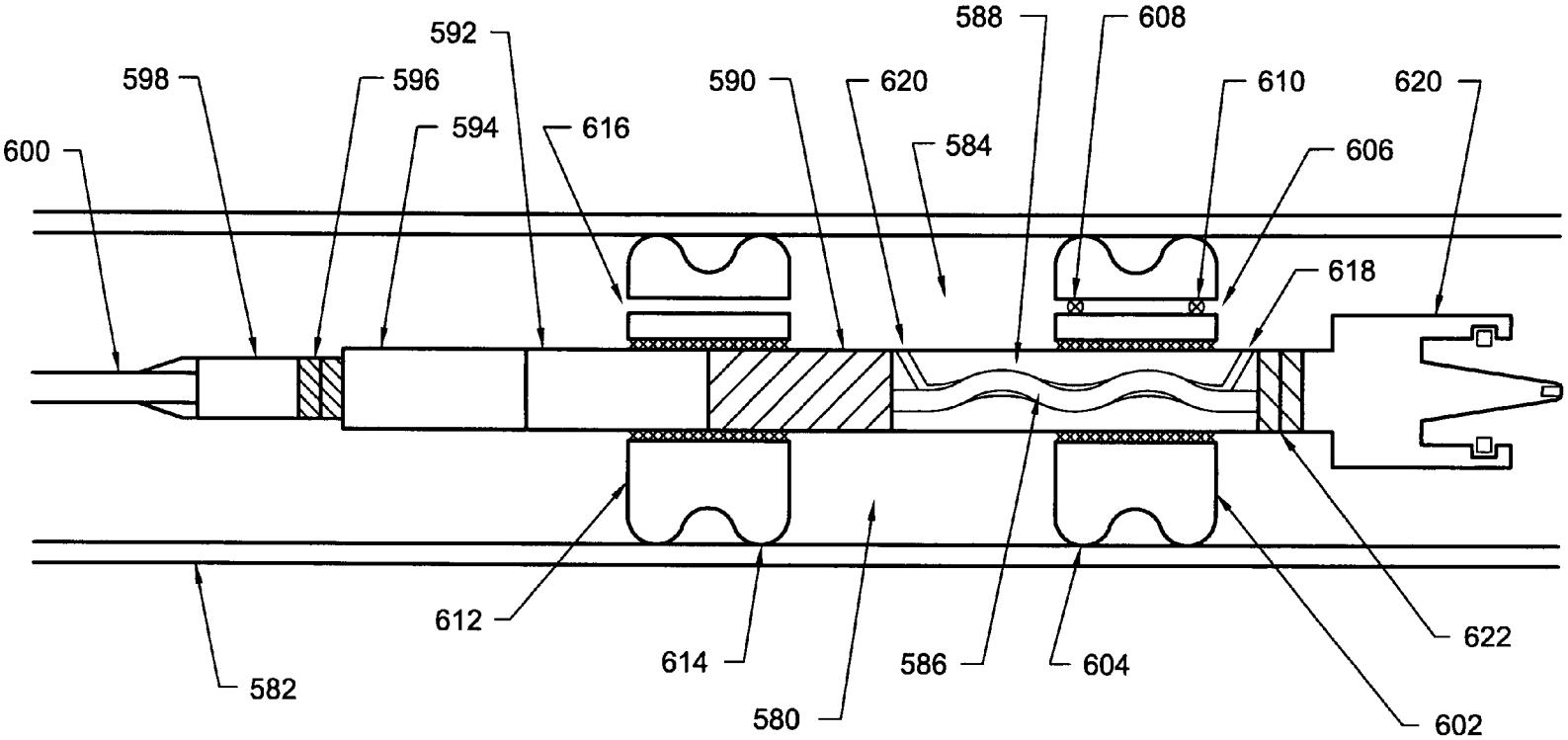
FIG. 24 shows a sectional view of one preferred embodiment of a Smart Shuttle®.

FIG. 24 shows one embodiment of the Smart Shuttle® generally designated with the numeral 580 that is located within a "pipe means" 582 that includes a casing, drill pipe, tubing, etc. The Smart Shuttle is comprised of a progressive cavity pump 584 that has a rotor 586 and stator 588 as is typical of such pumps. The progressive cavity pump is coupled to gear box 590 that is in turn coupled to the electrical submersible motor 592, which in turn is connected to electronics assembly 594 having any downhole computer, the downhole sensors, and communications system, which in turn is connected by the quick change collar 596 to the umbilical head 598 that is connected the umbilical 600.

The lower wiper plug assembly 602 has sealing lobe 604 and this assembly is firmly attached to the body of the progressive cavity pump at the location shown in FIG. 24. Lower wiper plug assembly has lower bypass passage 606 which has electrically operated valves 608 and 610. The upper wiper plug assembly 612 has sealing lobe 614 and this assembly is firmly attached to the sections of the apparatus having the gear box and the electrical submersible motor at the location shown in FIG. 24. The upper wiper assembly also has permanently open upper bypass port 616 in the embodiment shown in FIG. 24.

In terms of FIG. 24, and when the electrical submersible motor is suitably turning the rotor of the progressive cavity pump (PCP), a volume of fluid $\Delta V2$ per unit time in the wellbore is pumped into the lower side port 618 of the PCP and out of the upper side port 620 of the PCP. With valves 608 and 610 closed, the fluid $\Delta V2$ is then forced through the upper bypass port 616 into the portion of the well above the upper surface of the upper wiper plug assembly. In this manner, the Smart Shuttle is then forced downward into the wellbore. The Retrieval Sub 620 is attached to the body of the Smart Shuttle by quick change collar 622 that in turn is connected to the lower body of the progressive cavity pump. This, and related embodiments of the Smart Shuttle is used to transport equipment attached to the Retrieval Sub into wells and out of wells. The Smart Shuttle is an example of a "well conveyance means", or simply, a "conveyance means". Fluid conduction means 624 is able to conduct any fluids available from umbilical 600 through the Retrieval Sub 620, although that fluid conduction means 624 is not shown in FIG. 24 for simplicity. Fluid conduction means 624 is fabricated using tubing and technology currently available in the oil and gas industry.

Figure 25:
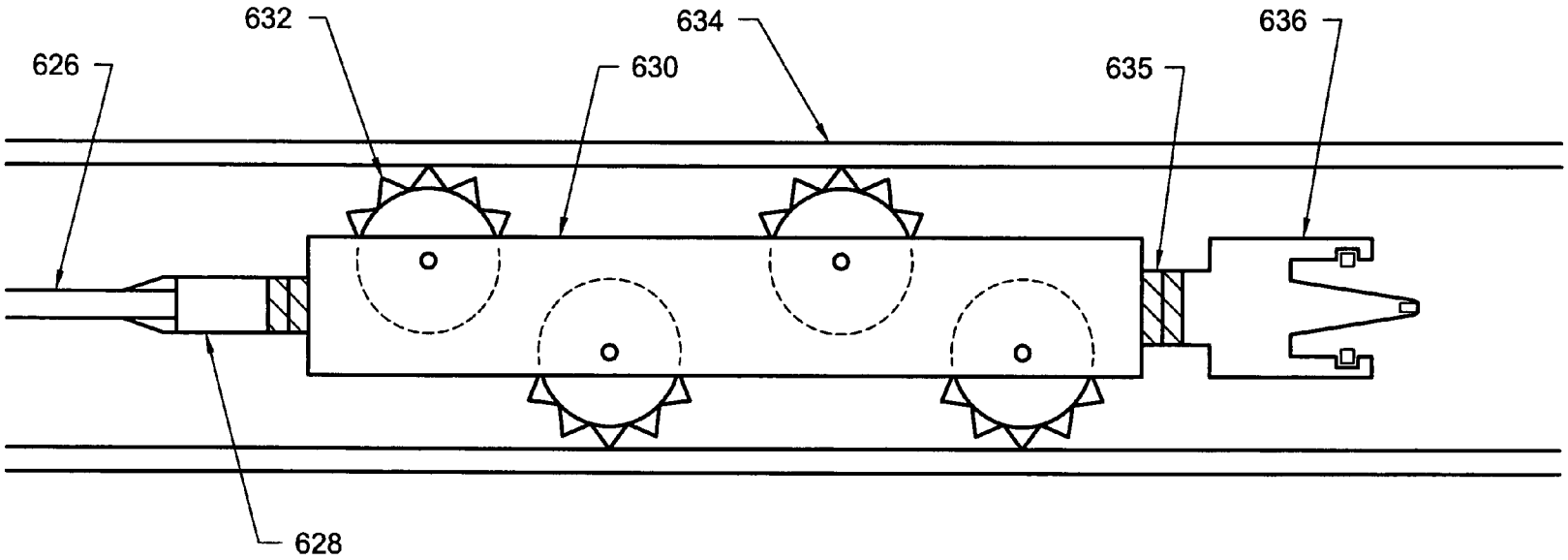
FIG. 25 shows a sectional view of a tractor deployer operated from an umbilical.

FIG. 25 shows another well conveyance means. Umbilical 626 possesses one or more electrical conductors. In several preferred embodiments, umbilical 626 possesses one or more high power electrical conductors. Umbilical head 628 connects the umbilical to tractor conveyor 630. The tractor conveyor has at least one friction wheel 632 which engages the interior of pipe 634. The tractor conveyor has four friction wheels as shown in FIG. 25. Quick change collar assembly 635 connects the tractor conveyor to the Retrieval Sub 636.

The tractor conveyor 630 with its Retrieval Sub 636 installed in FIG. 25 is an example of a "tractor conveyance means", a "tractor deployer", or a "downhole tractor deployment device". Electrical energy delivered via the umbilical to the tractor conveyor is used to drive electrical motors and/or electro-hydraulic systems 637 to provide rotational energy to the friction wheels (although the details of element 637 are not shown in FIG. 25 for simplicity). That rotational energy causes the tractor conveyor to move within the well.

The tractor conveyance means in FIG. 25 provides similar operational features as different embodiments previously described heretofore as Smart Shuttles. Fluid conduction means 638 is able to conduct any fluids available from umbilical 626 through the Retrieval Sub 636, although that fluid conduction means 638 is not shown in FIG. 24 for simplicity. Fluid conduction means 638 is fabricated using tubing and technology currently available in the oil and gas industry.

By analogy with the Smart Shuttle, one embodiment of the tractor conveyance means may be used as a portion of an "automated well drilling and completion system". As described herein, this automated system is called the "tractor conveyance system" or the "automated tractor conveyance system". The tractor conveyance means is substantially under the control of a computer system that executes a sequence of programmed steps that has at least one computer system located on the surface of the earth and has means to convey at least one completion device attached to the Retrieval Sub into the wellbore under the automated control of the computer system. The automated system has at least one sensor means located within the tractor conveyance means, has first communications means that provides commands from the computer system to the tractor conveyance means, has second communications means that provides information from the sensor means to the computer system, where the execution of the programmed steps of the computer system to control the tractor conveyance means takes into account information received from the sensor means to optimize the steps executed by the computer system to drill and complete the well.

Well Construction and Servicing

Figure 26:
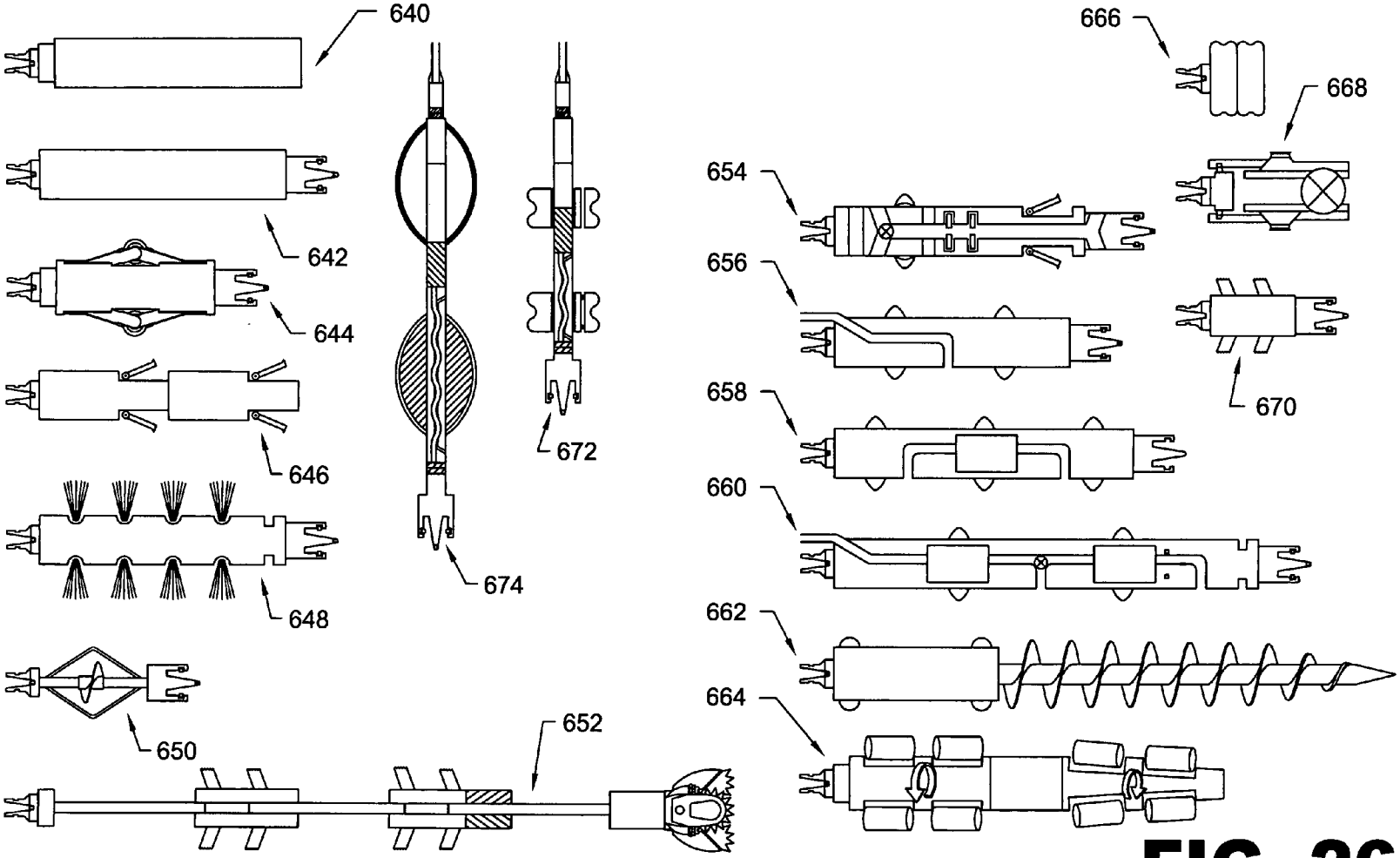
FIG. 26A shows any commercial tool or device 640.
FIG. 26B shows any logging tool 642.
FIG. 26C shows any torque reaction centralizer 644.
FIG. 26D shows any scraper 646.
FIG. 26E shows any perforating tool 648.
FIG. 26F shows any flow meter 650.
FIG. 26G shows any Downhole Rig with rotary bit 652.
FIG. 26H shows any Universal Completion Device™ 654.
FIG. 26J shows any straddle packer 656.
FIG. 26K shows any injection tool 658.
FIG. 26L shows any oil/gas separator 660.
FIG. 26M shows any flow line cleaning tool 662.
FIG. 26N shows any casing expanding tool 664.
FIG. 26P shows any plug 666.
FIG. 26Q shows any valve 668.
FIG. 26R shows any locking mechanism 670.
FIG. 26S shows a Cased Hole Smart Shuttle 672.
FIG. 26T shows an Open Hole Smart Shuttle 674.
Figure 26A:
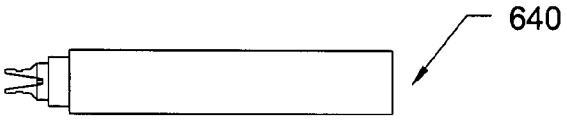
Figure 26B:
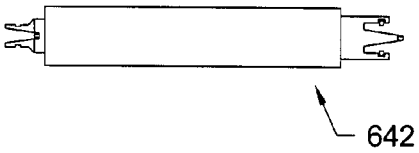
Figure 26C:
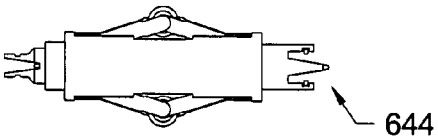
Figure 26D:
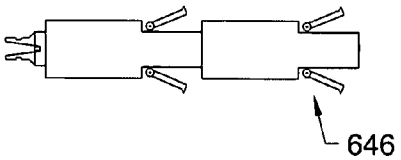
Figure 26E:
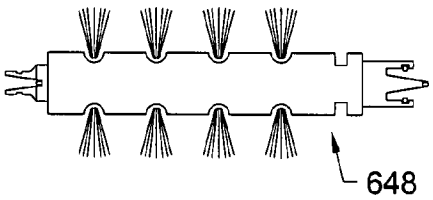
Figure 26F:
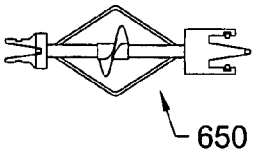
Figure 26G:
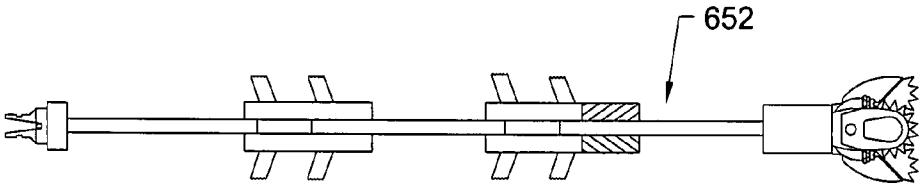
Figure 26H:
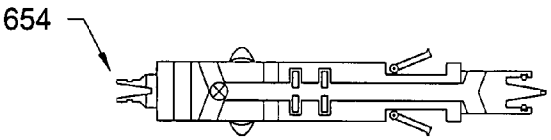
Figure 26J:
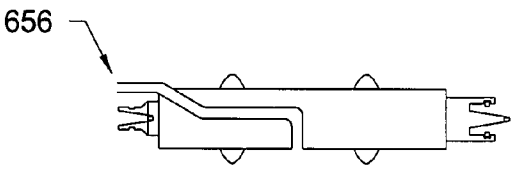
Figure 26K:
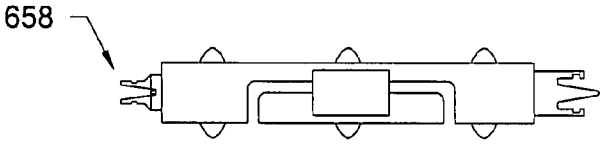
Figure 26L:
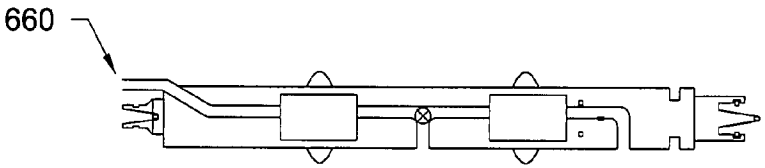
Figure 26M:
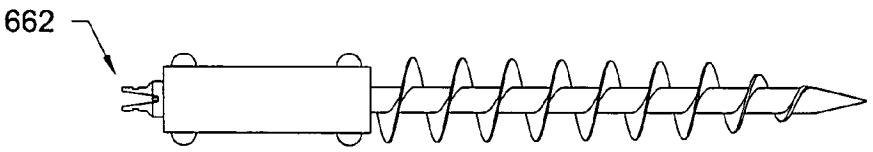
Figure 26N:
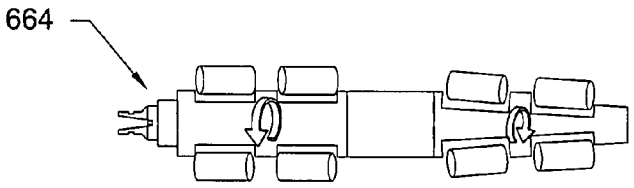
Figure 26P:
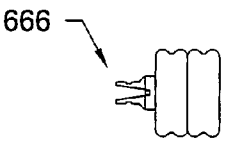
Figure 26Q:
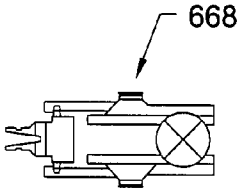
Figure 26R:
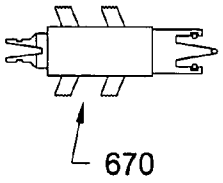
Figure 26S:
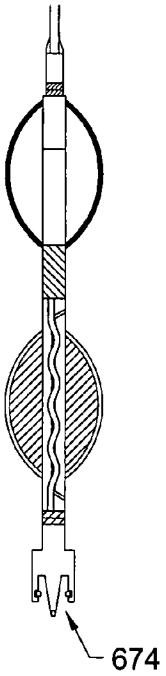
Figure 26T:
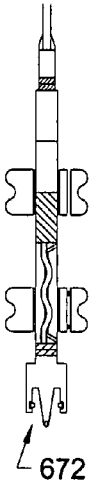

The Retrieval Sub can be attached to a number of the devices shown in FIG. 26. Those devices include any commercial tool or device 640; any logging tool 642; any torque reaction centralizer 644; any scraper 646; any perforating tool 648; any flow meter 650; any Downhole Rig with rotary bit 652; any Universal Completion Device™ 654; any straddle packer 656; any injection tool 658; any oil/gas separator 660;

any flow line cleaning tool 662; any casing expanding tool 664; any plug 666; any valve 668; and any locking mechanism 670. These different tools are either defined in applicant's applications or are tools used in the oil and gas industry. The point is that any of these devices can be attached to the Retrieval Sub of the Cased Hole Smart Shuttle 672 or to the Retrieval Sub of the Open Hole Smart Shuttle 674. These devices may similarly be attached to the Retrieval Sub of the tractor conveyance means. Each such device in this paragraph may be called a "completion device" and collectively, these may be referenced as "completion devices".

Figure 27:
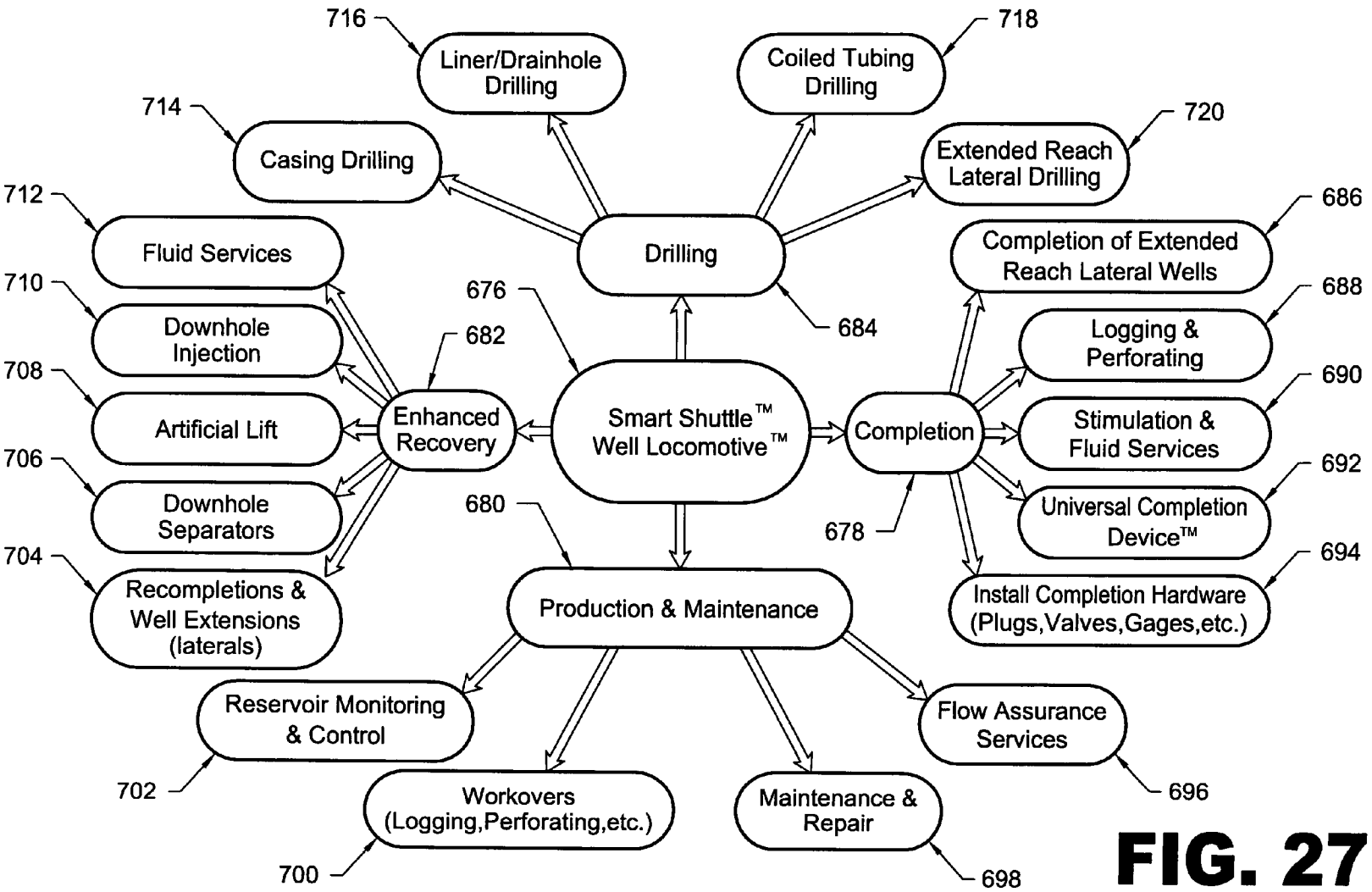
FIG. 27 shows a diagrammatic representation of functions that may be performed with the Smart Shuttle and the tractor conveyance system.

These devices specified in the previous paragraph may be used for a variety of different purposes in the oil and gas industry. Many of those tools can be used to serve wells. Please refer to FIG. 27 that shows a diagrammatic representation of functions that may be performed with the Smart Shuttle or the Well Locomotive. FIG. 27 shows that the Smart Shuttle or the Well Locomotive shown diagrammatically as element 676 may be used for the purposes of completion 678 (ie., to perform completion services on a well); production & maintenance 680 (ie., to perform production and maintenance services on a well); enhanced recovery 682 (ie., to perform enhanced recovery services on a well); and for drilling 684. Under completion functions, or "completion services", the Smart Shuttle and Well Locomotive may be used for the completion of extended reach lateral wells 686; for logging and perforating 688; for stimulation and fluid services 690; may be used to install the Universal Completion Device™ 692; and may be used to install completion hardware such as plugs, valves, gages, etc. 694. Under production and maintenance functions, or "production and maintenance services", the Smart Shuttle and Well Locomotive may be used for flow assurance services 696; for maintenance and repair 698; for workovers, that include logging, perforating, etc., 700; and for reservoir monitoring and control 702. Under enhanced recovery functions, or "enhanced recovery services", the Smart Shuttle and Well Locomotive may be used for recompletions, well extensions, and laterals 704; to install downhole separators 706; to perform artificial lift 708; to facilitate downhole injection 710; and for fluid services 712. Under drilling functions, or under "drilling services", the Smart Shuttle and the Well Locomotive may be used for casing drilling purposes 714; for liner drainhole drilling purposes 716; for coiled tubing drilling 718; and for extended reach lateral drilling 720. Extensive details are provided in about each of these functions in the related U.S. Disclosure Documents and in the related Provisional Patent Applications cited above.

Any one or more of the functions provided in the previous paragraph is called a "well service". Two or more of such functions are called "well services". The execution of the programmed steps of the automated computer system to control the Smart Shuttle®, or tractor conveyance means, takes into account information received from the sensor means within the tractor conveyance means to optimize the steps executed by the computer system to service the well.

The above umbilicals have stated calculations pertaining to lengths of 20 miles. However, the umbilicals can be any length from 100's of feet to 20 miles. The extreme distance of 20 miles was chosen to show neutrally buoyant umbilicals can provide high power and high speed data communications at great distances that has heretofore not been recognized in the oil and gas industry.

As stated previously, the phrase "substantially neutrally buoyant", "essentially neutrally buoyant", "near neutral buoyant", and "approximately neutrally buoyant" may be used interchangeably. In several preferred embodiments of the invention, the meaning of these terms is that in the presence of the well fluids, that the buoyancy of the umbilical causes the typical friction of the umbilical against the well to be substantially reduced.

As stated earlier, the tractor conveyor tractor conveyor 630 with its Retrieval Sub 636 in FIG. 25 is an example of a "conveyance means", a "tractor conveyance means", a "tractor deployer", or a "downhole tractor deployment device". There are many "well tractors", or devices related to well tractors, a selection of which are described in the following documents: U.S. Pat. Nos. 6,347,674; 6,345,669; 6,318,470; 6,296,066; 6,273,189; 6,257,332; 6,241,031; 6,241,028; 6,225,719; 6,179,058; 6,179,055; 6,173,787; 6,089,323; 6,082,461; 5,954,131; 5,794,703; 5,547,314; 5,375,668; 5,209,304; 5,184,676; 5,121,694; 5,018,451; 5,040,619; 4,960,173; 4,686,653; 4,643,377; 4,624,306; 4,570,709; 4,463,814; 4,243,099; 4,192,380; 4,085,808; 4,071,086; 4,031,750; 3,969,950; 3,890,905; 3,888,319; 3,827,512; in EP0564500B1; and in WO9806927; WO9521987; WO9318277; and WO9116520; entire copies of which are incorporated herein by reference. Entire copies of the 39 cited references in this paragraph are incorporated herein by reference. Many of these devices are means to cause or generate movement within wellbores. Such "movement means" may be attached to a device similar to the Retrieval Sub 636. Devices similar to Retrieval Sub 636 are called "retrieval means". So, movement means may be coupled to retrieval means to make a "tractor conveyance means", or tractor deployers, or downhole tractor deployment devices.

In view of the above, several embodiments of this invention use a closed-loop system to service a well for producing hydrocarbons from a borehole in the earth having at least one computer system located on the surface of the earth, which possess at least one conveyance means to convey at least one completion device into the borehole under the automated control of the computer system that executes a series of programmed steps, which possess at least one sensor means located within the conveyance means, which have first communications means that provides commands from the computer system to the conveyance means and possessing second communications means that provides information from the sensor means to the computer system, whereby the execution of the programmed steps by the computer system to control the conveyance means takes into account information received from the sensor means to optimize the steps executed by the computer to service the well. Such system is called a "closed-loop tractor conveyance system". The closed-loop system may also be used to monitor and control production of hydrocarbons from the wellbore.

The above described umbilicals, and other variations of such umbilicals that meet the above defined operational specifications, could be manufactured on a contractual basis by a firm called ABB Offshore Systems that is located in Stavanger, Norway, that has its U.S.A. office that may be reached through ABB Offshore Systems, Inc., having the address of 8909 Jackrabbit Road, Houston, Tex. 77095, having the telephone number of (281) 855-3200, that has its website that can be reached through www.abb.com. The above described umbilicals, and other variations of such umbilicals that meet the above defined operational specifications, might be manufactured on a contractual basis by a firm called the Fiberspar Corporation that may be reached at 28 Patterson Brook Road, West Warehan, Mass. 02576, having the telephone number (508) 291-9000, which has its website at www.fiberspar.com. This firm is capable of supplying various spoolable composite tubes capable of being spooled onto a reel having relevant anisotropic characteristic, a specified burst pressure, a specified collapse pressure, a specified tensile strength, a specified compression strength, a specified load carrying capacity, which is also bendable. Some of these tubes include an inner liner material, an interface layer, fiber composite layers, a pressure barrier layer, and an outer protective layer. The fiber composite layers can have triaxial braid structure. The composites may be fabricated from carbon-based composites.

In the above, syntactic foam materials were described in various preferred embodiments to change the apparent buoyancy of an umbilical in the presence of other surrounding fluids. However, any material of a different density may be used for this purpose.

A preferred embodiment above has described an apparatus to drill oil and gas wells having Subterranean Electric Drilling Machine disposed in a wellbore such as that shown as element 94 FIG. 6. The Subterranean Electric Drilling Machine possesses at least one downhole electric motor that is shown as element 114 in FIG. 6. This electric motor rotates a rotary drill bit identified as elements 106, 110 and 112 in FIG. 6. This electric motor rotates the drill bit at a selected RPM determined by the frequency, current and voltage applied to input terminals of the electric motor as shown in FIG. 2 and in FIG. 3. One advantage of such an electrically operated drill bit operating at relatively high RPM is that it produces very fine rock cuttings that are easily transported to the surface by mud flow. The input terminals of the electric motor are identified as the inputs to the downhole electrical load 22 in FIG. 2, which in several embodiments is an electric motor, which are also attached to the sensing unit 24. The input terminals of the electric motor are shown a the leads attached to either side of element 34 in FIG. 2. The electric motor operates properly with a particular voltage level applied to its electrical input. Please refer to the preferred embodiment discussed in relation to electric motor 34 in FIG. 3. It is important to note that in several preferred embodiments, the electrical motor 34 in FIG. 3 is dissipating 160 horsepower (119 kilowatts). A surface power supply means located on the surface of the earth provides a voltage output that is identified with element 20 in FIG. 2. An umbilical means disposed in the wellbore surrounded by well fluids connecting the surface power supply means to the Subterranean Electric Drilling Machine provides electrical power to the electrical input of the electric motor. For example, such an umbilical means is shown as element 116 in FIG. 6 and in FIG. 9. The umbilical means possesses insulated electric wires as shown in FIGS. 1, and 20. The umbilical means possess high speed data communications means such as high speed data link 14 in FIG. 1. The umbilical means possesses a fluid conduit for conveying drilling fluids through the interior of the umbilical means such as element 8 in FIGS. 1 and 506 in FIG. 20. The preferred embodiment has means to measure first voltage applied to the first electrical input of the electrical motor as shown by element 24 in FIG. 2. The preferred embodiment possesses means to transmit information related to the measured first voltage through a high speed data communications means within the umbilical to a computer located on the surface of the earth by using the high speed data link 14 in FIG. 1. The embodiment further possesses computer controlled means to adjust the first voltage output as shown by element 28 in FIG. 2. The computer system 26 in FIG. 2 is used to maintain first voltage input at a particular voltage level to provide proper operation of the electric motor within the Subterranean Electric Drilling Machine.

In several preferred embodiments, the electric motor 34 in FIG. 3 dissipates in excess of 60 kilowatts. This is important because it is the recollection of the inventors that several scientists and senior managers of a major oil services company stated their opinions that it would be impossible to provide over 60 kilowatts to an electric motor, or any other electrical load, at distances of up to 20 miles from a wellsite through any type of reasonably sized umbilical that would be practical to use within wellbores. According to the recollection of the inventors, these senior managers and scientists clearly stated their opinions before the invention herein was disclosed to those particular individuals. Yet further from this recollection, it apparently never occurred to these same scientists and senior managers that any such umbilical delivering in excess of 60 kilowatts could also be neutrally buoyant. However, only after disclosure of the invention herein to those scientists and senior managers, did they apparently accept that such umbilicals could be designed and built. Accordingly, because the individuals involved are well known in the oil and gas industry, and are experts in fields directly pertaining to the invention, the preferred embodiment described herein is not obvious to one having ordinary skill in the art.

Therefore, a preferred embodiment is an apparatus to drill oil and gas wells comprising:

(a) a Subterranean Electric Drilling Machine disposed in a wellbore that possesses at least one electric motor that rotates a rotary drill bit at a selected RPM, whereby the electric motor possesses first electrical input, whereby the electric motor properly operates with a particular voltage level applied to first electrical input, and whereby the electric motor dissipates in excess of 60 kilowatts with the particular voltage level applied to the first electrical input;

(b) surface power supply means located on the surface of the earth providing first voltage output;

(c) umbilical means disposed in the wellbore surrounded by well fluids connecting the surface power supply means to the Subterranean Electric Drilling Machine that provides electrical power to the first electrical input of the electric motor, whereby the umbilical means possesses insulated electric wires, whereby the umbilical means possesses high speed data communications means, and whereby the umbilical possesses a fluid conduit for conveying drilling fluids through the interior of the umbilical means;

(d) means to measure first voltage applied to the first electrical input of the electrical motor;

(e) means to transmit information related to the measured first voltage through the high speed data communications means within the umbilical to a computer located on the surface of the earth;

(f) computer controlled means to adjust the first voltage output so as to maintain first voltage input at the particular voltage level to provide proper operation of the electric motor within the Subterranean Electric Drilling Machine.

Another preferred embodiment of the invention described in the previous paragraph provides an umbilical means that a approximately neutrally buoyant within the well fluids to reduce the frictional drag on the neutrally buoyant umbilical.

In view of the above disclosure, yet another preferred embodiment is the method of feed-back control of an electric motor having at least one voltage input located within a Subterranean Electric Drilling Machine located in a borehole that dissipates at least 60 kilowatts that receives power from a surface power supply through an umbilical surrounded by well fluids that possesses at least two insulated electric wires, whereby the umbilical also possesses high speed data link for data communications, comprising the steps of:

(a) measuring the voltage input to the electric motor;

(b) sending information related to the measured voltage input through the high speed data link to a computer located on the surface of the earth; and (c) using the computer to adjust the voltage output of the surface power supply that is used to control the voltage input to the electrical motor.

Another preferred embodiment of the invention described in the previous paragraph provides an umbilical that is a approximately neutrally buoyant within the well fluids to reduce the frictional drag on the umbilical.

In view of the above disclosure, yet another preferred embodiment is the method of providing in excess of 60 kilowatts of electrical power to the electrical motor of a Subterranean Electric Drilling Machine through a substantially neutrally buoyant composite umbilical containing electrical conductors to reduce the frictional drag on the neutrally buoyant umbilical.

In view of the disclosure related to FIGS. 22 and 23, it is evident that the invention may be used to provide electrical power to an electric motor located within a remotely operated vehicle. Accordingly, a preferred embodiment of the invention provides a method of feed-back control of an electric motor having at least one voltage input located within a remotely operated vehicle that dissipates at least 60 kilowatts that receives power from a power supply located on a ship through an umbilical surrounded by sea water that possesses at least two insulated electric wires, whereby the umbilical also possesses high speed data link for data communications, comprising the steps of:

(a) measuring the voltage input to the electric motor;

(b) sending information related to the measured voltage input through the high speed data link to a computer located on the ship; and (c) using the computer to adjust the voltage output of the power supply located on the ship that is used to control the voltage input to the electrical motor.

Accordingly, yet another preferred embodiment of the invention is the method of providing in excess of 60 kilowatts of electrical power to the electric motor of a remotely operated vehicle through an umbilical containing electrical conductors and at least one high speed data communications means.

Several of the above preferred embodiments describe the Subterranean Electric Drilling Machine™, or simply the Subterranean Drilling Machine™ (SDM™), that performs Subterranean Electric Drilling™ (SED™) that is used to construct a Subterranean Electric Drilled Monobore Well™ or an SED Monobore Well™. Several of the above preferred embodiments also describe the Subterranean Liner Expansion Tool™ (SLET™) otherwise called the Casing Expansion Tool™ (CET™).

Subsea Completions

Figure 28:
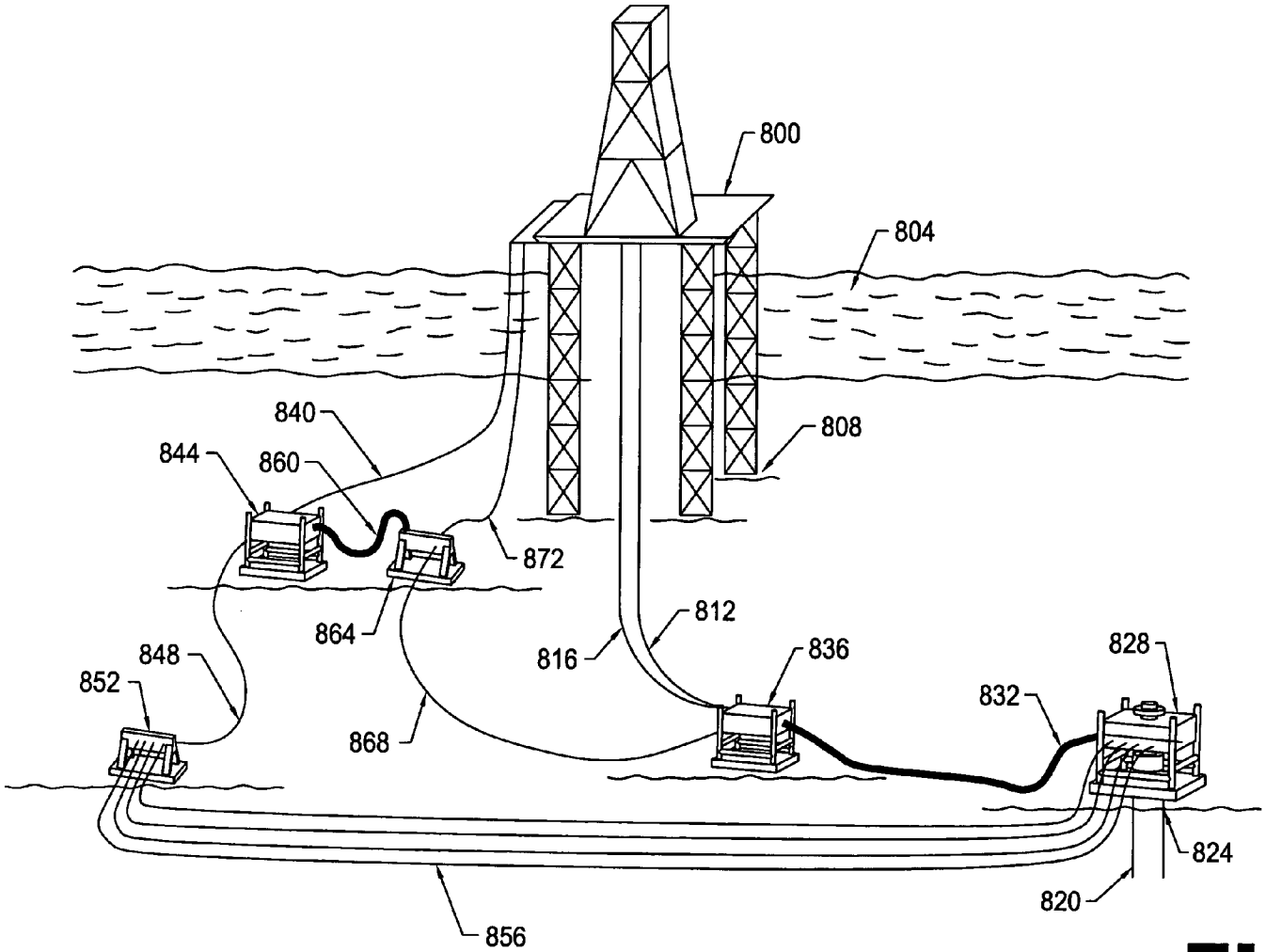
FIG. 28 shows a subsea well providing produced hydrocarbons to a fixed platform through several subsea flowlines.

FIG. 28 shows a fixed platform 800 penetrating ocean water 804 that is anchored in the ocean bottom at a particular location 808. Production flowline 812 and production flowline 816 carry oil and gas production to the fixed platform. Steel cased well 820 penetrates the ocean bottom at location 824 which is terminated in the first subsea Xmas Tree 828. Oil and gas production flows from the first Xmas Tree through jumper 832 to manifold 836. Oil and gas production flows from manifold 836 through flowlines 812 and 816 to the TLP 800. Subsea control umbilical 840 is connected to mid-flowline tie-in manifold 844 for a second Xmas Tree that in turn is connected to subsea control umbilical 848 that proceeds to the Umbilical Termination Assembly ("UTA") 852. (The second Xmas Tree is not shown in FIG. 28 for the purposes of simplicity.) Control signals are then sent through the Flying Leads, such as Flying Lead 856, that in turn are connected to the first Xmas Tree to control well production. Mid-flowline tie-in manifold 844 is connected to jumper 860 that is connected to assembly 864. Oil and gas production also flows through flowline 868 to assembly 864 and through flowline 872 to the TLP.

Installations such as shown in FIG. 28 are typical in the Gulf of Mexico. FIG. 28 shows a typical satellite field system. In some cases, the flowlines are single steel pipes, which are subject to wax build-up and to other blockage problems such as hydrates, scales or other solids forming from the production due to a loss in static pressure or in temperature, or to any other process or mechanism. In other cases, steel pipe-in-pipe systems with the outer pipe being externally insulated and hot water circulated through the annulus between the two pipes is used to heat the flowlines to avoid wax build-up and other blockage problems.

In FIG. 28, the "host" is illustrated as a fixed platform. However, many other "hosts" are possible including the following: an FPSO (a "Floating, Processing, Storage and Offloading" facility); all types floating platforms; Tension Leg Platforms ("TLP's); SPARS; floating platforms with dry tree risers including TLP's and SPARS; etc. Here a SPAR is a floating moored structure for offshore drilling and/or production operations, which is typically a deep draft structure with very low motions due to the environment, and is especially suited for deepwater, and often supports dry surface trees. For the purposes of this invention, a "host" may include any of the previously listed structures associated with the formal definition of an "offshore platform" as defined above in quotes.

Figure 29:
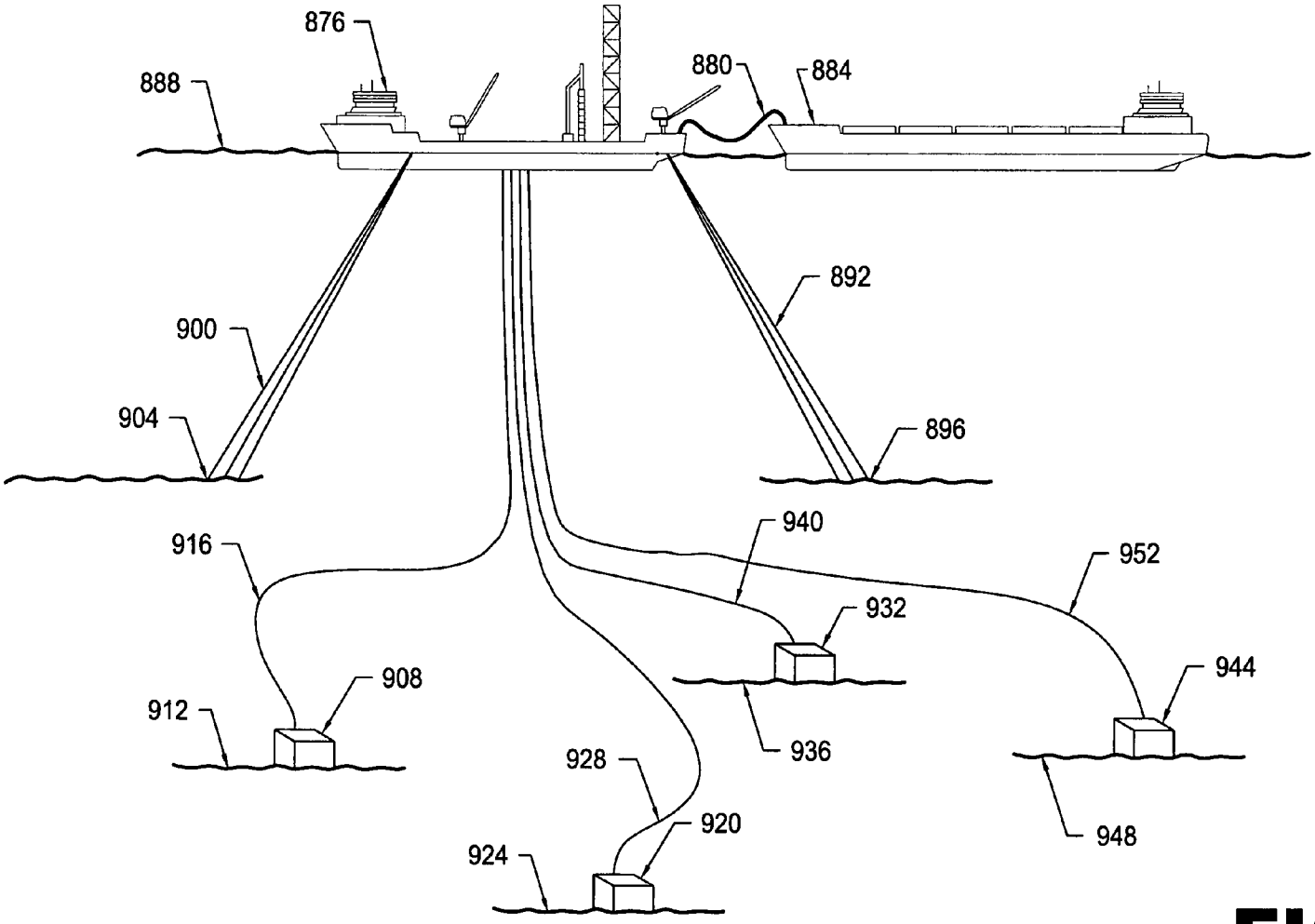
FIG. 29 shows four subsea wells providing produced hydrocarbons to a Floating Production, Storage, and Offloading structure (FPSO) through four different subsea flowlines.

FIG. 29 shows another "host" system. FIG. 29 shows Floating Production, Storage, and Offloading structure (FPSO) 876 loading crude through flexible line 880 to shuttle tanker 884 located on ocean surface 888. This is a typical FPSO arrangement as used in offshore Brazil and West Africa. Mooring component 892 is anchored to the sea bottom at location 896. Mooring component 900 is anchored to sea bottom at location 904. Subsea wellhead 908 at location 912 on the sea bottom passes crude production through flowline 916 to the FPSO. Subsea wellhead 920 at location 924 on the sea bottom passes crude production through flowline 928 to the FPSO. Subsea wellhead 932 at location 936 on the sea bottom passes crude production through flowline 940 to the FPSO. Subsea wellhead 944 at location 948 on the sea bottom passes crude production through flowline 952 to the FPSO. Often, the flowlines are single pipes that are subject to blockage from wax and other substances.

Electric Flowline Immersion Heating Systems

Figure 30:
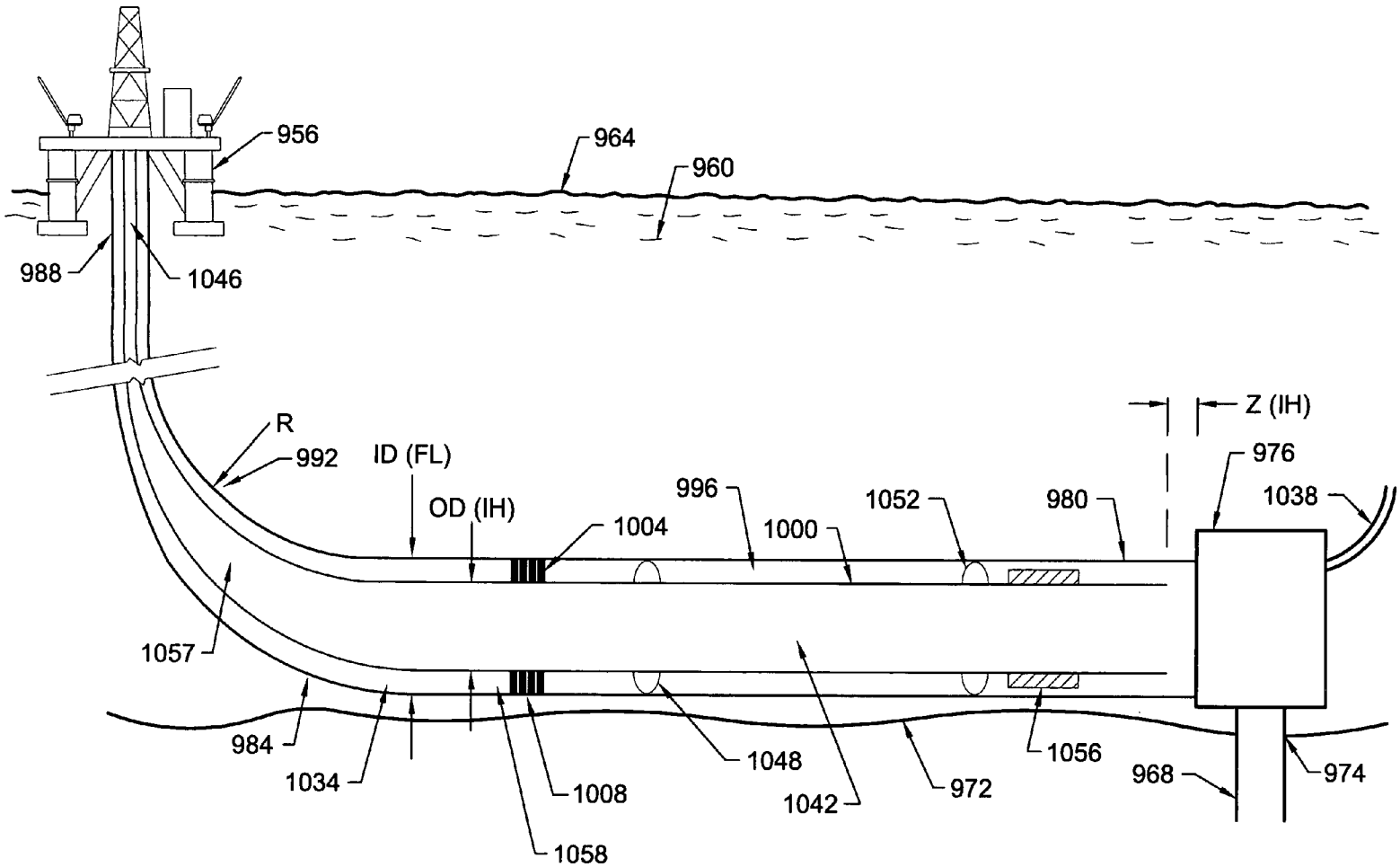
FIG. 30 shows an Electrically Heated Composite Umbilical ("EHCU") installed within a subsea flowline that is providing produced hydrocarbons to a floating platform that was conveyed into place using a particular method of conveyance.

Another host is shown in FIG. 30. Here floating platform 956 is shown floating in ocean 960 having ocean surface 964. Steel cased well 968 penetrates the sea bottom 972 at location 974, and is attached to wellhead 976. Steel flowline 980 is attached to wellhead 976 and lies on sea bottom 972 for a distance until it raises off the sea bottom at position 984. The upper extremity of the flowline 988, also known as a riser, is connected to the floating platform, and the riser is suspended below the floating platform having a minimum radius of curvature R at location 992 shown in FIG. 30.

The Electric Flowline Immersion Heater Assembly ("EFIHA") is generally shown as element 996 in FIG. 30. The EFIHA shown in FIG. 30 possesses Electrically Heated Composite Umbilical ("EHCU") 1000. The inside diameter of the steel flowline 980 is shown by the legend ID(FL) in FIG. 30. The wall thickness of the steel flowline 980 is WT(FL), which is not shown in FIG. 30 in the interests of brevity. The outside diameter of the EHCU is shown by the legend OD(IH) in FIG.

30. The wall thickness of the EHCU is WT(IH), which is not shown in FIG. 30 in the interests of brevity. Hydraulic seal 1004 is attached to the outside diameter of the EFIHA at location 1008. Hydraulic seal 1004 may be comprised of multiple individual hydraulic sealing elements 1012, 1016, 1020, and 1024, which four elements are shown in FIG. 30, but which are not so labeled in the interests of simplicity.

Hydraulic pressure may be generated with hydraulic equipment 1030 (not shown in the interests of simplicity in FIG. 30) located on the floating platform 956. This hydraulic pressure may be applied to the annular space defined by the difference between the inside diameter of the flowline ID(FL) and the outside demeter of the EHCU that is OD(IH) that is shown as region 1034 in FIG. 30. The hydraulic pressure applied in region 1034 in FIG. 30 is defined as P(EFIHA). This pressure acts on the hydraulic seal 1004 that generates force F(EFIHA) which is applied to the EFIHA that is provided by the following equation:

$$F(\text{EFIHA})=\pi\{[\text{ID(FL)}/2]^2-[\text{OD}(IH)/2]^2\}\{P(\text{EFIHA})\} \quad \text{Equation 2.}$$

The force shown in Equation 2 is used to force the EFIHA down into the steel flowline. In one preferred embodiment of the invention, if wellhead 976 is set by control means 1038 so that no fluid may flow back into the well, then when the EFIHA is forced downward into the well by hydraulic force F(EFIHA), any displaced fluid in the sealed system flows up the inside of the EFIHA through region 1042 within the EFIHA and to the floating platform at location 1046. This is called "backflow" within the EFIHA. So, in this case, the displaced fluid flows up the interior of the F(EFIHA) to the floating platform.

The EFIHA also possesses additional centralizing and hydraulic sealing elements 1048 and 1052. Instrumentation assembly and control assembly 1056 provides measurements of the ambient well conditions such as the pressure P(EFIHA), temperature (EFIHA), the depth, etc. The force used to drive the EFIHA into the well results in a downward velocity V(EFIHA) that may be a function of time. This downward velocity V(EFIHA) influences the pressure P(EFIHA). The force F(EFIHA) is adjusted so that the pressure P(EFIHA) does not exceed some predetermined maximum pressure P(EFIHA-MAX). The Electrically Heated Composite Umbilical ("EHCU") 1000 possesses internal electric heater wires, wires to power the instrumentation and control assembly 1056, means for high speed bidirectional communications, and power wires for any other services or purposes. As one example, wires 494 and 496 in the umbilical shown in FIG. 20 may be used instead as electrical resistors to generate heat to heat the EHCU. In this case, the heat delivered to the EHCU is equal to the following:

$$H(\text{EHCU})=[I(\text{EHCU})]^2R(\text{EHCU}) \quad \text{Equation 3.}$$

Here, H(EHCU) is the power in watts ("heat") delivered to the EHCU, the symbol I is the time averaged electrical current flowing through wires 494 and 496 in FIG. 20, and R(EHCU) is the combined series resistance of wires 494 and 496. The current I is caused to flow through the resistors by a power supply that is not shown for simplicity.

Instrumentation and control assembly 1056 may be used to sense the depth of the EHCU and the distance between the end of the EHCU and the wellhead shown by the legend Z(IH). In one preferred embodiment of the invention, when Z(IH) reaches a predetermined value, then at least one hydraulic locking mechanism (not shown in FIG. 30 for simplicity) within instrumentation and control assembly 1056 may be used to lock the EHCU into place within the well.

In one preferred embodiment of the invention, when it is time to retrieve the EHCU, and with wellhead 976 is set by control means 1038 so that no fluids may flow into the wellhead, then pressuring up the interior of region 1042 will apply pressure to the downhole side of seal 1004 and force the EHCU towards the floating platform 956 and out of the well. Suitable spooling and handling equipment for the EHCU are provided on the floating platform 988 which are not shown in FIG. 30 in the interests of simplicity. In another preferred embodiment, the EHCU is simply pulled out of the well by the spooling and handling equipment.

In another preferred embodiment, and after the EFIHA is locked in place within the well, a cross-over valve 1055 (not shown in FIG. 30 for simplicity) can be located at location 1058 which location is towards the floating platform from the position of seal 1004. When production is allowed to flow to the floating platform, this cross-over valve can be set to any one of three states ("State 1", "State 2", and "State 3"). In State 1, oil and gas production would proceed through the interior of EHCU to the floating platform. For example, in State 1, oil and gas production would flow through region 1057 of the EHCU that is located towards the floating platform from seal 1004. In State 2, oil and gas production would flow through region 1058 located between the outside diameter of the EHCU and the inside diameter of the flowline. State 2 has the advantage that all the heat generated in the EHCU is transferred to the surrounding production. In State 3, the oil and gas production would flow through both regions 1057 and 1058 simultaneously. There are many variations of the invention.

Figure 31:
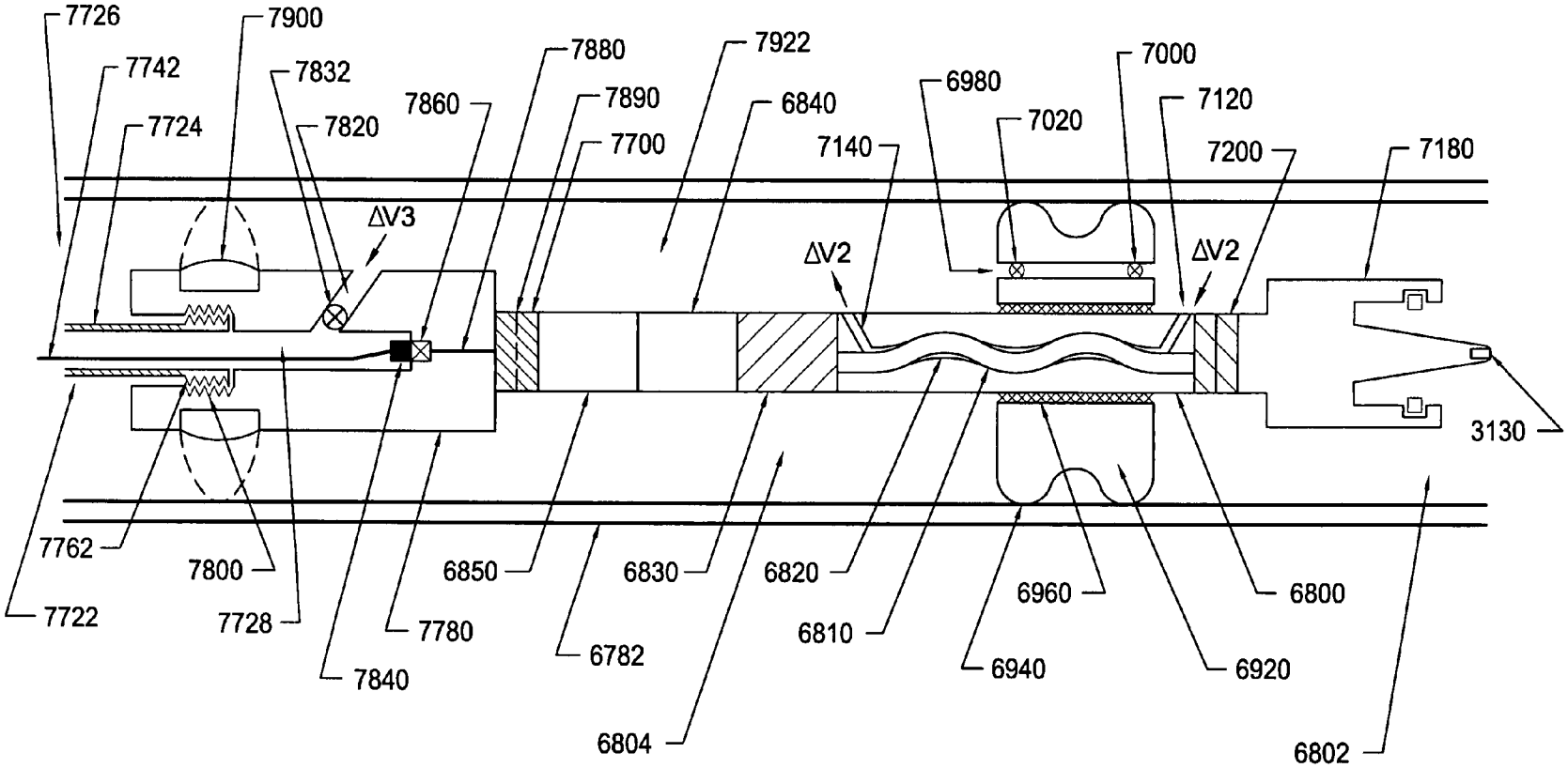
FIG. 31 shows an embodiment of an Electric Flowline Immersion Heater Assembly ("EFIHA") having an Electrically Heated Composite Umbilical ("EHCU") in a subsea flowline that was conveyed into place using a Smart Shuttle that obtains its power from a wireline located within the EHCU.

The next 12 paragraphs are paraphrased from page 66, line 41, to page 68, line 38, of Ser. No. 09/487,197, now U.S. Pat. No. 6,397,946 B1, that issued on Jun. 4, 2003, having the inventor of William Banning Vail III, that was incorporated entirely by reference in co-pending Ser. No. 10/223,025, having the Filing Date of Aug. 15, 2002, that is entitled "High Power Umbilicals for Subterranean Electric Drilling Machines and Remotely Operated Vehicles". These 12 paraphrased paragraphs originally related to FIG. 23 in U.S. Pat. No. 6,397,946, but now relate to FIG. 31 herein. In FIG. 23 in U.S. Pat. No. 6,397,946 B1, a coiled tubing was conveyed downhole. In FIG. 31 herein, an Electric Flowline Immersion Heater Assembly ("EFIHA") having an electrically heated composite umbilical ("EHCU") is conveyed into a flowline. In addition, an extra "0" was added to all numerals that appeared in the corresponding text of U.S. Pat. No. 6,397,946 B1, so for example element 780 in FIG. 23 in U.S. Pat. No. 6,397,946 is now labeled as element 7800 in FIG. 31 herein.

However, the Smart Shuttles may be conveyed downhole with an attached Electric Flowline Immersion Heater Assembly ("EFIHA") having an electrically heated composite umbilical ("EHCU") that is conveyed into a flowline. Such a Smart Shuttle with Retrieval Sub that is conveyed downhole that is attached to an EHCU is shown in FIG. 31 herein. In several preferred embodiments of the invention, the EHCU conveyed by the Smart Shuttle into the flowline as shown in FIG. 31 may be forced into the flowline by three different mechanisms: (a) by using mechanical "injectors" at the surface to force the coiled tubing downward into the flowline; (b) the PCP/ESM assembly may be used to assist by "pulling" the Smart Shuttle into the flowline; and (c) yet further, hydraulic forces on fluids from the surface may also force the Smart Shuttle into the flowline. That these three independent methods may be used to force the Smart Shuttle with its attached Retrieval Sub downward into the flowline will become better apparent with the following description of the elements in FIG. 31.

Most of the elements in FIG. 31 through element 7200 have been previously described in relation to FIG. 23 in U.S. Pat. No. 6,397,946 B1. The Progressive Cavity Pump is labeled with element 6800. The Progressive Cavity Pump is coupled to gear box 6830 that is in turn coupled to the Electrically Submersible Motor 6840, which in turn is connected to electronics assembly 6850 having any downhole computer, sensors, and communications system, which in turn is connected to the quick change collar 7700. The assembly below the quick change collar in FIG. 31 is often referred to as the Progressive Cavity Pump/Electrical Submersible Motor assembly that is abbreviated as the "PCP/ESM assembly". Therefore, the "PCP/ESM assembly" is attached to the quick change collar 7700 in FIG. 31.

In FIG. 31, an Electric Flowline Immersion Heater Assembly ("EFIHA") that is generally shown as numeral 7722 has an Electrically Heated Composite Umbilical ("EHCU") 7724 that is conveyed into steel flowline 6782. Tubing Termination Assembly 7780 has threads 7800 that mate to the threaded end 7762 of EHCU 7724. So, the Tubing Termination Assembly is inserted into the flowline and is attached to the threaded end 7762 of the EHCU 7724. In one preferred embodiment, any fluids that flow into, or out of, the EHCU are conducted to, and from, the interior of the flowline through fluid channel 7820. Valve 7832 located within fluid channel 7820 can be used to cut off any fluid flow through the channel. Valve 7832 may be open or closed as desired. For many of the following preferred embodiments, it is assumed that this valve 7832 is open unless explicitly stated otherwise. The wireline 7742 is connected to top submersible plug 7840 that connects to lower submersible plug 7860 which in turn passes the electrical conductors from the wireline to the quick change collar. The bundle of electrical conductors passing to the quick changer collar is designated with the numeral 7880 in FIG. 31. Within the quick change collar is yet another electrical plug assembly that provides power and electrical signals through a bundle of wires to the "PCP/ESM assembly" that is not shown in FIG. 31 solely for the purposes of simplicity. Typical design and assembly procedures used in the industry are assumed throughout this specification. It is often the case that a quick change collar surrounds male and female mating electrical connectors, which is typically the case in "logging tools" used in the wireline logging industry. Those connectors mate at the location specified by the dashed line 7890 shown on the interior of the quick change collar in FIG. 31.

In addition, the Tubing Termination Assembly 7780 also possesses expandable packer 7900. Upon command from the surface, this expandable packer can be inflated within the flowline to seal against the flowline as may be required during typical well completion procedures, and typical workover procedures, that are used in the industry. This expandable packer can also be used for a second purpose of forcing the Smart Shuttle into the wellbore as described below. This packer can also be used for additional purposes as described below.

With reference to FIG. 31, the Smart Shuttle may be forced downhole by three mechanisms that are described in separate paragraphs as follows.

In a first preferred embodiment of the invention, mechanical "injectors" at the surface are used to force the Electric Flowline Immersion Heater Assembly ("EFIHA") 7722 and its electrically heated composite umbilical ("EHCU") 7724 into the flowline 6782. These mechanical "injectors" were previously described in U.S. Pat. No. 6,397,946 B1, an entire copy of which is incorporated herein by reference.

In a second preferred embodiment of the invention, the electrically energized Progressive Cavity Pump forces fluid $\Delta V2$ into the lower side port 7120 of the PCP and out of the upper side port 7140 of the PCP, and the Smart Shuttle is conveyed downhole. If this method is used by itself, and if expandable packer 7900 is in its deflated state as shown by the solid line in FIG. 31, then no fluid would necessarily flow to the surface through fluid channel 7820. It could, but it is not necessary in this embodiment, and under the circumstances described.

In a third preferred embodiment of the invention, and in analogy with the pump-down single zone packer apparatus 658 described in FIG. 17 in U.S. Pat. No. 6,397,946 B1, the expandable packer 7900 in FIG. 31 is inflated so as to make a reasonable seal against the flowline 6782, but not so firmly so as to lock the device in place. In FIG. 31, the solid line labeled with numeral 7900 shows the uninflated state of the expandable packer, and the dotted line shows the expanded, or inflated, state of expandable packer 7900. Then, in analogy with fluid flow described in FIG. 17 of U.S. Pat. No. 6,387,946 B1, fluid forced into the upper flowline in annular region 7726 will force the apparatus attached to the expandable packer downward into the wellbore, and any fluid $\Delta V3$ displaced is forced upward through fluid channel 7820 and into the interior of the EHCU 7728 which in turn flows to the surface in analogy with previous description of fluid flow through coiled tubing to the surface in relation to FIG. 17 in U.S. Pat. No. 6,397,946. This of course assumes that valve 7832 is open.

In principle, all first, second, and third methods of conveyance downhole can be used simultaneously, provided that valves 6980 and 7000 are set in their appropriate positions for the applications, provided that valve 7832 is set in its appropriate position, and provided the Progressive Cavity Pump 6800 is suitably energized.

For simplicity, the particular embodiment of the invention shown in FIG. 31 will be called in certain portions of the text that follows the "Electric Flowline Immersion Heater Assembly with Wireline Smart Shuttle" abbreviated "EFIHAW-WSS" that is generally designated as numeral 7922 in FIG. 31.

Any smart completion device may be attached to the Retrieval Sub 7180 during any such conveyance downhole. For example, a casing saw or another packer can be installed on the Retrieval Sub so that many different services can be performed during one trip downhole. The casing saw and packers are descried in U.S. Pat. No. 6,397,946 B1. These include perforating, squeeze cementing, etc.—in fact many of the methods to complete oil and gas wells defined in the book entitled "Well Completion Methods", "Well Servicing and Workover", Lesson 4, from the series entitled "Lessons in Well Servicing and Workover", Petroleum Extension Service, The University of Texas at Austin, Austin, Tex., 1971, an entire copy of which is incorporated herein by reference.

In another preferred embodiment of the invention, the apparatus in FIG. 31 may be used to test production, or to assist production if it is used in another manner. In this embodiment, an electrically actuated production flowline lock 7940 (not shown in FIG. 31) is attached to the Retrieval Sub 7180. It has passages through it so that hydrocarbons below it can pass through it if necessary, but it otherwise locks the apparatus in FIG. 31 to the inside of the casing. Once locked in place, the PCP/ESM assembly can pump hydrocarbons through lower side port 7120 of the PCP and out of the upper side port 7140 of the PCP. Thereafter, hydrocarbons are pumped through fluid channel 7820 of the Tubing Termination Assembly 7780 in FIG. 31 provided that the expandable packer 7900 is suitably inflated. There are many variations on this particular embodiment of the invention but they are not further described here solely in the interests of brevity. With this embodiment, and with the PCP forcing fluids up the inside of the EHCU, then this provides a method of artificial lift for the produced hydrocarbons.

FIG. 31 also shows the Retrieval Sub electrical connector 3130, the rotor 6810 of the Progressing Cavity Pump, and the stator 6820 of the Progressing Cavity Pump. The Retrieval Sub 7180 is attached to the body of the Smart Shuttle by quick change collar 7200 that in turn is connected to the lower body of the Progressive Cavity Pump.

The lower wiper plug assembly 6920 has sealing lobe 6940 and this assembly is firmly attached to the body of the Progressive Cavity Pump at the location generally specified by numeral 6960 and this assembly further has lower bypass passage 6980 which has electrically operated valves 7000 and 7020. In FIG. 31, the Smart Shuttle is comprised of the Progressing Cavity Pump 6800 and the wiper plug assembly 6920.

FIG. 31 may be used to illustrate yet other preferred embodiments of the invention. The region of the well below the lower wiper plug assembly 6920 is designated by element 6802. The annular region of the well between the lower wiper plug assembly 6920 and the inflatable packer 7900 is designated by element 6804. The annular region of the well above the inflatable packer has already been designated by numeral 7726. In another preferred embodiment of the invention, the PCP may be used to pump fluids from region 6802 to region 6804. In this embodiment, valve 7832 is closed and the inflatable packer 7900 is in its uninflated state that is shown by the solid line in FIG. 31. In this embodiment, hydrocarbons produced from the well will be pumped to the surface through region 7726 of the well. In this case, the EHCU will heat the hydrocarbons to prevent any build up of wax, hydrates, or other blockage substances in the well. In yet another preferred embodiment of the invention, valve 7830 may also be left open, and in such case produced hydrocarbons would not only flow through region 7726 to the surface but also within the EHCU 7728 to the surface.

Other Embodiments Related to FIG. 31 Describing a Well Conveyance Apparatus

FIG. 31 shows the Electric Flowline Immersion Heater Assembly ("EFIHA") that is generally shown as numeral 7722. The downhole assembly is intrinsically a well conveyance device with a special attached Electrically Heated Composite Umbilical ("EHCU") 7724 in which wireline 7742 is positioned.

FIG. 31 shows an apparatus that may be used for other well conveyance purposes. In a preferred embodiment of the invention, the apparatus in FIG. 31 may be used as a well conveyance apparatus for conveying equipment into a wellbore. A new FIG. 31A could be provided as described in the next paragraph, but is not done so in the interests of brevity. The apparatus used for conveying equipment into a wellbore is designated as numeral 7722A in FIG. 31, which numeral is not shown for the purposes of brevity. In this new preferred embodiment of the invention, the borehole casing located within a wellbore is element 6782A in FIG. 31, which numeral is not shown for the purposes of brevity. In this new preferred embodiment of the invention, coiled tubing is designated as numeral 7724A in FIG. 31, which numeral is not shown for the purposes of brevity. The coiled tubing 7724A may be selected from any of the following: a steel coiled tubing; a coiled tubing made from aluminum alloy or titanium alloy; any coiled tubing made from any metallic substance; a composite coiled tubing; any type of coiled tubing used in the industry; or any type of threaded pipe segments joined together to form a tubular. In this new preferred embodiment of the invention, at least one hydraulic seal 7900A is attached to a mandrel body 7780A, which numerals are not shown for the purposes of brevity. In the location of the hydraulic seal as shown on the mandrel body is a hollow mandrel body. In this new preferred embodiment, attachment means 7180A are provided to attach equipment to the well conveyance apparatus. Any of the equipment shown in FIG. 26 can connected to the attachment means 7180A and can be deployed into the wellbore with the well conveyance apparatus. The equipment shown in FIG. 26 can be used to perform the tasks outlined in FIG. 27.

A new FIG. 31A can be drawn that is substantially the same as FIG. 31 except for the following changes: numeral 7722A is used in FIG. 31A to replace numeral 7722 in FIG. 31; numeral 6782A is used in FIG. 31A to replace numeral 6782 in FIG. 31; numeral 7724A is used in FIG. 31A to replace numeral 7724 in FIG. 31; numeral 7780A in used in FIG. 31A to replace numeral 7780 in FIG. 31; numeral 7780A is used in FIG. 31A to replace numeral 7780 in FIG. 31; numeral 7900A is used in FIG. 31A to replace numeral 7900 in FIG. 31; and numeral 7780A is used in FIG. 31A to replace numeral 7780 in FIG. 31.

Figure 32:
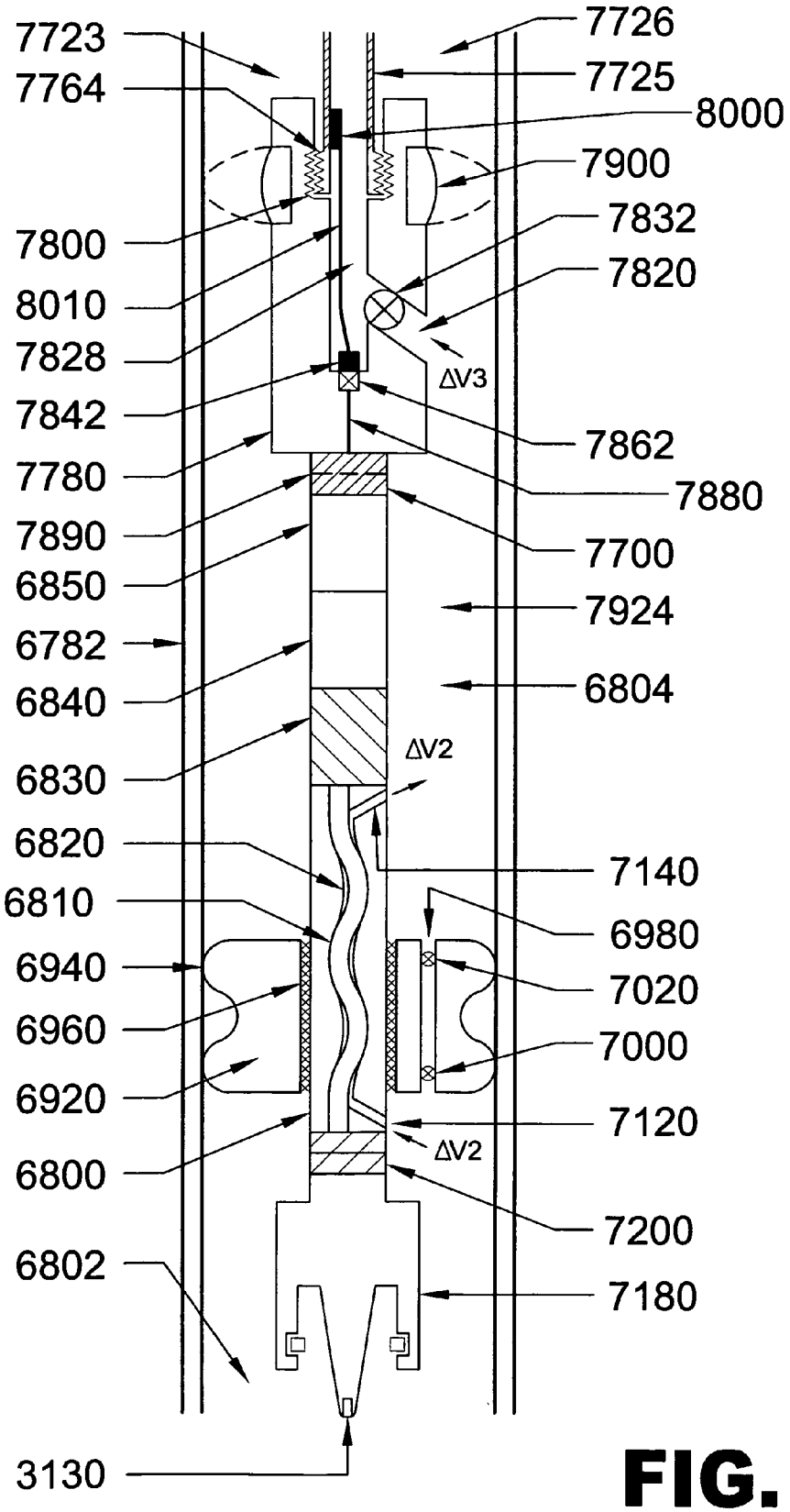
FIG. 32 shows another embodiment of an Electric Flowline Immersion Heater Assembly ("EHCU") having an Electrically Heated Composite Umbilical in a subsea flowline that was conveyed into place using a Smart Shuttle that obtains its electrical power from additional electrical conductors within the EHCU.

In FIG. 32, all the elements have been described except elements 7723, 7725, 7764, 7842, 7862, 7924, 8000, and 8010. In FIG. 32, there is no wireline within the Electrically Heated Composite Umbilical ("EHCU") 7725. In FIG. 32, an Electric Flowline Immersion Heater Assembly ("EFIHA") is generally shown as numeral 7723 having an Electrically Heated Composite Umbilical ("EHCU") 7725 that is conveyed into steel flowline 6782. Tubing Termination Assembly 7780 has threads 7800 that mate to the threaded end 7764 of EHCU 7725. Element 7924 in FIG. 32 generally designates the Smart Shuttle Conveyed Electric Flowline Immersion Heater Assembly ("SSCEFIHA") disposed within the flowline 6782.

The EHCU 7725 possesses electrical heater wires, power cables, any hydraulic tubes, fiber-optic cables, etc. within the wall thickness of the EHCU. The wall thickness of the EHCU is defined by the legend "WT(EHCU)", although that legend is not shown in FIG. 32 for the purposes of simplicity. Assembly 8000 provides means to pass the heater wires, power cables, any hydraulic cables, fiber-optic cables, etc. from within the wall thickness of the EHCU to jumper 8010 that connects to connector 7842 that in turn mates to connector 7862.

In FIG. 32, the Smart Shuttle is comprised of the Progressing Cavity Pump 6800 and the wiper plug assembly 6920. In one mode of operation of a preferred embodiment, fluid is pumped from the bottom side of the wiper plug assembly to the top side of the wiper plug assembly, and with expandable packer 7900 in the collapsed position shown in FIG. 32, the Smart Shuttle will convey the Electric Flowline Immersion Heater Assembly ("EFIHA") 7723 down into flowline 6782 (provided valve 7832 is open, and valves 6980 and 7000 are closed).

Other Embodiments Related to FIG. 32 Describing a Well Conveyance Apparatus

FIG. 32 shows the Smart Shuttle Conveyed Electric Flowline Immersion Heater Assembly ("SSCEFIHA") that is generally designated with numeral 7924. The downhole assembly is intrinsically a well conveyance device with a special attached Electrically Heated Composite Umbilical ("EHCU") designated by numeral 7725, which has no wireline on its interior.

FIG. 32 shows an apparatus that may be used for other purposes. In a preferred embodiment of the invention, the apparatus in FIG. 32 may be used as a well conveyance apparatus for conveying equipment into a wellbore. A new FIG. 32A could be provided as described in the next paragraph, but is not done so in the interests of brevity. The apparatus used for conveying equipment into a wellbore is designated as numeral 7724A in FIG. 32, which numeral is not shown for the purposes of brevity. In this new preferred embodiment of the invention, the borehole casing located within a wellbore is element 6782A in FIG. 32, which numeral is not shown for the purposes of brevity. In this new preferred embodiment of the invention, a composite umbilical is designated as numeral 7725A in FIG. 32, which numeral is not shown for the purposes of brevity. In certain preferred embodiments, the composite umbilical may be selected from any of those shown in FIGS. 1, 1A, 1B, or may be any other umbilical that has a fluid channel, electrical conductors, and can provide the strength requirements for borehole use. In this preferred embodiment, at least one hydraulic seal 7900A is attached to hollow mandrel body 7780A, which numerals are not sown for the purposes of brevity. In this new preferred embodiment, attachment means 7180A are provided to attach equipment to the well conveyance apparatus. Any of the equipment shown in FIG. 26 can connected to the attachment means 7180A and can be deployed into the wellbore with the well conveyance apparatus. The equipment shown in FIG. 26 can be used to perform the tasks outlined in FIG. 27.

A new FIG. 32A can be drawn that is substantially the same as FIG. 32 except for the following changes: numeral 7724A is used in FIG. 32A to replace numeral 7724 in FIG. 32; numeral 6782A is used in FIG. 32A to replace numeral 6782 in FIG. 32; numeral 7725A is used in FIG. 32A to replace numeral 7725 in FIG. 32; numeral 7900A is used in FIG. 32A to replace numeral 7900 in FIG. 32; numeral 7780A in FIG. 32A is used to replace numeral 7780 in FIG. 32; and numeral 7180A in FIG. 32A is used to replace numeral 7180 in FIG. 32.

Figure 33:
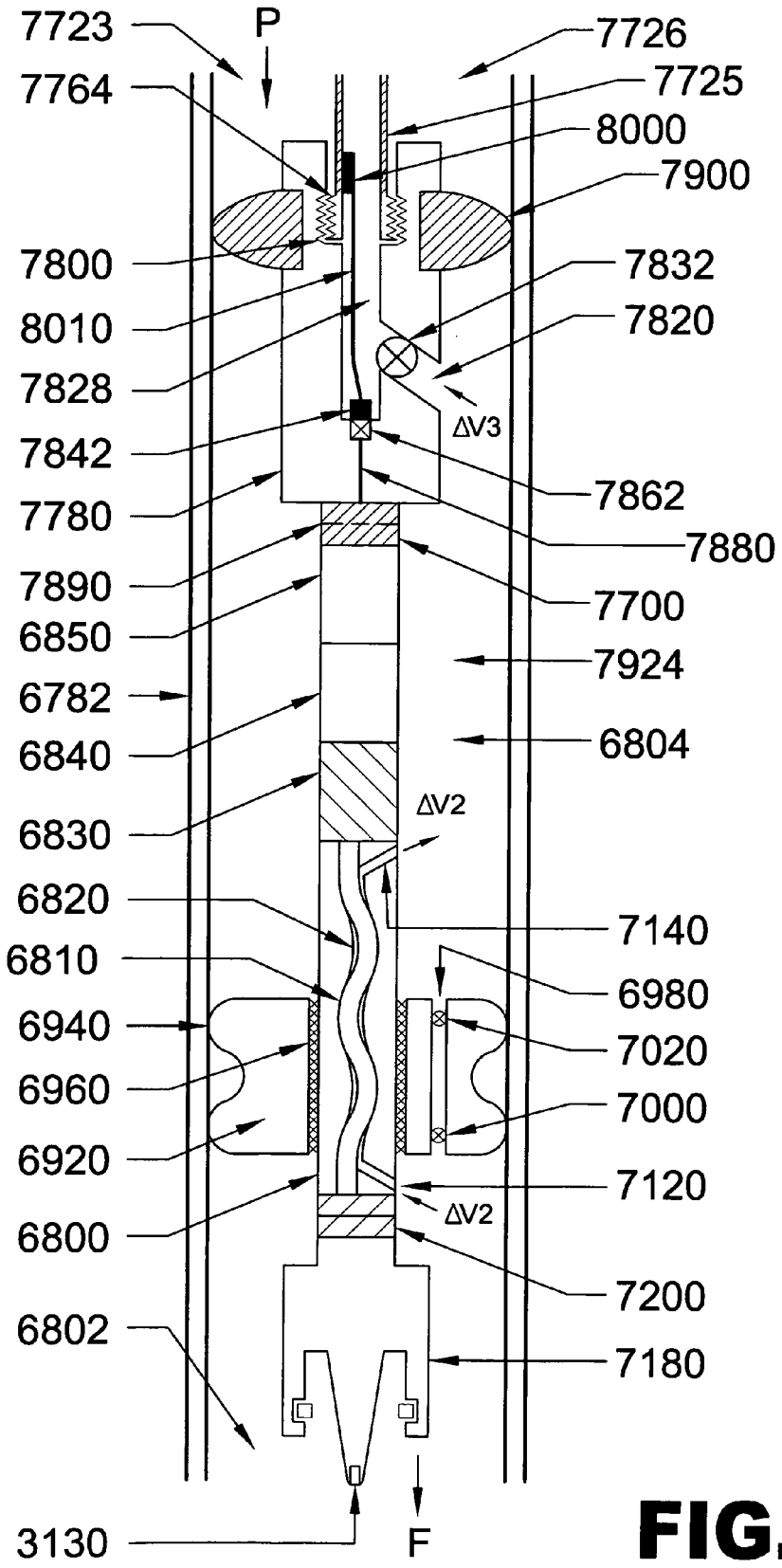
FIG. 33 shows yet another embodiment of an Electric Flowline Immersion Heater Assembly ("EFIHA") having an Electrically Heated Composite Umbilical in a subsea flowline that was conveyed into place using particular methods of operation so that no fluid will be forced into the reservoir during transit of the EFIHA into the flowline.

FIG. 33 is similar to FIG. 32, except here, expandable packer 7900, is in its extended position and makes contact with the interior wall of the flowline that is shown by the expanded solid line that is shaded. In this case, fluid pressure P provided to annular region 7726 by pumps located on the host (such as a floating platform), provide a net downward force on the assembly shown in FIG. 33. There are several different modes of operation that amount to different preferred embodiments of the invention.

In a first preferred embodiment, the Progressive Cavity Pump is turned on, valves 6980 and 7000 are closed, and valve 7832 is open. Here, the volume pumped by the Progressive Cavity Pump is $\Delta V2$ is equal to $\Delta V3$. Further, the volume pumped $\Delta V3$ is equal to the fluid displaced in the flowline during the downward travel of the apparatus shown in FIG. 33. Therefore, if any portion of the flowline is open to a reservoirs, or other source of fluid, below the apparatus shown in FIG. 33 (in region 6802), no fluid will be forced into those reservoirs, or other sources of fluid due to the downward motion of that apparatus. In another embodiment of the invention, the volume pumped by the Progressive Cavity Pump $\Delta V2$ is always equal to, or greater than $\Delta V3$. In yet another embodiment of the invention, the volume pumped by the Progressive Cavity Pump is $\Delta V2$ is substantially equal to $\Delta V3$. Many other variants of this preferred embodiment are possible. This particular method of conveyance of coiled tubings into cased wellbores was substantially described on page 67, lines 53-67, and on page 68, lines 1-4, of U.S. Pat. No. 6,387,946 B1.

In a second preferred embodiment, the Progressive Cavity Pump is turned off, valves 6980, 7000, and 7832 are open, and the pressure P forces Electric Flowline Immersion Heater Assembly ("EFIHA") 7723 down into flowline 6782.

Similar changes may be made to FIG. 33 to generate a new FIG. 33A as described in relation to generating a new FIG. 32A from FIG. 32. However, in the interests of brevity, those details will not be repeated here.

Figure 34:
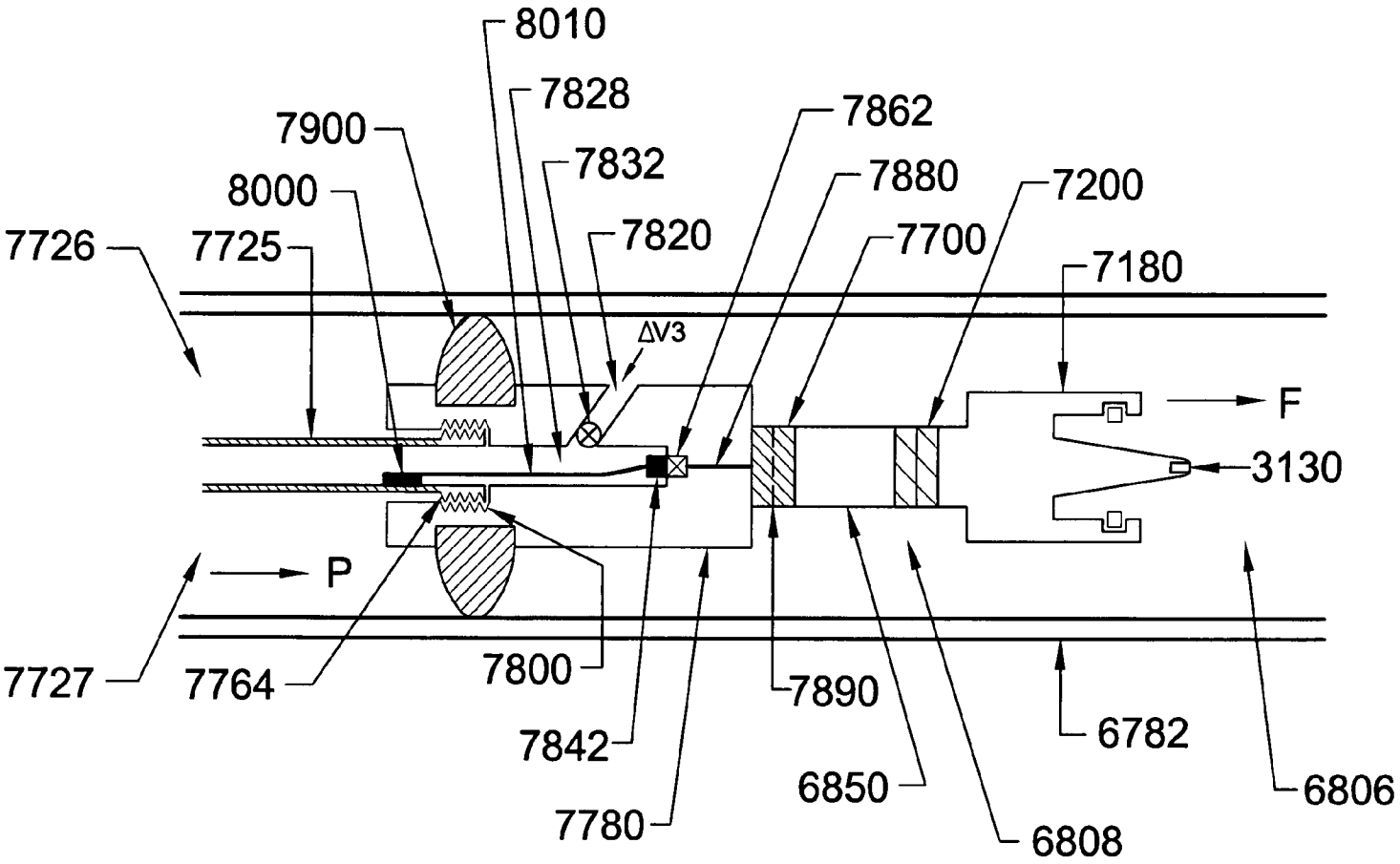
FIG. 34 shows still another embodiment of an Electric Flowline Immersion Heater Assembly having an Electrically Heated Composite Umbilical in a subsea flowline that was conveyed into place using yet another method of conveyance.

FIG. 34 shows yet another preferred embodiment of the invention that shows an Electric Flowline Immersion Heater Assembly ("EFIHA") 7727 generally disposed in a flowline 6782. Element 6806 shows the annular portion of the wellbore below the EFIHA, element 6808 shows the annular region of the well above the Retrieval Sub 7180 and below the inflatable packer 7900, and the region of the well above the inflatable packer 7726 has been previously defined. The other numerals have already been defined in FIG. 34. Functionally, this is very similar to the "second preferred embodiment" described in the previous paragraph. The Smart Shuttle in FIG. 33 has been removed to make the apparatus in FIG. 34. In this embodiment, valve 7832 is open, and the pressure P forces Electric Flowing Immersion Heater Assembly ("EFIHA") 7727 into the flowline. This installs the Electrically Heated Composite Umbilical ("EHCU") 7725 within flowline 6782.

Similar changes may be made to FIG. 34 to generate a new FIG. 34A as described in relation to generating a new FIG. 32A from FIG. 32. However, in the interests of brevity, those details will not be repeated here.

In relation to FIGS. 31-34, slip-ring mechanisms, or swivel mechanisms, may be suitably incorporated within portions of the apparatus that will prevent torque from building up in the coiled tubing, or composite umbilical, as the case may be, although such devices are not shown in any of these FIGS. 31-34 for the purposes of simplicity. Standard techniques that are currently used in the industry may be used to design and fabricate such slip-ring mechanisms, or swivel mechanisms.

Figure 35:
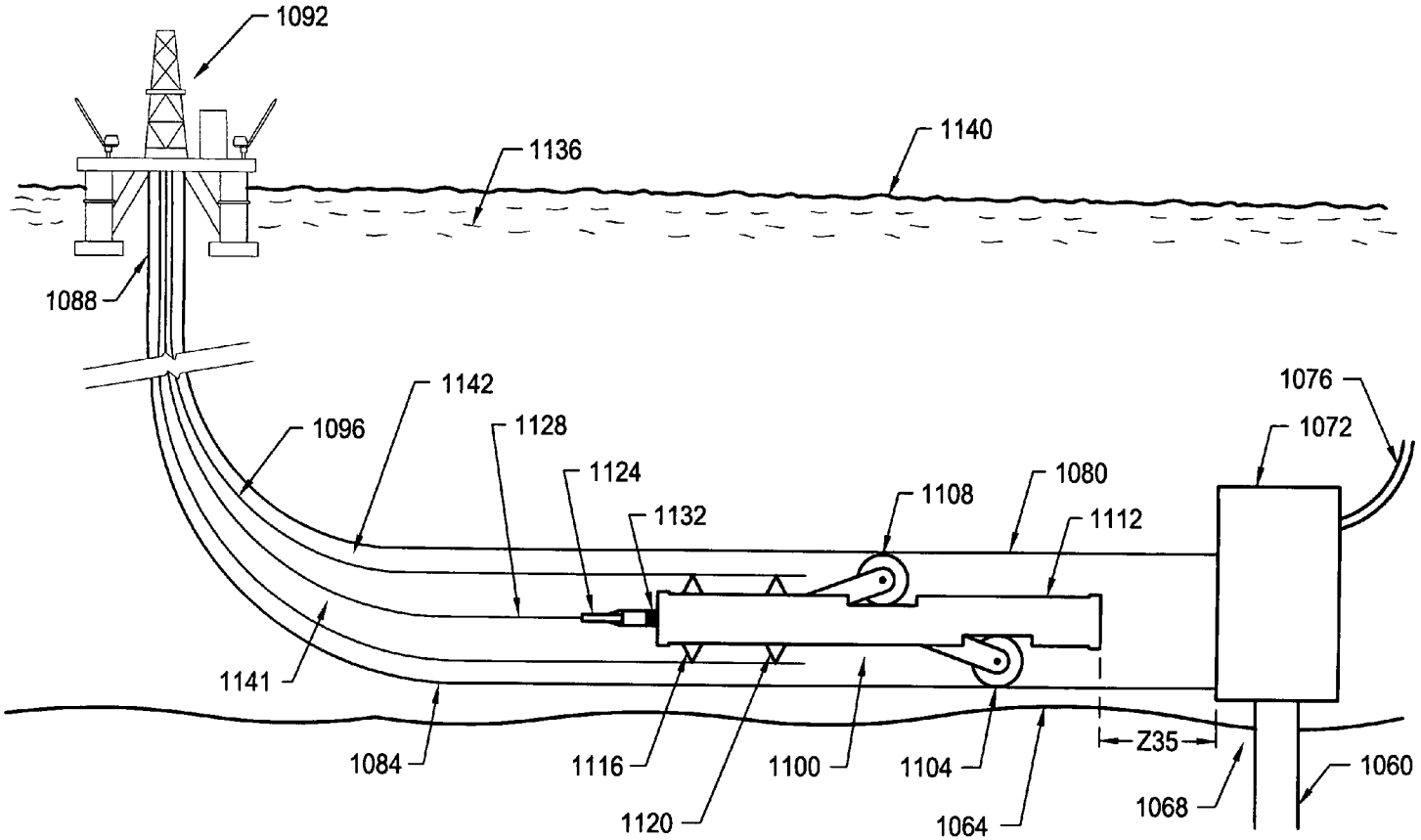
FIG. 35 shows an Electrically Heated Composite Umbilical being installed within a flowline by a tractor means, where the host of the flowline is a floating platform.

FIG. 35 shows cased well 1060 penetrating the sea bottom 1064 at location 1068. Steel cased well 1060 is attached to XMas Tree 1072 having control means 1076. The XMas Tree 1072 is attached to steel flowline 1080 that lies on the sea bottom until location 1084. At location 1084 the flowline begins its ascent to the upper portion of the flowline 1088, also known as a riser, that is connected to floating platform 1092.

For the purposes of this invention, the term "Xmas Tree", "subsea wellhead", and "wellhead" may be used interchangeably.

FIG. 35 shows an Electrically Heated Composite Umbilical ("EHCU") 1096 being installed within the flowline 1080 by tractor means 1100 having retractable traction wheels 1104 and 1108, tractor body 1112, tractor locking mechanisms 1116 and 1120, cablehead 1124 obtaining electrical power and control signals from wireline 1128 (which may also be an umbilical). The cablehead provides electrical power and control signals to the tractor body through connector 1132 which in turn provides electrical power and control signals to run the electrical motors that energize the traction wheels. The floating platform floats in ocean 1136 having ocean surface 1140.

In FIG. 35, the EHCU is locked to the tractor means by the tractor locking mechanisms. The traction wheels of the tractor means drags the EHCU into the flowline. After the EHCU reaches a particular distance Z35 away from the XMas Tree, then the traction wheels are turned off. The legend Z35 is defined in FIG. 35. Thereafter, the tractor locking mechanisms are released, and the traction wheels of the tractor means are retracted into the body of the tractor. The tractor means is then pulled out of the well by pulling on the wireline 1128. The EHCU is left installed in place within the flowline. Not shown in FIG. 35 are locking mechanisms 1122 and 1123 on the EHCU which will lock it in place within the flowline during production operations. In one preferred embodiment, produced oil and gas flows through the interior of the EHCU 1141 to the surface. In another preferred embodiment, produced oil and gas flows through the region between the inside diameter of the flowline and the outside diameter of the EHCU that is region 1142 in FIG. 35. In yet another embodiment, the production can flow through both regions 1141 and 1142.

Figure 36:
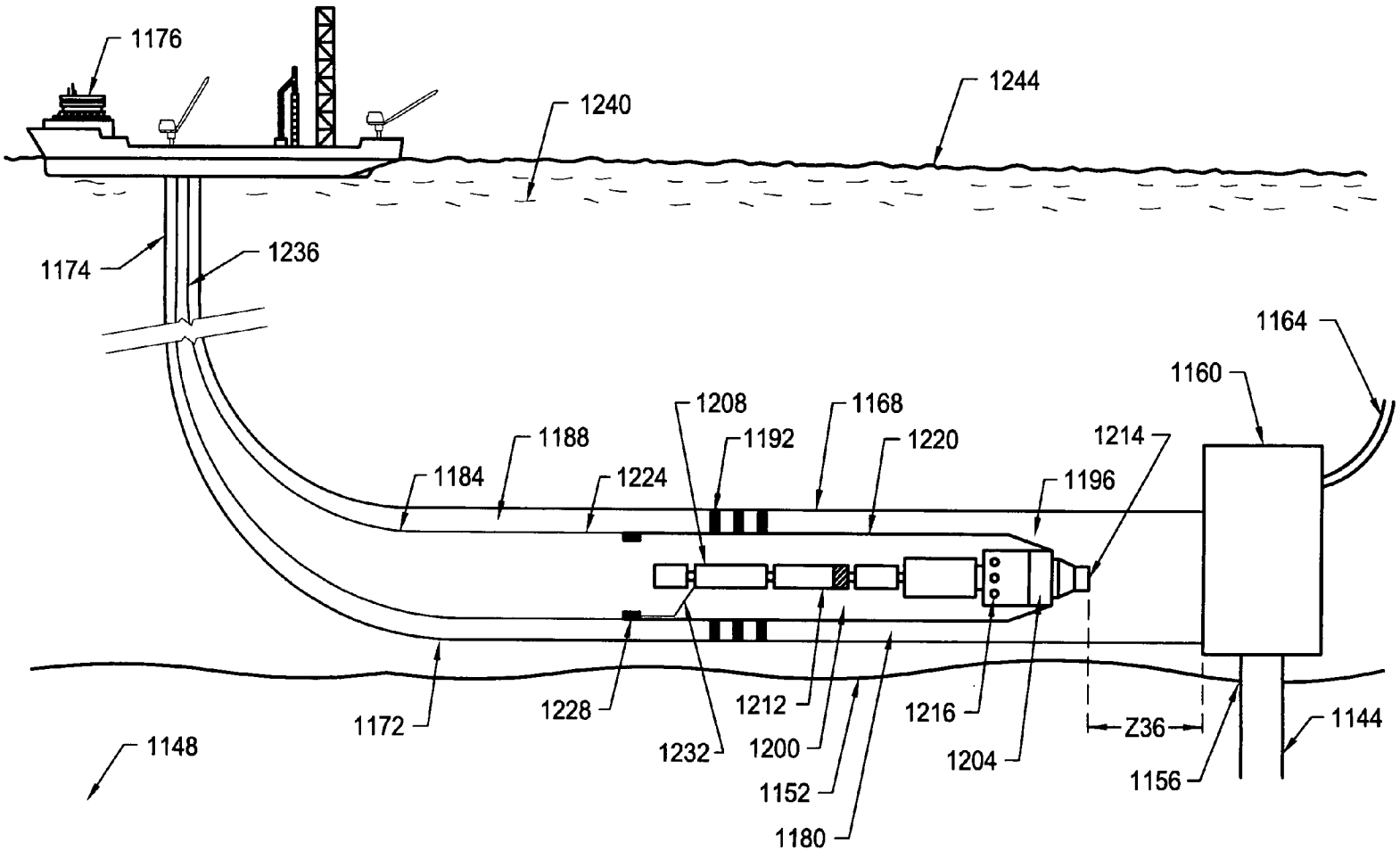
FIG. 36 shows a Pump-Down Conveyed Flowline Immersion Heater Assembly ("PDCFIHA") possessing an Electrically Heated Composite Umbilical ("EHCU") installed within a flowline, where the host of the flowline is a Floating Production, Storage and Offloading ("FPSO") ship.

In FIG. 36, steel cased well 1144 is located within a geological formation 1148 that penetrates the sea bottom 1152 at location 1156. Steel cased well terminates in XMas Tree 1160 having control means 1164. Steel flowline 1168 is attached to the XMas Tree and rests on the bottom of the sea until location 1172 at which point it raises towards the upper end of the flowline, which is riser 1174, that is connected to Floating Production, Storage and Offloading (FPSO) ship 1176.

The Pump-Down Conveyed Flowline Immersion Heater Assembly ("PDCFIHA") is generally shown as element 1180 in FIG. 36. A portion of this apparatus includes an Electrically Heated Composite Umbilical ("EHCU") 1184. Hydraulic pressure P in the annular space between the inside diameter of the flowline and the outside diameter of the EHCU, which space is designated by numeral 1188 in FIG. 36, applies a force F to the hydraulic seals 1192 attached to the PDCFIHA. Three seals are shown in FIG. 36 which are collectively labeled as element 1192 in FIG. 36. The hydraulic pressure P is used to carry the PDCFIHA into place a distance Z36 away from the XMas Tree. The legend Z36 is defined in FIG. 36.

If the control means 1164 has closed a valve connecting the flowline to the XMas Tree, then the displaced fluid from annular region 1196 must go somewhere. A downhole pump motor assembly is generally shown as element 1200 in FIG. 36 which is very similar to that shown in FIG. 8 herein. So, the detailed elements of the downhole pump motor assembly will not be labeled in the interests of simplicity. However, this downhole pump motor assembly possesses hydraulic pump 1204 that energized by electrical motors 1208 and 1212. Crude production flows into orifice 1214 of the hydraulic pump, and exits from the orifices collectively identified with numeral 1216 in FIG. 36. This exiting fluid is trapped within pump shroud 1220 that is attached to the EHCU at location 1224. Electrical power and control signals are provided by internal conductors and/or fiber optic cables within the walls of the EHCU, are broken out of the wall of the EHCU by apparatus 1228 that provides power and control signals to the downhole pump motor assembly by jumper 1232. The fluid then flows through the pump shroud and then through the EHCU towards the upper portion of the EHCU 1236 that is connected to the FPSO ship. If the volume produced by the hydraulic pump "V35P" exceeds the volume "V35D" displaced by the downward movement of the PDCFIHA, then the PDCFIHA can proceed into the well.

Even if the control means 1164 allowed the valve from the flowline to the cased well to remain open (said valve is not shown in FIG. 36 for simplicity), as long as V35P exceeds the volume V25D, then no fluid will flow back into the steel cased well. FPSO ship is located in ocean 1240 having ocean surface 1244.

Figure 37:
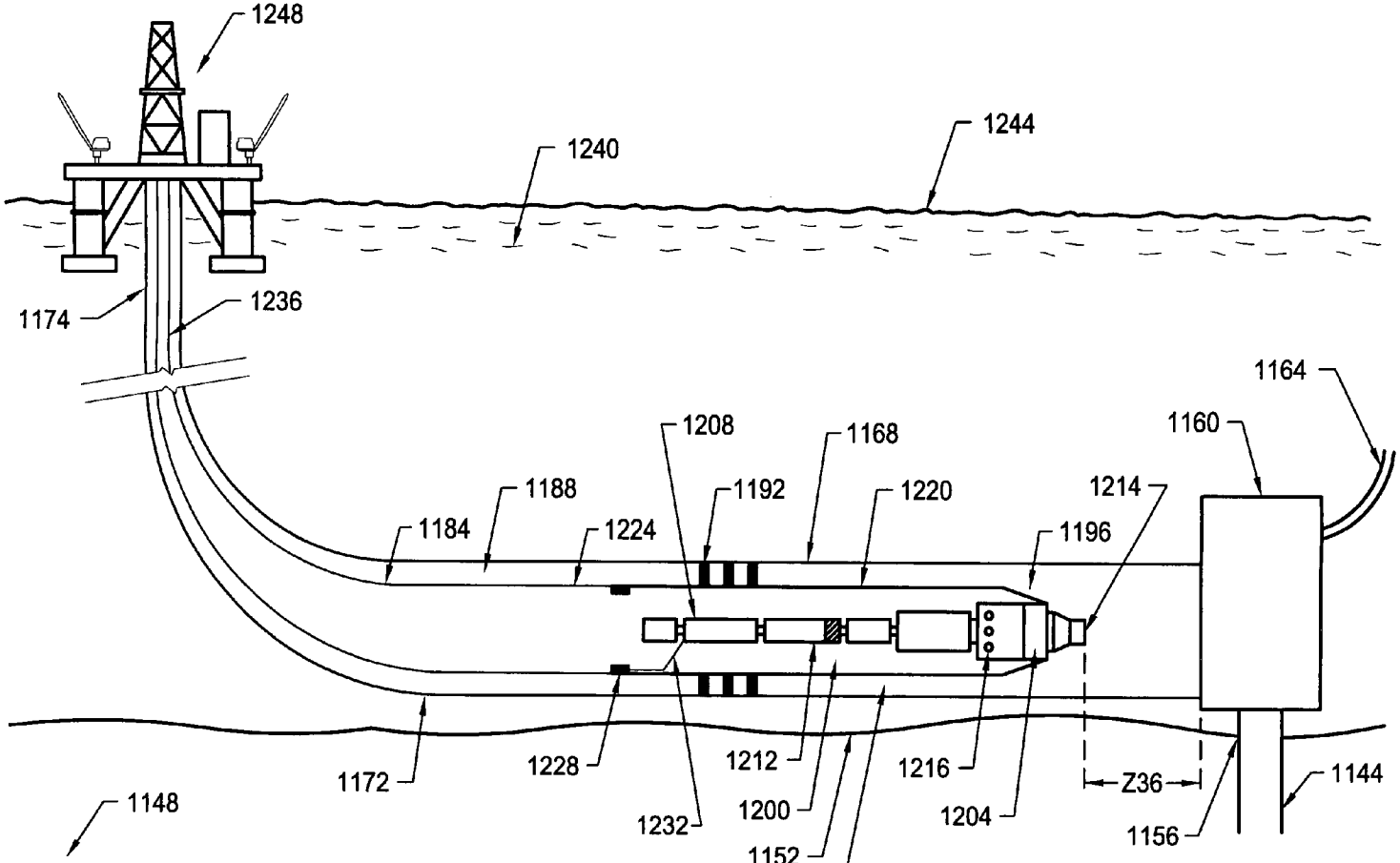
FIG. 37 shows a Pump-Down Conveyed Flowline Immersion Heater Assembly ("PDCFIHA") installed within a flowline, where the host of the flowline is a floating platform.

FIG. 37 is very similar to FIG. 36, except here the host is floating platform 1248. All the other numerals in FIG. 37 have already been otherwise identified and described in FIG. 36.

Figure 37A:
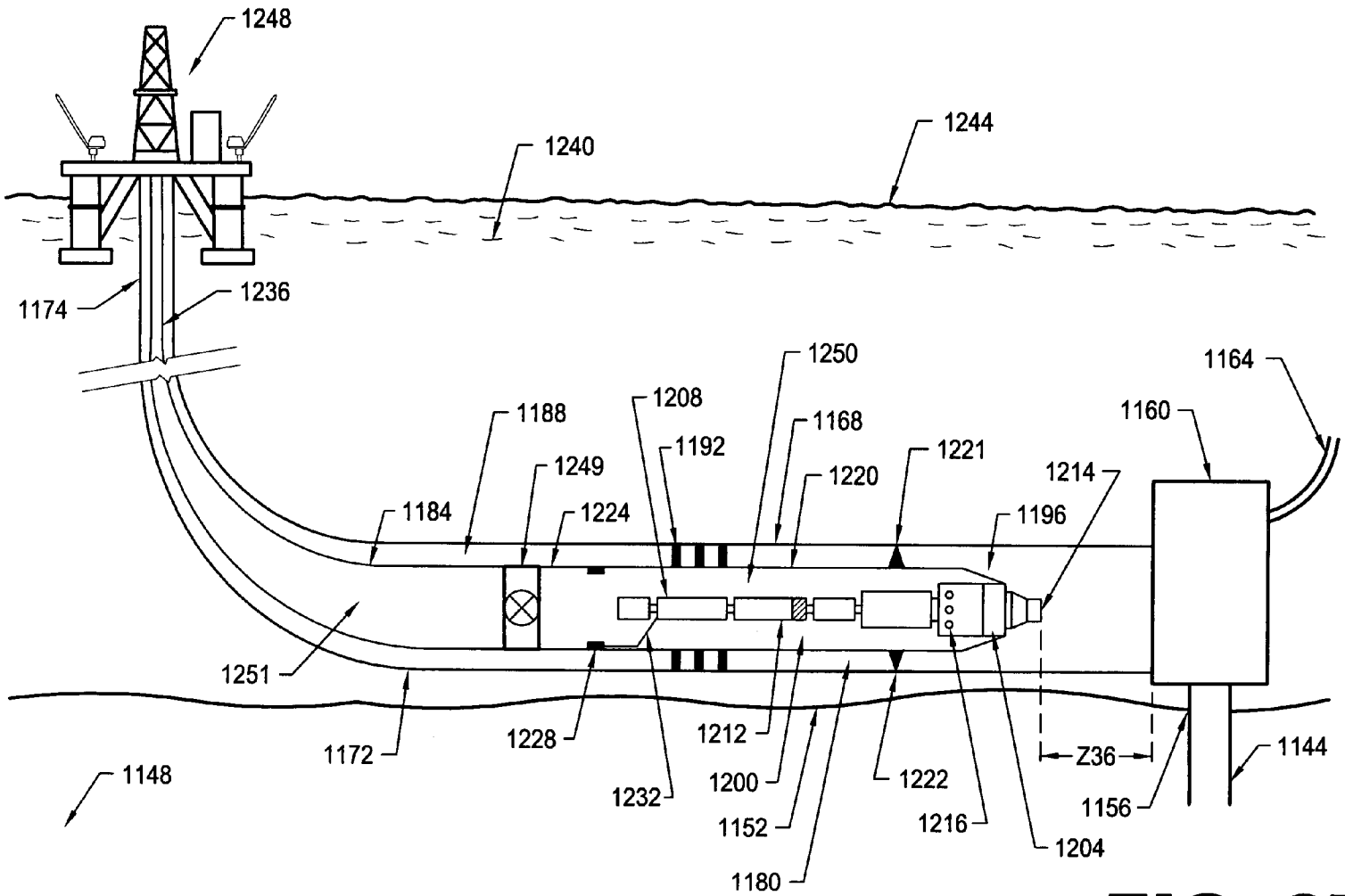
FIG. 37A shows a Pump-Down Conveyed Flowline Immersion Heater Assembly ("PDCFIHA") installed within a flowline to be used for artificial lift during hydrocarbon production, where the host of the flowline is a floating platform.

In FIG. 37A, all the numerals have been defined except those described in the following within this paragraph. Locks 1221 and 1222 serve to lock the "PDCFIHA" into place after it has been pumped down into the well. In one preferred embodiment, cross-over valve 1249 allows fluid flowing in region 1250 between the downhole pump motor assembly 1200 and the pump shroud 1220 to be directed into annular region 1188. Then production would flow through annular region 1188 to the surface. In yet another embodiment of the invention, the cross-over valve 1249 would allow fluid to not only flow through annular region 1128 to the surface but fluid would also be allowed to flow in the inside of the EHCU 1251 in that portion of the EHCU that is between the floating platform and cross-over valve 1249. In yet another embodiment, the cross-over valve 1249 may be chosen to direct production to region 1251 only; to region 1184 only; and to regions 1251 and 1184 simultaneously. After the locks 1221 and 1222 are deployed, the hydraulic pump 1204 may be used to assist well production by providing artificial lift.

Figure 38:
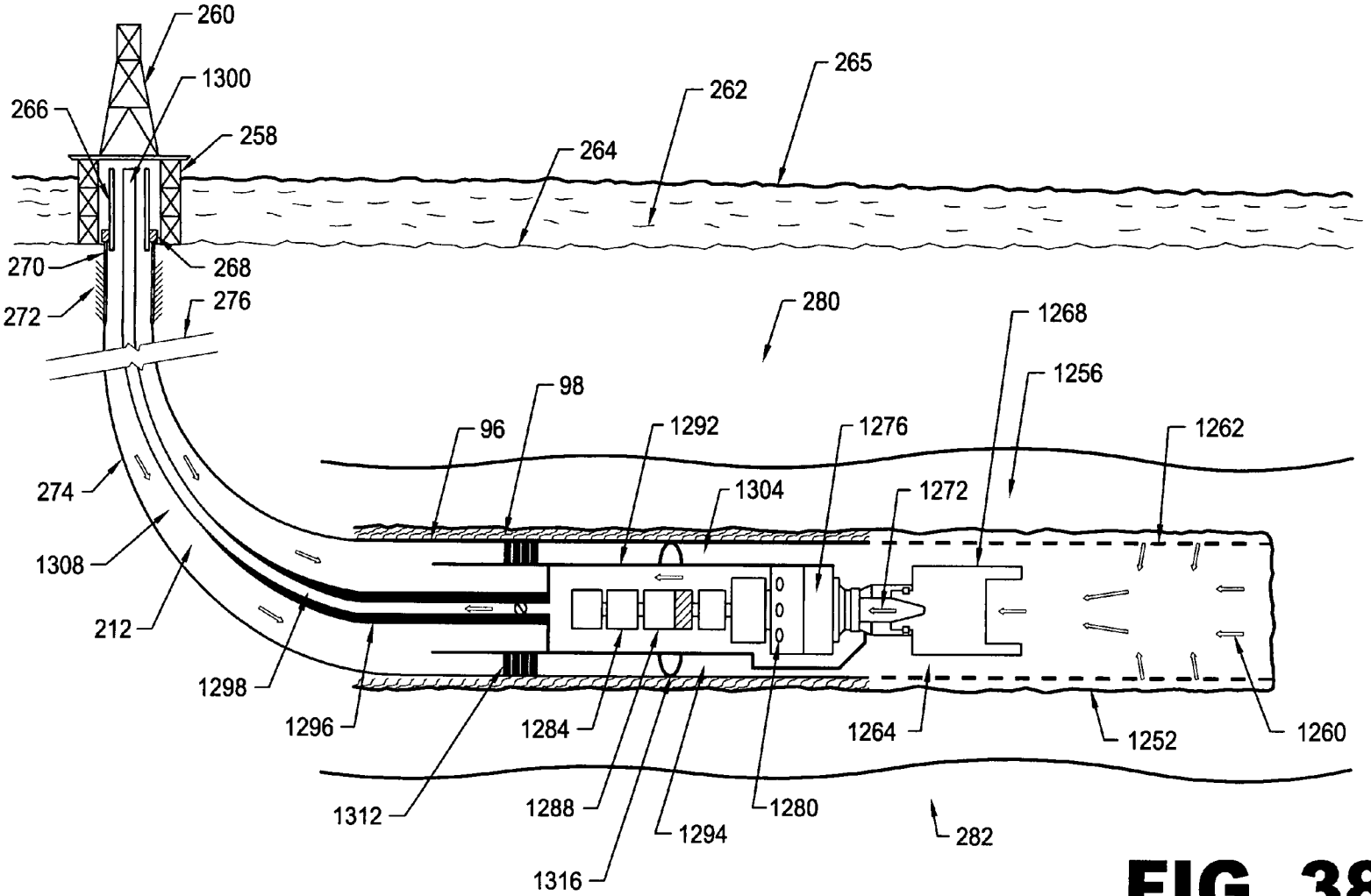
FIG. 38 shows an Electric Flowline Immersion Heater Assembly ("EFIHA") which possesses an Electrical Heated Composite Umbilical that is used to produce heavy oil from an open borehole that also uses a hydraulic pump for artificial lift.

In FIG. 38, all the elements having numerals less than 280 have been described in relation to FIG. 9 herein. However, casing 274 in FIG. 38 may also include other forms of tubulars, including tubing. Open hole completion 1252 in a reservoir with heavy oil 1256 causes heavy oil 1260 to flow through expanded screen 1262 into the open hole 1264. Heavy oil flows into the inflow assembly 1268, thorough intake orifice 1272, into hydraulic pump 1276, and out exhaust orifices that are collectively labeled with 1280 in FIG. 38. Electric motors 1284 and 1288 provide the power to drive the hydraulic pump. After the heavy oil emerges from the exhaust orifices, it is trapped by shroud 1292 that is connected to Electrically Heated Composite Umbilical ("EHCU") 1296. The annular region inside the shroud open to fluid flow is defined by numeral 1294. The heated production proceeds through the inside of EHCU 1298 towards the top of the EHCU 1300 attached to platform 258. Electrical power and control signals are provided to the electric motors by electrical conductors and by fiber optic fibers within the wall thickness of the EHCU. The hydraulic pump provides artificial lift to the heavy oil produced.

The Electric Flowline Immersion Heater Assembly ("EFIHA") is generally designated with element 1304 in FIG. 38 which includes the Electrical Heated Composite Umbilical 1296. In this case, hydraulic pressure P applied at the platform in the annular region between the outside diameter of the EHCU and the inside diameter of the casing 274, which is region 1308, provides a force on seals 1312 that forces the EFIHA down into the well. Guides 1316 help centralize the EFIHA. As the EFIHA is forced downhole, a certain displaced fluid volume V38D could be forced back into formation which could damage the formation. However, if the hydraulic pump forces a volume V38P into the EHCU, then provided that V38P is greater than V38D at all times, then no fluid is forced back into the open hole. This is important to prevent formation damage from "back flow".

In one of the preferred embodiments above, fluid flow from the open hole 1264 is caused to flow through region 1294 and then through the interior of the EHCU 1290 to the surface. As described above, a cross-over valve can be installed that will allow production to flow instead through region 1308 to the surface. And yet another embodiment would allow production to flow through both regions 1298 and 1308 to the surface.

The EHCU provides heat to reduce the viscosity of the heavy oil produced from the open hole. Therefore, the artificial lift provided by the hydraulic pump is used efficiently to produce heavy oil.

Exploratory Well with Sampling Capability

Figure 39:
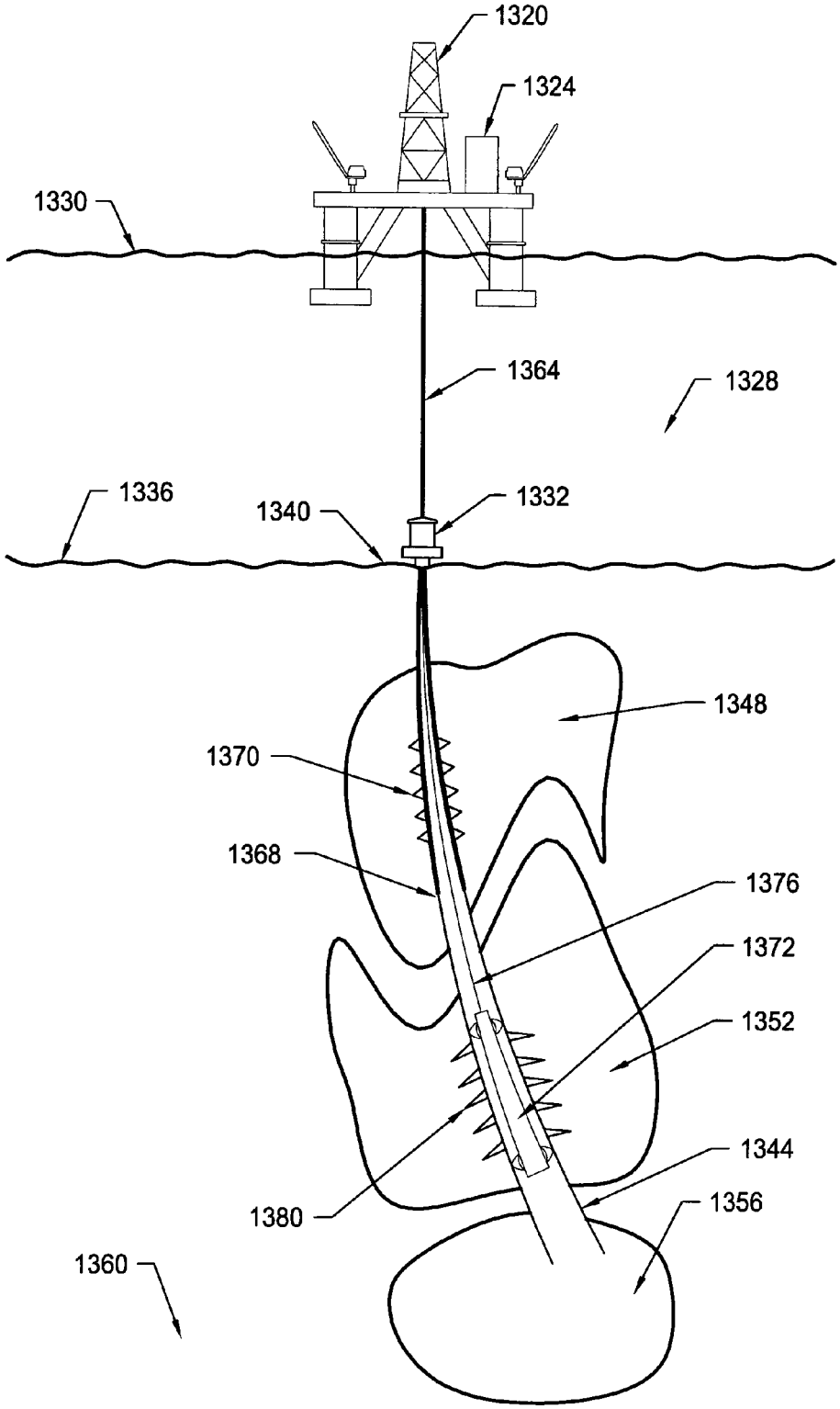
FIG. 39 an exploratory will with large volume fluid sampling capability obtained from a downhole sampling unit.

FIG. 39 shows an exploratory will with large volume fluid sampling capability. FIG. 39 shows a floating platform 1320 with a small separator with fluid storage 1324 in ocean 1328 having ocean surface 1330. Marine blowout preventer ("BOP") 1332 is shown on ocean bottom 1336 at location 1340. Borehole 1344 penetrates a first geological formation 1348, a second geological formation 1352, and a third geological formation 1356 in earth 1360. Casing 1364 penetrates the BOP and lines the borehole down to location 1368. Perforations 1370 were made into producing intervals in the first geological formation 1348. Downhole sampling unit shown as element 1372 in FIG. 39 possesses an open hole packer, with a sand screen filter, and a pump. The pump is used to pump samples up insulated and heated coiled tubing 1376 through the casing to the small separator with fluid storage 1324 on the floating platform. Perforations 1380 were made into intervals to be tested in second geological formation 1352. In a preferred embodiment, electrical power to operate the pump is obtained from electrical wires that are in the wall thickness of an umbilical as described earlier. On another preferred embodiment the heated tubing is comprised of an Electrical Heated Composite Umbilical (EHCU) as previously described above.

In relation to FIG. 39, heated coiled tubing that is pumped will allow large reservoir fluid samples to be collected without the expense of a downhole completion. In an emergency, the coiled tubing is cut at the marine BOP and the downhole pump shuts in the coiled tube to prevent a blowout path. Applications include areas with soft sandstone and areas where larger fluid volumes are required to determine the reservoir production fluid properties.

Providing Power to Subsea Systems

Figure 40:
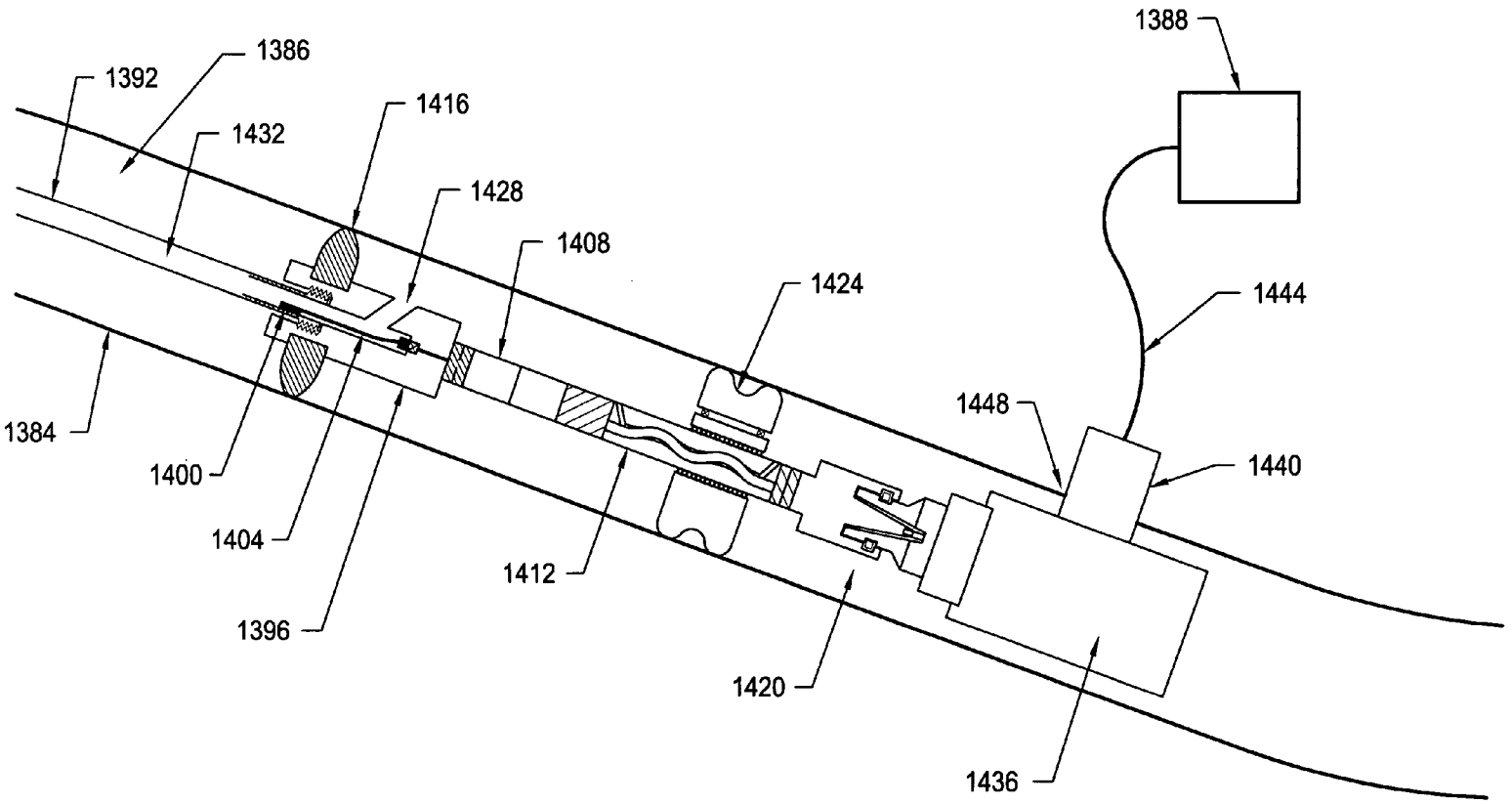
FIG. 40 shows an apparatus that provides electrical power from a flowline penetrating connector to other subsea systems.

FIG. 40 shows an apparatus that provides power to upstream functions. In preferred embodiments, this would apply to subsea systems that are external to a flowline. In FIG. 40, flowline 1384 is in the vicinity of a subsea installation 1388 that requires electrical power. Composite umbilical 1392 is attached to first assembly 1396. Composite umbilical 1392 possesses electrical wires within its wall thickness that are broken out by assembly 1400 that is connected to jumper 1404. The electrical power is used to energize electric motor 1408 that is used to energize Progressing Cavity Pump 1412. As has been described in relation to other embodiments above, pressure provided by an external source in the annular region between the outside diameter of the composite umbilical and the inside diameter of the flowline acting on hydraulic seal 1416 forces the entire apparatus collectively called the "Connector Apparatus" 1420 into the flowline. The annular region between the outside diameter of the composite umbilical and the inside diameter of the flowline is defined as element 1386 in FIG. 40. As previously described, the Progressing Cavity Pump, in conjunction with seals 1424, is used to pump displaced fluid through channel 1428 into the interior of the composite umbilical 1432 for return to the surface. Landing and locating shoulder 1436 is used to provide electrical power to the flowline penetrating connector 1440. Subsea power cable 1444 is attached to the flowline penetrating connector 1440. The flowline penetrating connector 1440 is placed into its proper position 1448 by an ROV. In various different embodiments, the flowline is penetrated for electrical, chemical and hydraulic power. This approach minimizes umbilical costs to small installations.

Designs of Electrically Heated Umbilicals

Figure 41:
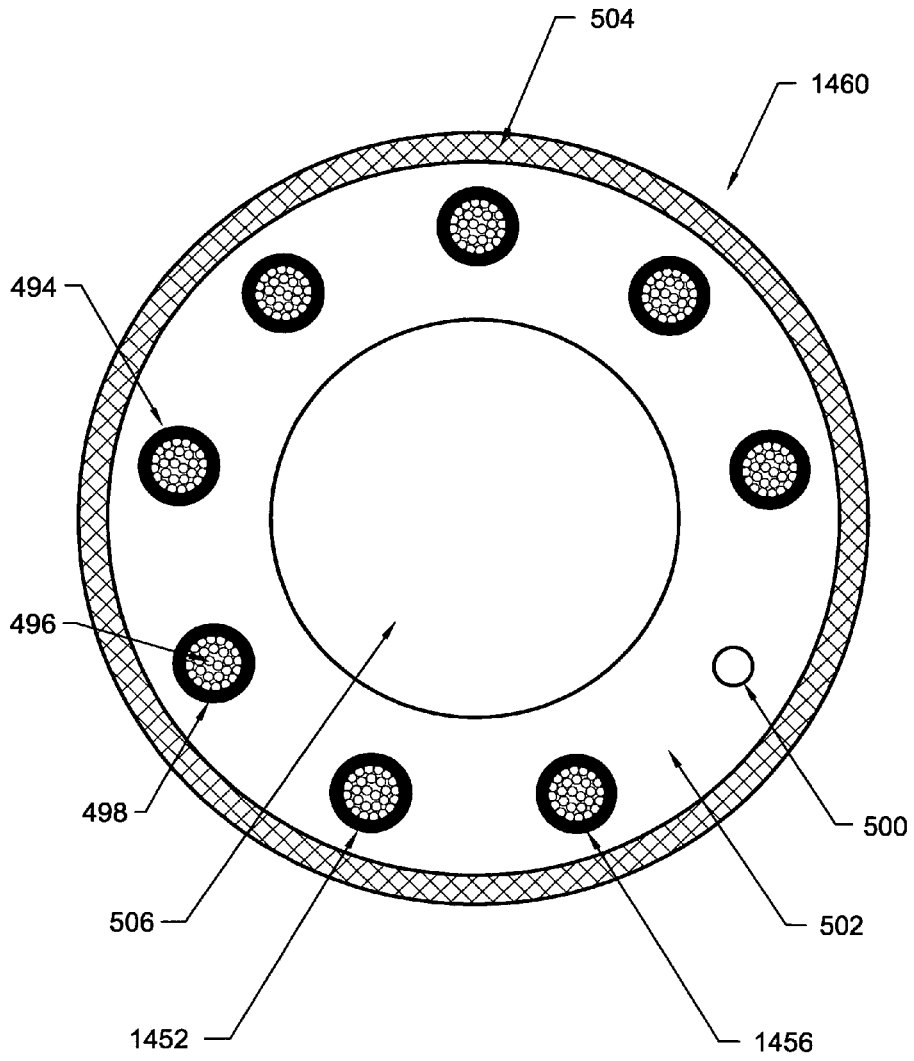
FIG. 41 shows one embodiment of a composite umbilical used to uniformly heat a flowline.

FIG. 41, all the elements through element 506 have been defined previously. In addition, two of the electrically insulated wires 1452 and 1456 are used to uniformly electrically heat composite umbilical 1460 in FIG. 41.

Figure 42:
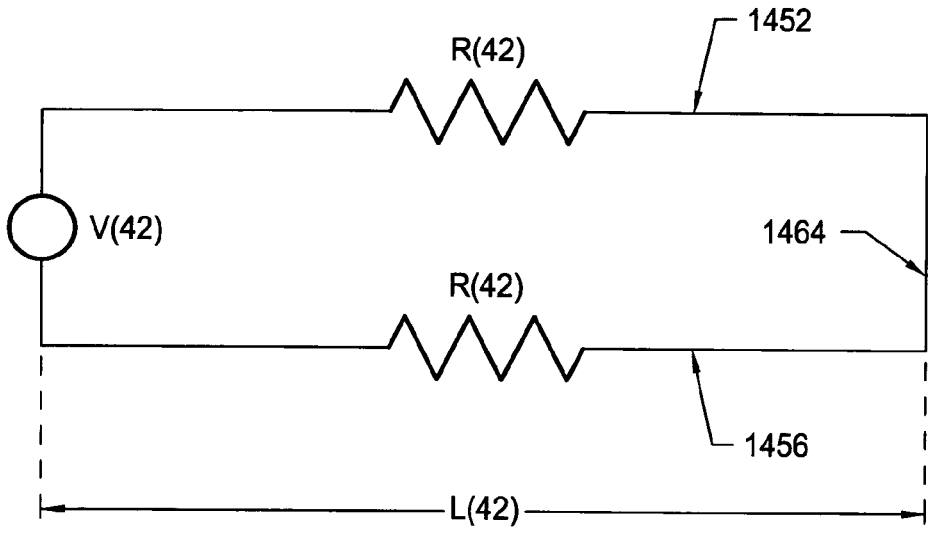
FIG. 42 shows a first resistor network used to electrically heat a composite umbilical.

FIG. 42 shows one embodiment of a first resistor network used to electrically heat composite umbilicals. Here, wires 1452 and 1456 have uniform resistance per unit length. The total resistance of each one of these electrically insulated wires is R(42) in ohms. These wires are connected together at the lower end of the composite umbilical shown by electrical jumper 1464. The total length of each wire in the composite umbilical is L(42), a legend that is defined on FIG. 42. The legend V(42) in FIG. 42 shows the voltage V(42) applied uphole to the resistive network. This first resistive network will result in uniform heating of the electrically heated composite umbilical.

Figure 43:
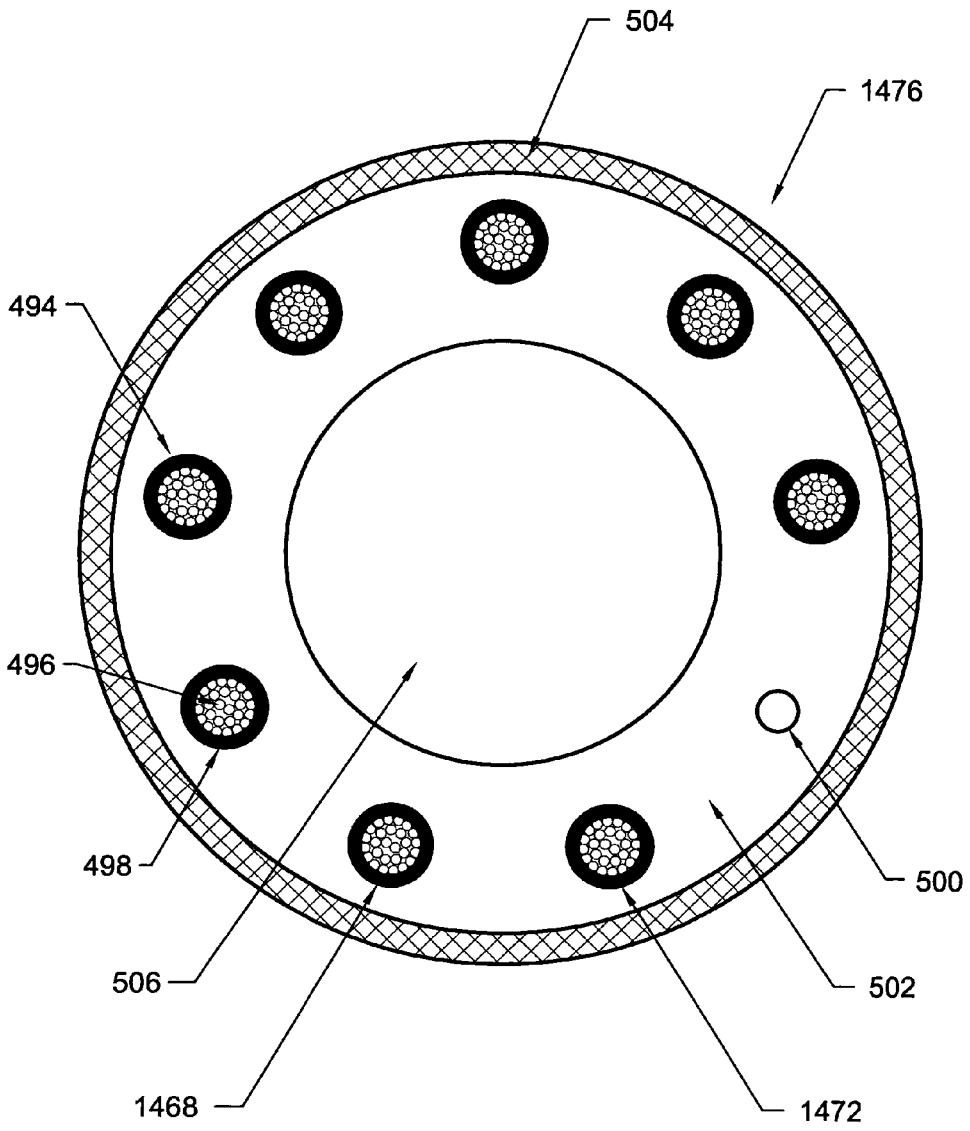
FIG. 43 shows an embodiment of a composite umbilical used to nonuniformly heat a flowline.

In FIG. 43, all the elements through elements 506 have been define previously. In addition, two of the electrically insulated wires 1468 and 1472 are used to nonuniformly heat composite umbilical 1476.

Figure 44:
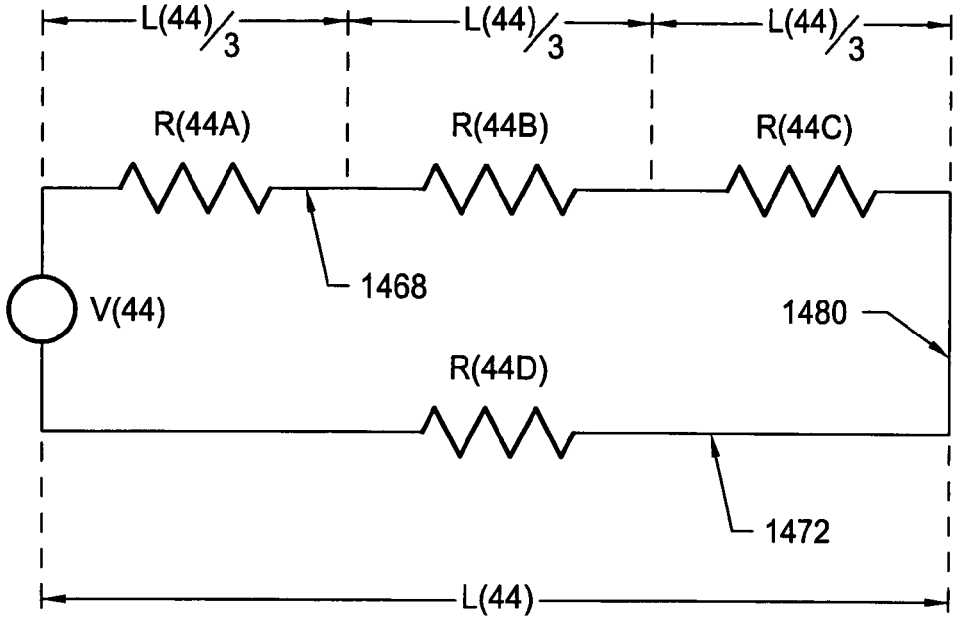
FIG. 44 shows an embodiment of a second resistor network used to nonuniformly heat a composite umbilical.

FIG. 44 shows an embodiment of a second resistor network used to nonuniformly electrically heat composite umbilicals. Here, wire 1468 does not have a uniform resistance per unit length. In FIG. 44, wire 1472 has uniform resistance per unit length (but in other embodiments, this need not be the case). Wires 1468 and 1472 are connected together at the lower end of the composite umbilical by a short electrical jumper 1480 having negligible electrical resistance. The length of the electrically heated composite umbilical is L(44) and that legend is defined in FIG. 44. Wire 1472 has a uniform resistance per unit length, and has a total resistance in ohms of R(44D), a legend that is defined in FIG. 44. Wire 1468 has a resistance in ohms of R(44A) during a first length L(44)/3; has a resistance in ohms of R(44B) during a second length L(44)/3; and has a resistance in ohms of R(44C) during a third length of L(44)/3. The legends R(44A), R(44B), and R(44C) are defined in FIG. 44. Many ways may be used to fabricate wire 1468, including suitably joining together different sections of different wires having different resistances per unit length, but otherwise having the same outside diameters of insulation. The legend V(44) in FIG. 44 shows the voltage V(44) applied uphole to the resistor network. The total resistive load is the sum of R(44A), R(44B), R(44C), and R(44D). If R(44C) is greater than R(44B); and if R(44B) is greater than R(44A); and if R(44A) is greater than R(44D); then the electrically heated composite umbilical will preferentially apply more electrical heat to the lower (right-had side) of the umbilical in FIG. 44. This nonuniform electrical heating has many advantages including the application of heat in poorly insulated areas of an umbilical or coiled tubing; the matching of required heat to the transportation process of hydrocarbons within the umbilical or coiled tubing to avoid the build up of waxes and hydrates such as the preferential heating of areas where high J-T cooling may exist; etc.

Figure 45:
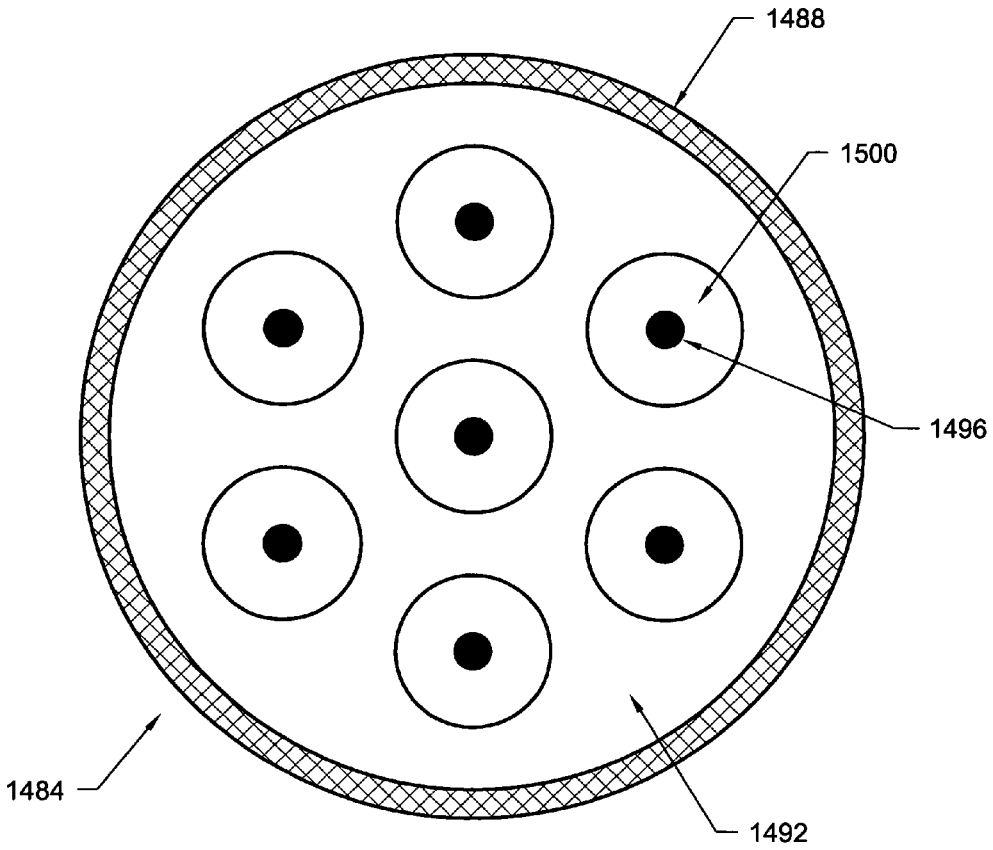
FIG. 45 shows an embodiment of an electrically heated umbilical that is surrounded with steel or synthetic armor.

FIG. 45 shows another preferred embodiment of the electrically heated umbilical that is labeled with numeral 1484 that is an armored electric cable umbilical. Steel or synthetic armor 1488 surrounds filler 1492 that encapsulates electrical wires 1496 surrounded by electrical insulation 1500. This preferred embodiment can include certain types of logging cables. The wires may be individual wires, pairs, bundles, etc. The cable may have some wires dedicated to communication, some for power and fiber optic fibers (not shown in FIG. 45) for communication and sensor service. For heating the production (besides loses due to routine power transmission losses) circuits may be dedicated to heating applications as described earlier. Sections of the circuits may be designed for heating, thus the heat can be directed to specific locations along the umbilical length as described in other embodiments above.

Figure 46:
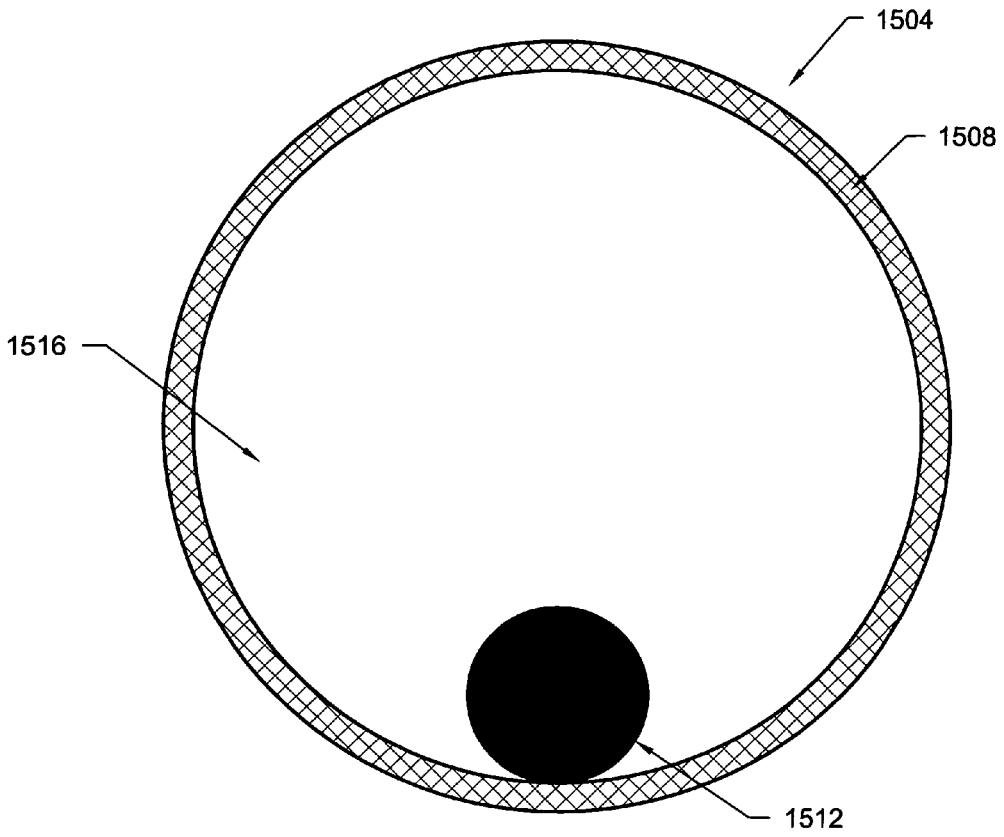
FIG. 46 shows an embodiment of an electrically heated umbilical that possesses an electric cable as a heating element within a steel coiled tubing.

FIG. 46 shows another preferred embodiment of the electrically heated umbilical generally designated as element 1504. The umbilical is surrounded by steel coiled tubing 1508 having any desirable outside diameter and having any desirable wall thickness. Electric cable 1512 provides electrical power for devices, provides communication service, and provides electrical power for electrical heating of fluids within region 1516 of the coiled tubing which may be retrofitted into the steel coiled tubing to be replaced or repaired. To replace cable 1512 after the steel tubing was installed into a flowline, it may be pulled out of the steel tubing leaving the steel tubing within the flowline. Then a hydraulic seal between the outside diameter of the cable and the inside diameter of the steel coiled tubing allows hydraulic pressure introduced into that annular area to be used to force down the cable into the steel coiled tubing. The outside diameter of electric cable is dependent upon the application for which it is chosen. In one preferred embodiment, hot fluid is circulated down region 1516 and the umbilical is used as an immersion heater. In another preferred embodiment, electric current goes down the electric cable and is conducted back up the coiled tubing that provides immersion heating. In yet another embodiment, all the heating comes from the power dissipated within electrical circuits within the electric cable. In yet other preferred embodiments, cable 1512 may also contain fiber optic cables, hydraulic tubes, etc. for other applications.

Figure 47:
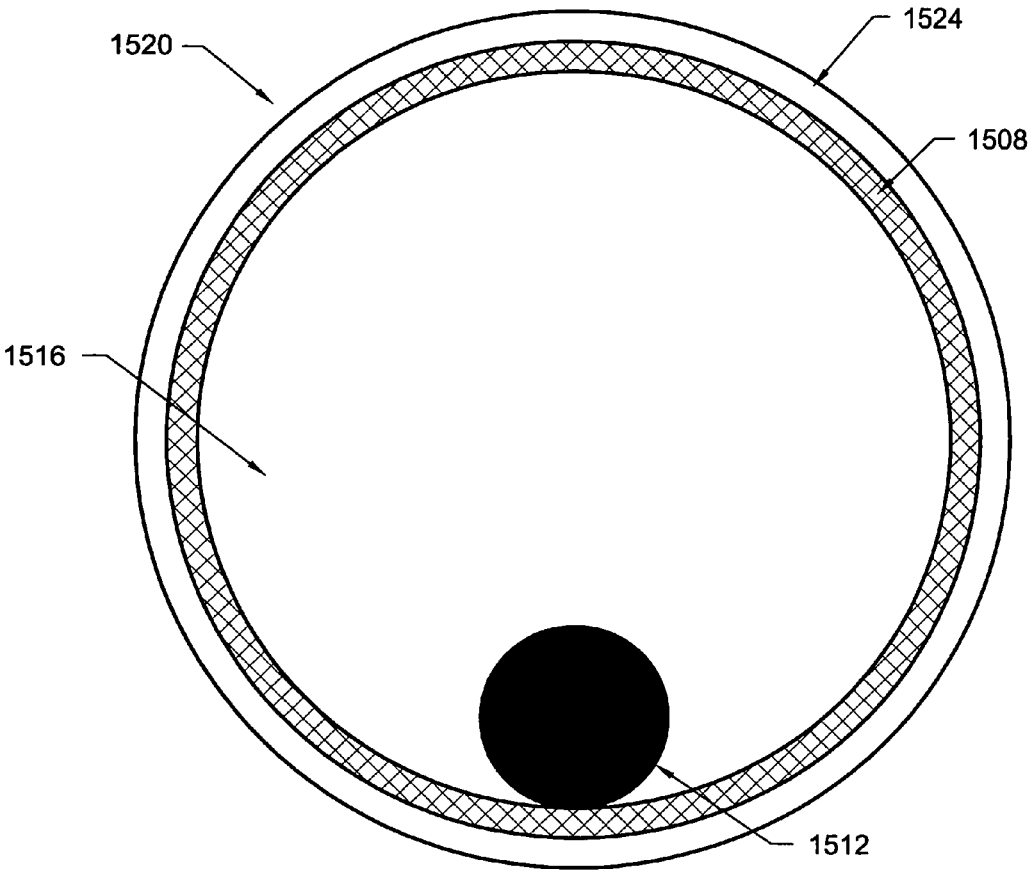
FIG. 47 shows another embodiment of an electrically heated umbilical that possesses an electric cable as a heating element within steel coiled tubing that is surrounded by thermal insulation.

FIG. 47 shows yet another embodiment of the electrically heated umbilical 1520 that is similar to that shown in FIG. 46, except here an extra thermal insulation layer 1524 is bonded to the outside of the steel coiled tubing. Umbilical 1520 is a thermally insulated umbilical with an electric cable. Here, the electric cable includes wires for heating the pipe, wires for control and power of a downhole electric pump, and fiber optic cables for measuring distributed temperature.

Figure 48:
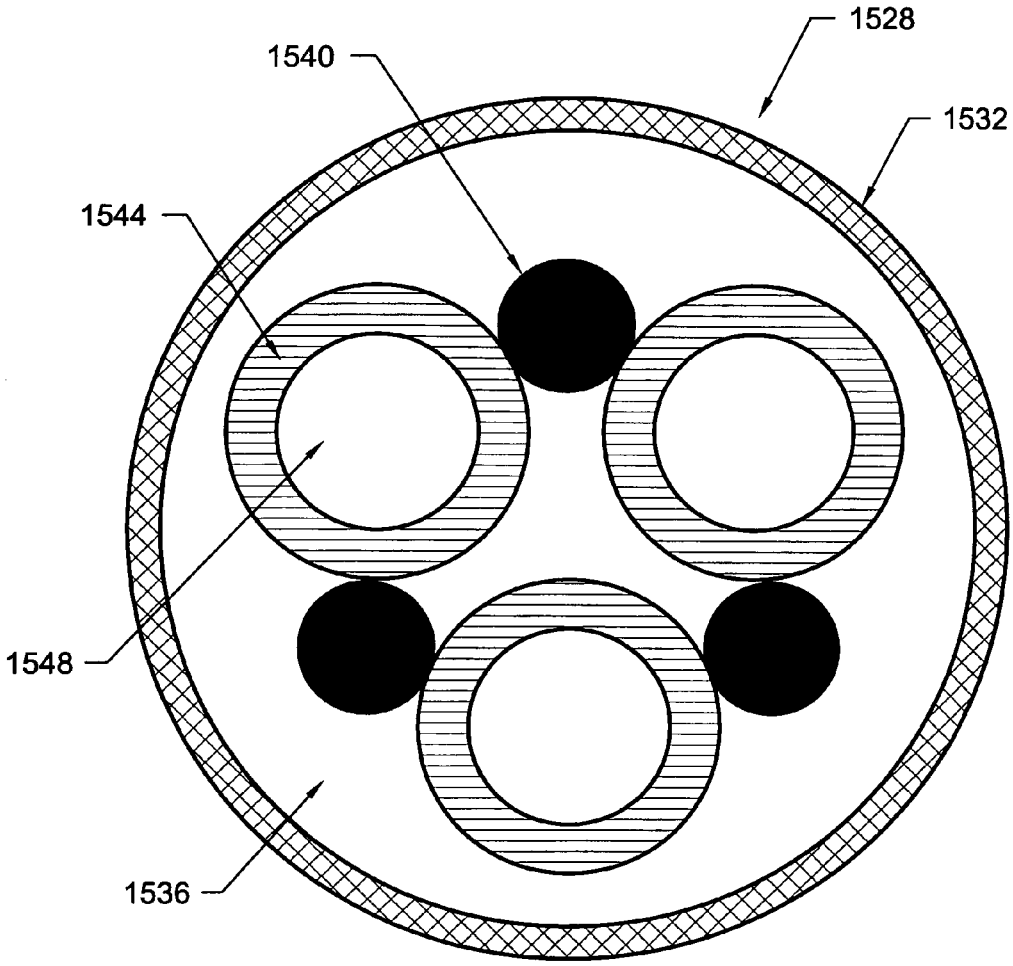
FIG. 48 shows yet another embodiment of an electrically heated umbilical that is a bundled umbilical possessing electric cables and tubes capable of carrying fluids.

FIG. 48 shows yet another embodiment of the eclectically heated umbilical 1528 that is called a bundled umbilical. Outer wear sheath 1532 surrounds filler or potting material 1536 which surrounds one or more electric cables 1540. Each such electric cable provides functions described in the previous paragraph. In addition, the potting material surrounds one or more tubes 1544 having channels 1548. The tubes may carry any fluid or chemical to the end of the umbilicals. For example, these fluids may include an emulsion breaker that is injected just upstream of a pump. The electric cables provide power and communication, and may provide distributed electrical heating. The filler binds the umbilical together and provides for control of the buoyancy of the umbilical.

FIGS. 28 and 29 show existing flowlines installed in a producing oil field. Any of the Electric Flowline Immersion Heater Assemblies shown in FIGS. 30, 31, 32,33, 34, 35, 36, 37, and 37A may be retrofitted into existing flowlines. The Electric Flowline Immersion Assemblies shown in these figures are different embodiments of "electric flowline immersion assembly means". Therefore, the "Electric Flowline Immersion Heater Assembly" ("EFIHA"), the "Electric Flowline Immersion Heater Assembly with Wireline Smart Shuttle" ("EFIHAWWSS"), the "Smart Shuttle Conveyed Electric Flowline Immersion Heater Assembly ("SS-CEFIHA"), and the "Pump-Down Conveyed Flowline Immersion Heater Assembly" ("PDCFIHA"), are all different embodiments of "electric flowline immersion assembly means".

In accordance with the preferred embodiments herein, any of the Electrically Heated Composite Umbilicals shown in FIGS. 30, 31, 32, 33, 34, 35, 36, 37, and 37A may be retrofitted into existing flowlines which are different embodiments of "electrically heated composite umbilical means" which are used to make "immersion heater means". In accordance with the preferred embodiments herein, the additional types of electrically heated umbilical immersion heaters shown in FIGS. 41, 43, 45, 46, 47, and 48 may be suitable retrofitted into existing flowlines and they are different preferred embodiments of "electrically heated umbilical means" that are used to make "immersion heater means".

Any of the umbilical conveyance means shown in FIGS. 30, 31, 32, 33, 34, 35, 36, 37, and 37A may be used to install any of the "electrically heated umbilical means" or the "electrically heated composite umbilical means" into a flowline to make "immersion heater means". As described in the preferred embodiments, these are installed with different embodiments of "electric flowline immersion assembly means" which provide different means to install, or remove, the electric flowline immersion assembly means from the well. Any means that is used to convey into a flowline, or remove from a flowline, any "electrically heated umbilical means" shall be defined herein as a "conveyance means to install an electrically heated umbilical means in a flowline". Any means that is used to convey into a flowline, or remove from a flowline, any "electrically heated composite umbilical means" shall be defined for the purposes herein as a "conveyance means to install an electrically heated composite umbilical means".

It is important to be able to retrofit such electrically heated immersion heater systems into existing flowlines for many reasons that includes the following:

(a) to introduce an immersion heater system into an existing flowline that was not expected to have wax or hydrate build-up problems;

(b) to have repair alternatives for previously installed, but failed, permanent heating systems; and (c) to have operating flexibility to adapt the production system to different production characteristics from original expectations.

Electrically heated immersion heater systems can be installed to prevent waxes and hydrates from forming. Hydrates are a solid ice-like materials typically composed of water and low molecular weight gases such as methane. Hydrates form in high-pressure, low temperature, environments such as those found in subsea production systems. Hydrates may easily plug production systems, especially during transient operating conditions if not properly managed.

In many of the preferred embodiments, a pump is installed in the flowline and may be used in combination with the electrically heated immersion heater system, which has many advantages, including the following:

(a) such methods and apparatus increases the production recovery rate helping the field's net present value ("NPV"); and (b) such methods and apparatus increases the total recoverable reserves from the reservoir by reducing the backpressure on the reservoir.

The installation of an electrically heated immersion heater system in a flowline heats up any produced heavy oils which reduces the viscosity of the produced heavy oils, which has many advantages, including the following:

(a) such methods and apparatus reduces the pumping energy required to transport produced hydrocarbons through the flowline which therefore reduces the costs of producing the hydrocarbons;

(b) such methods and apparatus makes some presently non-commercial fields economic to develop; and (c) such methods and apparatus allows for the efficient subsea transportation of typical gelling crude oils.

In many of the preferred embodiments described, nonuniform heating may be applied to the flowline(s) by the electrically heated immersion heater system which provides many advantages, including being able to configure the production facility to better match and manage the thermal requirements for heating of the flowline(s) to avoid build up of waxes and hydrates, and to reduce the cost of producing hydrocarbons from the reservoir.

Other preferred embodiments provide for the dynamic reconfiguring of the heat supplied by an electrically heated umbilical after the umbilical is installed into a flowline. As an example of such a preferred embodiment, the value of R(44C) in FIG. 44 can be selectable, and controlled from a surface computer. There are a variety of means for doing so, including computer controlled switches in the wall of an Electrically Heated Composite Umbilical that can be used to switch in, or out, certain resistor circuits.

Yet other preferred embodiments provide for the dynamic reconfiguring the buoyancy of an electrical heated umbilical. For example, computer controlled valves may distribute different densities of fluids within one or more fluid channels located within the wall of an Electrically Heated Composite Umbilical. Such systems are described in detail in Provisional Patent Application No. 60/432,045, filed on Dec. 8, 2002, and in U.S. Disclosure Document No. 531,687 filed May 18, 2003, entire copies of which are incorporated herein by reference.

In many of the preferred embodiments described, the electrically heated immersion heater system may be removed from the well, repaired, and retrofitted in the flowline without removing the flowline which provides many advantages, including the following:

(a) such methods and apparatus saves significant operating costs by performing both the heater and artificial lift pump service from the host facility without having to mobilize a subsea intervention vessel; and (b) such methods and apparatus allows for the use of conventional electric submersible pumps for critical subsea "tie-back services" to the host.

The term "tie-back service" has been used above. Satellite production wells are frequently used to develop small fields surrounding an existing facility to which they are connected, and from which they are controlled. These satellite wells provide tie-back service to the host production facility.

In view of the above disclosure, a preferred embodiment of the invention is an apparatus comprising an electrically heated composite umbilical means installed within a subsea flowline containing produced hydrocarbons as an immersion heater means to prevent waxes and hydrates from forming within the flowline and blocking the flowline, whereby the electrically heated composite umbilical means possesses at least one electrical conductor disposed within the composite umbilical means that conducts electrical current that is used to heat the electrically heated composite umbilical means within the subsea flowline.

In view of the above disclosure, a preferred embodiment of the invention is a method of installing an electrically heated composite umbilical means within a previously existing subsea flowline containing produced hydrocarbons to make an immersion heater means to prevent waxes and hydrates from forming within the flowline and blocking the flowline.

In view of the above disclosure, a preferred embodiment of the invention is a method of using an umbilical conveyance means to convey into an existing subsea flowline possessing produced hydrocarbons an electrically heated composite umbilical means used as an immersion heating means to prevent waxes and hydrates from forming within the flowline and blocking the flowline.

In view of the disclosure above, a preferred embodiment of the invention is a method of using an umbilical conveyance means to convey into an existing subsea flowline containing produced hydrocarbons an electrically heated umbilical means used as an immersion heating means to prevent waxes and hydrates from forming within the flowline and blocking the flowline.

In view of the above, a preferred embodiment of the invention is a method of providing artificial lift to produced hydrocarbons within a subsea flowline comprising at least the steps of:

(a) attaching a progressing cavity pump to an electric motor to make an electrically energized pump;

(b) attaching the electrically energized pump to to a first end of a tubular composite umbilical possessing a multiplicity of electrical conductors within the wall of the tubular composite umbilical;

(c) conveying into the flowline the electrically energized pump attached to the first end of the composite tubular umbilical;

(d) using first and second of a multiplicity of electrical conductors to electrically heat the composite umbilical to prevent waxes and hydrates from blocking the flow of the produced hydrocarbons within the flowline; and (e) using at least third and fourth electrical conductors of the multiplicity of electrical conductors to provide electrical energy to the electrically energized pump, whereby the progressing cavity pump provides artificial lift to the produced hydrocarbons within the subsea flowline.

In view of the above, a preferred embodiment of the invention is a method of providing artificial lift to produced hydrocarbons within a subsea flowline comprising at least the steps of:

(a) attaching a hydraulic pump to an electric motor to make an electrically energized pump;

(b) attaching the electrically energized pump to to a first end of a tubular composite umbilical possessing a multiplicity of electrical conductors within the wall of the tubular composite umbilical;

(c) conveying into the flowline the electrically energized pump attached to the first end of the composite tubular umbilical;

(d) using first and second of the multiplicity of electrical conductors to electrically heat the composite umbilical to prevent waxes and hydrates from blocking the flow of the produced hydrocarbons within the flowline; and (e) using at least third and fourth electrical conductors of the multiplicity of electrical conductors to provide electrical energy to the electrically energized pump, whereby the electrically energized pump provides artificial lift to the produced hydrocarbons within the subsea flowline.

In yet another preferred embodiment of the invention, an electrical heated composite umbilical means dissipating in excess of 60 kilowatts of electrical energy to heat produced hydrocarbons is installed within a flowline to prevent the formation of waxes and hydrates and blockage of the flowline.

In another preferred embodiment of the invention, an electrical heated umbilical means dissipating in excess of 60 kilowatts of electrical energy to heat produced hydrocarbons is installed within a flowline to prevent the formation of waxes and hydrates and blockage of the flowline.

In yet another preferred embodiment of the invention, electrically heated composite umbilicals are approximately neutrally buoyant within the fluids present within the flowlines to reduce the frictional drag on the neutrally buoyant umbilicals when they are installed into the flowlines.

Still further, in yet another preferred embodiment of the invention, electrically heated umbilicals are approximately neutrally buoyant within the fluids present within the flowlines to reduce the frictional drag on the neutrally buoyant umbilicals when they are installed into the flowlines.

In another preferred embodiment of the invention, fluid filled electrically heated composite umbilicals are approximately neutrally buoyant within the fluids present within the flowlines to reduce the frictional drag on the neutrally buoyant umbilicals when they are installed into the flowlines.

In yet another preferred embodiment of the invention, fluid filled electrically heated umbilicals are approximately neutrally buoyant within the fluids present within the flowlines to reduce the frictional drag on the neutrally buoyant umbilicals when they are installed into the flowlines.

In another preferred embodiment of the invention is using the methods and apparatus to drill and complete boreholes for infrastructure purposes such as for water, sewer, electric power, and communications facilities in metropolitan areas, and for subterranean pipelines in other suitable locations.

Offshore flowlines and pipelines are typically constructed of steel and may be insulated to minimize internal product heat losses. These pipelines are designed to lie on the ocean floor with a sufficient weight to remain stable in the subsea environment. Typically, this involves a submerged weight that is greater than 2 lbs per foot of pipe length in sea water. However, long term material fatigue problems may develop if this pipe spans different varieties of subsea terrain features. The unsupported pipe span may respond with vortex induced motion ("VIM") if the ocean current flow is sufficiently strong and the length of span has a natural frequency that is excited by the VIM caused by the current flow. Significant costs are incurred engineering VIM solutions to remediate spans when encountered in pipelines which have already been installed.

Most offshore pipelines have historically been located on top of the continental shelf where the terrain features are gentle and resemble coastal plains. Now, pipelines are being extended onto the continental slope where the subsea terrain more closely resembles rugged hill country. There are slot canyons, and escarpments, that are significant pipeline routing problems (to avoid unreasonably long spans). Most routing solutions are expensive to resolve for traditional steel pipelines. An alternative approach is needed that does not have these inherent problems.

Steel flowlines and pipelines are routinely one time installations. That is, a pipeline is rarely, or never, relocated due to the high recovery and relocation cost. It is less expensive to install a completely new pipeline than to relocate an existing line. A major factor in this economic scenario is the large and expensive vessels required to install the pipelines. It is not unusual for these large vessels to lease for more than $300,000 per day and to have a substantial mobilization cost. An offshore development may easily have pipeline and flowline installation costs which represent as much as 30% to 35% of the entire field development capital expense. These substantial large vessels are required to assemble, and weld, the steel pipe into a pipeline and safely lower this pipeline to lie on the ocean floor.

A preferred embodiment of the invention provides an alternative approach. In this preferred embodiment, a pipeline is constructed of a light-weight, strong, material so that the pipeline is buoyant, especially in deepwater where there would be no pipeline conflict with fishing interests. This buoyant pipe would be anchored to the ocean floor at strategic points along the desired route. The floating pipe would assume an arching configuration between the anchor points. The shape of the buoyant arch would be controlled by the axial tension in the pipeline itself. Any ocean currents would deflect and deform the arch in the direction of the ocean currents. A specific advantage of this configuration is that the pipeline can arch over significant seafloor terrain features like escarpments or slot canyons.

Carefully selecting the buoyant pipe materials and insulation (while considering the range of internal products to be transported), allows the pipe to be designed to minimize VIM. On one preferred embodiment, the pipe and its contents to have a specific gravity between 0.6 and 0.9 when submerged in sea water (and is therefore, "positively" buoyant). Further, by selecting a light weight composite material, the necessary strength may be obtained, with good fatigue resistant properties, to resist the almost continuous flexing motion the pipe material will experience in service. Composite tubular products with mechanical properties that begin to approach those required for this application are currently being developed by companies like ABB Vetco Gray, Hydril, Wellstream, Fiberspar and others (in Europe), although the application of these materials to the preferred embodiments herein is a new invention as provided herein. Today, some of these manufacturers are using their composite products as shallow water flowlines. They increase the weight of the composite pipe and its internal product so that the pipe lays on the ocean floor as a one-to-one replacement for steel pipe. The novel application of using positively buoyant pipelines, and neutrally buoyant pipelines, is technically different as described in the several preferred embodiments herein.

One preferred embodiment provides a new method of installation that uses the support of two or three relatively inexpensive anchor handling boats (a monohull vessel that may also include tugs, supply boats, etc.). The following method of installation is one several preferred embodiments that may be used to install, and commission, a buoyant, or substantially neutrally buoyant, pipeline.

Step 1. Survey the pipeline route and select pipeline anchoring points. These are envisioned to be about 1 kilometer apart along the route. The actual distance is not critical, and spacing would be adjusted to conform to terrain features. For example one anchor point could be near the base of an escarpment, and the other on top of the escarpment, so the buoyant pipe would arch over the seafloor.

Step 2. Mobilize anchor handling vessels and install the anchor systems at the selected locations. These anchors are envisioned to be suction anchors, but any anchor capable of resisting up-lift would be feasible to use. See the publication by H. Dendani referenced below for further discussion of suction anchors and their proper design. Aker Maritime has recently installed these anchors using only an anchor handling vessel and an ROV. Each anchor is left with a marker and a pendant to make relocation easy. Survey the anchor sites for their installed geometric locations.

Step 3. At the pipeline shore base mobilization point, anchor clamps are installed on the pipe at the appropriate locations. These clamps feature integral strain relief devices to prevent pipeline damage at these points of pipe inflection. In one preferred embodiment, at each anchor point the pipe will be bent and the strain relief device prevents over-stress in the pipeline in this area. These clamps will be secured to the pendants rising from each of the anchors during the installation process. The clamps will be designed such that they may be installed underwater by an ROV, or repositioned along the pipe itself if needed to relocate a clamp.

Step 4. The flexible pipeline may either be transported to site spooled on a vessel or it may be towed in the water. For the purpose of this description, it is assumed that the pipeline is towed to location from a shore based mobilization point. The pipeline is buoyant and fatigue resistant so a surface tow is practical. As with other buoyant towed installations, there will be a lead towing vessel, a following "drag" vessel, and one or two intermediate vessels alongside the floating pipeline. These vessels help maneuver the pipeline and guard the pipeline to keep other vessels from running across and damaging the towed pipeline.

Step 5. On the installation site, a draw-down installation technique is utilized. A (synthetic) line is rigged by the ROV between a surface (traction) winch, a sheave on the end anchor and the buoyant pipe clamp. This pull-down line then draws the pipeline to the ocean floor by pulling with the winch. The ROV then connects the anchor pendent line to the appropriate anchor clamp. Meanwhile the surface vessels control the location of the surface part of the pipeline.

Step 6. The pull-down and connection process is repeated for each anchor point along the pipeline until all anchors are attached to the pipeline.

Step 7. The ROV spread is then used to sequentially pull the pipeline ends into their termination points and the two end connections secured. If the pipeline route is too long for a single length of pipeline, then multiple sections of buoyant pipeline may be connected together to provide the required length.

In the above described preferred embodiment of a method to install the positively buoyant or neutrally buoyant pipeline, it is worthwhile to note that all steps of the installation process are reversible. This allows suction anchors to be relocated if required, and allows the release and recovery of the buoyant pipeline for relocation or repairs should such service ever be required. The anchor clamps may be repositioned along the pipeline if necessary.

This installation process (using several anchor handlers and ROV's) is inexpensive compared to steel pipeline installations. The buoyant installation spread cost is sufficiently low, and the value of the pipeline material is sufficiently high, so that routine recovery and relocation of the pipeline is expected to become a common practice. In fact, this scenario may enable a long-term rental business where the lines are rented and relocated regularly. This is the current marketing model for some deepwater mooring systems, but is a new business model as proposed herein.

Composite construction of buoyant flowline may incorporate a number of additional features. These may include integral insulation to retain the thermal energy of the fluids within the pipeline. This insulation serves as part of the flow assurance strategy for the entire production system.

Other preferred embodiments of the invention include:

a. Integral tubular condition monitoring sensors are incorporated into the tubular walls of the positively buoyant or neutrally buoyant pipelines. These are envisioned as fiber optic sensors monitoring the distributed stress, temperature, and/or internal pressure, or any other relevant physical parameter, in the tubular.

b. Integral power lines for providing energy to subsea installations such as pumps are incorporated into the tubular walls of the positively buoyant or neutrally buoyant pipelines.

c. Integral electric lines are incorporated into in the tubular walls of the positively buoyant or neutrally buoyant pipelines that are designed for heating the internal fluids within the pipeline.

d. Integral control lines for data communication between the ends of the pipeline are incorporated into the tubular walls of the positively buoyant or neutrally buoyant pipelines.

e. Integral fluid passages (tubes or hoses) for hydraulic service or for chemical transport to the far end of the pipeline are incorporated into the tubular walls of the positively buoyant pipelines.

In various preferred embodiments, some, or all of these features may be integrated into the walls of the positively buoyant flowline, or neutrally buoyant flowline, so that it has sufficient functionality to meet the needs of the field being developed.

In these preferred embodiments, the phrase "flowline" and "pipeline" may be used interchangeably.

One preferred embodiment utilizes subsea bottom anchored buoyant pipelines that provides an "arching over terrain features" capability.

Another preferred embodiment utilizes a low cost draw-down installation process using ROV deployed rigging.

Such embodiments provide complete reversible installation or recovery process. This facilitates repair for damaged pipelines or for easy relocation to another area.

Typical practices in the industry are used as set forth in the following references, entire copies of which are incorporated herein by reference:

Dendani, H., OTC Paper #15376 entitled "Suction Anchors: Some critical aspects for their design and installation in clayey soils", OTC 2003, Houston, Tex., May 2003.

Eltaher, A., et. al., OTC Paper #15265 entitled "Industry Trends for Design of Anchoring Systems for Deepwater Offshore Structures", OTC 2003, Houston, Tex., May 2003.

Buoyant Umbilicals in Seawater

Figure 49:
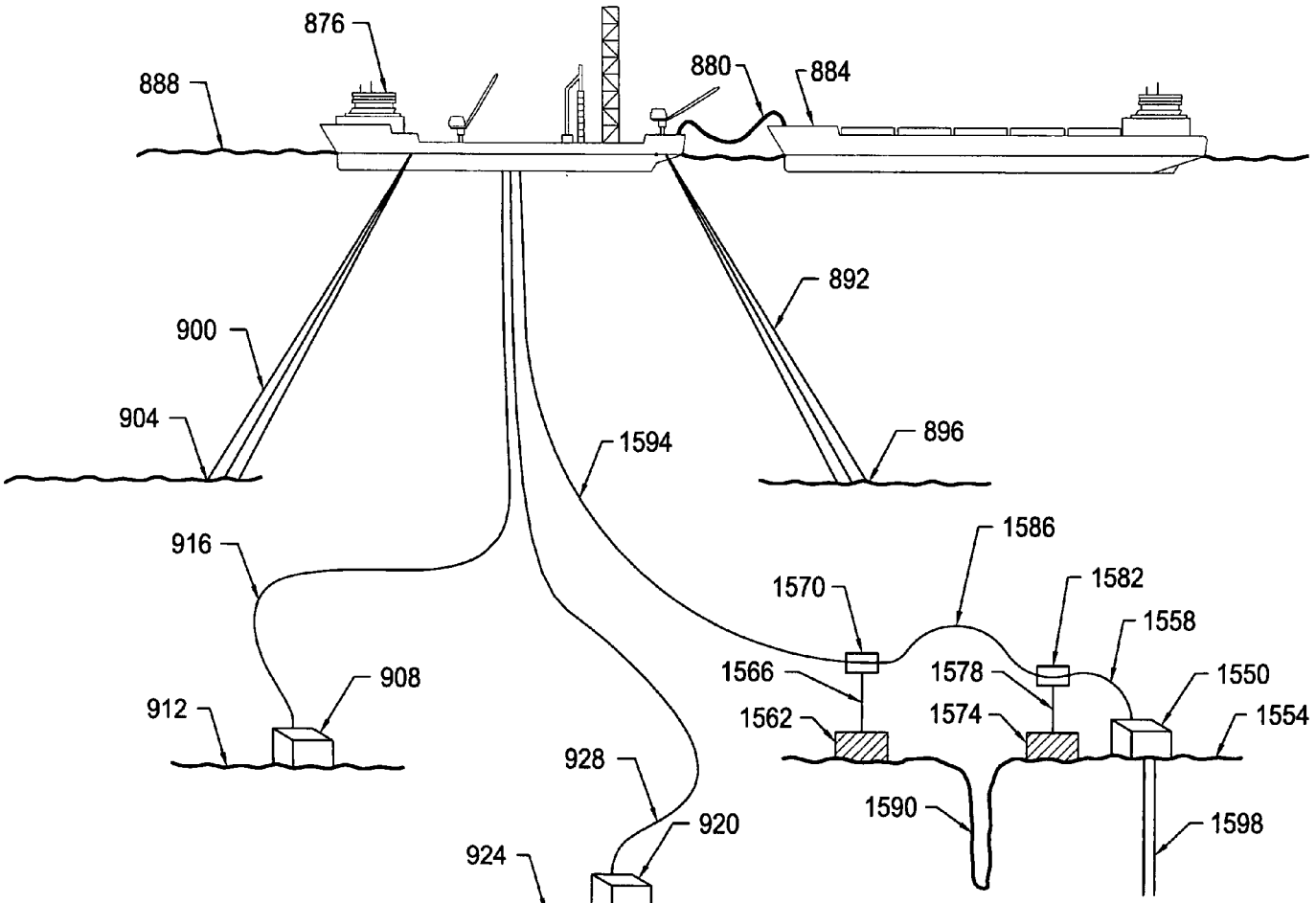
FIG. 49 shows one subsea well providing produced hydrocarbons to a Floating Production, Storage, and Offloading structure (FPSO) through a positively buoyant and electrically heated composite umbilical.

In FIG. 49, all the elements through 928 have been previously defined in relation to FIG. 29. In addition in FIG. 49, subsea wellhead 1550 at location 1554 on the sea bottom passes crude (oil, gas, and water) production through the positively buoyant and electrically heated flowline 1558 to the FPSO as a riser. Subsea anchor 1562 supports tether 1566 that is connected to first clamping apparatus 1570. Subsea anchor 1574 supports tether 1578 that is connected to second clamping apparatus 1582. The positively buoyant and electrically heated flowline 1558 passes through the first and second clamping apparatus. The positively buoyant and electrically heated flowline 1558 has a portion 1586 that raises upward (or "arcs" upward) under buoyant force between the first and second clamping apparatus so as to pass over canyon 1590 in the ocean bottom. A portion of the positively buoyant and electrically heated flowline 1594 raises towards the FPSO. As described above, the positively buoyant and electrically heated flowline may be one piece, or may be comprised of many sections assembled with the assistance of one or more ROV's. Electrical power and control signals may also be passed through the walls of positively buoyant electrically heated flowline 1558 from the FPSO to the subsea wellhead 1550 that in turn may be used to provide power downhole and to monitor production within the well 1598 located below the subsea wellhead 1550.

In other embodiments of the invention, no electrical heating is provided within the positively buoyant flowline.

Figure 50:
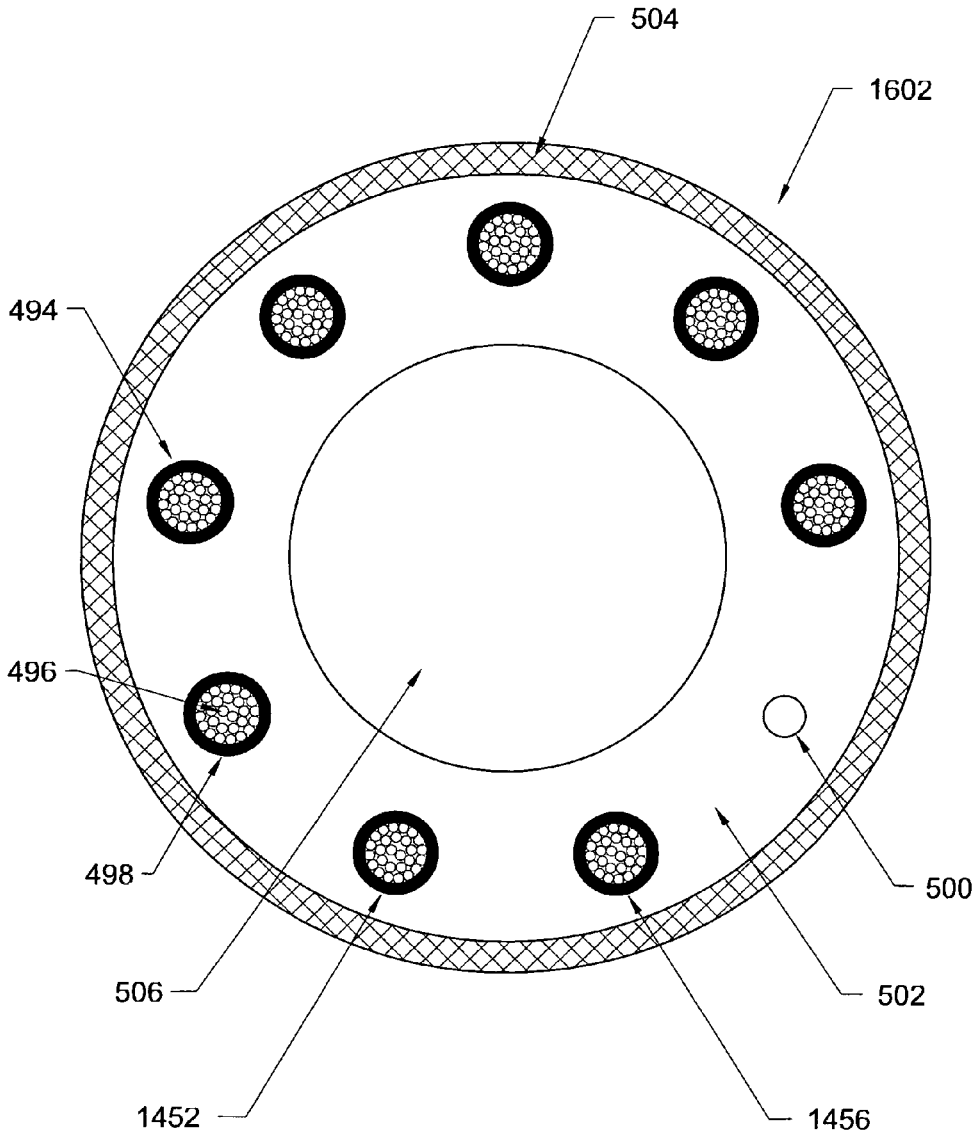
FIG. 50 shows a cross section of one embodiment a positively buoyant electrically heated flowline.

FIG. 50 shows a cross section of a positively buoyant electrically heated flowline 1602. Many of the elements in FIG. 50 were shown in FIG. 20, in FIG. 41, and in FIG. 43. The description in relation to FIG. 20 shows syntactic foam materials having silica microspheres as provided by the Cumming Corporation at www.emersoncumming.com (now CRP Incorporated, at www.CRPGroup.co.uk) may be used to adjust the buoyancy of the electrically heated flowline 1602. As in FIG. 20, the density may be chosen to produce neutrally buoyancy in drilling mud, or in this case, may be chosen to produce substantially neutrally buoyancy, or positive buoyancy, in sea water.

In view of the above description of preferred embodiments, a flowline for producing hydrocarbons from a subsea well has been disclosed that is comprised of a substantially neutrally buoyant tubular composite umbilical means that possesses electrical heating means within the tubular walls of the tubular composite umbilical means to prevent waxes and hydrates from forming within the flowline and blocking the flowline, whereby the electrical heating means is comprised of at least one electrical conductor disposed within the tubular walls of the composite umbilical means that conducts electrical current that is used to heat the tubular composite umbilical means, and whereby the tubular composite umbilical means that contains any produced hydrocarbons is substantially neutrally buoyant in the sea water adjacent to the subsea well.

In view of the above description of preferred embodiments, a method of using a flowline for producing hydrocarbons from a subsea well has been disclosed that is comprised of a substantially neutrally buoyant tubular composite umbilical means that possesses electrical heating means within the tubular walls of the tubular composite umbilical means to prevent waxes and hydrates from forming within the flowline and blocking the flowline, whereby the electrical heating means is comprised of at least one electrical conductor disposed within the tubular walls of the composite umbilical means that conducts electrical current that is used to heat the tubular composite umbilical means, and whereby the tubular composite umbilical means that contains any produced hydrocarbons is substantially neutrally buoyant in the sea water adjacent to said subsea well.

In view of the above described preferred embodiments, a flowline has been disclosed for producing hydrocarbons from a subsea well that is comprised of a substantially neutrally buoyant tubular composite umbilical means, whereby the tubular composite umbilical means that contains any produced hydrocarbons is substantially neutrally buoyant in the sea water adjacent to the subsea well.

In view of the above described preferred embodiments, a flowline has been disclosed for producing hydrocarbons from a subsea well that is comprised of a positively buoyant tubular composite umbilical means that possesses electrical heating means within the tubular walls of the tubular composite umbilical means to prevent waxes and hydrates from forming within the flowline and blocking the flowline, whereby the electrical heating means is comprised of at least one electrical conductor disposed within the tubular walls of the composite umbilical means that conducts electrical current that is used to heat the tubular composite umbilical means, and whereby the tubular composite umbilical means that contains any produced hydrocarbons is positively buoyant in the sea water adjacent to the subsea well.

In view of the above description of preferred embodiments, a method of using a flowline for producing hydrocarbons from a subsea well has been disclosed that is comprised of a positively buoyant tubular composite umbilical means that possesses electrical heating means within the tubular walls of the tubular composite umbilical means to prevent waxes and hydrates from forming within the flowline and blocking the flowline, whereby the electrical heating means is comprised of at least one electrical conductor disposed within the tubular walls of the composite umbilical means that conducts electrical current that is used to heat the tubular composite umbilical means, and whereby the tubular composite umbilical means that contains any produced hydrocarbons is positively buoyant in the sea water adjacent to the subsea well.

And finally, in view of the above described preferred embodiments, a flowline for producing hydrocarbons from a subsea well has been disclosed that is comprised of a positively buoyant tubular composite umbilical means, whereby the tubular composite umbilical means that contains any produced hydrocarbons is positively buoyant in the sea water adjacent to the subsea well.

It is further evident from the above description that the flowlines may be used for transporting fluids between any two points. For example, one point may be on the ocean bottom, and another point may be on another portion of the ocean bottom or on the surface of the ocean.

It is further evident from the above description that the electrically heated flowlines may be used to elevate the temperature of the fluids being transported within the flowlines. Such a temperature elevation reduces the viscosity of the transported fluids, thus requiring less energy to transport the fluids through the flowlines. The electrically heated flowlines are an example of a means to maintain transported fluids at an elevated temperature.

Power Systems for the Subterranean Electric Drilling Machine

Figure 51:
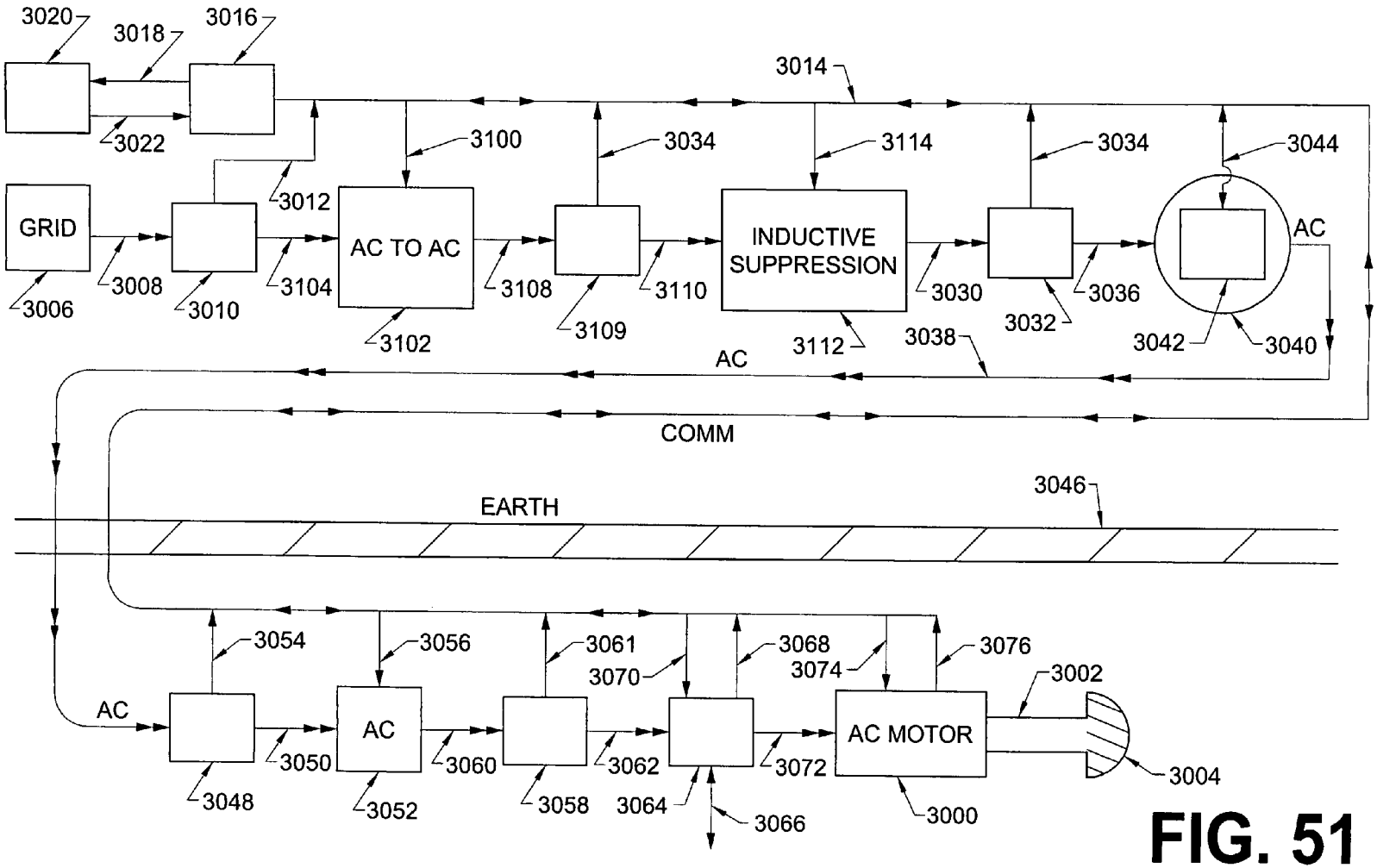
FIG. 51 is a block diagram that shows the power and closed-loop feedback controls to drill a borehole with the Subterranean Electric Drilling Machine using an AC electric motor to rotate the rotary drill bit energized by AC current conducted down the umbilical.

FIG. 51 shows the power and logical controls to drill a borehole with the Subterranean Electric Drilling Machine using an AC electric motor 3000.

FIG. 51 shows AC electric motor 3000 attached to shaft 3002 which is in turn attached to rotary drill bit 3004. The length of shaft 3002 may be independently controlled by apparatus previously described.

AC power grid 3006 provides AC electrical power through electrical cable 3008 to first sensor system 3010. Electrical measurements are made by suitable electronic means within sensor system 3010. Such measurements include the voltage, current and phases between the various conductors (for example, between phases A, B, and C of 208 Y as an example). The results of those measurements are provided as digital signals through cable communications means 3012 to bidirectional digital fiber optic communications means 3014 which are sent to bidirectional fiber optic to voltage converter 3016 that provides input data through cable 3018 to computer system 3020. The opposing arrows in FIG. 51 show the bidirectional digital fiber optic communications means 3014. In this case cable communications means 3012 may be a fiber optic cable or an electronic cable properly terminated and coupled to the bidirectional digital fiber optic communications means 3014 using typical techniques in the industry.

Computer system 3020 may send commands over cable 3022 which are suitably encoded by bidirectional fiber optical voltage converter 3016 and sent over bidirectional digital fiber optic communications means 3014. Suitable encoded signals are sent over cable means 3100 to the AC Voltage Generator System 3102 which receives power from the power grid through cable 3104. The AC Voltage Generator System provides multiple voltage outputs on typically 3 conductors having different phases (for example, phase A, phase B, and phase C in a Y configuration). Any voltage output may be generated, for example, in delta mode (4 phases). In fact, AC Voltage Generator System 3102 may be replaced with Arbitrary Voltage Generator System 3106 (not shown in FIG. 51) in different preferred embodiments which provides a predetermined arbitrary voltage in time, at arbitrary current levels, having arbitrary phase relationships, on any number of conductors. However, for the sake of simplicity only from this point forward, in this preferred embodiment shown in FIG. 51, AC Voltage Generator System 3102 is shown that in this case, provides phases A, B, and C in a Y configuration to three conductors A, B, and C, at one frequency, and where the phases A, B, and C can be adjusted, but are typically 120 degrees between each phase. So, in a preferred embodiment, phases A, B, and C provide sinusoidal voltage waveforms, of approximately equal magnitude, with phases differing by 120 degrees each. Computer commands from computer 3020 are used to control input AC power provided through cable 3104 and to generate and control the AC power provided by cable 3108.

Second sensor system 3109 is used to determine measurements and provide the results through cable 3034 to the computer system 3020. The output AC electrical power is provided over cable 3110 to Inductive Reactance Control System 3112 for "inductive suppression" that is used to control the "reactive inductance" or "reactive impedance" of the umbilical system as described in the foregoing. Commands from the computer system 3020 are sent over communications means 3114 to the Inductive Reactance Control System 3112. The output of the Inductive Reactance Control System 3112 is sent over cable 3030 to third sensor system 3032. Data from the third sensor system 3032 is sent to computer system 3020 via communications means 3034. AC electrical power is provided over cable means 3036 to the umbilical 3038 wound on drum 3040. The voltage, current, phases, and other characteristics of the AC power provided over cable means 3036 is controlled by computer means 3020. Drum controller 3042 sends and receives data over bidirectional data cable 3044 and the computer system 3020 is used to suitably control the position of umbilical 3038. The surface of the earth is shown figuratively as element 3046.

AC electrical power is sent downhole thorough umbilical 3038. The closely spaced arrows show a direction of power flow downhole. Fourth sensor system 3048 measures the characteristics of the AC voltage provided downhole. The electrical power is provided by cable 3050 to power filter 3052 that is used to "smooth over" any spikes or other interfering signals. Signals from the fourth sensor system 3048 are sent over cable 3054 to the computer system 3020 which then controls power filter 3052 by commands sent over cable means 3056. Fifth sensor system 3058 measures electrical parameters on its input cable means 3060 and provides output power on its output cable means 3062. Signals from the fifth sensor system 3058 are sent over cable 3061 to the computer system 3020 which then controls Downhole Power Distribution and Control System 3064.

Except for the AC electric motor 3000, all other electrical power requirements for the Subterranean Electric Drilling Machine are provided by Downhole Power Distribution and Control System 3064. Suitable power control, waveshaping, filtering, and active power control electronics may also be incorporated in various embodiments in element 3064. Power and data signals are sent to and from the other systems over cable means 3066. Sensor data from system 3064 is provided to the computer system 3020 over cable means 3068 and commands are received over cable means 3070 that are used to control the power and data signals provided by the Downhole Power Distribution and Control System 3064. If the AC electric motor 3000 can receive commands internally, then such commands are sent by the computer system 3020 through cable means 3074. Internal sensor means within the AC electric motor (voltage, frequency, temperature, etc.) are sent to the computer system 3020 by cable means 3076. In selected embodiments of the invention, various control electronics may be located within the AC electric motor in FIG. 51 including wave shaping control, phase control, RPM control, current limiting, temperature regulation, and suitable sensors may be provided to allow for such control.

In this way, the closed-loop feedback controlled AC electric motor is provided its required operating voltage, current, and other inputs as controlled by the computer system 3020. Adjustments are made to the power supplied by the uphole system (volts, current, frequency, waveforms, etc.) above the surface of the earth so that the downhole electrical motor obtains the optimal electrical power required by the operating characteristics of the AC electric motor. Computer system 3020 is used in a closed-loop feedback system to control the outputs 3104, 3108, 3110, 3030, 3036, 3038, 3050, 3060, 3062, 3066, and 3072 in response to measurements obtained by the various sensors already described in FIG. 51 including sensors within elements 3010, 3109, 3032, 3048, 3058, 3064, and 3000. In other embodiments of the invention, certain sensors may be eliminated such as element 3058 in FIG. 51 to save cost and complexity. In yet other embodiments of the invention, selected elements of the closed-loop feedback system may be eliminated to save cost and complexity.

The umbilical 3038 wound on drum 3040 comprises an inductor. The wires have electrical resistance, and an inductance defined by the geometry. Each wire also has a capacitance to ground and every other wire. So, the umbilical 3038 comprises a complex AC transmission system having distributed resistors, inductors, and capacitors which responds as a "reactive inductance" or "reactive impedance" or "distributed reactive impedances" to applied AC voltages and currents. Systems having a reactive impedance can demonstrate resonance phenomena at various frequencies, and can produce unpredictable voltage vs. current waveforms. For example, a series RLC system exhibits series resonance, where destructive voltages can build up across individual components of the system. The purpose of the Inductive Reactance Control System 3112 for "inductive suppression" is used to control the "reactive inductance" or the "reactive impedance" of the umbilical system. Various filters, transformers, and active electronic suppression systems can be used as are known in the industry. Suppression devices including additional resistors, inductors, capacitors, and other active electronics means can also be installed downhole within element 3052 or within other downhole elements.

FIG. 51 may be used to control any downhole AC electric motor, including any stepper motor, or any other electric motor requiring varying voltage and currents, including all such electric motors defined in the following References 101, 102, 103, 104, 105, 106, 107, and 108. Further, an "AC electric motor" 3000 shown in FIG. 51 is also defined to include any suitable combination of an electric motor and associated hydraulic system used to rotate drill bit 3004, and/or any electric motor and gear reduction box used to rotate drill bit 3004, and/or any electric motor in combination with any additional mechanical or electrical means to rotate drill bit 3004.

It is also evident that the feedback control system in FIG. 51 may be suitably modified to provide any type of time varying current and voltage to any AC electric motor 3000 defined in References 101, 102, 103, 104, 105, 106, 107, and 108.

For such known art, and references on electric motors and associated electronics, please refer to the following References 101, 102, 103, 104, 105, 106, 107, and 108, entire copies of which are incorporated herein by reference:

Ref 100. The book entitled "Electric Motor Handbook" by H. Wayne Beaty and James L. Kirtley, Jr., McGraw-Hill Book Company, 1998, an entire copy of which is incorporated herein by reference, which describes various types of electric motors, particularly including Chapter 2, "Terminology and Definitions"; Chapter 4, "Induction Motors"; Chapter 6, "Permanent Magnet-Synchronous (Brushless); Chapter 7, "Direct Current Motors"; and Chapter 8, "Other Types of Electric Motors and Related Apparatus".

Ref 102. The book entitled "Electric Motors and Drives, Fundamentals, Types and Applications", by Austin Hughes, Elsevier, Third Edition, 2006, an entire copy of which is incorporated herein by reference, which describes different types of electric motors and the types of power generation systems needed to operate the different electric motors, including ALL chapters.

Ref 103. The book entitled "Electric Motors and Control Techniques" by Irving M. Gottlieb, TAB Books a Division of McGraw-Hill, Inc., 1994, an entire copy of which is incorporated herein by reference, which describes different types of electric motors and the required control techniques, particularly including Chapter 2 "The classic dc motors"; and Chapter 3 "the classic ac motors".

Ref 104. The book entitled "Power Electronics, Converters, Applications and Design", by Ned Mohan, Tore M. Undeland, and William P. Robbins, John Wiley & Sons, Inc., 2003, an entire copy of which is incorporated herein by reference, which primarily describes practical electronic power generation systems, some of which have direct application to electric motors, particularly including Part 4 "Motor Drive Applications".

Ref 105. The book entitled "Feedback and Control Systems", Joseph J. DiStefano, III, Ph.D., Allen R. Stubberud, Ph.D., and Ivan J. Williams, Ph.D., Schaum's Outline Series, McGraw-Hill, Second Edition, 1990, an entire copy of which is incorporated herein by reference, which describes the general features used in feedback control systems particularly including Chapter 2 "Control Systems Terminology"; and Chapter 7, "Block Diagram Algebra and Transfer Functions of Systems".

Ref 106. The book entitled "Electric Power Systems", by Syed A. Nasar, Ph.D., Schaum's Outline Series, McGraw-Hill, 1990, an entire copy of which is incorporated herein by reference, which describes the general features of distributed power systems particularly including Chapter 2, "Power System Representation"; Chapter 3, "Transmission-line Parameters"; and Chapter 4 "Transmission-Line Calculations".

Ref 107. The book entitled "Electric Machines and Electromechanics", by Syed Nasar, Schaum's Outline Series, McGraw-Hill, 1998, an entire copy of which is incorporated herein by reference, which describes important electrical components, particularly including: Chapter 2, "Power Transformers"; Chapter 4, DC Machines; Chapter 5 "Polyphase Induction Motors"; Chapter 7 "Single-Phase Motors and Permanent Magnet Machines"; and Chapter 8 "Electronic Control of Motors".

Ref 108. The book entitled "Electronics Designer's Handbook", by Robert W. Landee, Donovan C. Davis, Albert P. Albrecht, McGraw Hill Book Company, Second Edition, 1977, an entire copy of which is incorporated herein by reference, including all relevant portions to the above, and particularly including Section 5 entitled "Circuit Analysis" and further including FIG. 5.8 entitled "Resonant circuits" on page 5-11.

Accordingly, the above description in relation to FIG. 51 discloses a method of providing the closed-loop feedback control of a remote AC electric motor means (3000) that has specific required operating parameters including the required operating frequency, the required operating voltage, and the required operating current, said AC electric motor means disposed below the surface of the earth (3046) and located within in a borehole in the earth that receives electrical energy through a long umbilical means (3038) which receives power from an uphole AC generator means (3109) that comprises at least the steps of:

(a) measuring a first set of electrical parameters including the first measured frequency, first measured voltage and first measured current provided to said remote AC electric motor means (3000) using a multiplicity of sensors located below the surface of the earth (3048, 3058, 3066, and within 3000);

(b) sending information related to said first set of measured parameters through a bidirectional communications means (3014) to a computer means (3020) located on the surface of the earth (3046);

(c) comparing said first set of measured parameters with the required operating parameters within said computer means (3020);

(d) determining within said computer means (3020) any first set of adjustments that need to be made to the first set of measured parameters to provide the required operating parameters to said AC electric motor means (3000);

(e) sending information related to any first set of said adjustments through bidirectional communications means (3014) to the uphole AC generator means (3102) to adjust its output parameters to provide a second output frequency, second output voltage, and second output current provided by said AC generator means (3102);

(f) suppressing any inductive reactance associated with the long umbilical (3038) that may be partially wound on a drum (3040) using an inductive suppression means (3112);

(g) providing a second set of operating parameters to said AC electric motor means (3000);

(h) repeating said measurements and said adjustments a plurality of successive times, thereby providing the closed-loop feedback control to provide the required operating frequency, the required operating voltage, and the operating current to said AC electric motor means (3000).

Accordingly, the above description in relation to FIG. 51 further discloses a method wherein the AC electric motor means (3000) provides the rotational energy of a rotary drill bit (3004) located within the borehole.

Accordingly, the above description in relation to FIG. 51 further discloses a method wherein the AC electric motor means (3000) is provided the required operating frequency, the required operating voltage, and the required operating current while power and data is also simultaneously sent to at least one other electrical component (3066) located within the borehole.

Accordingly, the above description in relation to FIG. 51 and previous figures above discloses a method wherein the AC electric motor means (3000) provides the rotational energy of a submersible electric pump located within the borehole.

Accordingly, the above description in relation to FIG. 51 discloses a method wherein the AC electric motor means (3000) is a stepper motor means.

Accordingly, the above description in relation to of FIG. 51 further discloses a method wherein the AC electric motor means (3000) is any electric motor requiring varying voltage and currents.

FIG. 52 shows the power and logical controls to drill a borehole with the Subterranean Electric Drilling Machine using a AC electric motor 4000.

In general comparison with the previous preferred embodiment in FIG. 51, the preferred embodiment in FIG. 52 avoids sending AC electric power over the umbilical as in FIG. 1 and therefore avoids the necessity of needing a robust inductive suppression system as shown in FIG. 51, but instead sends DC electric power over the umbilical and therefore requires a downhole DC to AC converter to energize an AC electric motor to rotate the drill bit as described in the following. AC electric motors for downhole use are readily available in the industry.

FIG. 52 shows AC electric motor 4000 attached to shaft 4002 which is in turn attached to rotary drill bit 4004. The length of shaft 4002 may be independently controlled by apparatus previously described.

AC power grid 4006 provides AC electrical power through electrical cable 4008 to first sensor system 4010. Electrical measurements are made by suitable electronic means within sensor system 4010. Such measurements include the voltage, current and phases between the various conductors (for example, between phases A, B, and C of 208 Y as an example). The results of those measurements are provided as digital signals through cable communications means 4012 to bidirectional digital fiber optic communications means 4014 which are sent to bidirectional fiber optic to voltage converter 4016 that provides input data through cable 4018 to computer system 4020. The opposing arrows in FIG. 52 show the bidirectional digital fiber optic communications means 4014. In this case cable communications means 4012 may be a fiber optic cable or an electronic cable properly terminated and coupled to the bidirectional digital fiber optic communications means 4014 using typical techniques in the industry that provides data from first sensor system 4010.

Computer system 4020 may send commands over cable 4022 which are suitably encoded by bidirectional fiber optical voltage converter 4016 and sent over digital fiber optical communications means 4014. Suitable encoded signals are sent over cable means 4024 to the AC to DC converter 4026. Computer commands from computer 4020 are used to control input AC power provided through cable 4028 and to generate and control the DC power provided by cable 4030. Second sensor system 4032 is used to determine measurements and provide the results through cable 4034 to the computer system 4020. DC electrical power is provided over cable means 4036 to the umbilical 4038 wound on drum 4040. The voltage, current and other characteristics of the DC power provided over cable means 4036 is controlled by computer means 4020. Drum controller 4042 sends and receives data over bidirectional data cable 4044 and the computer system 4020 is used to suitably control the position of umbilical 4038. The surface of the earth is shown figuratively as element 4046.

DC electrical power is sent downhole thorough umbilical 4038. The closely spaced arrows show a direction of power flow downhole. Third sensor system 4048 measures the characteristics of the DC voltage provided downhole. The electrical power (mostly DC) is provided by cable 4050 to DC to AC converter 4052 that generates the basic AC power for AC electric motor 4000. Signals from the third sensor system 4048 are sent over cable 4054 to the computer system 4020 which then controls the DC to AC converter 4052 by commands sent over cable means 4056. Fourth sensor system 4058 measures electrical parameters on its input cable means 4060 and provides output power on its output cable means 4062. Signals from the fourth sensor system 4058 are sent over cable 4061 to the computer system 4020 which then controls Downhole Power Distribution and Control System 4064.

Except for the AC electric motor 4000, all other electrical power requirements for the Subterranean Electric Drilling Machine are provided by Downhole Power Distribution and Control System 4064. Power and data signals are sent to and from the other systems over cable means 4066. Sensor data from system 4064 is provided to the computer system 4020 over cable means 4068 and commands are received over cable means 4070 that are used to control the power and data signals provided by the Downhole Power Distribution and Control System 4064. Suitable power control, waveshaping, filtering, and active power control electronics may also be incorporated in various embodiments in element 4064. Cable 4072 provides electrical power to AC electric motor 4000. If the electric motor 4000 can receive commands internally, then such commands are sent by the computer system 4020 through cable means 4074. Internal sensor means within the electric motor (voltage, frequency, temperature, etc.) are sent to the computer system 4020 by cable means 4076. In selected embodiments of the invention, various control electronics may be located within the AC electric motor in FIG. 52 including wave shaping control, phase control, RPM control, current limiting, temperature regulation, and suitable sensors may be provided to allow for such control.

In this way, the closed-loop feedback controlled AC electric motor is provided its required operating voltage, current, and other inputs as controlled by the computer system 4020. Adjustments are made to the uphole system above the surface of the earth so that the downhole electrical motor obtains the optimal electrical power required by the operating characteristics of the AC electric motor. Computer system 4020 is used in a closed-loop feedback system to control the outputs 4008, 4028, 4030, 4036, 4038, 4050, 4060, 4062, 4066 and 4072 in response to measurements obtained by the various sensors already described in FIG. 52 including sensors within elements 4010, 4026, 4032, 4048, 4058, 4064, and 4000. In other embodiments of the invention, certain sensors may be eliminated such as element 4058 in FIG. 52 to save cost and complexity. In yet other embodiments of the invention, selected elements of the closed-loop feedback system may be eliminated to save cost and complexity.

The DC electric power provided through umbilical 4038 wound on drum 4040 does not produce the undesirable inductive effects described in relation to FIG. 51. Power interruptions can produce such inductive effects (and those can be suppressed using standard techniques).

FIG. 52 may be used to control any downhole AC electric motor, including any stepper motor, or any other electric motor requiring varying voltage and currents, including all such electric motors defined in References 101, 102, 103, 104, 105, 106, 107, and 108. Further, an "AC electric motor" 4000 shown in FIG. 52 is also defined to include any suitable combination of an electric motor and associated hydraulic system used to rotate drill bit 4004, and/or any electric motor and gear reduction box used to rotate drill bit 4004, and/or any electric motor in combination with any additional mechanical or electrical means to rotate drill bit 4004.

It is also evident that the feedback control system in FIG. 52 may be suitably modified to provide any type of time varying current and voltage to any AC electric motor 4000 defined in References 101, 102, 103, 104, 105, 106, 107, and 108.

Existing technology can be used to fabricate the DC to AC converter 4052. Reference 200 describes the synthesis of dc-to-dc voltage. A portion of the technology describes a dc to ac conversion process and then the ac to dc conversion process. In the case at hand in FIG. 52, the technology is particularly useful to fabricate the DC to AC converter 4052. Relevant to Ref 200 are References 201, 202, and 203.

References 200, 201, 202, and 203 also provide detailed references to wet connector technology that can be used to connect different umbilicals together for the current application.

Ref 200. The paper entitled "Synthesis of Medium Voltage dc-to-dc Converters from Low-Voltage, High-Frequency PWM Switching Converters", by Vitache Vorperian, IEEE Transactions on Power Electronics, Vol. 22, no. 5, September 2007, p. 1619 to 1635, an entire copy of which is incorporated herein by reference. An entire copy of the IEEE paper accompanies this document, and entire copies of all the individual reference documents (#1 to #22) that are listed on page 1635 are also expressly incorporated herein in their entirety by reference.

Ref 201. The paper entitled "NEPTUNE: dc power beyond MARS", by P. C. Lancaster, R. Jacques, G. W. Nicol, G. Waterworth, Alcatel Submarine Networks Ltd., and H. Kirkham, J P L, an entire copy of which is incorporated herein by reference, that is available on Jul. 24, 2008 at the following web address: http://neptunepower.apl.washington.edu/publications.documents/ndpbm.pdf. An entire copy of this document accompanies this document, and entire copies of all the reference documents listed on page 3 (#1 to #4) are also incorporated herein by reference.

Ref 202. The paper entitled "Submarine Fiber-Optic and DC Power Solution for Ultralong Tieback", by Marc Fullenbaum, Neville Hazel, Gary Waterworth, and Laruie Doyle, Alcatel Submarine Networks, OTC Paper 19113, Offshore Technology Conference, 2007, an entire copy of which is incorporated herein by reference, that is available through www.onepetro.org. An entire copy of the paper accompanies this document, and entire copies of all the reference documents listed at the end of the paper are also incorporated herein by reference.

Ref 203. Entire copies of all papers presented at the IEEE Fourth International Workshop on Scientific Use of Submarine Cables & Related Technologies, 07-10 Feb. 2006, are incorporated by reference herein, entire abstracts of which are available at http:www.ssc06.com. Entire copies of each paper defined in the Programme attached to this document are also incorporated herein by reference. Entire copies of each paper defined in the Table of Contents attached to this document are also incorporated herein by reference. Entire copies of all references cited in each such paper defined in the Table of Contents are also incorporated herein by reference. An entire copy of the "Download Complete Book of Abstracts" at www.ssc06.com is also incorporated herein by reference.

Accordingly, the above description in relation to FIG. 52 discloses a method of providing the closed-loop feedback control of a remote AC electric motor means (4000) that has specific required operating parameters including the required operating frequency, the required operating voltage, and the required operating current, said AC electric motor means disposed below the surface of the earth (4046) and located within in a borehole in the earth that receives electrical energy through a long umbilical means (4038) which receives power from an uphole AC to DC converter means (4026) that comprises at least the steps of:

(a) measuring a first set of electrical parameters including the first measured frequency, first measured voltage and first measured current provided to said remote AC electric motor means (4000) using a multiplicity of sensors located below the surface of the earth (4048, 4058, 4066, and within 4000);

(b) sending information related to said first set of measured parameters through a bidirectional communications means (4014) to a computer means (4020) located on the surface of the earth (4046);

(c) comparing said first set of measured parameters with the required operating parameters within said computer means (4020);

(d) determining within said computer means (4020) any first set of adjustments that need to be made to the first set of measured parameters to provide the required operating parameters to said AC electric motor means (4000);

(e) sending information related to any first set of said adjustments through the bidirectional communications means (4014) to the AC to DC converter means (4026) to adjust its output parameters to provide a second output voltage, and second output current provided by said AC to DC converter means (4026);

(f) sending information related to any first set of said adjustments through bidirectional communication means (4014) to the DC to AC converter (4052) located within said borehole to adjust its output parameters to provide third output frequency, third output voltage, and third output current;

(g) providing said third output frequency, third output voltage, and third output current to said AC electric motor means (4000); and (g) repeating said measurements and said adjustments a plurality of successive times, thereby providing the closed-loop feedback control to provide the required operating frequency, the required operating voltage, and the operating current to said AC electric motor means (4000).

Accordingly, the above description in relation to FIG. 52 further discloses a method wherein the AC electric motor means (4000) provides the rotational energy of a rotary drill bit (4004) located within the borehole.

Accordingly, the above description in relation to FIG. 52 further discloses a method wherein the AC electric motor means (4000) is provided the required operating frequency, the required operating voltage, and the required operating current while power and data is also simultaneously sent to at least one other electrical component (4066) located within the borehole.

Accordingly, the above description in relation to FIG. 52 and previous figures above discloses a method wherein the AC electric motor means (4000) provides the rotational energy of a submersible electric pump located within the borehole.

Accordingly, the above description in relation to FIG. 52 discloses a method wherein the AC electric motor means (4000) is a stepper motor means.

Accordingly, the above description in relation to FIG. 52 further discloses a method wherein the AC electric motor means (4000) is any electric motor requiring varying voltage and currents.

FIG. 53 shows the power and logical controls to drill a borehole with the Subterranean Electric Drilling Machine using a DC electric motor 5000.

In general comparison with the previous preferred embodiment in FIG. 52, this embodiment does not require DC to AC conversion downhole. However, this preferred embodiment in FIG. 53 does therefore require a DC electric motor. Such DC electric motors are not generally available in the industry at this time for commercial downhole use, although some are in development. Only AC electric motors are now commonly available for commercial downhole use. When such DC electric motors become available, then this preferred embodiment will be simpler to implement than that shown in FIG. 51 or 52.

FIG. 53 shows DC electric motor 5000 attached to shaft 5002 which is in turn attached to rotary drill bit 5004. The length of shaft 5002 may be independently controlled by apparatus previously described.

AC power grid 5006 provides AC electrical power through electrical cable 5008 to first sensor system 5010. Electrical measurements are made by suitable electronic means within sensor system 5010. Such measurements include the voltage, current and phases between the various conductors (for example, between phases A, B, and C of 208 Y as an example). The results of those measurements are provided as digital signals through cable communications means 5012 to bidirectional digital fiber optic communications means 5014 which are sent to bidirectional fiber optic to voltage converter 5016 that provides input data through cable 5018 to computer system 5020. The opposing arrows in FIG. 53 show the bidirectional digital fiber optic communications means 5014. In this case cable communications means 5012 may be a fiber optic cable or an electronic cable properly terminated and coupled to the bidirectional digital fiber optic communications means 5014 using typical techniques in the industry that provides information from first sensor system 5010 to computer system 5020.

Computer system 5020 may send commands over cable 5022 which are suitably encoded by bidirectional fiber optical voltage converter 5016 and sent over digital fiber optical communications means 5014. Suitable encoded signals are sent over cable means 5024 to the AC to DC converter 5026. Computer commands from computer 5020 are used to control input AC power provided through cable 5028 and to generate and control the DC power provided by cable 5030. Second sensor system 5032 is used to determine measurements and provide the results through cable 5034 to the computer system 5020. DC electrical power is provided over cable means 5036 to the umbilical 5038 wound on drum 5040. The voltage, current and other characteristics of the DC power provided over cable means 5036 is controlled by computer means 5020. Drum controller 5042 sends and receives data over bidirectional data cable 5044 and the computer system 5020 is used to suitably control the position of umbilical 5038. The surface of the earth is shown figuratively as element 5046.

DC electrical power is sent downhole thorough umbilical 5038. The closely spaced arrows show a direction of power flow downhole. Third sensor system 5048 measures the characteristics of the DC voltage provided downhole. The electrical power (mostly DC) is provided by cable 5050 to power filter 5052 that is used to "smooth over" any spikes or other interfering signals. Signals from the third sensor system 5048 are sent over cable 5054 to the computer system 5020 which then controls power filter 5052 by commands sent over cable means 5056. Fourth sensor system 5058 measures electrical parameters on its input cable means 5060 and provides output power on its output cable means 5062. Signals from the fourth sensor system 5058 are sent over cable 5061 to the computer system 5020 which then controls Downhole Power Distribution and Control System 5064.

Except for the electric motor 5000, all other electrical power requirements for the Subterranean Electric Drilling Machine are provided by Downhole Power Distribution and Control System 5064. Suitable power control, waveshaping, filtering, and active power control electronics may also be incorporated in various embodiments in element 5064. Cable 5072 provides power to the D.C. Motor 5000 from the Downhole Power Distribution and Control System 5064. Power and data signals are sent to and from the other systems over cable means 5066. Sensor data from system 5064 is provided to the computer system 5020 over cable means 5068 and commands are received over cable means 5070 that are used to control the power and data signals provided by the Downhole Power Distribution and Control System 5064. If the DC electric motor 5000 can receive commands internally, then such commands are sent by the computer system 5020 through cable means 5074. Internal sensor means within the electric motor (voltage, frequency, temperature, etc.) are sent to the computer system 5020 by cable means 5076. In selected embodiments of the invention, various control electronics may be located within the AC electric motor in FIG. 53 including wave shaping control, phase control, RPM control, current limiting, temperature regulation, and suitable sensors may be provided to allow for such control.

In this way, the closed-loop feedback controlled DC electric motor is provided its required operating voltage, current, and other inputs as controlled by the computer system 5020. Adjustments are made to the uphole system above the surface of the earth so that the downhole electrical motor obtains the optimal electrical power required by the operating characteristics of the DC electric motor. Computer system 5020 is used in a closed-loop feedback system to control the outputs 5028, 5030, 5036, 5038, 5050, 5060, 5062, and 5072 in response to measurements obtained by the various sensors already described in FIG. 53 including sensors within elements 5010, 5032, 5048, 5058, 5064, and 5000.

The DC power system described in FIG. 53 eliminates the potential problems involved with the inductive reactance of the umbilical 5038 wound up on drum 5040 as described in FIG. 51 and avoids the necessity for DC to AC conversion as described in FIG. 52. There have been, and continue to be major development efforts in the industry to provide practical DC electric motors for downhole use. The initial use for these DC electric motors will probably be to operate various types of downhole pumps. However, those DC electric motors can be used for drilling purposes as outlined herein.

FIG. 53 may be used to control any downhole DC electric motor, including all such electric motors defined in the following References 101, 102, 103, 104, 105, 106, 107, and 108. Further, an "DC electric motor" 5000 shown in FIG. 53 is also defined to include any suitable combination of an electric motor and associated hydraulic system used to rotate drill bit 5004, and/or any electric motor and gear reduction box used to rotate drill bit 5004, and/or any electric motor in combination with any additional mechanical or electrical means to rotate drill bit 5004.

It is also evident that the feedback control system in FIG. 53 may be suitably modified to provide any type of current and voltage to any DC electric motor 5000 defined in References 101, 102, 103, 104, 105, 106, 107, and 108.

The DC power system can provide a single polarity output, with ground current returning through the earth. Or, the DC power system can provide essentially two outputs downhole, for example, a plus voltage, and a minus voltage. Or, the DC power system can provide essential three outputs downhole, for example, a plus voltage, a minus voltage, and system ground. Or, the DC power system can provide any number of outputs downhole, having any number of desired polarities or magnitudes, and any desired current. Each can be used under appropriate circumstances.

FIGS. 51, 52, and 53 describe the Grid, which in those figures is the AC electric power provided by the AC electrical grid provided by power stations. However, the Grid can equally be provided by portable generators, or by any suitable power source of any type.

In the above, standard engineering procedures are used to establish bidirectional communications over communications means 3014, 4014, and 5014 between the many different sensors and to issue commands to the various electronics means that are used to control their respective outputs.

Accordingly, the above description in relation to FIG. 53 discloses a method of providing the closed-loop feedback control of a remote DC electric motor means (5000) that has specific required operating parameters including the required operating voltage, and the required operating current, said DC electric motor means disposed below the surface of the earth (5046) and located within in a borehole in the earth that receives electrical energy through a long umbilical means (5038) which receives power from an uphole AC to DC converter means (5026) that comprises at least the steps of:

(a) measuring a first set of electrical parameters including first measured voltage and first measured current provided to said remote DC electric motor means (4000) using a multiplicity of sensors located below the surface of the earth (5048, 5058, 5066, and within 5000);

(b) sending information related to said first set of measured parameters through a bidirectional communications means (5014) to a computer means (5020) located on the surface of the earth (5046);

(c) comparing said first set of measured parameters with the required operating parameters within said computer means (5020);

(d) determining within said computer means (5020) any first set of adjustments that need to be made to the first set of measured parameters to provide the required operating parameters to said DC electric motor means (5000);

(e) sending information related to any first set of said adjustments through bidirectional communications means (5014) to the AC to DC converter means (5026) to adjust its output parameters to provide a second output voltage, and second output current provided by said AC to DC converter means (5016);

(f) providing a second set of operating parameters to said DC electric motor means (5000);

(g) repeating said measurements and said adjustments a plurality of successive times, thereby providing the closed-loop feedback control to provide the required the required operating voltage, and the operating current to said DC electric motor means (5000).

Accordingly, the above description in relation to FIG. 53 further discloses a method wherein the DC electric motor means (5000) provides the rotational energy of a rotary drill bit (5004) located within the borehole.

Accordingly, the above description in relation to FIG. 53 further discloses a method wherein the DC electric motor means (5000) is provided the required operating frequency, the required operating voltage, and the required operating current while power and data is also simultaneously sent to at least one other electrical component (5066) located within the borehole.

Accordingly, the above description in relation to FIG. 53 and previous figures above discloses a method wherein the DC electric motor means (5000) provides the rotational energy of a submersible electric pump located within said borehole.

Accordingly, the above description in relation to FIG. 53 discloses a method wherein the DC electric motor means (5000) includes any type of electric motor that requires substantially constant inputs of voltage and current for any duration of time.

FIGS. 51, 52, and 53 may be summarized as follows in Table 1:

TABLE 1

| | FIG. 51 | FIG. 52 | FIG. 53 |
|---|---|---|---|
| Umbilical Power | AC | DC | DC |
| Downhole Power Conversion? | No | Yes | No |
| Type Electric Motor | AC | AC | DC |
| Electric Motor Commercially Available Now? | Yes | Yes | No |

Adaptive Electronics Control Systems

Figure 54:
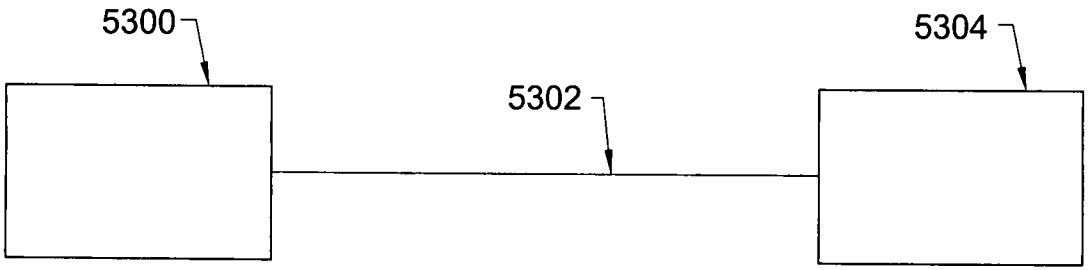
FIG. 54 shows a block diagram of one fundamental type of power distribution system where an uphole power system is connected by a long umbilical to a downhole power consumption device.

FIG. 54 shows a distributed power system. Uphole power system 5300 is connected by a long umbilical 5302 to downhole power device 5304. Various uphole power systems have been described in FIGS. 51, 52, and 53, to send power over umbilicals to downhole electric motors (that are examples of downhole power consumption devices). In general, the output of uphole power system 5300 is controlled so that after electrical losses over the umbilical, the downhole electric motors (downhole power consumption devices) receive the appropriate voltage and/or current levels. This approach contrasts with the methods and apparatus set forth in OTC 19113 (Ref 202) whereby an uphole system powers an umbilical that provides electrical power downhole that is then regulated downhole remotely at subsea locations. So, in OTC 19113, and as one example, even if the downhole load is only 1 amp at 400 volts, the regulator downhole is still capable of providing the full 25 amps (see Table 1 on page 3 of OTC 19113). This is a waste of power and complexity. In the approach of the preferred embodiment described herein, the uphole power system is adjusted by a computer system so that the proper power is delivered to the downhole power consumption device—after losses over the umbilical—and this approach works well because downhole sensors measure the amount of power delivered to the downhole power consumption device, and a closed-loop feedback system is used to adjust the uphole power system to deliver just the appropriate amount of power to the downhole power consumption device (but not necessarily more than is required for the specific application at the time), which is one embodiment of an "Adaptive Electronics Control System™", a term defined herein. Alternatively, this system is also called an "Adaptive Power Control System™". In FIG. 54, suitable sensors are located within elements 5300, 5302, and 5304, and suitable communications means and computer means to control the various elements are also located within elements 5300, 5302, and 5304 but those additional elements are not shown in FIG. 54 for the purposes of brevity. Suitable sensors located within elements 5300, 5302, and 5304 may also be referred to as different sensor means for the purposes herein. Suitable communication means within elements 5300, 5302, and 5304 are defined as communication means for the purposes herein.

In FIG. 54, first communications means 5330 is located within element 5300, second communications means 5332 is located within element 5302, and third communications means 5334 is located within element 5304, although elements 5330, 5332, and 5334 are not shown in FIG. 54 solely for the purposes of brevity. First, second, and third communications means are of any convenient type used in the art, and are configured to allow communications between elements 5300, 5302, and 5304. The various communications means may be bidirectional, or may be comprised of means to separately send signals and commands uphole, and means to send signals and commands downhole.

In FIG. 54, first sensor means 5340 are located within element 5300, second sensor means 5342 are located within element 5302, and third sensor means 5344 are located within element 5304.

In FIG. 54, first computer means 5350 is located within element 5300, a second optional computer means 5352 is located within element 5302, and a third optional computer means 5354 is located within element 5304. There are many preferred embodiments of the invention involving the location of differ computer means, sensor means, and communication means.

For the purposes of this invention, in one preferred embodiment of the invention the "long umbilical" is comprised of any umbilical where the input voltage drops to ½ or less of its value at a remote location at the end of the "long umbilical". Here, the input voltage a measure of voltage that is used to monitor or measure the power delivered to the umbilical.

In another preferred embodiment of the invention the "long umbilical" is comprised of any umbilical were the voltage input drops to ⅓ or less of its value at a remote location at the end of the "long umbilical"

In another preferred embodiment of the invention the "long umbilical" is comprised of any umbilical were the voltage input drops to 1/10 or less of its value at a remote location at the end of the "long umbilical"

In another preferred embodiment of the invention, the "long umbilical" is comprised of any umbilical were the voltage input drops to ⅔ or less of its value at a remote location at the end of the "long umbilical".

Figure 55:
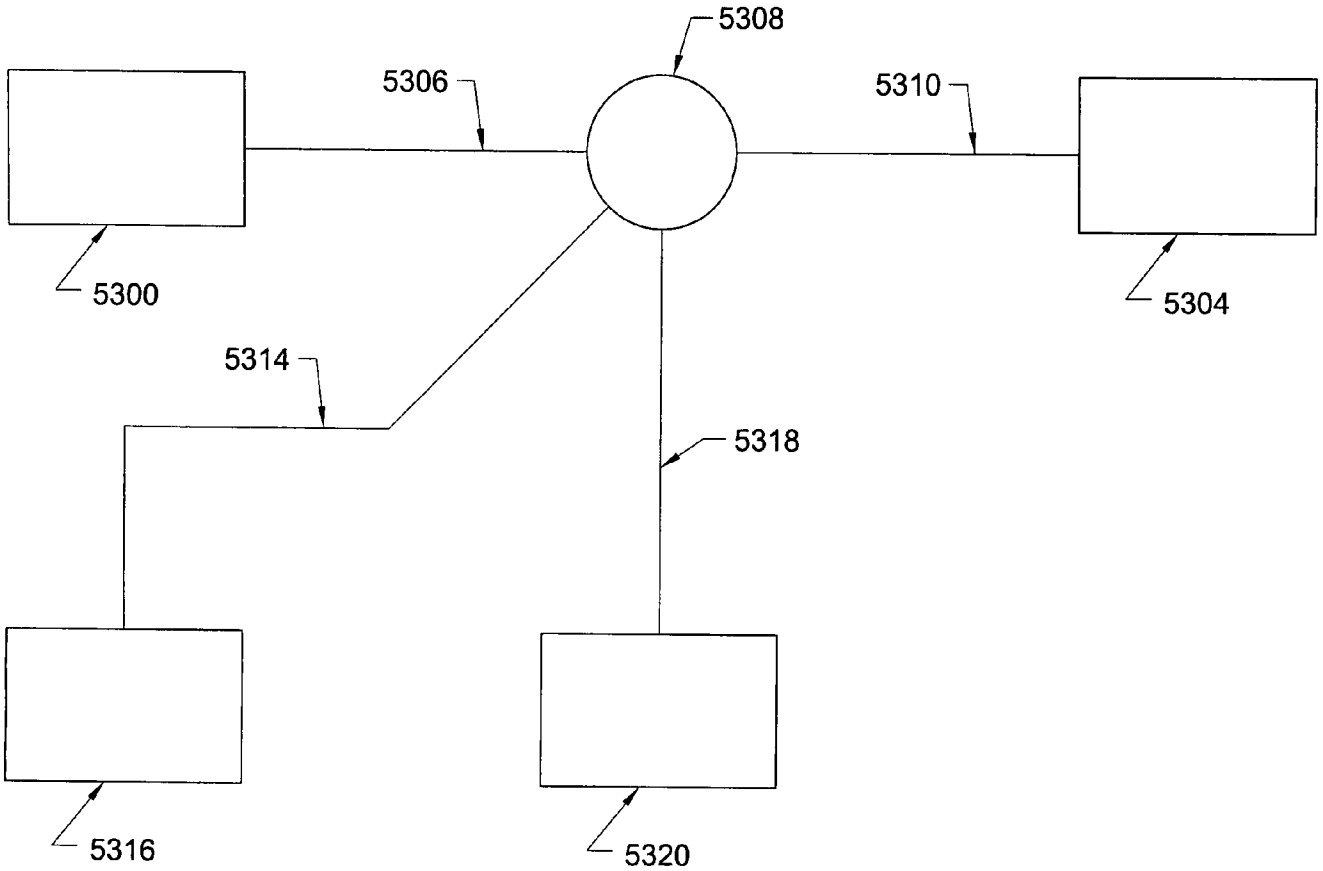
FIG. 55 shows a distributed power system where an uphole power system is connected by a long umbilical to a control node that is in turn connected to other downhole power consumption devices.

FIG. 55 shows a distributed power system with a control node and other downhole power consumption devices. Elements 5300 and 5304 have been previously defined. In FIG. 55, as an example, element 5304 could be an electric motor of a Subterranean Electric Drilling Machine. Long umbilical 5306 connects uphole power system 5300 to control node 5308. Control node 5308 is connected to downhole power consumption device 5304 by umbilical 5310. Control node 5308 is also connected by umbilical 5314 to downhole power consumption device 5316. Similarly control node 5308 is connected by umbilical 5318 to downhole power consumption device 5320.

As an example from FIG. 51, downhole power device 5304 could be electric motor 3000, and control node 5308 could be Downhole Power Distribution and Control System 3064. In different preferred embodiments, control node 5308 may be selected to have a variety of different communications means, various different sensor means, and its own computer means, but those means are not enumerated in FIG. 55 for the purposes of brevity.

As a further example in FIG. 55, if 5304 is a downhole electric motor of the Subterranean Electric Drilling Machine, and element 5316 is a large power consumption tractor device, and element 5320 is a downhole electric pump, then under the control of the computer system, control node 5308 would adjust the speed of the electric motor 5304, the intermittent use of the tractor device 5316, and the intermittent use of the downhole electric pump 5320 so that the maximum amount of power provided by the uphole power system would not be exceeded, and would be used efficiently under all operating conditions.

In the above description, umbilical 5310 may itself be a "long umbilical" as defined in various embodiments above. Similarly, in different preferred embodiments, umbilical 5314 may also be a "long umbilical" as defined in various embodiments above. And finally, in different preferred embodiments, umbilical 5318 may also be a "long umbilical" as defined in various embodiments above.

Further, in various preferred embodiments, selected communications means, selected sensor means, and selected computer means may be located within element 5314, but those means are not enumerated in FIG. 55 for the purposes of brevity.

In various preferred embodiments, selected communications means, selected sensor means, and selected computer means may be located within element 5316, but those means are not enumerated in FIG. 55 for the purposes of brevity.

In various preferred embodiments, selected communications means, selected sensor means, and selected computer means may be located within element 5318, but those mans are not enumerated in FIG. 55 for the purposes of brevity.

In various preferred embodiments, selected communications means, selected sensor means, and selected computer means may be located within element 5320, but those means are not enumerated in FIG. 55 for the purposes of brevity.

Accordingly, the closed-loop feedback control of the computer system is used with at least one node and at least two power consumption devices to optimize power delivered to the system generally disclosed in FIG. 55. Such preferred embodiments apply to downhole power consumption devices in wellbores and to subsea power consumption devices.

FIGS. 54 and 55 may be generalized to include any number of power distribution nodes (1, 2, or N, where N is any number); any number of power consumption devices attached to any such node (Mij, where i specifies the node, and j is the number of power consumption devices attached to that node).

In FIG. 55, and if any of the elements 5308, 5304, 5316 and/or 5320 are located below the surface of the ocean, then this is an embodiment of the "Subsea Adaptive Electronics Control System™".

In additional preferred embodiments, there may be cross-connections for power and data between any two nodes or any two power consumption devices. In essence here, the connections may look somewhat like a neural net in various preferred embodiments. Put another way, various preferred embodiments may have topologies resembling neural nets.

In yet other preferred embodiments, there are cross-connections between one or more surface power systems.

In yet other preferred embodiments, there are cross-connections between at least two power surface systems, and at least one subsea systems.

In yet other preferred embodiments, there are cross-connections between at least two power surface systems, and two or more subsea systems.

In many of the embodiments above, communications within the umbilical are made by fiber optic cables. These are efficient, and have proven themselves reliable. However, ordinary copper conductors can be used for such purposes, although they are subject to electromagnetic cross-talk, which is a disadvantage of using copper wires.

In many of the embodiments above, DC systems and AC systems are described.

In general, a DC system can be comprised of any number of wires, having any polarities. It is common for DC systems to have 2 and 3 wires, but in principle any number can be provided in a DC system providing any desired voltages and current levels. In a two wire system, it is common for one wire having a plus DC voltage, and another having a minus DC voltage. In a three wire system, it is common for one wire to be "neutral", one wire having a plus DC voltage and another having a minus DC voltage.

In general, an AC system can be comprised of any number of wires, having different voltages, currents, and phases. It is common for AC systems to have 2, 3, and 4 wires, but in principle any number can be provided in an AC system providing any desired AC voltages, currents, and phases. In multiple downhole systems, a first AC power system can provide AC voltage at a first frequency, and a second AC power system can provide AC voltage at a second frequency, so that the first and second power systems can conveniently control distant loads (such as two electric motors) using different frequencies for each load.

Further, a power system can be constructed using a mix of DC and AC systems for specific purposes in various preferred embodiments of the invention.

Any practical system may use any protocol for communications, including an Ethernet. Any practical umbilical system may use wetmate connectors of the type currently used in the industry.

And finally, the systems in FIGS. 51, 52, 53, 54, and 55 may be modified to take into account the peculiarities of any real specific electric motor such as its starting requirements, its harmonic content, back emf, etc., to provide a particular electric motor the necessary power for optimal performance in wellbore or in subsea applications. Accordingly, the different methods and apparatus described herein may be used to "soft start" various electric motors, which is a term often used in the art to describe controlling and/or minimizing adverse electrical effects during start-up of electric motors.

As stated earlier, an entire copy of U.S. Provisional Patent Application No. 61/189,253, entitled "Optimized Power Control of Downhole AC and DC Electric Motors and Distributed Subsea Power Consumption Devices", having the Filing Date of Aug. 15, 2008 is incorporated in its entirety by reference herein. In particular, and to be redundant, entire copies of all the reference documents defined in U.S. Provisional Patent Application No. 61/189,253 are also incorporated in their entirety by reference herein that are used in part to define relevant portions of the prior art for the purposes of this application, and which further define what any individual having ordinary skill in the art would know and understand for the purposes of this application.

Accordingly, the above description in relation to FIG. 54 discloses a method to provide the closed-loop feedback control of an uphole power system means (5300) located above the surface of the earth connected by a long umbilical means (5302) to at least one downhole power consumption device (5304) that is located within a borehole within the earth and which uphole power system means (5300) is controlled by a computer means to provide the required operating parameters to said downhole power consumption device (5304) based in part on information obtained from one or more sensor monitoring means within said downhole power consumption device (5304).

Accordingly, the above description in relation to FIG. 55 discloses a method of the closed-loop feedback control of an uphole power system means (5300) that provides electrical power to the power and control distribution node (5308) through a long umbilical (5306) and which node is connected to at least two power consumption devices (5304 and 5320) requiring specific input electrical operating parameters that includes at least the steps of:

(a) measuring selected sensor information within said power consumption devices (5304 and 5320);

(b) measuring selected sensor information within said node (5308);

(c) communicating said selected sensor information to a computer system means controlling said uphole power system means (5300);

(d) using said selected sensor information to adjust the electrical output parameters of said uphole power system means (5300) to provide said power consumption devices with their required specific input electrical operating parameters.

Accordingly, the above description in relation to FIG. 55 further discloses a method wherein the power and control distribution node (5308) and the power consumption devices (5304 and 5320) are located within a wellbore.

Accordingly, the above description in relation to FIG. 55 and other figures above further discloses a method wherein the power and control distribution node (5308) and the power consumption devices (5304 and 5320) are located at a subsea location within an ocean.

Accordingly, the above description in relation to FIG. 55 discloses a method to provide the closed-loop feedback control of a power system located on the surface of the earth connected through a long umbilical to at least one control node that selectively delivers power to remote power consumption devices so as to optimize power delivered to the power consumption devices by the uphole power system.

Accordingly, the above description in relation to FIG. 55 and other figures above discloses a method wherein the control node and the remote power consumption devices are located within a wellbore.

Accordingly, the above description in relation to FIG. 55 and other figures above discloses a method wherein the control node and the remove power consumption devices are located at a subsea location within an ocean.

Various embodiments of the invention as disclosed in relation to FIGS. 51-55 may also be used to power underwater remote operated vehicles to distances of 5 to 20 miles from a tethered station that can conveniently provide electrical power in the ranges of 150 horsepower to 500 horsepower.

Various embodiments of the invention as disclosed in relation to FIGS. 51-55 may also be used to power mining equipment or other type of remote robotic type applications. There are many uses for different preferred embodiments of the invention.

Various embodiments of the invention as disclosed in relation to FIGS. 51-55 may also be used to power underwater pumps and compressors for remote subsea production operations which individually require independent speed control. Some of these pumps and compressor motors may range between 100 horsepower to 3,000 horsepower. These motors may be located in seafloor installations or they may be installed downhole. In several preferred embodiments, downhole pumps may exceed 1,000 horsepower. Independent operation of motors is such production arrangement are important. In some preferred embodiments, distances for such operations may be as great as 400 miles between the power source and the remote motors being controlled.

In particular relation to FIGS. 51-55 herein, the following additional references help define technology that is known to anyone having ordinary skill in the art for the purposes of application, and entire copies of all such references are incorporated herein in their entirety by reference:

The book entitled "The Smart Grid: Enabling Energy Efficiency and Demand Response", by Clark W. Gellings, CRC Press, Jul. 15, 2009, 250 pages, an entire copy of which is incorporated herein by reference.

The book entitled "The Electric Power Engineering Handbook, Second Edition", Volumes 1, 2, 3, 4 and 5 (total of five volumes), by Leonard L. Grigsby, CRC Press, May 30, 2007, 2,320 pages, an entire copy of all five volumes of which are incorporated herein by reference.

The book entitled "Power-Switching Converters, Second Edition, by Alejandro Oliva and Simon Ang, CRC Press, Mar. 17, 2005, 568 pages, an entire copy of which is incorporated herein by reference.

The book entitled "Complex Behavior of Switching Power Converters" by Chi Kong Tse and Muhammad H. Rashid, CRC Press, Jul. 28, 2003, 280 pages, an entire copy of which is incorporated herein by reference.

The book entitled "Protection Devices and Systems for High-Voltage Applications", CRC Press, Feb. 4, 2003, 304 pages, an entire copy of which is uncarpeted herein by reference.

Long-Lasting Seals for Smart Shuttles

Smart Shuttles attached to armored cables are described in FIGS. 8, 8A, 8B, and 24 herein. Smart Shuttles attached to coiled tubings and umbilicals are described in FIGS. 31, 32, 33, and 34 herein.

Smart Shuttles are also thoroughly described in FIGS. 19, 19A, 19B, and 20 in U.S. Pat. No. 7,325,606 B1 having the lead inventor of William Banning Vail III, that issued on Feb. 5, 2008, an entire copy of which is incorporated herein by reference. One embodiment of a Smart Shuttle seal is element 692 FIG. 19 of the Vail (606) patent. Smart Shuttles are also thoroughly described in FIGS. 23, 23A, 23B, 23C, and 23D of the Vail (606) patent. Element 692 that is one embodiment of a Smart Shuttle seal is shown in FIGS. 19, 19B, 19C, 23, 23A, 23B, 23C, and 23D.

Figure 56:
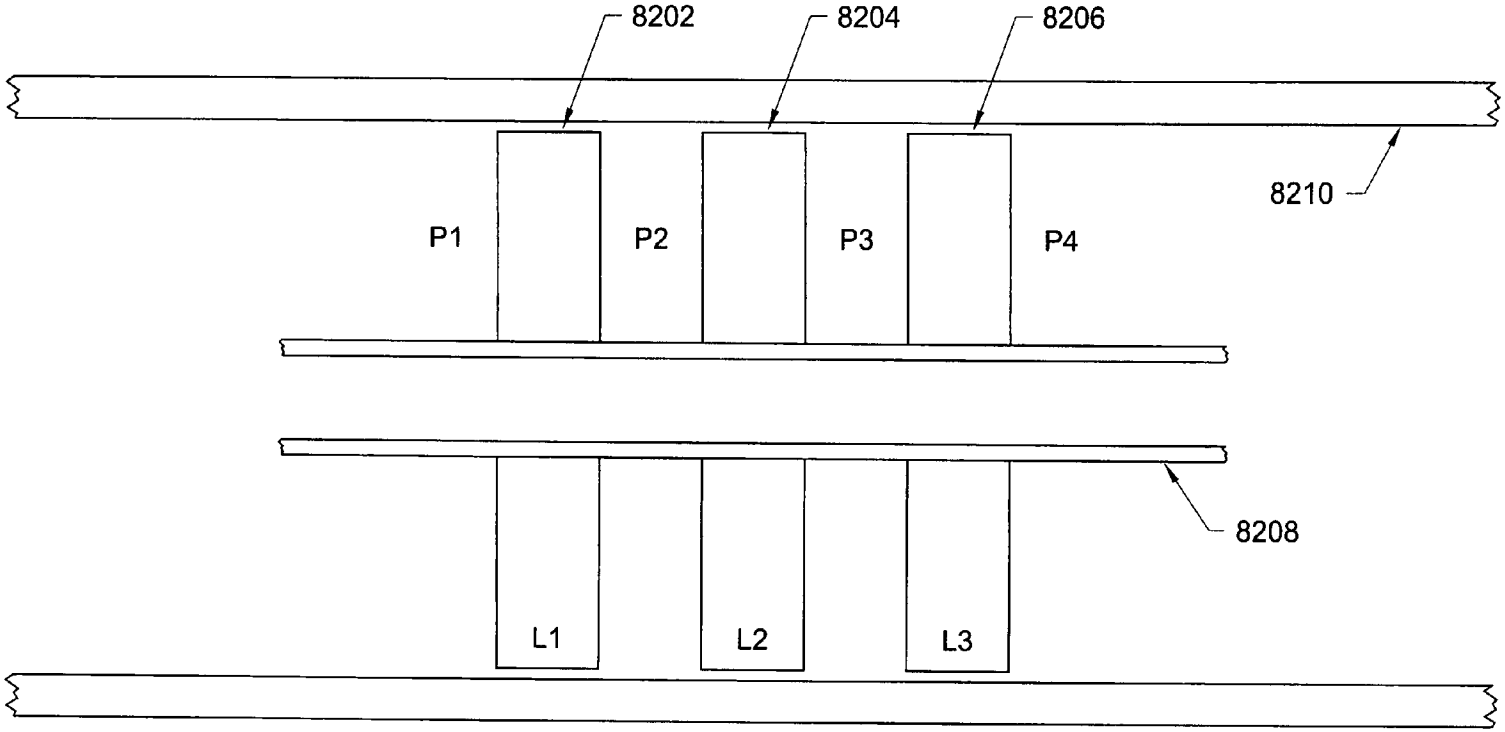
FIG. 56 shows a section view of a Smart Shuttle seal having three elements.

In different embodiments, the Smart Shuttle may use one seal, two seals, or any number of seals. The seals do not have to be identical and may be selected for different physical properties in different preferred embodiments. Another version of that seal for the Smart Shuttle is shown in FIG. 56. First Smart Shuttle seal 8202, Second Smart Shuttle Seal 8204, and third Smart Shuttle seal 8206 are permanently mounted on tubular mandrel 8208 inside pipe 8210. Smart Shuttle seals 8202, 8204, and 8206 make seals on the inside of pipe 8210. The seals may be manufactured from any material such as urethane, nitrile, fabric reinforced nitrile, etc, or may be complex assemblies as described below. So any one Smart Shuttle may have any number of seals, which may have different designs, and which are made of different materials. Pressures P1, P2, P3 and P4 in the fluids present (which may be mixtures of fluids and may have one or more gasses present) are shown by these particular legends in FIG. 56. Fluid leakages L1, L2, and L3 are shown bypassing the seals under the stated pressure conditions and these legends are also shown in FIG. 56. One unit of measurement of fluid leakage is in volume/second. (Similar techniques may be used if combinations of one or more gasses and one or more fluids are present). If P1 is much larger than P4, then the Smart Shuttle will be pushed to the right-hand side in FIG. 56.

Figure 57:
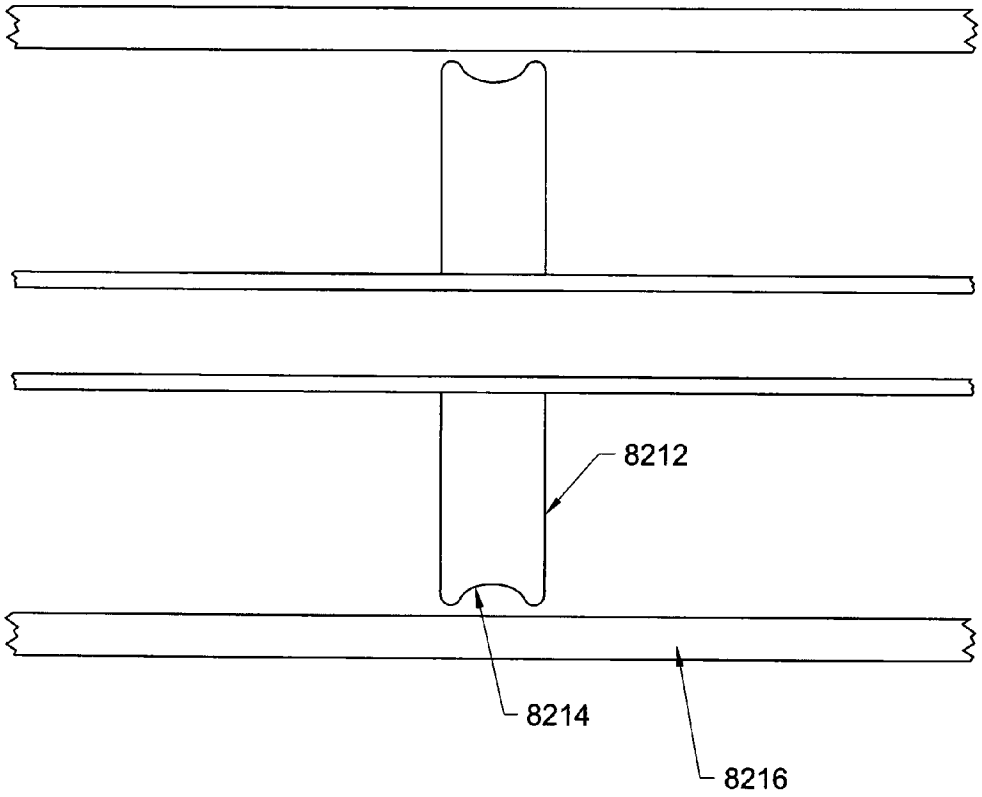
FIG. 57 shows one design of an individual Smart Shuttle seal having a suitable profile to make contact with the interior of a pipe.

FIG. 57 shows a typical individual Smart Shuttle seal 8212 that may have any suitable profile 8214 that makes contact with the interior of pipe 8216. Different profiles may have different leakages, and those leakages may be different for different pressures present. Profiles may be selected for minimum leakage under certain circumstances. Profiles may be selected for minimum leakage at specific pressure differentials across the seal. For example, a profile may be selected that multiply contacts the interior surface of the pipe. Or a profile may be selected that resembles a typical cup seal or chevron seal typically used in the industry.

Many preferred embodiments are contemplated having different detailed profiles. In FIG. 57, the sides of the seal may be reinforced with reinforcement plates placed on either side of the seal, although those reinforcements are not shown for the purposes of brevity. In several preferred embodiments, a solid urethane seal may be captured between two pieces of steel with holes bored out to accept the tubular mandrel. The entire assembly is then mounted in a suitable fashion on the tubular mandrel. Any other suitable means may be used to reinforce portions of the walls of the seals depending upon the application. In different preferred embodiments, any suitable reinforcement means may be cast into the body of a seal, and/or any additional reinforcement means may be attached externally to the body of the seal. In one preferred embodiment, seals may be fabricated from fabric reinforced nitrile material. In other preferred embodiments, the shaped metal parts may be cast into the seal (and such approaches are particularly useful in certain cup seals or chevron seals). Any seal made of any material may be similarly captured between two pieces of metal material with holes bored out to accept the tubular mandrel.

Figure 58:
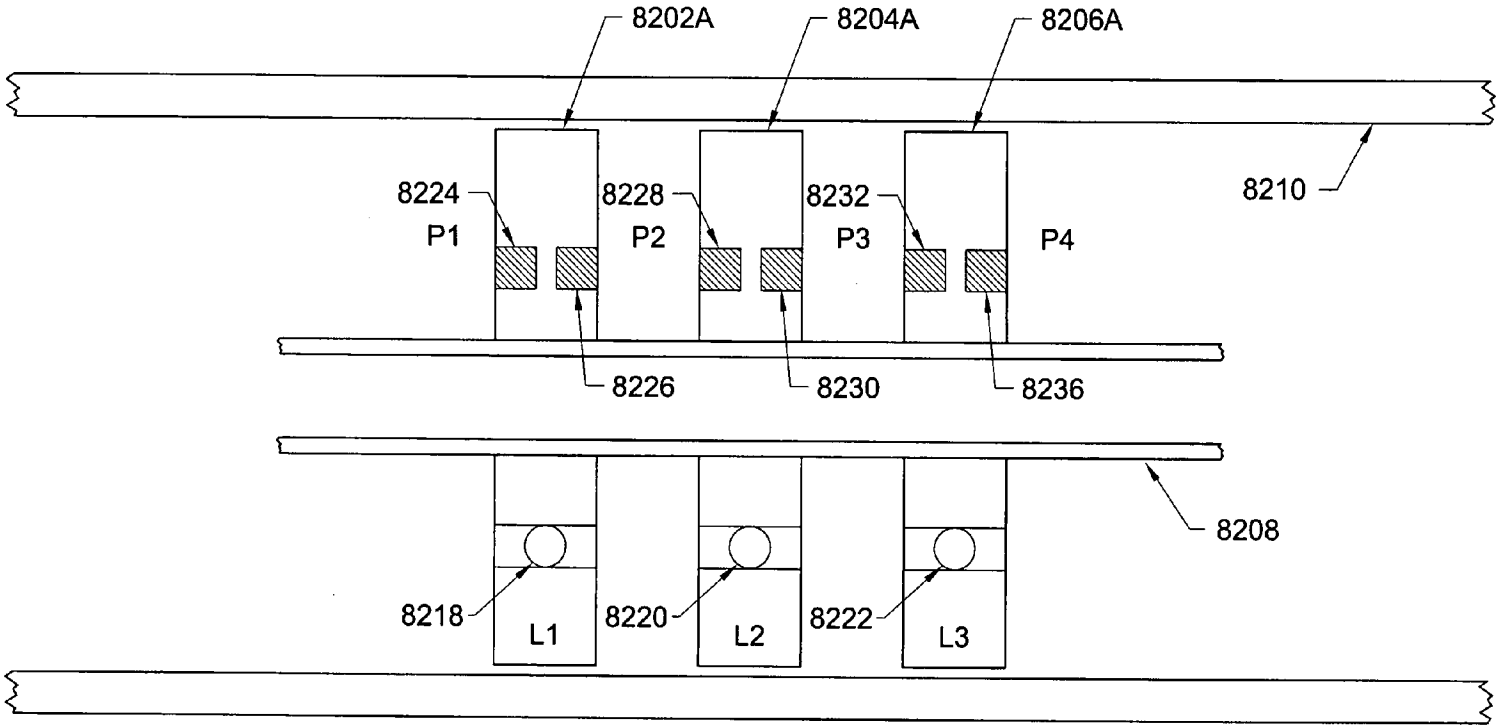
FIG. 58 shows improvements to FIG. 56, which includes pressure relief valves and sensors which may be used for the closed-loop control of the Smart Shuttle seals.

FIG. 58 shows improvements to FIG. 56. Elements 8208 and 8210 have already been defined in relation to FIG. 56. Here, pressure relief valves 8218, 8220, and 8222 are shown in seals 8202A, 8204A, and 8206A (which correspond respectively to seals 8202, 8204, and 8206 in FIG. 56). If the pressure drop P1-P4 is too high for one seal, then the pressure drops may be divided between the seals. So, pressure relief valves 8218, 8220, and 8222 are set so that P1-P2, P2-P3, and P3-P4 are within acceptable ranges. In one preferred embodiment, these pressure relief valves are set to pass fluid at a particular predetermined pressure differential. In another preferred embodiment of the invention, the pressure relief valves may be electronically controlled from the surface using techniques described in the above cited intellectual property and in the following. In another preferred embodiment of the invention, sensor arrays 8224, 8226, 8228, 8230, 8232, and 8236 may be fabricated within the respective seals. Each sensor array may measure one or more properties including, but not limited to, the pressure adjacent to the sensor, the temperature in the vicinity of the sensor, and the properties of the seal (such as stress or strain, and other parameters to be described below). In certain preferred embodiments, the sensor arrays may be physically extended to measure properties throughout each seal (such as the stress and strain in various selected portions of the seal). In yet another preferred embodiments of the invention, the sensor arrays may include means to measure the leakage levels L1, L2 and L3, as one example. In one variation of the invention, acoustic sensors within the sensor arrays are designed to measure the sound due to the leakage levels in order to quantitatively determine the leakage levels. Any other means may be provided in the sensor arrays to measure the leakage levels passing by the respective seals. A Smart Shuttle seal may have any number of sensors within it (from zero to N, where N is any number). In different preferred embodiments, the sensors may be distributed at any number of locations within any element of the Smart Shuttle or attached to any element of the Smart Shuttle.

With respect to FIG. 58, a preferred embodiment of the invention includes a closed-loop system to control the pressure relief valves. Portions of the sensor arrays can be connected to the pressure relief valves, and information about the status of the pressure relieve valves (open, or status of proportional control valves) may be sent through a first communications system (not shown) to a computer located on the surface of the earth (not shown). Other information may also be sent from the sensor arrays through the first communications system to a computer on the surface of the earth. Then this information may be processed by the computer on the surface of the earth, and commands sent downhole through a second electronics communications system (not shown) to adjust the electronically controlled pressure relief valves. In one preferred embodiment, the pressure relief valves are controlled to minimize appropriate leakage levels. Such closed-loop feedback control systems have been previously discussed herein and in the references cited herein.

Figure 59:
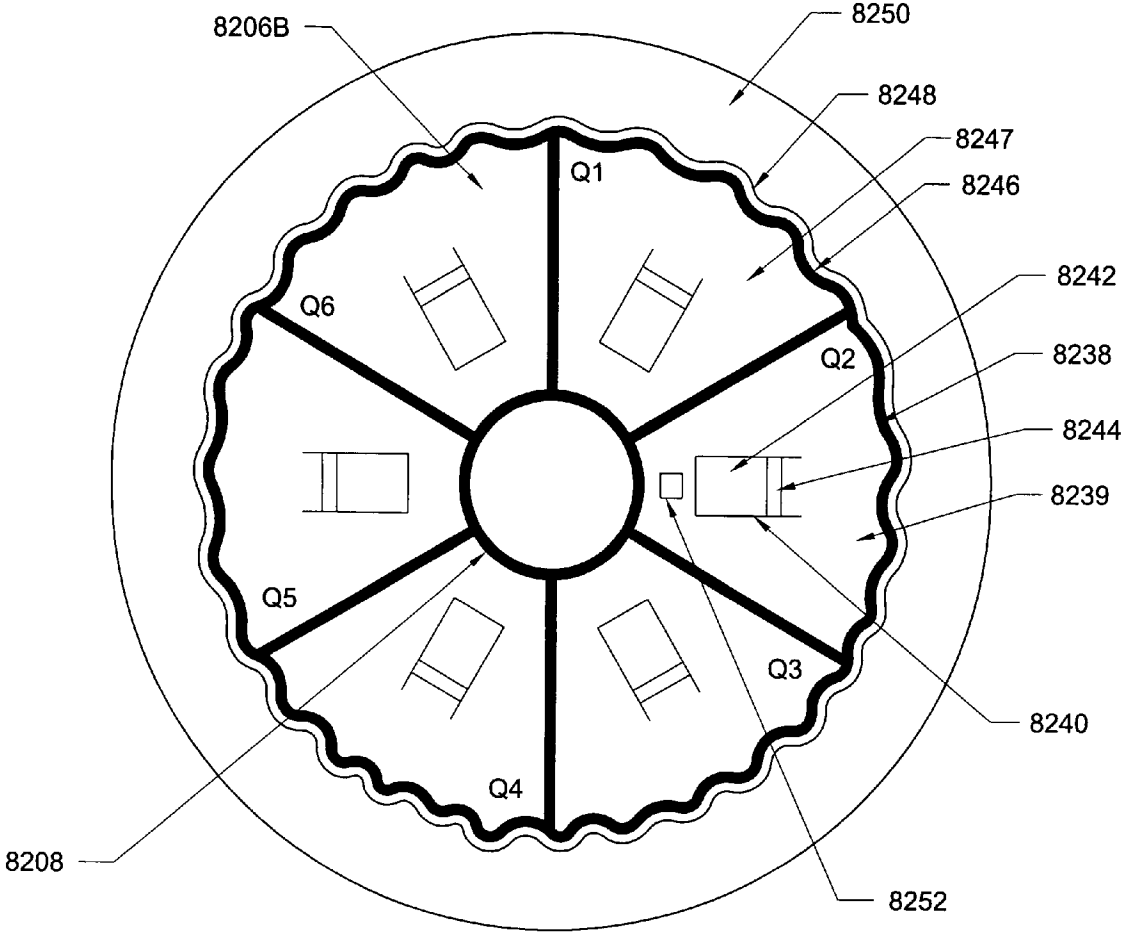
FIG. 59 shows a Smart Shuttle seal having different quadrants that may be independently hydraulically controlled to make contact with a pipe having an irregular inside diameter.

FIG. 59 is a preferred embodiment of the invention shown in FIG. 58. FIG. 59 shows a top view of a Smart Shuttle seal. This seal is electronically controlled to properly follow the irregular contours of the interior of a pipe.

In FIG. 59, seal 8206B corresponds to seal 8206 in FIG. 56 and seal 8206A in FIG. 58. However, seal 8206B is divided into 6 quadrants, respectively labeled in FIG. 59 with legends Q1, Q2, Q3, Q4, Q5, and Q6. As an example, the portion of the seal in quadrant Q1 is comprised of the dark shaded rubber walls 8246 forming a sealed cavity that encapsulates fluid 8247. The sealed cavities in the other quadrants are hydraulically isolated. (There are many ways to fabricate such a device, including simply gluing different quadrants together to form the seal. Other methods to cast a single seal are also appropriate.) Electronically controlled piston assembly 8240 is electronically controlled from the surface. Extra hydraulic fluid 8242 is injected into the piston assembly to move piston 8244 outward that in turn moves the outward surface of the seal 8238 towards the irregular interior surface 8248 of pipe 8250. (The hydraulic means to inject the extra hydraulic fluid are not shown in the interests of brevity.) Therefore, the portion of the Smart Shuttle seal adjacent to quadrant Q1 makes a better seal with the irregular interior of the pipe.

The extra hydraulic fluid is provided by a downhole hydraulic pump that is controlled from the surface of the earth (not shown). Sensors 8252 within quadrant Q1 are used to determine the pressure, temperature and any other physical parameter of interest in quadrant Q1. That information is the sent uphole to a surface computer by a first communications system. After processing uphole, information is sent downhole through a second communications system to control the amount of extra hydraulic fluid pumped into piston assembly 8240. Therefore, the quadrant Q1 is under closed-loop computer control from the surface. (The computer processing can also be done in the downhole unit and that is another preferred embodiment of the invention.)

The other quadrants are operated in a similar fashion. In this manner, the dimensions of the seal are changed in preferential directions to make better contact with the interior of an irregular pipe. Many alternative methods may be used to selectively control portions of the Smart Shuttle seal in preferential directions. For example, in certain preferred embodiments, motor driven screws can drive nuts encapsulated in urethane. In other embodiments, actuators of various types may be placed within urethane seals. There are many options. Any means may be used to selectively control preferential portions of the seal. Any method may be used to selectively control preferential portions of the seal.

If the seal is made thick enough, then the roller of the type used to centralize casings may be physically incorporated into the body of the seal of a Smart Shuttle to lower friction in certain preferred embodiments although a drawing is not shown here in the interests of brevity. Any rolling means may be suitably attached to or encapsulated within the seal in various preferred embodiments of the invention.

Figure 60:
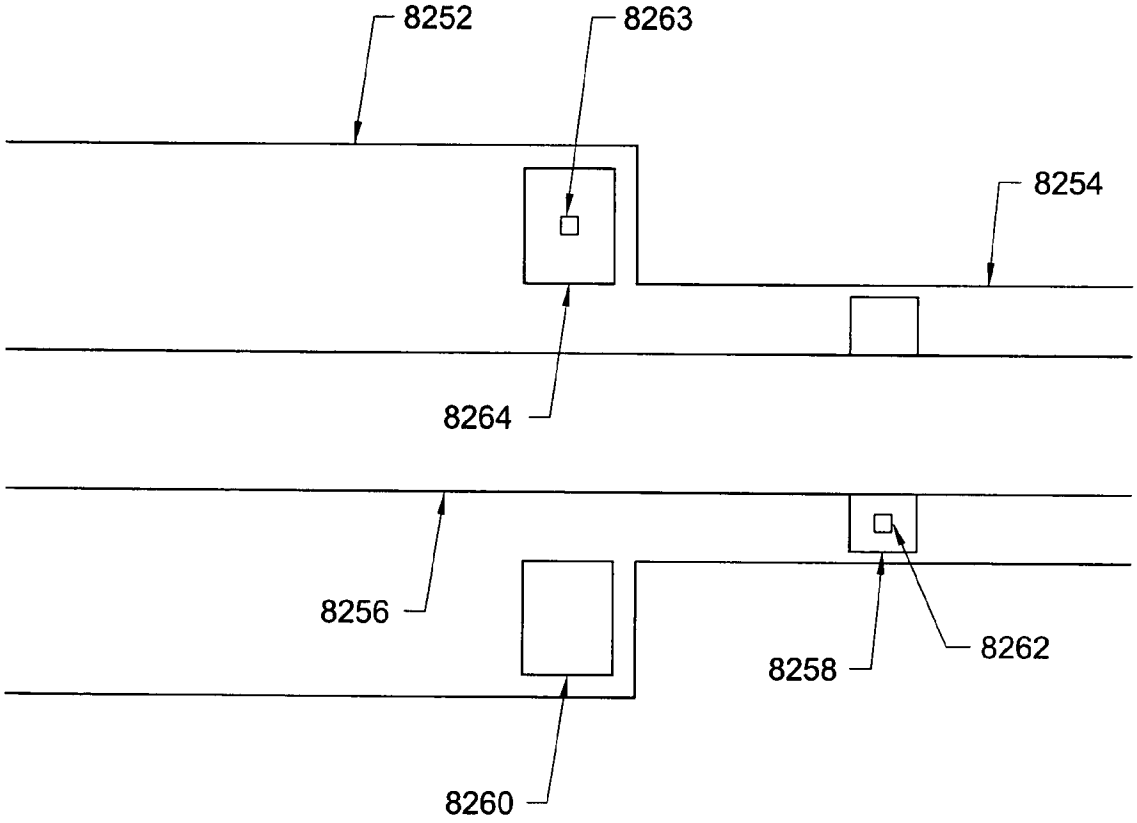
FIG. 60 shows a multiple diameter Smart Shuttle that may be used to properly seal two pipes having different inside diameters that are joined together.

In another preferred embodiment of the invention, multiple diameter Smart Shuttle seals may be used within pipes that dramatically change size. For example, this approach may be used in a joint where a 7 inch liner joins into 14 inch casing. Please see FIG. 60. Here, 14 inch casing 8252 joins 7 inch casing 8254. Tubular mandrel 8256 has small seal 8258 that seals against the interior of the 7 inch casing 8254. On the trip downhole, the large seal 8260 was "dropped off" during the trip downhole. The OD of the large seal 8260 seals against the interior of the 14 inch casing. In a preferred embodiment, the larger seal can be decoupled from the smaller seal by an electronically controlled latch mechanism 8262 that is controlled from the surface of the earth during the trip downhole. A portion of the latch mechanism may also be incorporated within large seal 8260 that is shown as numeral 8263 in FIG. 60. The outer portion of small seal 8258 that seals against the interior of the 7 inch casing is also used to seal the exterior portion of the small seal to the interior of the large seal (at location 8264) during the tip downhole. Downhole sensors provide information uphole about the location of the larger seal in relation to the pipe joint. During the return trip uphole, the larger seal can be latched onto the smaller seal—again under control from the surface computer. (Although the computer functions can also be incorporated downhole in another preferred embodiment of the invention.) In different preferred embodiments, the larger and smaller seals can have one or more of the additional features cited above—including any types of sensors located within any portion of the seals or within any portion of the apparatus, any types of bypass valves located within any portion of the seals or within any portion of the apparatus, and any types of actuators located anywhere in the apparatus under the control of a computer system as used in the industry. In different embodiments, the latch mechanisms 8262 and 8263 may be controlled, or may be self-actuated using typical designs known in the art. Seals 8258 and 8260 may be have any suitable geometric design, and in certain preferred embodiments, can be made of any materials, and can be made based on any typical downhole seal design including cup seals and chevron seals of the type typically used in the industry. For cup seals and chevron seals, a simple alternative design of the latching mechanisms and the internal sealing mechanisms would be required but standard techniques in the industry would be used for those designs.

Figure 61:
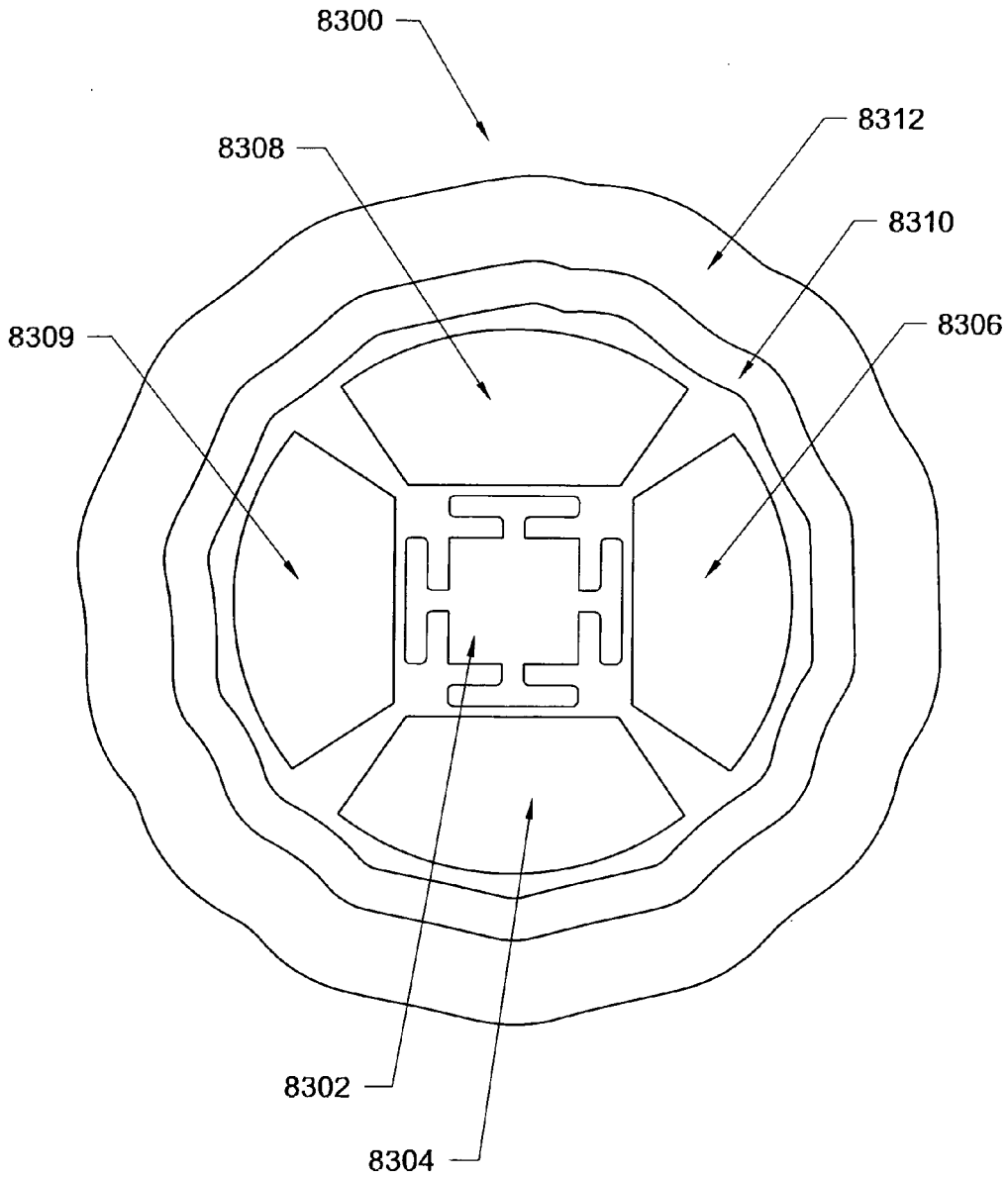
FIG. 61 shows an expandable seal for the Smart Shuttle.

FIG. 61 shows an Expandable Seal 8300 for the Smart Shuttle. Only the seal 8300 is shown in FIG. 61, which may be used in combination with any number of similar or other types of seals with any associated apparatus. (The pipe 8301 is not shown in FIG. 61.) The position of the Expansion/Contraction Driver 8302 may be controlled by any suitable Expansion/Contraction Driver means including pneumatic means, hydraulic means, electric means, electric motor means, mechanical means, electric pulse means, etc. To expand the seal, the Expansion/Contraction Driver is pushed "down" (downward into the paper). The Expansion/Contraction Driver rides on the inside of the Thermoset Segments 8304, 8306, 8308, and 8309, which have tapered interiors (the smaller cross section is in the direction into the paper as shown.) As the Expansion/Contraction Driver is pushed down, the tapered Thermoset Segments are pushed radially outward, therefore expanding the diameter of the Telescoping Shaped Circular Ring 8310. That in turn expands the outside diameter of the outer rubber seal 8312. In this preferred embodiment, the seal expands to make better contact with the interior of the pipe (not shown for simplicity in FIG. 61). The rubber is flexible enough to compensate for various different imperfections on the interior of the pipe. To contract the seal, the Expansion/Contraction Driver is pulled "up" (upward with respect to the paper). There are many possible variations of the invention. In different preferred embodiments, sensors within the seal send information uphole through a first communications system to a computer means. This data is analyzed by the computer means and commands are sent downhole to properly control the Expansion/Contraction Driver. This invention, and other related preferred embodiments, may also be incorporated within pigs that are used in pipelines. Seal 8300 may be of any suitable geometric design, and in certain preferred embodiments, can be made of any material, and can be made based on any typical downhole seal design including designs for cup seals and chevron seals of the type typically used in the industry. The seal may include any types of sensors located with any portion of the seal or within any portion of any associated apparatus, may include any types of bypass valves located within any portion of the seal or within any portion of any associated apparatus, and may include any types of actuators located anywhere in the seal or anywhere in any related apparatus—any of said devices being under the control of a computer system utilizing closed-loop feedback control in certain preferred embodiments. The expansion mechanism may be placed within any interior portion of any cup seal or chevron seal, and a simple alternative designs for those type of seals would be required using standard techniques in the industry. Any seal shape controlling means may be used to control the shape of the seal. Any seal shape controlling methods may be used to control the shape of the seal.

Figure 61A:
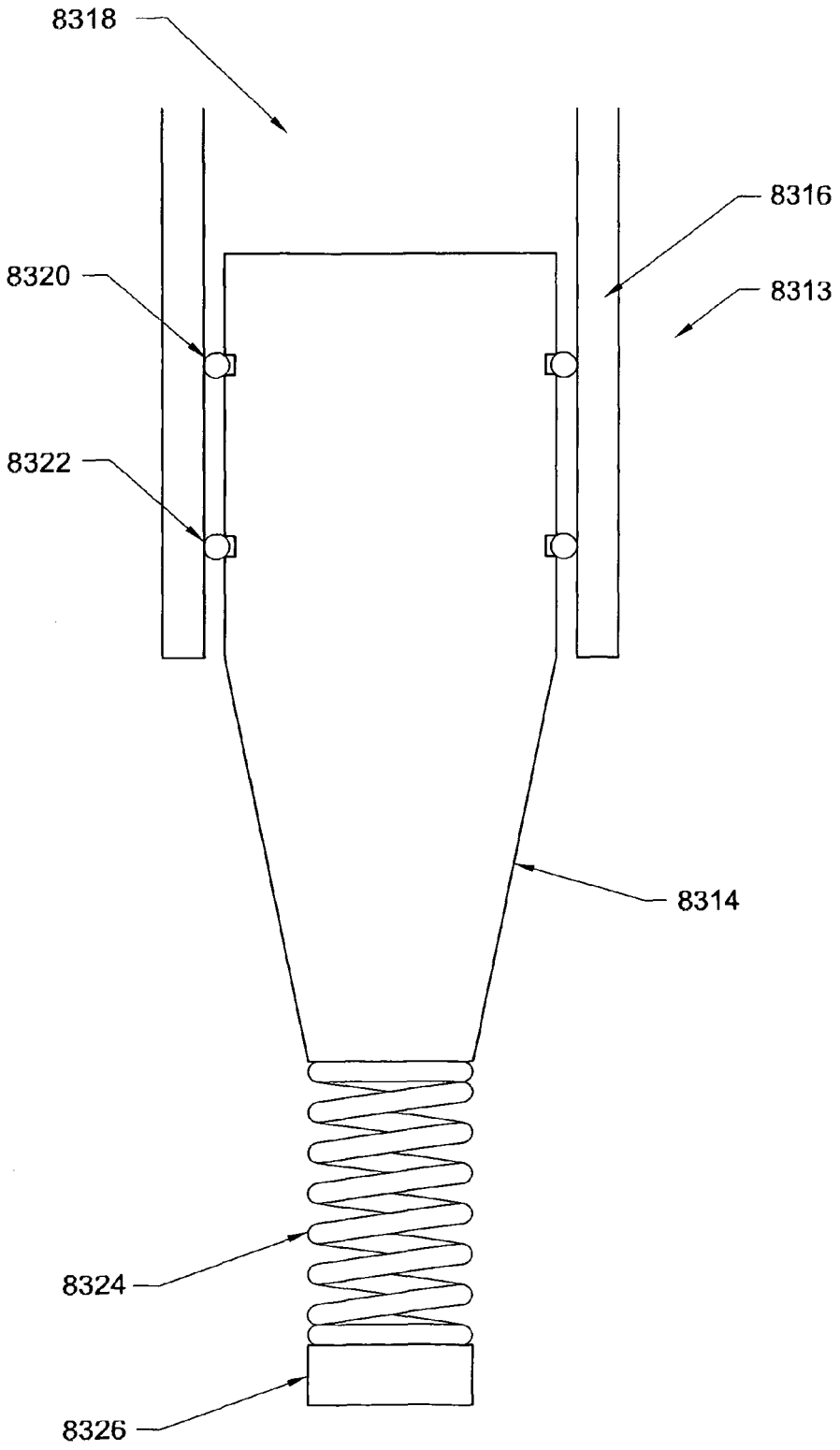
FIG. 61A shows a section view of the Expansion/Contraction Driver apparatus for the seal shown in FIG. 61.

FIG. 61A shows a section view of a preferred embodiment of an Expansion/Contraction Driver apparatus generally shown as 8313. Tapered Driver 8314 is pushed down by hydraulic cylinder 8316 having hydraulic oil 8318 under pressure that is sealed by o-rings 8320 and 8322. The hydraulic oil is pressurized using typical techniques in the industry. As discussed in relation to FIG. 61, when the Tapered Driver 8314 is pushed down, outer rubber seal 8312 is expanded. To contract the outer rubber seal 8312, the pressure on hydraulic oil 8318 is reduced, allowing spring 8324 having backstop 8326 to push upward the Tapered Driver 8314. In alternative embodiments, the return spring and backstop is made integral with the hydraulic cylinder so that only the Tapered Driver would move up and down as required.

Accordingly, the invention discloses one or more sealing means attached to a Smart Shuttle.

Accordingly, the invention discloses the use of any suitable geometric shape of any sealing means attached to a Smart Shuttle.

Accordingly, the invention discloses any means to adjust the pressure between different seals of the Smart Shuttle.

Accordingly, the invention discloses the use of any pressure relief means to adjust the pressure between two or more seals of a Smart Shuttle.

Accordingly, the invention discloses the use of any sensor means within seals of the Smart Shuttle to measure relevant parameters.

Accordingly, the invention discloses the use of any sensor means located within any portion of the Smart Shuttle apparatus to measure relevant physical parameters.

Accordingly, the invention discloses one or more sensors located within any seal of the Smart Shuttle.

Accordingly, the invention discloses one or more sensors located within any portion of the Smart Shuttle apparatus to measure relevant physical parameters.

Accordingly, the invention discloses the use of any sensor means associated with the Smart Shuttle to measure sealing parameters of the seals of the Smart Shuttle.

Accordingly, the invention discloses the use of any sensing means to measure the fluid leakage past seals of the Smart Shuttle.

Accordingly, the invention discloses the use of any closed-loop means to measure downhole information associated with the Smart Shuttle seals, sending said information uphole through a first communications system to a computer means located on the surface of the earth, processing said information, and then sending commands downhole to one or more actuator means located downhole and associated with the Smart Shuttle to adjust at least one parameter of a Smart Shuttle seal (such as the shape of one at least one part of the seal).

Accordingly, the invention discloses means to selectively control portions of a Smart Shuttle seal in at least one preferential direction to improve the sealing ability of the seal within irregular pipes.

Accordingly, the invention discloses any means to expand and contract the size of a seal to make better contact with the interior of the pipe.

Accordingly, the invention discloses any means to control the contour of a seal to make better sealing contact with the interior of irregular pipe.

Accordingly, the invention discloses concentrically attached sealing means to allow the Smart Shuttle to enter into pipe systems having substantially different diameters.

Accordingly, the invention discloses two or more concentrically located sealing means for entering pipe systems having different diameters.

Any of the devices defined herein may be monitored and controlled by a surface computer. Data is acquired downhole to monitor any functional aspect of any device. Data is then sent uphole through a first data communications channel. That data is received by a computer. The computer makes decisions about how to control the downhole devices. Commands are then sent downhole to control those devices through a second data communications channel. This amounts to the closed-loop control of any of the devices defined herein. Various preferred embodiments of the invention use closed-loop computer control to determine the shape of the seal of a Smart Shuttle.

Accordingly, the invention discloses any Smart Shuttle seal shape controlling means.

Accordingly, the invention discloses any Smart Shuttle seal shape controlling means that is subject to the closed-loop feedback control of a computer system.

Accordingly, the invention discloses any Smart Shuttle seal shape controlling method to determine at least the shape of any portion of a seal.

Accordingly, the invention discloses any Smart Shuttle seal shape controlling method to determine at least the shape of any portion of a seal that is subject to the closed-loop feedback control of a computer system.

The inventions above may also be used to improve "pigs" used in the industry. If the pigs are attached to an umbilical, the techniques mentioned above are also applicable. If the pig is an autonomous device, then the computer mentioned above can be placed within the autonomous device. If acoustic transmission means are used to communicate with a pig, then such acoustic transmission means may be used for the closed-loop feedback control of a pig. If any wireless transmission means are used to communicate with a pig, then such wireless transmission means may be used for the closed-loop feedback control of a pig. Accordingly, similar techniques may be used to improve the performance of pigs. There are many combinations and alternatives which are yet other preferred embodiments of the invention to make improved pigs. In certain preferred embodiments, a mix of communication means may be used (for example, acoustic means to communicate to the pig and electromagnetic means to communicate with the surface computer).

Accordingly, the invention discloses the use of any closed-loop means as described above for pig applications (and if the pig is an autonomous pig, this includes placing the computer system within the pig in certain preferred embodiments.)

Accordingly, the invention discloses the use of any bidirectional wireless communication means, including acoustic and electromagnetic means, to control pigs using closed-loop feedback control as described above.

FIGS. 51-61 and 61A and the above description provides many specificities of preferred embodiments of the invention described herein. While the above description contains many specificities, these should not be construed as limitations on the scope of the invention but rather as exemplification of preferred embodiments thereto. As have been briefly described, there are many possible variations.

Cup seals, also called chevron seals, are commonly used to provide hydraulic seals to the inside of pipes and pipelines. For example, please refer to U.S. Pat. No. 6,561,280 entitled "Method of Injecting Tubing Down Pipelines" by Baugh, et al., that issued on May 13, 2003, an entire copy of which is incorporated herein by reference. Baugh (280) et al., describes "one or more sealing apparatus 64" in relation to FIG. 5 therein (column 4, lines 56-57). Baugh (280) et al. also states on column 4, line 66, to column 5, line 3, the following: "In one embodiment, the body encloses the check valves, and there is a greater number of sealing cups which extend the length of the body." Baugh et al., (280) also states in column 10, lines 32-34, the following: "The thruster pig has a sealing apparatus, for example one or more chevrons, to impede fluid migration between the body of the thruster pig and the inner surface of the pipe". Baugh et al. (280), also states in column 10, lines 39-51: "The seal between the injected tubing and the thruster pig can be a metal weld, a screw type seal, a compression type seal, or any other seal known to the art. The thruster pug is adapted to form a seal to the interior surface of the pipe. The seals can be any type of seal including extrusions, cups, chevrons, disks, or a combination thereof. The seal or seals are preferably cups as depicted in FIG. 3 and as are used in the art for pipeline pigs. The materials of the seals are advantageously elastic so that it can move past obstructions in the pipeline while maintaining some sealing capability, and then re-forming an essentially fluid-tight seal after passing the obstruction."

Such cup seals and chevron seals are also described in OTC Paper No. 8675 entitled "Extended Reach Pipeline Blockage Remediation" by Baugh, et al., presented at the Offshore Technology Conference during May 4-7, 1998, an entire copy of which is incorporated herein by reference. Cup seals and chevron seals are also described in OTC Paper No. 8524 entitled "Testing and Evaluation of Coiled Tubing Methods to Remove Blockages from Long Offset Subsea Pipelines" by Baugh et al., 1998, an entire copy of which is also incorporated herein by reference.

Relevant downhole apparatus is described in U.S. Pat. No. 6,779,598 that is entitled "Swivel and Eccentric Weight to Orient a Roller Sub" having the inventor of Robert Hall, that issued on Aug. 24, 2004, an entire copy of which is incorporated herein by reference. This U.S. Patent references Baugh et al. (280).

Cup seals and chevron seals are also described in U.S. Pat. No. 7,025,142 entitled "Bi-Directional Thruster Pig Apparatus and Method of Utilizing Same" having the inventor of James Crawford, that issued on Apr. 11, 2006, an entire copy of which is incorporated herein by reference.

Cup seals and chevron seals are also described in U.S. Pat. No. 7,406,738 entitled "Thruster Pig" having the inventors of Kinnari et al., that issued on Aug. 8, 2008 that is assigned to Statoil, an entire copy of which is incorporated herein by reference.

Cup seals and chevron seals are also described in U.S. Pat. No. 7,279,052 entitled "Method for Hydrate Plug Removal" having the inventors of Kinnari et al., that issued on Oct. 9, 2007 that is assigned to Statoil, an entire copy of which is incorporated herein by reference.

Cup seals and chevron seals are also described in U.S. Pat. No. 6,964,305 B2 entitled "Cup Seal Expansion Tool" having the inventors of McMahan, et al., that issued on Nov. 15, 2008 that is assigned to Baker Hughes Incorporated, an entire copy of which is incorporated herein by reference.

Cup seals and chevron seals are also described in U.S. Pat. No. 5,010,958 entitled "Multiple Cup Bridge Plug for Sealing a Well Casing and Method" having the inventors of Meek, et al., that issued on Jan. 5, 1990 that is assigned to Schlumberger Technology Corporation, an entire copy of which is incorporated herein by reference.

Cup seals and chevron seals are also described in U.S. Pat. No. 7,328,742 B2 entitled "Seal Cup for a Wellbore Tool and Method" having the inventor of Maurice Slack, that issued on Feb. 12, 2008 that is assigned to Tesco Corporation, an entire copy of which is incorporated herein by reference.

FIG. 62 shows a first cup seal 8402 that is also called a chevron seal. Cup seal 8402 is located within pipe 8404, and makes movable and slidable contact with the interior of the pipe 8406 with hydraulic sealing portion 8408 of the first cup seal. The hydraulic sealing portion 8408 makes contact with the interior of the pipe 8406 at depth Z8408, a legend shown in FIG. 62. First cup seal 8402 is mounted on hollow mandrel 8410, having hollow mandrel interior 8412, and hollow mandrel external surface 8414. The thickness of pipe 8404 is T8404, but this legend is not shown in FIG. 62 for the purposes of simplicity. The thickness of hollow mandrel 8410 is T8410, but this legend is not shown in FIG. 62 for the purposes of simplicity.

First cup seal 8402 is mounted on hollow mandrel 8410 in a manner such that it forms a hydraulic seal within region 8416 defined in FIG. 62, that is physically between the interior of the pipe 8406 and hollow mandrel external surface 8414. Plate 8418 is welded to the hollow mandrel at location 8420. Threaded bolt 8422 passes through a hole in plate 8418, then through a hole in first cup seal 8402, and then through plate 8424 that is tightened in place with nut 8426. Respective aligned bolt circles in plate 8418, in the first cup seal 8402, and in plate 8424 allow the first cup seal to be bolted securely to the mandrel in a manner making an effective hydraulic seal within region 8416 using techniques typically used in the industry.

The interior portion 8428 of the first cup seal 8402 faces in the "UP" direction, a legend that is defined in FIG. 62.

Second cup seal 8430 is located within pipe 8404, and makes movable and slidable contact with the interior of the pipe 8406 with hydraulic sealing portion 8432 of the second cup seal. The hydraulic sealing portion 8432 makes contact with the interior of the pipe 8406 at depth Z8432, a legend shown in FIG. 62. Second cup seal 8430 is mounted on hollow mandrel 8410.

Second cup seal 8430 is mounted on hollow mandrel 8410 in a manner such that it forms a hydraulic seal within region 8434 defined in FIG. 62, that is physically between the interior of the pipe 8406 and hollow mandrel external surface 8414. Plate 8436 is welded to the hollow mandrel at location 8438. Threaded bolt 8440 passes through a hole in plate 8436, through an aligned hole in second cup seal 8430, and then through an aligned hole in plate 8442, that is tightened in place with nut 8444. Respective aligned bolt circles in plate 8436, in the second cup seal 8430, and in plate 8442 allow the second cup seal to be bolted securely to the mandrel in a manner making an effective hydraulic seal within region 8434 using techniques typically used in the in the industry.

The interior portion 8446 of the second cup seal 8430 faces in the "DOWN" direction, a legend that is defined in FIG. 62.

The two-cup seal arrangement shown in FIG. 62 is commonly used within the industry. For example, please refer to U.S. Pat. No. 6,561,280 entitled "Method of Injecting Tubing Down Pipelines" by Baugh, et al., that issued on May 13, 2003, an entire copy of which is incorporated herein by reference. In particular, please refer to the two-cup seal arrangement shown in FIG. 5 of U.S. Pat. No. 6,561,280. This arrangement can be called for the purposes herein an "opposing cup seal arrangement" because the interior portion of the first cup seal 8428 faces UP in FIG. 62 and the interior portion of the second cup seal 8446 faces DOWN in FIG. 62. For the purposes herein, this "opposing cup seal arrangement" will be called "a dual cup seal".

Downhole apparatus having two or more "dual cup seals" are commonly used in the industry. For example, please refer to OTC Paper No. 8675 entitled "Extended Reach Pipeline Blockage Remediation" by Baugh, et al., presented at the Offshore Technology Conference during May 4-7, 1998, an entire copy of which is incorporated herein by reference. In particular, please refer to FIG. 15 entitled "Combination Setup" which shows a first dual cup seal and a second dual cup seal.

By virtue of the construction of the dual cup seal arrangement in FIG. 62, a hydraulic seal is also produced in region 8448 between the two cup seals. The distance of separation of the hydraulic contact points respectively 8408 and 8432 is algebraically (Z8432-Z8408) is defined herein to be the distance of Y62, however that legend is not shown in FIG. 62 for the purposes of brevity.

The dual cup seal arrangement shown in FIG. 62 is capable of bidirectional movement. Pressures P8416, P8448, and P8434 are shown as legends in FIG. 62. The designation P8416 means the pressure in region 8416. If P8416 is larger than P8434, then the apparatus in FIG. 62 will slide towards the Down direction. In this downward movement, hydraulic sealing portion 8408 of the first cup seal and hydraulic sealing portion 8432 of the second cup seal slide along the interior of the pipe 8406. In general, there is a certain fluid leakage past the hydraulic sealing portion 8408 of the first cup seal that is designated by the legend L8408 that is necessarily a function of time and other physical variables, including pressure differentials, etc. In general, there is also a certain fluid leakage past the hydraulic sealing portion 8432 of the second cup seal that is designated by the legend L8432 that is necessarily a function of time and other physical variables including pressure differentials, etc. In certain preferred embodiments, the fluid leakages L8408 and L8432 are measured in units of volume per second. The entire dual cup seal arrangement shown in FIG. 62 is generally designated with numeral 8450.

Figure 63:
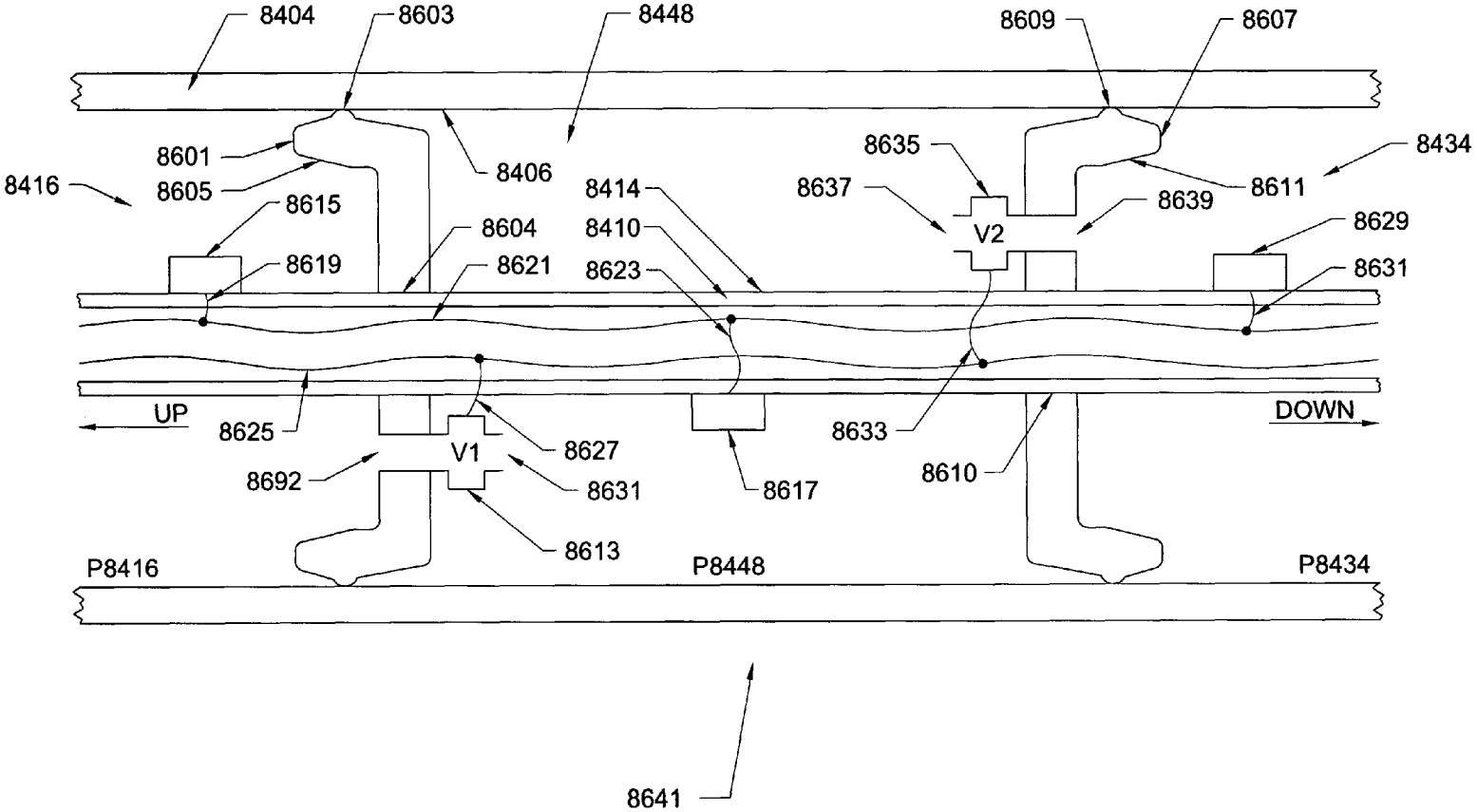
FIG. 63 shows another version of a dual cup seal arrangement similar to that shown in FIG. 62, but where pressure relief valves, and sensor systems are also explicitly shown.

FIG. 63 has many similarities to the dual cup seal arrangement shown in FIG. 62. However, the details concerning how the first seals and second seals are bolted in place in FIG. 62 are not shown for simplicity in FIG. 63. Instead, other detail as described below is shown. In FIG. 63, all the elements from within the range of 8400 to 8498 have been defined including: 8404, 8406, 8410, 8414, 8416 (and pressure P8416), 8434 (and pressure P8434), 8448 (and pressure P8448).

First cup seal 8601 has a hydraulic sealing portion 8603 that makes movable and slidable contact with the interior of pipe 8406 at depth Z8603, a legend that is not shown in FIG. 63 for the purposes of simplicity. The interior portion 8605 of the first cup seal 8601 faces in the "UP" direction, a legend that is defined in FIG. 63. First cup seal 8601 makes static hydraulic seal with hollow mandrel external surface 8414 using typical art in the industry, including that shown in FIG. 62. Any means may be used to form the static hydraulic seal between hollow mandrel external surface 8414 and the mandrel-mating portion 8604 of first cup seal.

Second cup seal 8607 has a hydraulic sealing portion 8609 that makes movable and slidable contact with the interior of pipe 8606 at depth 28609, a legend that is not shown in FIG. 63 for the purposes of simplicity. The interior portion 8611 of the second cup seal 8607 faces in the "DOWN" direction, a legend that is defined in FIG. 63. Second cup seal 8607 makes a static hydraulic seal with hollow mandrel external surface 8414 using typical art in the industry, including that shown in FIG. 62. Any means may be used to form the static hydraulic seal between hollow mandrel external surface 8414 and the mandrel-mating portion 8610 of the second cup seal.

First pressure control valve 8613 provides a predetermined pressure drop algebraically defined by the quantity (P8448-P8416) across first seal 8603. Usual techniques are used in the industry to fabricate this valve within first seal 8603. (Alternative embodiments of the invention place such a pressure relief valve in another portion of the apparatus including within a portion of hollow mandrel 8410.) First sensor array 8615 provides measurements of at least pressure P8416 and any other useful parameters including temperature, fluid velocity, acoustic parameters related to leakage past hydraulic sealing portion 8603 of first cup seal 8601, etc., using typical techniques in the art. Second sensor array 8617 provides similar measurements including pressure P8448.

In one preferred embodiment, pressure P8416 is measured using first sensor array 8615, and data is communicated from said first sensor array through cable 8619 to communications link 8621, and data is sent uphole to a computer system (not shown for the purposes of brevity in FIG. 63). Similarly, pressure P8448 is measured using second sensor array 8617, and data is communicated from said second sensor array through cable 8623 to communications link 8621, and data is sent uphole to a computer system. Said computer system determines appropriate commands, and commands are sent downhole through command link 8625 to cable 8627 that controls first valve 8613. First valve 8613 identified with legend V1 has an upper fluid port 8692 and a lower fluid port 8631. Fluid may flow either way. Valve V1 may be commanded to keep a certain algebraically defined pressure drop across first valve 8613.

Third sensor array 8629 provides measured data including the pressure P8434 to cable 8631 that in turn provides data to communications link 8621 that is sent uphole to a computer system (not shown for simplicity). That computer system processes data, determines appropriate commands, and commands are sent downhole through command link 8625 to cable 8633 that sends commands to second pressure control valve 8635 that has upper fluid port 8637 and lower fluid port 8639. Second pressure control valve is labeled with legend V2 in FIG. 63. Fluid may flow either way. Valve V2 may be commanded to keep a certain algebraically defined pressure drop across second pressure control valve 8635.

In several preferred embodiments, the interior of hollow mandrel 8410 is pressure free and in other preferred embodiments, it is filled with pressure compensated oil as is typical in the industry.

In yet other preferred embodiments the sensor arrays 8615, 8617, and 8629, the communications link 8621, the command link 8625, and all the other cables are located on the interior of hollow mandrel 8410. In these embodiments, suitable passages through the first and second cup seals are provided for the required cables, fiber optic cables, etc. as necessary using typical techniques used in the industry. In this embodiment, fluid may be pumped from the surface of the earth, or from other wellbore positions, through the interior of the hollow mandrel 8410 for different purposes.

As described in relation to FIG. 62, if P8416 is larger than P8434, then the apparatus in FIG. 62 and FIG. 63 will slide towards the Down direction. If on the other hand, if P8434 is larger than P8416, and if the pressure inside hollow mandrel is larger or equal to P8416, then the dual cup seal arrangement in FIG. 63 will be forced in the "UP" direction. For such operation, please refer to U.S. Pat. No. 6,561,280 that is "Baugh (280)", OTC Paper No. 8675 by Baugh et al., and U.S. Pat. Nos. 7,025,142 and 7,406,738, which are all described above, and which are incorporated herein in their entirety by reference.

In addition, in yet other preferred embodiments, hollow mandrel 8410 may surround one or more concentric tubes. In addition, in yet other preferred embodiments, hollow mandrel may be inside one or more concentric tubes, and the first and second cup seals may be mounted on the outer concentric tubes. So, hollow mandrel 8410 in FIG. 63 may be replaced by one or more concentric tubes.

In yet other preferred embodiments, wire carrying tubes, and/or fluid carrying tubes may be installed within hollow mandrel 8410 for different purposes.

The entire dual cup seal arrangement shown in FIG. 63 is generally designated with numeral 8641. Accordingly, element 8641 is used to define any one of the preferred embodiments described above in relation to FIG. 63.

Figure 64:
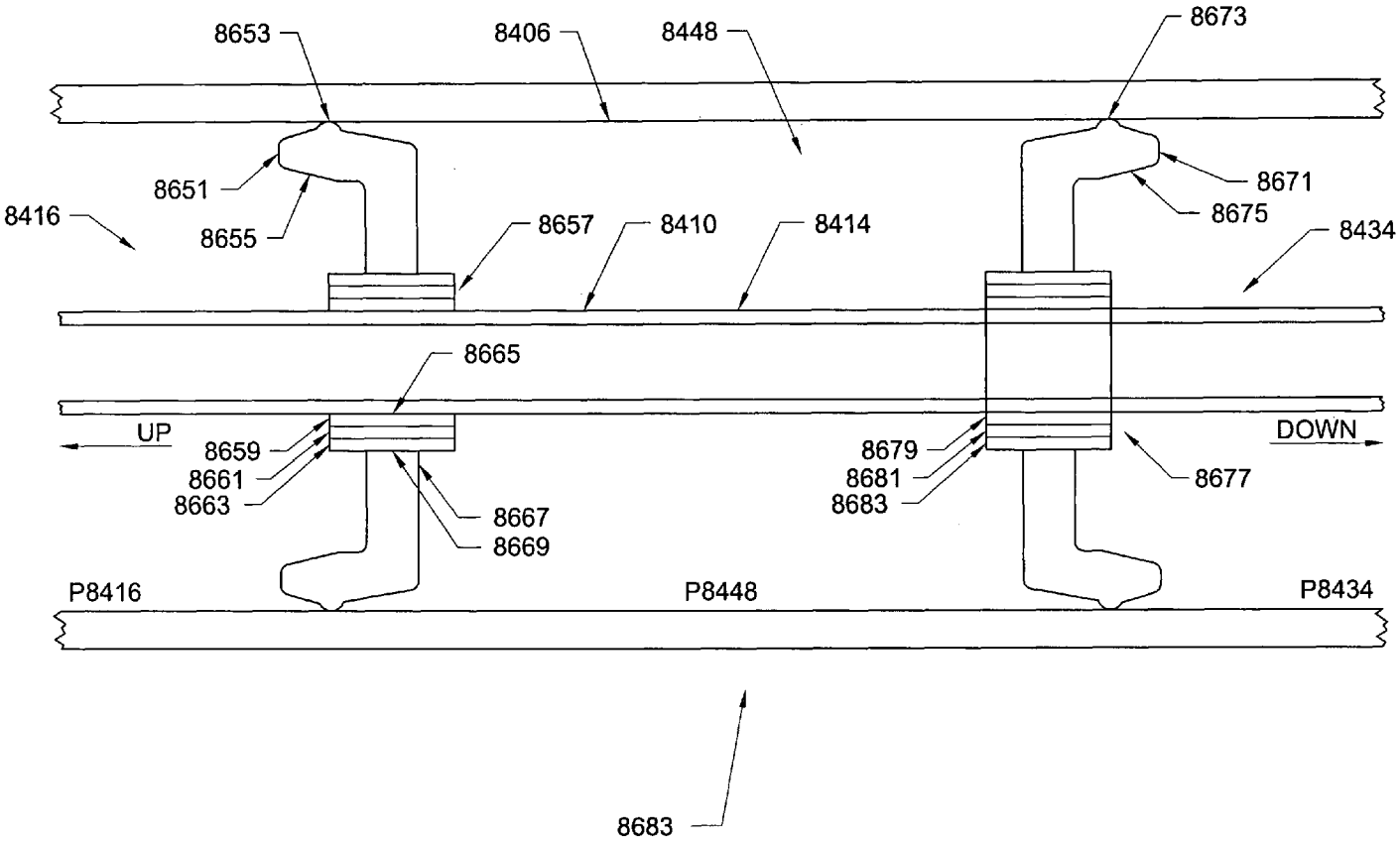
FIG. 64 has many features from FIGS. 62 and 63, but in addition, bearing assemblies mounted on the mandrel allow the cup seals to rotate within the pipe during movement of the Smart Shuttle.

In FIG. 64, first cup seal 8651 has a hydraulic sealing portion 8653 that makes movable and slidable contact with the interior of pipe 8406 at depth Z8653, a legend that is not shown in FIG. 64 for the purposes of simplicity. The interior portion 8655 of the first cup seal 8651 faces in the "UP" direction, a legend that is defined in FIG. 64.

First bearing assembly 8657 possesses inner race 8659, rotational subassembly 8661, and outer race 8663. The inside diameter of inner race 8659 is joined within region 8665 to hollow mandrel external surface 8414 to make a static hydraulic seal using any convenient technique typically used in the industry including a force fit, using glues of various types, and/or using welding techniques of various types. Lower portion of first cup seal 8667 is suitably bonded to the exterior surface 8669 of the outer race 8663 in a manner that forms a static hydraulic seal so that no fluid leaks through this joining region. Typical techniques are used in the industry to make this static hydraulic seal to the exterior race 8663 including forming the seal on the exterior race during the fabrication process of the seal, or by using bolts of the type generally shown in FIG. 63 (although suitably rearranged for this preferred embodiment).

The bearing assembly 8657 is allowed to freely rotate while the dual cup assembly translates in any direction (UP or DOWN). Torques naturally build up on any cup seal during translation in any direction, and rotation of bearing assembly 8657 will prevent undue wear due to these rotational torques. Bearing assembly 8657 forms a hydraulic seal, even when the first cup seal 8651 rotates about the axis of hollow mandrel 8410. So, as the first seal 8651 rotates, little fluid leaks past first cup seal in any region except the leakage which occurs past hydraulic sealing portion 8653 of the first cup seal.

In alternate preferred embodiments, first cup seal 8651 may be formed on yet another additional sleeve (not shown in FIG. 64) that is force-fitted over sleeve 8663. In yet other preferred embodiments, metal parts are fabricated within first cup seal 8651 that make attachment to bearing assembly 8657 convenient, and which also strengthen the first cup seal. The interior portion 8655 of the first cup seal 8601 faces in the "UP" direction, a legend that is defined in FIG. 64. Regions 8416, 8448, and 8434 have been previously defined in relation to FIG. 62. Pressures P8416, P8448, and P8434.

Second cup seal 8671 has a hydraulic sealing portion 8673 that makes movable and slidable contact with the interior of pipe 8406 at depth Z8673, a legend that is not shown in FIG. 64 for the purposes of simplicity. The interior portion 8675 of the second cup seal 8671 faces in the "DOWN" direction, a legend that is defined in FIG. 64.

Second bearing assembly 8677 possesses inner race 8679, rotational subassembly 8681, and outer race 8683. Second cup seal 8671 and second bearing assembly 8677 functions similar to that described for the first cup seal 8651 and its associated first bearing assembly 8657.

The entire dual cup seal arrangement shown in FIG. 64 is generally designated with numeral 8683. Accordingly, element 8683 is used to define any one of the preferred embodiments described above in relation to FIG. 64.

There are many preferred embodiments of the invention. Any one of the embodiments of the invention described in relation to FIG. 62 for mounting seals may be used in combination with any pressure relief valve and sensor arrays described in relation to FIG. 63 that may be used in combination with any of the preferred embodiments described in FIG. 64. It is simply too complex to make one drawing showing details of seal mounting, pressure relief valves, sensor arrays, cables, and bearing assemblies. Accordingly, various figures have been used to emphasize certain aspects of preferred embodiments. In addition, any features shown in FIGS. 56, 57, 58, 59, 60, 61, and 61A, may be used in combination with any features in FIGS. 62, 63, and 64.

Figure 65:
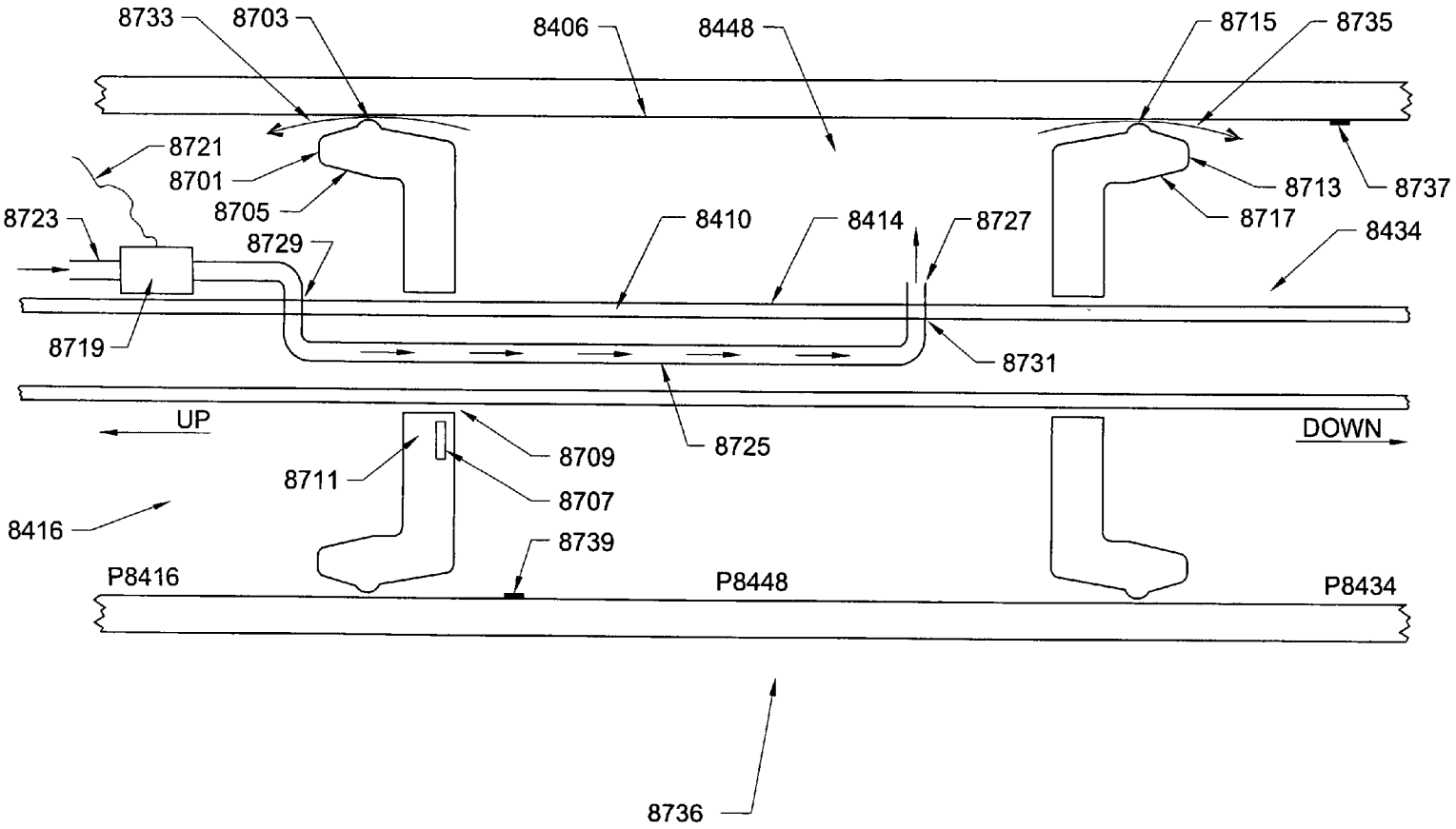
FIG. 65 has any of the selected features from FIGS. 62, 63, and 64, but in addition, shows a hydraulic pump which pumps fluid into the region between the two cup seals to reduce friction of the seals during movement of the Smart Shuttle within the pipe.

In FIG. 65, first cup seal 8701 has a hydraulic sealing portion 8703 that makes movable and slidable contact with the interior of pipe 8406 at depth Z8703, a legend that is not shown in FIG. 65 for the purposes of simplicity. The interior portion 8705 of the first cup seal 8701 faces in the "UP" direction, a legend that is defined in FIG. 65. Numeral 8707 stands for any type of device installed within the first cup seal including sensor arrays, pressure control valves, etc., including those specifically described in FIGS. 62, 63 and 64 above. Numeral 8709 stands for any means used to form a static hydraulic seal between the inner portion of the first cup seal 8711 and hollow mandrel external surface 8414 that may include bearings, direct seals, etc. as explained in relation to FIGS. 62, 63 and 64 above. So, first cup seal 8701 is a "figurative" cup seal that represents many alternative preferred embodiments. Numerals 8416, 8434, and 8448 have been previously defined in terms of FIG. 62. Pressures P8416, P8434, and P8448 have also been defined in terms of FIG. 62.

Second cup seal 8713 has a hydraulic sealing portion 8715 that makes movable or slidable contact with the interior of pipe 8406 at depth Z8715, a legend that is not shown in FIG. 65 for the purposes of simplicity. The interior portion 8717 of the second cup seal 8715 faces in the "DOWN" direction, a legend that is defined in FIG. 65. Similarly, as in the case of the first cup seal 8701, the second cup seal 8713 is also a "figurative" cup seal that represents many alternative preferred embodiments.

In addition, modulating pressure pump 8719 receives power and commands from a computer system (often on the surface) and sends measured sensory data within the pump to the computer system over multiple cable bundle 8721. The modulating pressure pump 8719 has inlet port 8723, tubing pathway 8725, and exit port 8727. The tubing pathway proceeds through the wall of the hollow mandrel 8410 using appropriate pass-through means 8729 and 8731 as are typically used in the industry. The modulating pressure pump 8719 causes a net fluid flow into region 8448 shown by the arrows. The extra fluid flow causes additional fluid leakages (in ADDITION to those fluid flows already in existence in relation to FIGS. 62, 63 and 64 above) to flow by the hydraulic sealing portions of first and second cup seals respectively shown as elements 8733 and 8735 in FIG. 65, and these additional fluid flows may not be equal depending on the pressures P8416 and P8434. The modulating pressure pump 8719 causes a first fluid flow in one direction as shown by the arrows in FIG. 65 which tends to lubricate the hydraulic sealing portions 8703 and 8715 to reduce wear of those hydraulic sealing portions of the first and second cup seals respectively.

Figure 66:
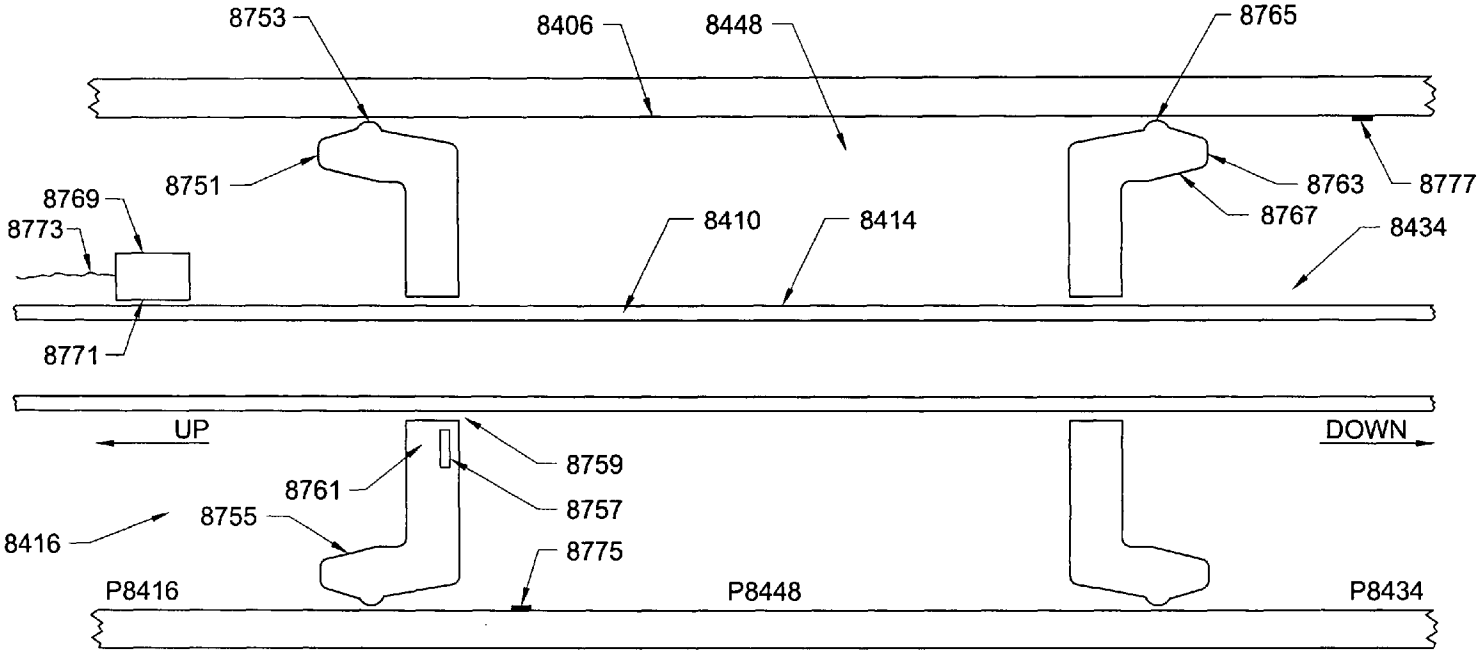
FIG. 66 has any of the selected feature from FIGS. 62, 63, 64, and 65, but in addition, has a vibration means attached to the apparatus to reduce friction of the seals during movement of the Smart Shuttle within the pipe.

The total leakage past any one seal is the combination of all pertinent leakages due to different causes. For example, under the assumptions described in FIG. 62, the quantity L8408 is the leakage by hydraulic sealing portion 8408. However, the additional leakage past hydraulic sealing portion 8703 in FIG. 65 caused by modulating pressure pump 8719 is defined by numeral 8733 (that is also defined here by legend L8733, which is not shown in FIG. 65 for the purposes of brevity). So, in this case, the net leakage past hydraulic sealing portion 8703 is given by L8408+L8733. The leakages due to specific causes can be algebraically summed in certain preferred embodiments. It is also true that the leakages will vary at different angular positions around the seal. For example, the hydraulic sealing portion 8703 is making contact with the interior of pipe 8406 as shown in FIG. 66. However, the circumference of hydraulic sealing portion 8703 can be divided into 360 degrees conveniently. The leakage by hydraulic sealing portion 8703 at 0 degrees may be very different than at 11 degrees that may be very different than 163 degrees. So, the leakages at different angular positions can be summed in certain preferred embodiments of the invention. Nevertheless, on the average, and under specific hydraulic conditions at a specific portion of the pipe, there will be an average leakage past the hydraulic sealing portion that is averaged over all the angular positions, that is another preferred embodiment of the invention. So, at any given depth, say at the depth of 28703, there will be an average leakage past the hydraulic sealing portion 8703 that is averaged over all the angular positions, which is another variation of the invention.

In another preferred embodiment, the modulating pressure pump 8719 also generates a modulation in the flow rate. The purpose of this modulation is to cause the hydraulic sealing portion to "vibrate over" the often rusty discontinuities on the interior of the pipe such as those shown as elements 8737 and 8739 in FIG. 65.

So, the flow is algebraically defined as follows. The flow rate generate by the modulating pressure pump 8719 that does not change in time is defined as F(o). The flow rate that changes in time is defined as follows:

$$F(c)\{(\cos wt+\text{phase shift})\}.$$

So, the total flow rate in time F(t) is:

$$F(t)=F(o)+F(c)\{(\cos wt+\text{phase } 1)\}$$

Here, "w" is the angular frequency, "t" is the time, and "phase 1" is a first angular phase shift using typical mathematical procedures used in the art.

The pressure caused by the modulating pressure pump 8719 (in ADDITION to all other causes of pressure in existence in FIGS. 62, 63 and 64) is given by:

$$P(t)=P(o)+P(c)\{(\cos wt+\text{phase } 2)\}$$

Here, phase 2 is another angular phase shift.

There are many other preferred embodiments using modulated flow to improve wear characteristics of dual cup seal assemblies of the type that are shown in FIG. 65. There are yet other embodiments of the invention shown in FIG. 65 where the cup seals are replaced by any hydraulic sealing means.

Accordingly, one embodiment of the invention is a method of modulating pressure in the region between any two hydraulic cup seals to reduce wear on the hydraulic sealing surfaces of said hydraulic cup seals.

Accordingly, another embodiment of the invention is a method of modulating pressure in the region between any two hydraulic sealing means to reduce wear on the hydraulic sealing portions of said hydraulic sealing means.

In alternative embodiments, the modulation pressure pump may be placed in any suitable portion of the apparatus, including within the hollow mandrel 8414 or within region 8448 between the two cup seals. There are many variations of the invention.

The entire dual cup seal arrangement shown in FIG. 65 is generally designated with numeral 8736. Accordingly, element 8736 is used to define any one of the preferred embodiments described above in relation to FIG. 65.

There are many preferred embodiments of the invention. Any one of the embodiments of the invention described in relation to FIG. 62 for mounting seals may be used in combination with any pressure control valve and sensor arrays described in relation to FIG. 63 that further may be used in combination with any of the seals mounted on bearings as described in FIG. 64 that may be further used in combination with any means to cause additional pressure modulation between the cup seals to prevent wear of the sealing surfaces of the cup seals as shown in FIG. 65. It is simply too complex to make one drawing showing details of seal mounting, pressure control valves, pressure relief valves, sensor arrays, cables, bearing assemblies, and pressure modulation systems. Accordingly, various figures have been used to emphasize certain aspects of the preferred embodiments, but those particular drawings are not limiting to all the various preferred embodiments of the invention In addition, any features shown in FIGS. 56, 57, 58, 59, 60, 61, and 61A, may be used in combination with any features in FIGS. 62, 63, 64 and 65.

In FIG. 66, first cup seal 8751 has a hydraulic sealing portion 8753 that makes movable or slidable contact with the interior of pipe 8406 at depth Z8753, a legend that is not shown in FIG. 66 for the purposes of simplicity. The interior portion 8755 of the first cup seal 8751 faces in the "UP" direction, a legend that is defined in FIG. 66. Numeral 8757 stands for any type of device installed within the first cup seal including sensor arrays, pressure control valves, etc., including those specifically described in FIGS. 62, 63, 64 and 65 above. Numeral 8759 stands for any means used to form a static hydraulic seal between the inner portion of the first cup seal 8761 and hollow mandrel external surface 8414 that may include bearings, direct seals, etc. as explained in relation to FIGS. 62, 63, 64 and 65 above. So, first cup seal 8751 is a "figurative" cup seal that represents many alternative preferred embodiments. Elements 8416, 8448, and 8434 have already been defined in FIG. 62. Pressures P8416, P8448, and P8434 have also been defined in FIG. 62.

Second cup seal 8763 has a hydraulic sealing portion 8765 that makes movable or slidable contact with the interior of pipe 8406 at depth Z8765, a legend that is not shown in FIG. 66 for the purposes of simplicity. The interior portion 8767 of the second cup seal 8763 faces in the "DOWN" direction, a legend that is defined in FIG. 64. Similarly, as in the case of the first cup seal 8751, the second cup seal 8763 is also a "figurative" cup seal that represents many alternative preferred embodiments.

Element 8769 is a vibration means attached to hollow mandrel 8410 at location 8771. In one preferred embodiment, cable bundle 8773 provides electrical power from the surface to an electric motor within a pressure free environment that possesses an eccentric mass mounted on its rotating shaft as one type of vibratory means (details not shown in FIG. 65 for simplicity). Another alternative for a vibratory means includes having one or more permanent magnets subject to an applied AC electromagnetic field from a coil. Sensor arrays within the vibration means sends signals uphole through cable bundle 8773 to be monitored by a computer system that in turn, sends commands to the electric motor to set speed, phase, etc. So, in this case, closed-loop feedback control is provided to control the vibratory means.

A purpose of the vibratory means is to vibrate hydraulic sealing portions 8753 and 8765 to assist them to move over the often rusty discontinuities on the interior of the pipe such as those shown as elements 8775 and 8777 shown in FIG. 66. Another purpose of the vibratory means is decrease the wear on the hydraulic sealing portions during movement in the interior wall of the pipe 8406.

In other preferred embodiments, any vibratory means may be used to extend the life of cup seals.

In other preferred embodiments, any vibratory means may be used to extend the life of any hydraulic sealing means.

In other preferred embodiments, the vibratory means may be placed within region 8416, or 8448, or 8434.

In other preferred embodiments, the vibration caused by the typical operation of a progressing cavity pump is used to extend the life of cup seals, or of any other hydraulic sealing means.

In other preferred embodiments, the vibration caused by the typical operation of a centrifugal pump is used to extend the life of cup seals, or of any other hydraulic sealing means.

The invention provides a method of using any vibratory means to extend the life of any hydraulic sealing means within any pipe.

An entire copy of EP0911483B1 entitled "Well System including composite pipes and a downhole propulsion system", having the inventor of James B. Terry and Thomas Platt Wilson, that issued on Aug. 16, 2008, is incorporated by reference herein.

There are many preferred embodiments of the invention. Any one of the embodiments of the invention described in relation to FIG. 62 for mounting seals may be used in combination with any pressure control valve and sensor arrays described in relation to FIG. 63 that further may be used in combination with any of the seals mounted on bearings as described in FIG. 64 that may be further used in combination with any means to cause additional pressure modulation between the cup seals to prevent wear of the sealing surfaces of the cup seals as shown in FIG. 65 that may further be used in combination with any vibratory means as shown in FIG. 66. It is simply too complex to make one drawing showing details of seal mounting, pressure control valves, pressure relief valves, sensor arrays, cables, bearing assemblies, and pressure modulation systems. Accordingly, various figures have been used to emphasize certain aspects of the preferred embodiments, but those particular drawings are not limiting to all the various preferred embodiments of the invention. In addition, any features shown in FIGS. 56, 57, 58, 59, 60, 61, and 61A, may be used in combination with any features shown in FIGS. 62, 63, 64, 65, and 66.

In other preferred embodiments particularly in relation to FIG. 64, pressure relief valves and or sensors may be located between the mandrel external surface 8414 and the inner race 8569 of first bearing 8657. To do so, the inside diameter of the inner race 8569 would be suitably increased, providing the increased area to mount the pressure relief valves and or sensors. Similar comments apply to the other FIGS. 62, 63, 65 and 66 which may also incorporate bearings in selected preferred embodiments. The pressure relief valves and or sensors may be located in yet other portions of the bearings, but those are not described herein in the interests of brevity.

Figure 67:
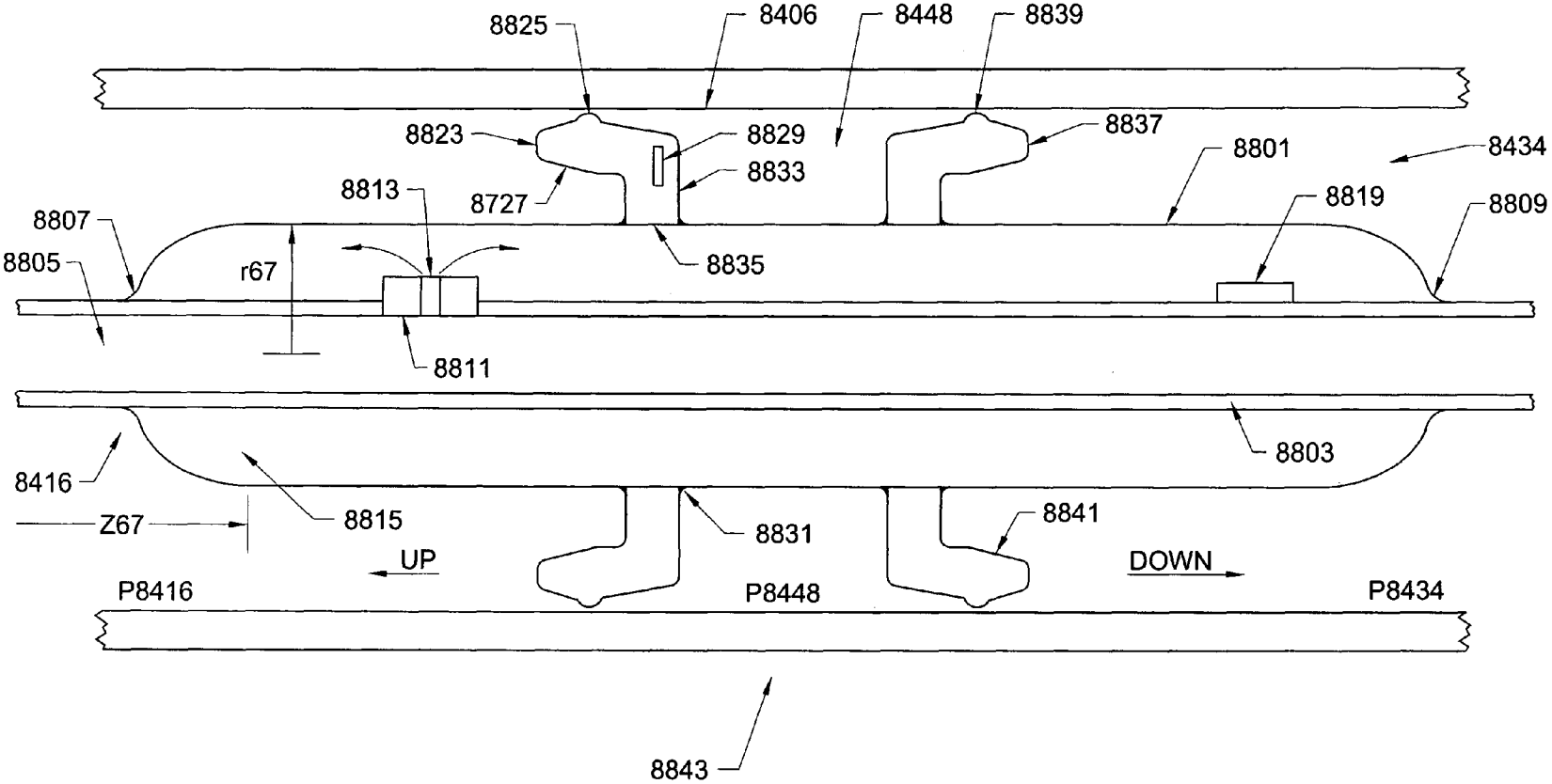
FIG. 67 shows two cup seals bonded to exterior portions of an inflatable packer to make a seal for the Smart Shuttle.

FIG. 67 shows two cup seals bonded to exterior portions of an inflatable packer. The inflatable packer is of a variety typically used in the industry as described in the following.

Inflatable packer membrane 8801 is typically a membrane made of nitrile rubber of other acceptable elastic material. Element 8801 may also be called an elastic membrane for the purposes herein. Hollow mandrel 8803 possesses a hollow interior that contains oil 8805 that is pressurized by a pump means on the surface (or in another preferred embodiment, by a suitable downhole pump means). The upper end of the inflatable packer membrane 8807 is attached to the outside of the hollow mandrel that makes a good hydraulic seal by using typical techniques in the industry and the lower end of the inflatable packer membrane 8809 is attached to the outside of the mandrel that makes a good hydraulic seal by using typical techniques in the industry (see the references cited below). Pressure control valve 8811 allows fluid flow through pressure control valve channel 8813 and oil flows into the interior region 8815 of the inflatable mandrel as indicated by the arrows adjacent to the pressure control valve channel 8813. As fluid flows into this region 8815, the exterior portion of the inflatable mandrel at depth Z67 (a legend defined in FIG. 67) expands to radius r67 (a legend also defined in FIG. 67), and that radius is a function of the azimuthal angle ranging from 0 degrees to 360 degrees (not shown in FIG. 67 for simplicity). Pressure control valve 8811 obtains electrical power from wire bundle 8817 (not shown in FIG. 67 for simplicity) and the pressure control valve 8811 also sends sensory data to a computer system on the surface of the earth through wire bundle 8817 that provides information about the operational state and condition of the pressure relief valve and any other sensory data related to the pressure control valve. (In an alternative embodiment, the computer system may be downhole.) Sensor array 8819 also measures physical parameters within region 8815 and that information is sent uphole to a computer via wire bundle 8821 (not shown for simplicity in FIG. 67). Elements 8416, 8434, and 8448 have been defined in FIG. 62. Elements P8416, P8448, and P8434 have also been defined in FIG. 67.

In FIG. 67, first cup seal 8823 has a hydraulic sealing portion 8825 that makes movable or slidable contact with the interior of pipe 8406 at depth 28825, a legend that is not shown in FIG. 67 for the purposes of simplicity. The interior portion 8727 of the first cup seal 8823 faces in the "UP" direction, a legend that is defined in FIG. 67. Numeral 8829 stands for any type of device installed within the first cup seal including sensor arrays, pressure control valves, etc., including those specifically described in FIGS. 62, 63, 64, 65 and 66 above. Numeral 8831 stands for any means used to form a static hydraulic seal between the inner portion of the first cup seal 8833 and the adjacent portion 8835 of the inflatable elastic membrane. Means 8831 may include bearings, direct seals, etc. as explained in relation to FIGS. 62, 63, 64, 65 and 66 above. Means 8831 may also include the seals formed during the fabrication of the membrane itself in a mold. So, in some preferred embodiments, the two cup seals and the membrane are formed at one time within a mold. In other preferred embodiments, the cup seals are attached to the respective exterior portions of the membrane using techniques typically used in the industry. So, first cup seal 8823 is a "figurative" cup seal that represents many alternative preferred embodiments.

Second cup seal 8837 has a hydraulic sealing portion 8839 that makes movable or slidable contact with the interior of pipe 8406 at depth 28839, a legend that is not shown in FIG. 67 for the purposes of simplicity. The interior portion 8841 of the second cup seal 8837 faces in the "DOWN" direction, a legend that is defined in FIG. 67. Similarly, as in the case of the first cup seal 8823, the second cup seal 8837 is also a "figurative" cup seal that represents many alternative preferred embodiments.

As oil is pumped into region 8815, hydraulic sealing surface 8825 moves radially outward to radius r8825 (not shown in FIG. 67 for simplicity), and hydraulic sealing portion 8825 of the first cup seal eventually makes contact with interior of the a pipe at depth 28825. (In general, the radius to the outer portion of the membrane is a function along the length of the mandrel, but the above description is used for clarity.) The radius r8825 is a function of the amount of oil that is pumped into region 8815. Similarly, the hydraulic sealing surface 8839 moves radially outward to radius r8839 (not shown in FIG. 67 for simplicity), and eventually makes contact with the interior of the pipe at depth Z8839. After the first and second cup seals reach their operating positions with suitable oil pressure in region 8815, the dual cup seal arrangement in FIG. 67 operates similarly to the other dual cup seal arrangements as described in FIGS. 62, 63, 64, 65 and 66.

The dual cup seal arrangement on an inflatable packer depicted in FIG. 67 is designated with numeral 8843.

In other preferred embodiments, the inflatable packer depicted in FIG. 67 may be subdivided into different quadrants. For example, in one preferred embodiment, the hydraulic sealing portion 8825 of the first cup seal can be preferentially expanded in different quadrants to make better contact with the interior of a pipe that has an oblong interior dimension. The quadrants could be divided in analogy to those shown in FIGS. 59 and 61. There are many variations of the invention.

In yet other preferred embodiments, the inflatable packer depicted in FIG. 67 may be divided into any number of cells, some being in different quadrants, and other cells being different along the length of the packer. There are many variations of the invention.

In other preferred embodiments, various different cup seals and chevron seals may be suitably attached to inflatable packer apparatus as generally described in FIG. 67.

In yet other embodiments in relation to FIG. 67, new bearing assemblies may be suitably added between a new inner tool mandrel placed in the space 8805 and the inside surface of hollow mandrel 8803. FIG. 67 does not show these new features, but a new FIG. 67A could be easily provided that shows these new features. These improvements would allow the hollow mandrel 8803, and the attached inflatable packer membrane 8801, to rotate about the new inner tool mandrel to prevent the build-up of torques on the tool and to increase life, and minimize the wear, of the seals 8823 and 8837. In several preferred embodiments, vibratory means may also be added to the apparatus shown in FIG. 67 (or in any new FIG. 67A). In yet other preferred embodiments, the vibratory means may be a progressing cavity pump.

Accordingly, the invention discloses a method of attaching at least one cup seal to an inflatable packer means to make a hydraulic seal.

Accordingly, the invention discloses a method of attaching dual cup seals to an inflatable packer means to make hydraulic seals.

Accordingly, the invention discloses a method of attaching any sealing means to an inflatable packer means to make a hydraulic sealing means.

Inflatable packers are also described in U.S. Pat. No. 6,341,654 entitled "Inflatable packer setting tool assembly" having the inventors of Wilson, et al., that issued on Jan. 29, 2002 that is assigned to Weatherford/Lamb, Inc. which is the third entry in the search mentioned in the previous paragraph.

Figure 68:
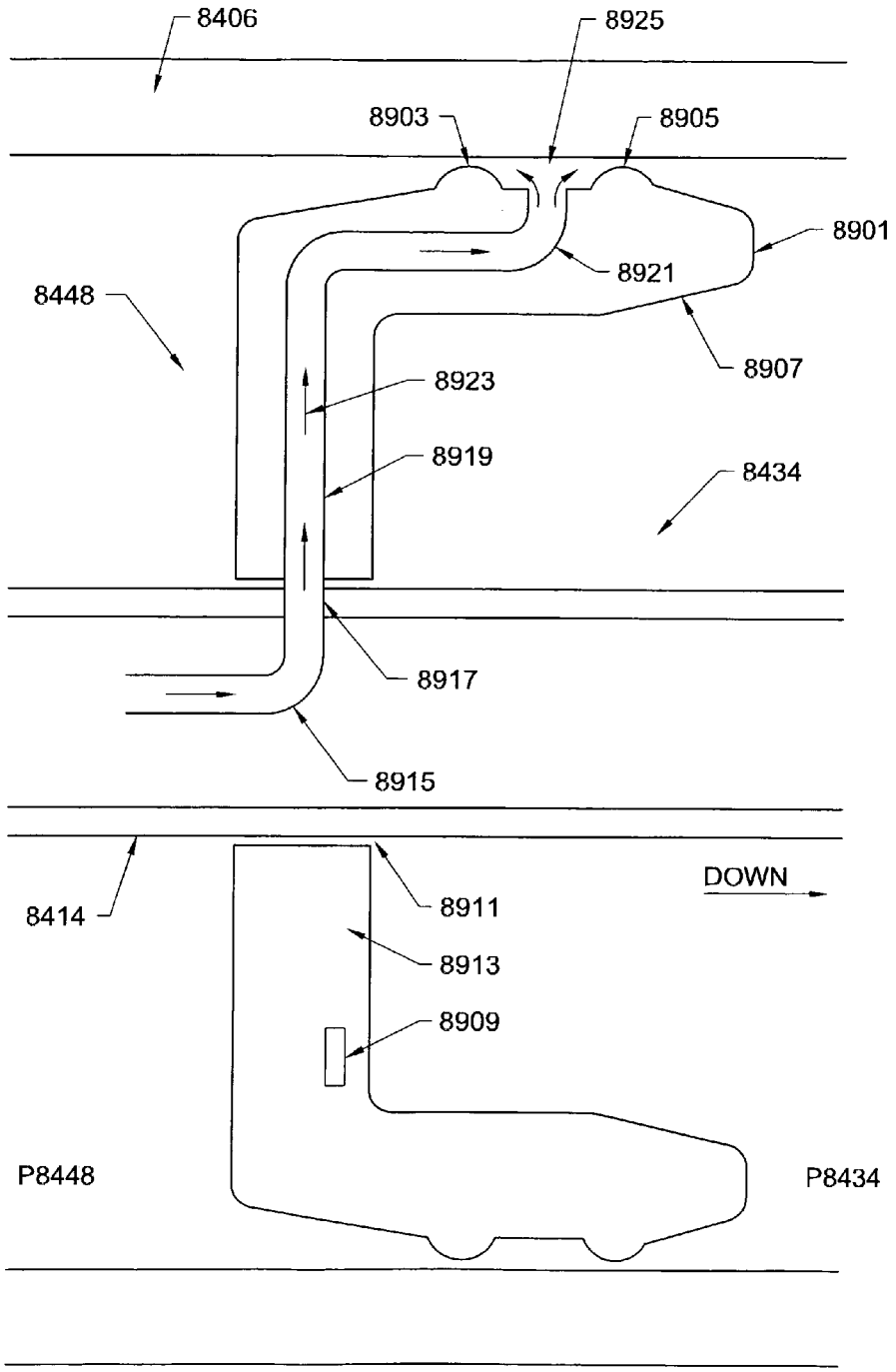
FIG. 68 shows one individual cup seal, or chevron seal, that possesses a fluid channel allowing hydraulic fluid to flow through the interior of the seal to reduce friction during movement of the Smart Shuttle.

FIG. 68 shows second cup seal 8901 that may be a portion of any dual cup seal arrangement. In particular, this second cup seal 8901 here may replace cup seal 8713 in FIG. 65 as further explained below. Second cup seal 8901 has first hydraulic sealing portion 8903 that makes movable or slidable contact with the interior of pipe 8406 at depth Z8903 (not shown in FIG. 68 for simplicity). Second cup seal 8901 has second hydraulic sealing portion 8905 that makes movable or slidable contact with the interior of pipe 8406 at depth Z8905 (not shown in FIG. 68 for simplicity). The interior portion 8907 of the second cup seal 8901 faces in the "DOWN" direction, a legend defined in FIG. 68.

Numeral 8909 in FIG. 68 stands for any type of device installed within the first cup seal including sensor arrays, pressure control valves, etc., including those specifically described in FIGS. 62, 63, 64, 65, 66, and 67 above. Numeral 8911 stands for any means used to form a static hydraulic seal between the inner portion of the second cup seal 8913 and hollow mandrel external surface 8414 that may include bearings, direct seals, etc. as explained in relation to FIGS. 62, 63, 64, 65, 66, and 67 above (and as may be modified to take into account the following using ordinary skills in the art). So, second cup seal 8901 is a "figurative" cup seal that represents many alternative preferred embodiments.

In addition, and in relation to FIG. 65, tubing pathway 8725, and exit port 8727 are modified using ordinary skills in the art so as to connect tubing pathway 8725 to tubing pathway 8915 in FIG. 68 that in turn connects to first exit port 8917, that in turn connects to second cup seal internal pathway 8919, that in turn is connected to second exit port 8921. The arrows (collectively identified by 8923) show the direction of fluid flow delivered from modulating pressure pump 8719 in FIG. 65. Elements 8448 and 8434 are defined in FIG. 62. Elements P8448 and P8434 are also defined in FIG. 62.

The modulating pressure pump 8719 causes a net fluid flow into region 8925 shown by the arrows.

The extra fluid flow causes additional fluid leakages (in ADDITION to those fluid flows already in existence in relation to FIGS. 62, 63, 64, 65, 67, and 68 above) to flow by the first and second hydraulic sealing portions 8903 and 8905 to lubricate the hydraulic sealing portions 8903 and 8905 to reduce wear of those hydraulic sealing portions of the second cup seal 8901.

There are many variations of the invention. Multiple fluid pathways may be provided through the cup seals for hydraulic lubrication purposes. Such pathways may be provided through the first cup seal of a dual cup seal arrangement, or may be provided through the second cup seal of a dual cup seal arrangement, or through both cup seals of a dual cup seal arrangement.

Any one individual cup seal may have one, two, or more hydraulic sealing portions, and each said cup seal may have one or more fluid channels.

In an apparatus having multiple cup seals, each seal may have one or more fluid pathways for hydraulic lubrication purposes.

The invention discloses a method of providing a fluid flow through a fluid channel within a cup seal to provide extra lubrication to any hydraulic sealing portion of said cup seal to reduce the wear of said hydraulic sealing portion.

Figure 69:
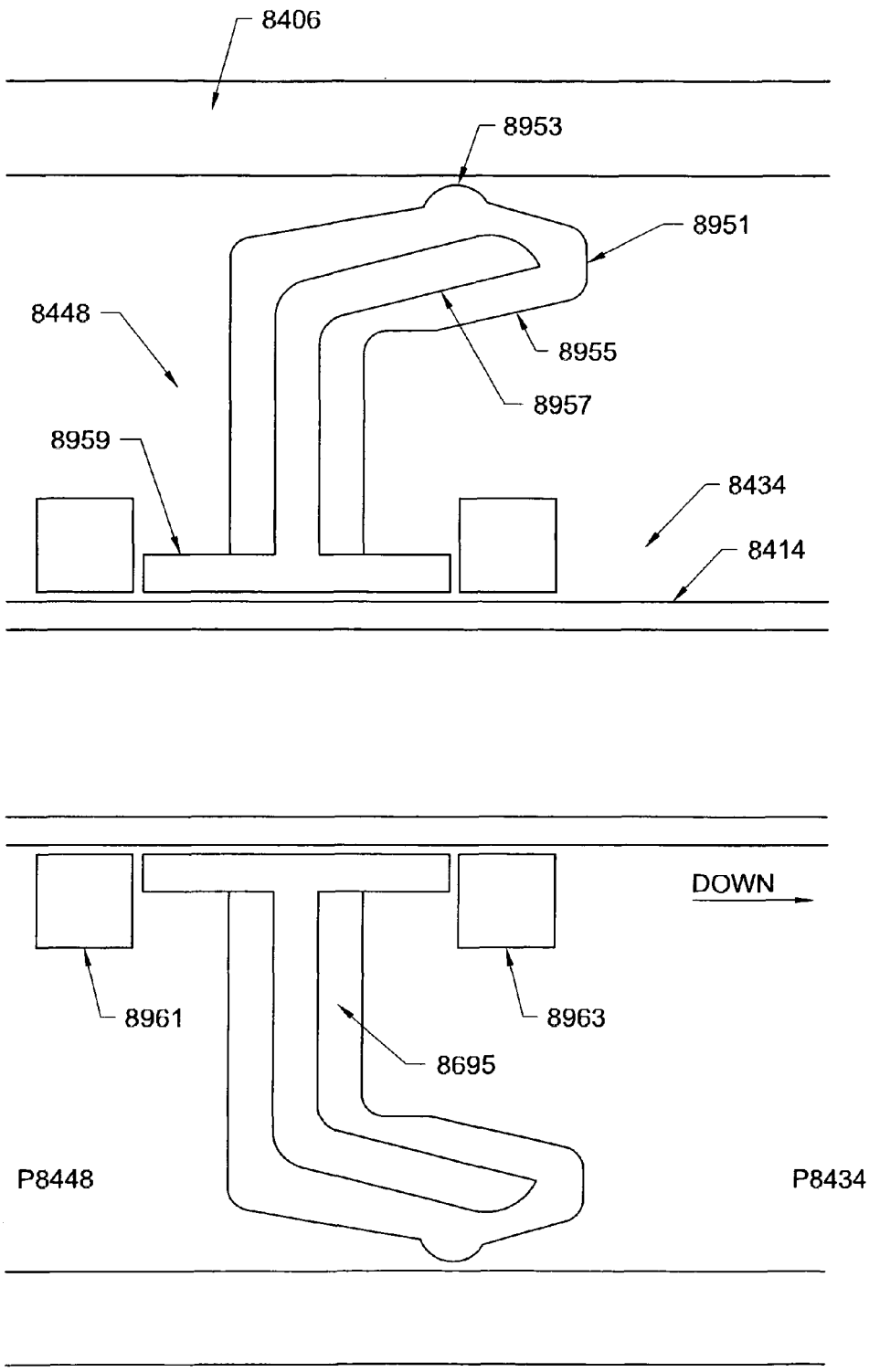
FIG. 69 shows one individual cup seal, or chevron seal, that possesses internal steel reinforcement.

FIG. 69 shows second cup seal 8951 that may be a portion of any dual cup seal arrangement. Second cup seal 8951 has a hydraulic sealing portion 8953 that makes movable or slidable contact with the interior of pipe 8406 at depth Z8953 (not shown in FIG. 69 for simplicity). The interior portion 8955 of the second cup seal 8951 faces in the "DOWN" direction, a legend defined in FIG. 69.

Second cup seal 8951 has internal steel reinforcement means 8957 having integral steel base member 8959 having an inside dimensions that slips over hollow mandrel external surface 8414 in the fashion of a hydraulically tight slip fit as is typical in the industry (alternatively, O rings on an appropriate inside diameter can be used.) The integral steel base member is held in place by first split clamp 8961 and second split clamp 8963 as are typically used in the industry. These split clamps prevent any movement of the integral steel base member.

The elastomer portion of second cup seal 8951 is designated as element 8965 that is cast in one piece over the steel reinforcement means 8957 having integral steel base member 8959 to make a hydraulically tight cup seal. The elastomer portion may be comprised of nitrile material as one example. Elements 8448 and 8434 have been defined in relation to FIG. 62. Elements P8448 and P8434 have also been defined in terms of FIG. 62.

Second cup seal 8951 may be incorporated into any of the apparatus shown in FIGS. 62, 63, 64, 65, 66, 67, and 68, using suitable modification using typical techniques in the industry.

A first cup seal of a typical dual cup seal arrangement may be similarly reinforced.

Any cup seal may have one or more steel reinforcement means located within said cup seal.

In summary of the above, any one selected feature shown in any of the FIGS. 56, 57, 58, 59, 60, 61, 61A, 62, 63, 64, 65, 66, 67, 68, and 69 may be used in combination with any other selected feature shown respectively in any of the FIGS. 56, 57, 58, 59, 60, 61, 61A, 62, 63, 64, 65, 66, 67, 68, and 69 to make various preferred embodiments of the invention. Similarly, multiple features from different drawings may be combined with any number of features from other drawings to make yet other preferred embodiments of the invention.

In further summary of the above, any one selected feature shown in any of the FIGS. 56, 57, 58, 59, 60, 61, 61A, 62, 63, 64, 65, 66, 67, 68, and 69 may be used to make the seals of the Smart Shuttles shown in FIGS. 8, 8A, 8B, 24, 31, 32, 33, and 34.

In further summary of the above, any one selected feature shown in any of the FIGS. 56, 57, 58, 59, 60, 61, 61A, 62, 63, 64, 65, 66, 67, 68, and 69 may be used in combination with any other selected feature shown respectively in any of the FIGS. 56, 57, 58, 59, 60, 61, 61A, 62, 63, 64, 65, 66, 67, 68, and 69 to make the seals of the Smart Shuttles shown in FIGS. 8, 8A, 8B, 24, 31, 32, 33, and 34. Yet further, multiple features from different drawings may be combined with any number of features from other drawings to make yet other preferred embodiments of the invention. Each of the above listed drawings provided selected features, and it is far too complex to put all the features of the preferred embodiments into one drawing. Accordingly, any combinations not explicitly shown have not been provided solely in the interests of brevity.

The above discloses the following:

A well conveyance apparatus (7922A, 7924A) for conveying equipment into a wellbore possessing at least one hydraulic seal (7900A) that is rotatably attached to a mandrel portion (7780A) which forms a movable and slidable hydraulic seal against the interior of a borehole casing (6782A) located within a wellbore in a geological formation in the earth that is caused to move by the application of pressurized wellbore fluids against the seal, the apparatus further comprising:

(a) a bearing assembly (8657, 8677) having an inner race (8659, 8679) attached to the mandrel portion (8410) and an outer race (8663,8683) that is bonded to an interior portion of the hydraulic seal that allows the seal to rotate within the casing;

(b) a vibratory means (8769) attached to the mandrel portion (8414) that vibrates the movable and slidable seal (8751, 8763);

(c) at least one sensor array (8615, 8617, 8629) attached to the mandrel portion (8414) providing physical measurement information; and (d) a computer system (26) to process the measurement information that is used in part to control the vibratory means (8769) to minimize wear on the portion of the movable and slidable hydraulic seal making contact with the interior of the borehole casing (8408, 8432, 8603, 8609, 8653, 8673, 8703, 8715, 8753, 8765, 8903, 8925, 8953).

The apparatus in where the mandrel portion (7780A) is a hollow mandrel portion.

The apparatus in wherein the vibratory means is a progressing cavity pump (6800) attached to the hollow mandrel portion (7780A) of the conveyance apparatus.

The apparatus wherein the progressing cavity pump (6800) pumps fluids through a hollow mandrel portion of the conveyance apparatus.

The apparatus wherein fluid pumped through the hollow mandrel portion (7780A) flows through a coiled tubing (7724A) positioned within the borehole casing to the surface of the earth.

The apparatus in wherein fluid pumped though the hollow mandrel portion (7780A) flows through an umbilical (7725A) positioned within the borehole casing to the surface of the earth.

The apparatus in claim 1 wherein the vibratory means (8769) is an electric motor possessing an eccentric weight attached to its rotating shaft.

The apparatus wherein attachment means (7180A) are provided to attach equipment (640, 642, elements in FIG. 26) to the well conveyance apparatus.

The apparatus wherein the equipment attached to the conveyance apparatus is used to perform at least one well service task (714, 716, 718, . . . all elements in FIG. 27).

The well conveyance apparatus in wherein the hydraulic seal is a cup seal (8402, 8430, 8601, 8607, 8651 8671, 8701, 8713, 8751, 8763, 8823, 8837, 8951).

The well conveyance apparatus in having a multiplicity of hydraulic seals (8202, 3204, 8206).

The well conveyance apparatus in wherein at least a portion of the multiplicity of hydraulic seals are cup seals (8402, 8430, 8601, 8607, 8651 8671, 8701, 8713, 8751, 8763, 8823, 8837, 8951).

The well conveyance apparatus in having at least one dual cup seal (both 8402 and 8430, etc.)

The well conveyance apparatus in having multiple sets of dual cup seals.

The well conveyance apparatus wherein the measurement information includes at least the pressure within any fluids present in the wellbore (P8416, P8448, P8434).

The well conveyance apparatus in wherein the measurement information includes at least the fluid leakage passing between the interior of the casing and the movable and slidable hydraulic seal (L1, L2, L3, 8733, 8735).

The well conveyance apparatus in claim 1 wherein the movable and slidable hydraulic seal possesses at least one pressure relief valve (8218, 8220, 8222).

The well conveyance apparatus in wherein two or more movable and slidable hydraulic seals each possess at least one pressure relief valve (8218, 8220, 8222).

The well conveyance apparatus in wherein each separate member of the dual cup seals possesses at least one pressure relief valve (8218, 8220, 8222).

The well conveyance apparatus in claim 1 wherein no wellbore fluids are allowed to pass through the inner race and the outer race of the bearing assembly (8661, 8668).

In summary, the above discloses a well conveyance apparatus for conveying equipment into a wellbore possessing long-lasting movable and slidable hydraulic seals against the interior of a borehole casing located within a wellbore in a geological formation in the earth that is caused to move by the application of pressurized wellbore fluids against the seals. The seals are allowed to rotate on bearings about the tool mandrel to prevent the build-up of torque on the seals to minimize wear and to extend the life of the seals. Vibratory means are attached to the tool mandrel to vibrate the sealing portion of the seals, so as the extend the life of the seals and to minimize wear of the seals. The rotational freedom of the sealing portion of the seals, and the vibrational freedom of the sealing portion of the seals, minimizes wear and extends the life of the seals. Sensor arrays provide information to a computer system that is used to control the vibratory means, pressure relief valves, and other parameters to minimize wear of the hydraulic seals.

As is evident from the above detailed description, many of the above described preferred embodiments of movable and slidable hydraulic seals may be used to make injectors for coiled tubings, injectors for umbilicals, and to make seals for pipeline pigs.

Additional Comments on the Subterranean Electric Drilling Machine and the Smart Shuttle There are many particular uses for the Subterranean Electric Drilling Machine. In particular, many oil reservoirs are located within 20 miles off the coast of California near Santa Barbara. Those can be drilled from onshore.

Furthermore, the Subterranean Electric Drilling Machine may be used to drill offshore wells using a "dry tree" located on the surface of the platform. This results in lower costs than to drill a "wet tree" well.

A most recent target for drilling in the Arctic National Wildlife Refuge is located about 11 miles from the Western boundary of ANWR. This "first target" reservoir could be drilled into from outside the boundary of ANWR, which would be preferred for environmental reasons. The completion and production systems described above can be used to drill to this "first target" and to complete the well.

There is yet another method of using the above methods and apparatus to drill a well. Perhaps this might be called the "Next Step Drilling System". In this preferred embodiment of the invention, standard well drilling techniques are used to drill and complete a cased well to a distance 6 miles or up to a maximum of perhaps 8 miles from the initial wellbore. However, this still leaves 3-5 miles of drilling after the installation of the initial well to reach the "first target" reservoir in ANWR.

In the above figures that show various seals for Smart Shuttles, pressure control valves are described as being installed within cup seals or chevron seals. For example, please see elements 8613 and 8635 in FIG. 63. Such pressure control valves may also be called pressure relief valves or pressure drop valves. Many of the preferred embodiments of Smart Shuttle seals shown in FIGS. 56-69 can have those pressure relief valves installed. With a pressure relief valve installed, for the purposes herein, we can also call these "leaky seals" for the Smart Shuttle, where pressurized borehole fluid is intentionally caused to flow through the pressure relief valves for a variety of different reasons as described in the following.

First, in a preferred embodiment of the invention, a Smart Shuttle having a "leaky seal" is installed within a cased wellbore that is connected by an umbilical to the surface. In one preferred embodiment, this Smart Shuttle has a first electric motor that is used to turn the shaft of the pump of the Smart Shuttle. A Subterranean Electric Drilling Machine is attached to the downhole side of the Smart Shuttle thereby making an apparatus that resembles that shown in FIG. 6. In one preferred embodiment, this Subterranean Electric Drilling Machine possesses a second electric motor that is independently controlled from the first using apparatus and methods described above. Then, mud is pressurized in the annulus using mud pumps on the surface platform, and mud then flows through the "leaky seals", and the mud proceeds to clear out chips cut by the rotating drill bit of the Subterranean Electric Drilling Machine, and those rock chips are returned to the surface that are pumped through the pump of the Smart Shuttle and through the interior of the umbilical to the surface. However, there is a net force applied to the "leaky seals" of the Smart Shuttle because of the controlled pressure drops across those seals, and that force is applied through the Smart Shuttle to the Subterranean Electric Drilling Machine that loads it against the rock. This method of operation negates the necessity of having anchor and weight on bit mechanisms 140 and 142 in FIG. 6.

After drilling a segment of the well, the drilled portion needs to be cased to make an extension of the previous cased well. For completion steps, the same Smart Shuttle is connected to the umbilical that has the same seals described above. In one preferred embodiment it has a first electric motor that turns the pump shaft. In another preferred embodiment, the Subterranean Liner Expansion Tool is attached to the downhole side of the Smart Shuttle. In other preferred embodiments, a second electric motor within the Subterranean Liner Expansion Tool is used to expand the casing in a fashion as shown in FIGS. 10 and 11. During the trip downhole, the annulus is pressured up, force is generated on the seals of the Smart Shuttle, and the expandable casing is forced into the wellbore. The pump of the Smart Shuttle pumps fluid up the interior of the umbilical to the surface to prevent "fluid lock" in a wellbore and/or to prevent reverse fluid flow into formation. During the trip downhole, in several preferred embodiments, there may be no need to open the pressure relief valves. Using techniques already described, the expandable casing is expanded by the Subterranean Liner Expansion Tool and an extension of the well is made. Incremental sections can be drilled, and casings expanded, to extend the well great distances into formation.

This relatively simple Next Step Drilling Machine and the associated methods of operation may be used to extend cased wells that are already in place, or which cannot be drilled any further using standard drilling techniques (rotary drilling from the surface or using coiled tubing mud motors). The Next Step Drilling Machine may also be called the Next Step Subterranean Electric Drilling Machine or the Next Step Electric Drilling Machine.

As is evident from the above detailed description, many portions of the above preferred embodiments may be combined to make injectors for coiled tubings, and to make pipeline pigs.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A well conveyance apparatus (7922, 7924) for conveying equipment into a wellbore possessing at least one hydraulic seal (7900) that is rotatably attached to a mandrel portion (7780) which forms a movable and slidable hydraulic seal against an interior portion a borehole casing (6782) located within a wellbore in a geological formation that is caused to move by the application of pressurized wellbore fluids against the seal, said apparatus further comprising:

(a) a bearing assembly (8657, 8677) having an inner race (8659, 8679) attached to said mandrel portion (8414) and an outer race (8663, 8683) that is bonded to an interior portion of said hydraulic seal that allows said seal to rotate within said casing;

(b) a vibratory means (8769) attached to said mandrel portion (8414) that vibrates said movable and slidable seal (8751, 8763);

(c) at least one sensor array (8615, 8617, 8629) attached to said mandrel portion (8414) to determine leakage level of said wellbore fluids passing by said hydraulic seal; and (d) a computer system (26) to process said measurement information that is used in part to control said vibratory means (8769) to minimize wear on the portion of the movable and slidable hydraulic seal making contact with the interior of said borehole casing (8408, 8432, 8603, 8609, 8653, 8673, 8703, 8715, 8753, 8765, 8903, 8925, 8953).

2. The apparatus in claim 1 said mandrel portion (7780) is a hollow mandrel portion.

3. The apparatus in claim 2 wherein said vibratory means is a progressing cavity pump (6800) attached to said hollow mandrel portion (7780) of said conveyance apparatus.

4. The apparatus in claim 3 wherein said progressing cavity pump (6800) pumps fluids through said hollow mandrel portion (7780) of said conveyance apparatus.

5. The apparatus in claim 4 wherein fluid pumped through said hollow mandrel portion (7780) flows through a coiled tubing (7724) positioned within said borehole casing to the surface of the earth.

6. The apparatus in claim 4 wherein fluid pumped though said hollow mandrel portion (7780) flows through an umbilical (7725) positioned within said borehole casing to the surface of the earth.

7. The apparatus in claim 1 wherein said vibratory means (8769) is an electric motor possessing an eccentric weight attached to the rotating shaft of said electric motor.

8. The apparatus in claim 1 further possessing attachment means (7180) to attach equipment (640, 642, 644, 646, 648, 650, 652, 654, 656, 658, 660, 662, 664, 666, 668, 670, 672, 674) to said well conveyance apparatus.

9. The apparatus in claim 8 wherein said equipment attached to said conveyance apparatus is used to perform at least one well service task (714, 716, 718).

10. The well conveyance apparatus in claim 1 wherein said hydraulic seal is a cup seal (8402, 8430, 8601, 8607,8651 8671, 8701, 8713, 8751, 8763, 8823, 8837, 8951).

11. The well conveyance apparatus in claim 1 having a multiplicity of hydraulic seals (8202, 8204, 8206).

12. The well conveyance apparatus in claim 11 wherein at least a portion of said multiplicity of hydraulic seals are cup seals (8402, 8430, 8601, 8607, 8651 8671, 8701, 8713, 8751, 8763, 8823, 8837, 8951).

13. The well conveyance apparatus in claim 11 having at least one dual cup seal (8402, 8430).

14. The well conveyance apparatus in claim 13 having multiple sets of dual cup seals.

15. The well conveyance apparatus in claim 11 wherein two or more movable and slidable hydraulic seals each possess at least one pressure relief valve (8218, 8220, 8222).

16. The well conveyance apparatus in claim 13 wherein each separate member of the dual cup seals possesses at least one pressure relief valve (8218, 8220, 8222).

17. The well conveyance apparatus in claim 1 wherein said measurement information includes at least the pressure within any fluids present in the wellbore (P8416, P8448, P8434).

18. The well conveyance apparatus in claim 1 wherein said measurement information includes at least the fluid leakage passing between the interior of the casing and said movable and slidable hydraulic seal (L1, L2, L3, 8733, 8735).

19. The well conveyance apparatus in claim 1 wherein said movable and slidable hydraulic seal possesses at least one pressure relief valve (8218, 8220, 8222).

20. The well conveyance apparatus in claim 1 wherein no wellbore fluids are allowed to pass through said inner race and said outer race of said bearing assembly (8661, 8668).

* * * * *